US012636551B2

(12) United States Patent
Greaney et al.

(10) Patent No.: US 12,636,551 B2
(45) **Date of Patent: *May 26, 2026**

(54) GOLF CLUB HEAD

(71) Applicant: Taylor Made Golf Company, Inc., Carlsbad, CA (US)

(72) Inventors: Mark Vincent Greaney, Vista, CA (US); Kraig Alan Willett, Fallbrook, CA (US); Joe Hoffman, Carlsbad, CA (US); Todd P. Beach, Encinitas, CA (US); Robert Story, Carlsbad, CA (US); Jake Feuerstein, Carlsbad, CA (US); Michelle Penney, Carlsbad, CA (US); Bradley Poston, San Diego, CA (US); Christopher Rollins, Carlsbad, CA (US); Joseph Yu, Kaohsiung (TW); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 237 days.

This patent is subject to a terminal disclaimer.

(21) Appl. No.: 18/197,594

(22) Filed: May 15, 2023

(65) Prior Publication Data

US 2023/0390612 A1 Dec. 7, 2023

Related U.S. Application Data

(63) Continuation of application No. 17/476,025, filed on Sep. 15, 2021, now Pat. No. 11,691,054, which is a (Continued)

(51) Int. Cl.
*A63B 53/04* (2015.01)
*A63B 53/02* (2015.01)

(Continued)

(52) U.S. Cl.
CPC ..... *A63B 53/04* (2013.01); *A63B 53/0466* (2013.01); *A63B 60/02* (2015.10);

(Continued)

(58) Field of Classification Search
CPC ... A63B 53/04; A63B 53/0466; A63B 53/023; A63B 53/0408; A63B 53/0412;

(Continued)

(56) References Cited

U.S. PATENT DOCUMENTS

| | | | | |
|---|---|---|---|---|
| 1,674,173 A | | 6/1928 | Haupt | |
| 2,023,885 A | | 12/1935 | Hinckley | |
| 2,395,837 A | | 3/1946 | Baymiller et al. | |
| 2,652,256 A | * | 9/1953 | Thomas | A63B 53/047 473/333 |
| 3,625,518 A | | 12/1971 | Solheim | |
| 4,367,878 A | | 1/1983 | Schmidt | |
| 4,471,961 A | | 9/1984 | Masghati | |
| 4,521,022 A | | 6/1985 | Schmidt | |

(Continued)

FOREIGN PATENT DOCUMENTS

GB 2258408 2/1993

OTHER PUBLICATIONS

Covey, "Ultimate Review—Adams Speedline Tech," https://mygolfspy.com/adams-speedline-tech-driver-review/, retrieved Feb. 27, 2018; 23 pages (Aug. 28, 2012).

(Continued)

*Primary Examiner* — Sebastiano Passaniti
(74) *Attorney, Agent, or Firm* — Klarquist Sparkman, LLP

(57) ABSTRACT

Golf club heads are described having a club head portion, a shaft portion connected to the club head portion, and a grip portion connected to the shaft portion. The club head portion has a heel portion, a sole portion, a toe portion, a crown portion, a hosel portion, and a striking face. The striking face can have a center face roll contour, a toe side roll contour, a heel side roll contour, a center face bulge contour, a crown side bulge contour, and a sole side bulge contour. The toe side roll contour can be more lofted than the center face roll contour. The heel side roll contour can be less lofted than the center face roll contour. The crown side bulge contour can (Continued)

be more open than the center face bulge contour, and the sole side bulge contour can be more closed than the center face bulge contour.

30 Claims, 35 Drawing Sheets

Related U.S. Application Data continuation of application No. 17/105,234, filed on Nov. 25, 2020, now Pat. No. 11,130,024, which is a continuation of application No. 16/750,599, filed on Jan. 23, 2020, now Pat. No. 10,881,916, which is a continuation of application No. 16/160,884, filed on Oct. 15, 2018, now Pat. No. 10,543,405, which is a continuation-in-part of application No. 15/811,430, filed on Nov. 13, 2017, now Pat. No. 10,265,586, which is a continuation of application No. 15/199,603, filed on Jun. 30, 2016, now Pat. No. 9,814,944.

(51) Int. Cl.
*A63B 60/02* (2015.01)
*A63B 60/52* (2015.01)
*A63B 71/06* (2006.01)

(52) U.S. Cl.
CPC ..... *A63B 60/52* (2015.10); *A63B 53/023* (2020.08); *A63B 53/0408* (2020.08); *A63B 53/0412* (2020.08); *A63B 53/0433* (2020.08); *A63B 2053/0491* (2013.01); *A63B 2071/0694* (2013.01)

(58) Field of Classification Search
CPC ..... A63B 53/0433; A63B 60/52; A63B 60/02; A63B 2053/0491; A63B 2071/0694
USPC ..... 473/324–350, 287–292
See application file for complete search history.

(56) References Cited

U.S. PATENT DOCUMENTS 4,725,062 A 2/1988 Kinney, III
5,098,103 A 3/1992 MacKeil
5,141,231 A 8/1992 Cox
5,310,185 A 5/1994 Viollaz
5,322,285 A 6/1994 Turner
5,415,405 A 5/1995 Vincent
5,857,920 A 1/1999 Hong
6,093,115 A 7/2000 Murtland
6,139,445 A 10/2000 Werner et al.
6,183,380 B1 2/2001 Yim
6,402,639 B1 6/2002 Iwata et al.
6,428,426 B1 8/2002 Helmstetter et al.
6,454,664 B1 9/2002 Long
6,582,322 B2 6/2003 Long et al.
6,620,055 B2 9/2003 Saso
6,663,504 B2 12/2003 Hocknell et al.
6,902,497 B2 6/2005 Deshmukh et al.
7,056,227 B2 6/2006 Giraldi
7,059,972 B2 6/2006 Miyamoto
7,066,830 B2 6/2006 Day
7,140,974 B2 11/2006 Chao et al.
7,153,220 B2 12/2006 Lo
7,186,190 B1 3/2007 Beach et al.
7,753,806 B2 7/2010 Beach et al.
7,789,766 B2 9/2010 Morris et al.
7,850,538 B1 12/2010 Yoon
7,874,936 B2 1/2011 Chao
7,887,431 B2 2/2011 Beach et al.
8,012,039 B2 9/2011 Greaney et al.
8,147,350 B2 4/2012 Beach et al.
8,152,652 B2 4/2012 Curtis et al.
8,157,672 B2 4/2012 Greaney et al.
8,167,737 B2 5/2012 Oyama
8,388,459 B2 3/2013 Chuck
8,496,544 B2 7/2013 Curtis
8,790,195 B1 * 7/2014 Myers ..... A63B 53/0466 473/335
9,295,885 B2 * 3/2016 Matsunaga ..... A63B 60/52
9,814,944 B1 11/2017 Greaney et al.
10,265,586 B2 4/2019 Greaney et al.
10,265,587 B2 4/2019 Greaney et al.
10,449,423 B2 10/2019 Greaney et al.
10,463,926 B2 11/2019 Greaney et al.
10,518,143 B1 12/2019 Greaney et al.
10,543,405 B2 1/2020 Greaney et al.
10,556,157 B2 2/2020 Greaney et al.
10,881,916 B2 1/2021 Greaney et al.
10,960,277 B2 3/2021 Greaney et al.
11,130,024 B2 9/2021 Greaney et al.
11,691,054 B2 * 7/2023 Greaney ..... A63B 53/04 473/330
2006/0094532 A1 5/2006 Seeley
2007/0142124 A1 6/2007 Ban
2007/0270236 A1 11/2007 Hirano
2007/0275791 A1 11/2007 Shear
2009/0088269 A1 4/2009 Beach et al.
2009/0088271 A1 4/2009 Beach et al.
2009/0176600 A1 * 7/2009 Kouno ..... A63B 53/0466 473/348
2009/0286611 A1 11/2009 Beach et al.
2010/0311520 A1 12/2010 Bezilla et al.
2010/0331103 A1 * 12/2010 Takahashi ..... A63B 53/0466 473/345
2011/0207552 A1 * 8/2011 Finn ..... A63B 53/0466 473/346
2011/0263349 A1 10/2011 Kodama
2012/0202615 A1 * 8/2012 Beach ..... A63B 60/52 473/345
2013/0029780 A1 1/2013 Beno et al.
2013/0029781 A1 1/2013 Beno et al.
2013/0079175 A1 3/2013 Lee
2013/0324281 A1 12/2013 Boyd et al.
2013/0331203 A1 * 12/2013 Takahashi ..... A63B 60/02 473/345
2014/0349777 A1 11/2014 Beno et al.
2015/0094164 A1 4/2015 Galvan et al.
2015/0297961 A1 * 10/2015 Voshall ..... A63B 53/06 473/335
2015/0321055 A1 * 11/2015 Golden ..... A63B 60/42 473/334
2018/0065003 A1 3/2018 Greaney et al.
2018/0318659 A1 11/2018 Greaney et al.
2018/0318660 A1 11/2018 Greaney et al.
2018/0318661 A1 11/2018 Greaney et al.
2018/0318662 A1 11/2018 Greaney et al.
2019/0076705 A1 3/2019 Greaney et al.
2020/0261774 A1 8/2020 Greaney et al.
2021/0146201 A1 5/2021 Greaney et al.

OTHER PUBLICATIONS

Declaration of Steven M. Nesbit in Support of Petition for Post-Grant Review of U.S. Pat. No. 9,814,944, filed Jul. 6, 2018, 84 pages.
Post Grant Review of U.S. Pat. No. 9,814,944, Case No. PGR2018-00074, filed Jul. 6, 2018, 73 pages.
Decision Granting Institution of Post-Grant Review of U.S. Pat. No. 9,814,944, Case No. PGR2018-00074, filed Jan. 24, 2019, 47 pages.
Statement by Applicant; 5 pages (executed on May 29, 2018).

* cited by examiner

GOLF CLUB HEAD

CROSS REFERENCE TO RELATED APPLICATIONS

This application is a continuation of U.S. application Ser. No. 17/476,025, filed on Sep. 15, 2021, which is a continuation of U.S. application Ser. No. 17/105,234, filed on Nov. 25, 2020, now U.S. Pat. No. 11,130,024, which is a continuation of U.S. application Ser. No. 16/750,599, filed on Jan. 23, 2020, now U.S. Pat. No. 10,881,916, which is a continuation of U.S. application Ser. No. 16/160,884, filed on Oct. 15, 2018, now U.S. Pat. No. 10,543,405, which is a continuation-in-part of U.S. application Ser. No. 15/811,430, filed on Nov. 13, 2017, now U.S. Pat. No. 10,265,586, which is a continuation of U.S. patent application Ser. No. 15/199,603, which was filed on Jun. 30, 2016, now U.S. Pat. No. 9,814,944, each of which are incorporated herein by reference in their entirety.

In addition to the incorporations discussed further herein, other patents and patent applications concerning golf clubs, including U.S. Pat. Nos. 7,753,806; 7,887,434; 8,118,689; 8,663,029; 8,888,607; 8,900,069; 9,186,560; 9,211,447; 9,220,953; 9,220,956; 9,848,405; and 9,700,763 and U.S. Publication No. 2018/0126228, are herein incorporated by reference in their entireties.

FIELD

The present disclosure relates to a golf club head. More specifically, the present disclosure relates to wood-type golf club heads having a unique face construction.

BACKGROUND

When a golf club head strikes a golf ball, a force is seen on the club head at the point of impact. If the point of impact is aligned with the center face of the golf club head in an area of the club face typically called the sweet spot, then the force has minimal twisting or tumbling effect on the golf club. However, if the point of impact is not aligned with the center face, outside the sweet spot for example, then the force can cause the golf club head to twist around the center face. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which will ultimately result in the golf ball curving to the left. This phenomenon is what is commonly referred to as "gear effect."

Bulge and roll are golf club face properties that are generally used to compensate for this gear effect. The term "bulge" on a golf club typically refers to the rounded properties of the golf club face from the heel to the toe of the club face.

The term "roll" on a golf club typically refers to the rounded properties of the golf club face from the crown to the sole of the club face. When the club face hits the ball, the ball acquires some degree of backspin. Typically this spin varies more for shots hit below the center line of the club face than for shots hit above the center line of the club face.

FIG. 1 illustrates the problem to be solved by the present invention. FIG. 1 shows a ball location with respect to the intended target when the golf ball is struck with a club having a constant bulge and roll radius. The nine rectangles indicate the ball location when struck in the respective heel, toe, center, high, center, low combinations. The fairway 124 is separated from the rough 126 by a fairway edge 120,122. The final ball location is shown with respect to an intended target line 118. The intended target line 118 is the line along which the golf club head center is aimed when the golf is at the address position. When the golf ball is struck in the high position, the golf ball tends to have a "left tendency" which means the ball's final resting position will be left of the target line 118. As illustrated by points 100, 102, and 104 shown in FIG. 1. When the golf ball is struck in the low position, the golf ball tends to have a "right tendency" which means the ball's final resting position will likely be to the right of the target line 118 as illustrated by points 112, 114,116 shown in FIG. 1. When a golf ball impacts the ball in the central horizontal portion of the face, the ball tends to come to rest on target relative to the target line 118 as illustrated by points 106, 108, 110 shown in FIG. 1.

A golf club design is needed to counteract the left and right tendency that a player encounters when the ball impacts a high or low position on the club head striking face.

SUMMARY

The present application concerns fairway, hybrid, and rescue wood-type golf club heads with twisted striking faces. In a representative embodiment, a golf club comprises a club head portion having a hosel portion, a heel portion, a sole portion, a toe portion, a crown portion, and a striking face, wherein the striking face has a bulge curvature and a roll curvature. The golf club further comprises a shaft portion connected to the club head portion, and a grip portion connected to the shaft portion. The striking face has a center face location. A center face vertical plane passes through the center face location and extends from adjacent the crown portion to adjacent the sole portion, and intersects with the striking face surface to define a center face roll contour. A toe side vertical plane is spaced away from the center face vertical plane by 14 mm toward the toe portion, extends from adjacent the crown portion to adjacent the sole portion, and intersects with the striking face surface to define a toe side roll contour. A heel side vertical plane is spaced away from the center face vertical plane by 14 mm toward the heel portion, extends from adjacent the crown portion to adjacent the sole portion, and intersects with the striking face surface to define a heel side roll contour. A center face horizontal plane passes through the center face location, extends from adjacent the toe portion to adjacent the heel portion, and intersects with the striking face surface to define a center face bulge contour. A crown side horizontal plane is spaced away from the center face horizontal plane by 7.5 mm toward the crown portion, extends from adjacent the toe portion to adjacent the heel portion, and intersects with the striking face surface to define a crown side bulge contour. A sole side horizontal plane is spaced away from the center face horizontal plane by 7.5 mm toward the sole portion, the sole side horizontal plane extending from adjacent the toe portion to adjacent the heel portion and intersecting with the striking face surface to define a sole side bulge contour. The club head portion has a volume less than 300 cc, and a head height ($H_{CH}$) of less than 48 mm. The striking face has a center face loft angle greater than 14 degrees. The club head portion has a Zup less than 24 mm. The toe side roll contour is more lofted than the center face roll contour, the heel side roll contour is less lofted than the center face roll contour, the crown side bulge contour is more open than the center face bulge contour, and the sole side bulge contour is more closed than the center face bulge contour.

In some embodiments, a point located at 7.5 mm above the center face location has a LA° Δ that is substantially unchanged compared to a 0° twist golf club head.

In some embodiments, a point located at 7.5 mm above the center face location has a FA° Δ of between 0.10 and 1.5° relative to the center face location.

In some embodiments, a point located at 7.5 mm above the center face location has a FA° Δ of between 0.10 and 0.750 relative to the center face location.

In some embodiments, a point located at 7.5 mm below the center face location has a FA° Δ of between −0.1° and −1.5° relative to the center face location.

In some embodiments, a point located at 7.5 mm below the center face location has a FA° Δ of between −0.1° and −0.75° relative to the center face location.

In some embodiments, an average FA° Δ of an upper toe quadrant is between 0.080 to 1°.

In some embodiments, an average FA° Δ of an upper toe quadrant is between 0.080 to 0.7°.

In some embodiments, a heel side point located at a x-y coordinate of (14 mm, 0 mm) has a LA° Δ relative to the center face location that is between 0° and −2.8°, and wherein a toe side point located at a x-y coordinate of (−14 mm, 0 mm) has a LA° Δ relative to the center face location that is between 0° and 2.8°.

In some embodiments, an average LA° Δ of an upper toe quadrant is between 0.250 to 3.1°.

In some embodiments, an average LA° Δ of an upper toe quadrant is between 0.250 to 1.6°.

In some embodiments, the volume of the club head portion is at least partially hollow, and has a volume of from 85 cc to 299 cc.

In some embodiments, the striking face has a bulge radius between 203 mm and 407 mm, and the striking face has a roll radius between 203 mm and 407 mm.

In some embodiments, the golf club further comprises a sleeve portion connected to the shaft portion, the sleeve portion being capable of adjusting the loft, lie, or face angle of the club head when the sleeve portion is removed from the hosel portion in a first configuration and reinserted into the hosel portion in a second configuration.

In some embodiments, a length of the shaft is between 37 inches and 44 inches.

In another representative embodiment, a golf club head comprises a hosel portion, a heel portion, a sole portion, a toe portion, a crown portion, and a striking face, and the striking face has a bulge curvature and a roll curvature. The striking face has a center face location. A center face vertical plane passes through the center face location, extends from adjacent the crown portion to adjacent the sole portion and intersects with the striking face surface to define a center face roll contour. A toe side vertical plane is spaced away from the center face vertical plane by 14 mm toward the toe portion, extends from adjacent the crown portion to adjacent the sole portion and intersects with the striking face surface to define a toe side roll contour. A heel side vertical plane is spaced away from the center face vertical plane by 14 mm toward the heel portion, extends from adjacent the crown portion to adjacent the sole portion and intersects with the striking face surface to define a heel side roll contour. A center face horizontal plane passes through the center face location, extends from adjacent the toe portion to adjacent the heel portion and intersects with the striking face surface to define a center face bulge contour. A crown side horizontal plane is spaced away from the center face horizontal plane by 7.5 mm toward the crown portion, extends from adjacent the toe portion to adjacent the heel portion and intersects with the striking face surface to define a crown side bulge contour. A sole side horizontal plane is spaced away from the center face horizontal plane by 7.5 mm toward the sole portion, extends from adjacent the toe portion to adjacent the heel portion and intersects with the striking face surface to define a sole side bulge contour. A volume of the golf club head is less than 300 cc, the club head portion has a head height ($H_{CH}$) of less than 48 mm, and the striking face has a center face loft angle greater than 14 degrees. The club head portion has a Zup less than 24 mm. The toe side roll contour is more lofted than the center face roll contour, the heel side roll contour is less lofted than the center face roll contour, the crown side bulge contour is more open than the center face bulge contour, and the sole side bulge contour is more closed than the center face bulge contour, wherein an average LA° Δ of an upper toe quadrant is between 0.250 to 2.1°.

In another representative embodiment, a golf club head comprises a hosel portion, a heel portion, a sole portion, a toe portion, a crown portion, and a striking face, and the striking face has a bulge curvature and a roll curvature. A center face vertical plane passes through the center face location, extends from adjacent the crown portion to adjacent the sole portion and intersects with the striking face surface to define a center face roll contour. A toe side vertical plane is spaced away from the center face vertical plane by 14 mm toward the toe portion, extends from adjacent the crown portion to adjacent the sole portion and intersects with the striking face surface to define a toe side roll contour. A heel side vertical plane is spaced away from the center face vertical plane by 14 mm toward the heel portion, extends from adjacent the crown portion to adjacent the sole portion and intersects with the striking face surface to define a heel side roll contour. A center face horizontal plane passes through the center face location, extends from adjacent the toe portion to adjacent the heel portion and intersects with the striking face surface to define a center face bulge contour. A crown side horizontal plane is spaced away from the center face horizontal plane by 7.5 mm toward the crown portion, extends from adjacent the toe portion to adjacent the heel portion and intersects with the striking face surface to define a crown side bulge contour. A sole side horizontal plane is spaced away from the center face horizontal plane by 7.5 mm toward the sole portion, extends from adjacent the toe portion to adjacent the heel portion and intersects with the striking face surface to define a sole side bulge contour. A volume of the golf club head is less than 300 cc, the club head portion has a head height ($H_{CH}$) of less than 48 mm, and the striking face has a center face loft angle greater than 14 degrees. The club head portion has a Zup less than 24 mm. The toe side roll contour is more lofted than the center face roll contour, the heel side roll contour is less lofted than the center face roll contour, the crown side bulge contour is more open than the center face bulge contour, and the sole side bulge contour is more closed than the center face bulge contour, wherein an average FA° Δ of an upper toe quadrant is between 0.080 to 0.7°.

In some embodiments, a point located at 7.5 mm above the center face location has a LA° Δ that is substantially unchanged compared to a 0° twist golf club head.

In some embodiments, a point located at 7.5 mm above the center face location has a FA° Δ of between 0.10 and 1° relative to the center face location.

In some embodiments, a point located at 7.5 mm above the center face location has a FA° Δ of between 0.10 and 0.5° relative to the center face location.

In some embodiments, a point located at 7.5 mm below the center face location has a FA° Δ of between −0.1° and −1° relative to the center face location.

In some embodiments, a point located at 7.5 mm below the center face location has a FA° Δ of between −0.1° and −0.5° relative to the center face location.

In some embodiments, the striking face has a degree of twist that is between 0.10 and 4° when measured between two critical locations, the first critical location being located at 15 mm above the center face location, and the second critical location being located at between 15 mm below the center face location.

In some embodiments, a heel side point located at a x-y coordinate of (14 mm, 0 mm) has a LA° Δ relative to the center face location that is between −0.2° and −1.9°.

In some embodiments, a toe side point located at a x-y coordinate of (−14 mm, 0 mm) has a LA° Δ relative to the center face location that is between 0.2° and 1.9°.

In some embodiments, the striking face has a bulge radius between 203 mm and 407 mm.

In some embodiments, the striking face comprises a titanium alloy including 6.75% to 9.75% aluminum by weight and 0.75% to 3.25% molybdenum by weight.

The foregoing and other objects, features, and advantages of the disclosed technology will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the disclosed technology will be described with reference to details discussed below, and the accompanying drawings will illustrate the various embodiments. The following description and drawings are illustrative and are not to be construed as limiting the disclosure. Numerous specific details are described to provide a thorough understanding of various embodiments of the disclosed technology.

First Representative Embodiment

Figure 1:
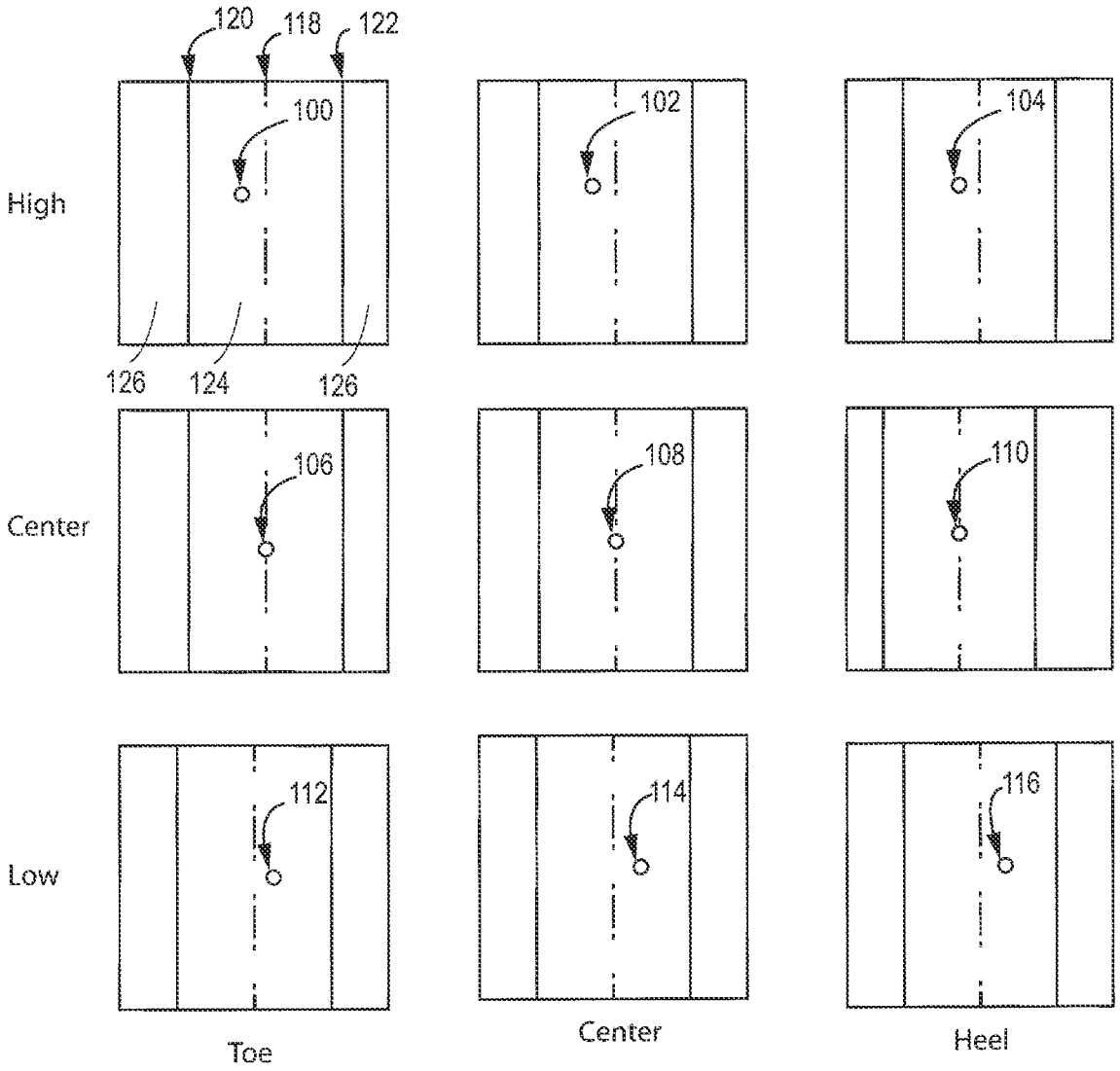
FIG. 1 is an illustration of different ball locations relative to the impact location on a golf club face.
Figure 2A:
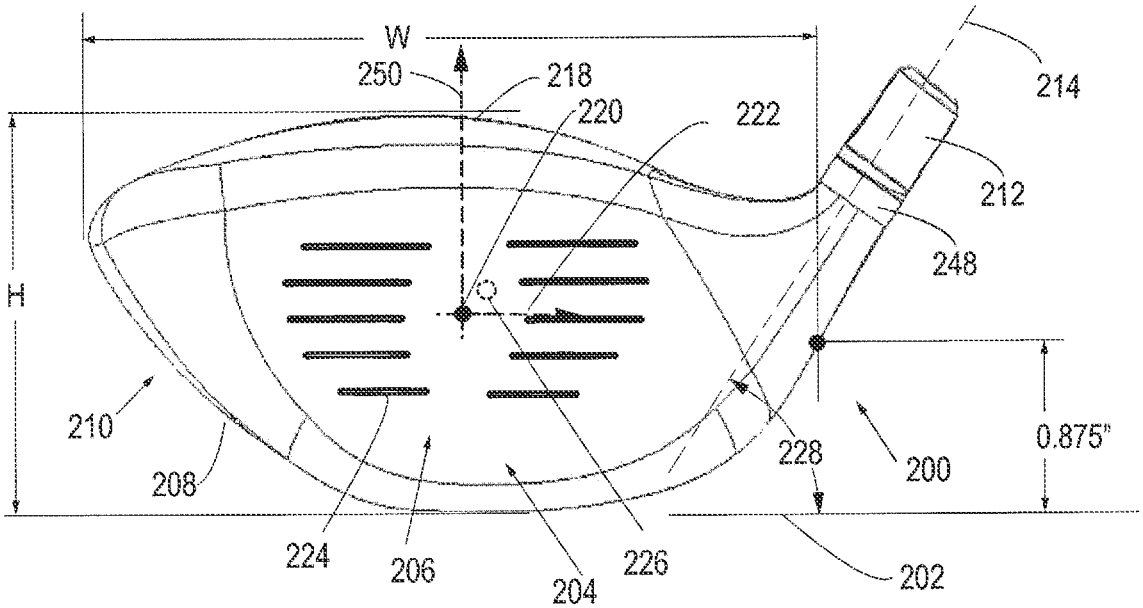
FIG. 2*a* is an elevated front view of a golf club head.

FIG. 2*a* illustrates a golf club head having a front portion 204, a heel portion 200, a toe portion 210, a crown portion 218, a hosel portion 248, a sole portion 208, a hosel axis 214, a lie angle 228, and a hosel insert 212. The golf club head has a width dimension W, a height dimension H, and a depth dimension D measured when the golf club head is positioned in an address position. The address position is defined as the golf club head in a lie angle of fifty-seven degrees and the loft of the club adjusted to the designated loft of the club head. Unless otherwise stated, all the measured dimensions described herein are evaluated when the club head is oriented in the address position. If the club head at a fifty-seven degree lie angle visually appears to be unlevel from a front face perspective, an alternative lie angle called the "scoreline lie" may be used. The scoreline lie is defined as the lie angle at which the substantially horizontal face scorelines are parallel to a perfectly flat ground plane. The width dimension W is not greater than 5 inches, and the depth dimension D is not greater than the width dimension W. The height dimension H is not greater than 2.8 inches. In some embodiments, the depth dimension D or the width dimension W is less than 4.4", less than 4.5", less than 4.6", less than 4.7", less than 4.8", less than 4.9", or less than 5". In some embodiments the height dimension H is less than 2.7", less than 2.6", less than 2.5", less than 2.4", less than 2.3", less than 2.2", less than 2.1", less than 2", less than 1.9" or less than 1.8". In certain embodiments, the club head height is between about 63.5 mm to 71 mm (2.5" to 2.8") and the width is between about 116.84 mm to about 127 mm (4.6" to 5.0"). Furthermore, the depth dimension is between about 111.76 mm to about 127 mm (4.4" to 5.0").

These dimensions are measured on horizontal lines between vertical projections of the outermost points of the heel and toe, face and back, and sole and crown. The outermost point of the heel is defined as the point on the heel that is 0.875" above the horizontal ground plane 202.

FIG. 2*a* further illustrates a face center 220 location. This location is found by utilizing the USGA Procedure for Measuring the Flexibility of a Golf Clubhead, Revision 2.0 published on Mar. 25, 2005, herein incorporated by reference in its entirety. Specifically, the face center 220 location is found by utilizing the template method described in section 6.1.4 and FIG. 6.1 described in the USGA document mentioned above.

A coordinate system for measuring CG location is located at the face center 220. In one embodiment, the positive x-axis 222 is projecting toward the heel side of the club head, the positive z-axis 250 is projecting toward the crown side of the club head, and the positive y-axis 216 is projecting toward the rear of the club head parallel to a ground plane.

In some embodiments, the golf club head can have a CG with a CG x-axis coordinate between about −5 mm and about 10 mm, a CG y-axis coordinate between about 15 mm and about 50 mm, and a CG z-axis coordinate between about −10 mm and about 5 mm. In yet another embodiment, the CG y-axis coordinate is between about 20 mm and about 50 mm.

Scorelines 224 are located on the striking face 206. In one exemplary embodiment, a projected CG location 226 is shown on the striking face and is considered the "sweet spot" of the club head. The projected CG location 226 is found by balancing the clubhead on a point. The projected CG location 226 is generally projected along a line that is perpendicular to the face of the club head. In some embodiments, the projected CG location 226 is less than 2 mm above the center face location, less than 1 mm above the center face, or up to 1 mm or 2 mm below the center face location 220.

Figure 2B:
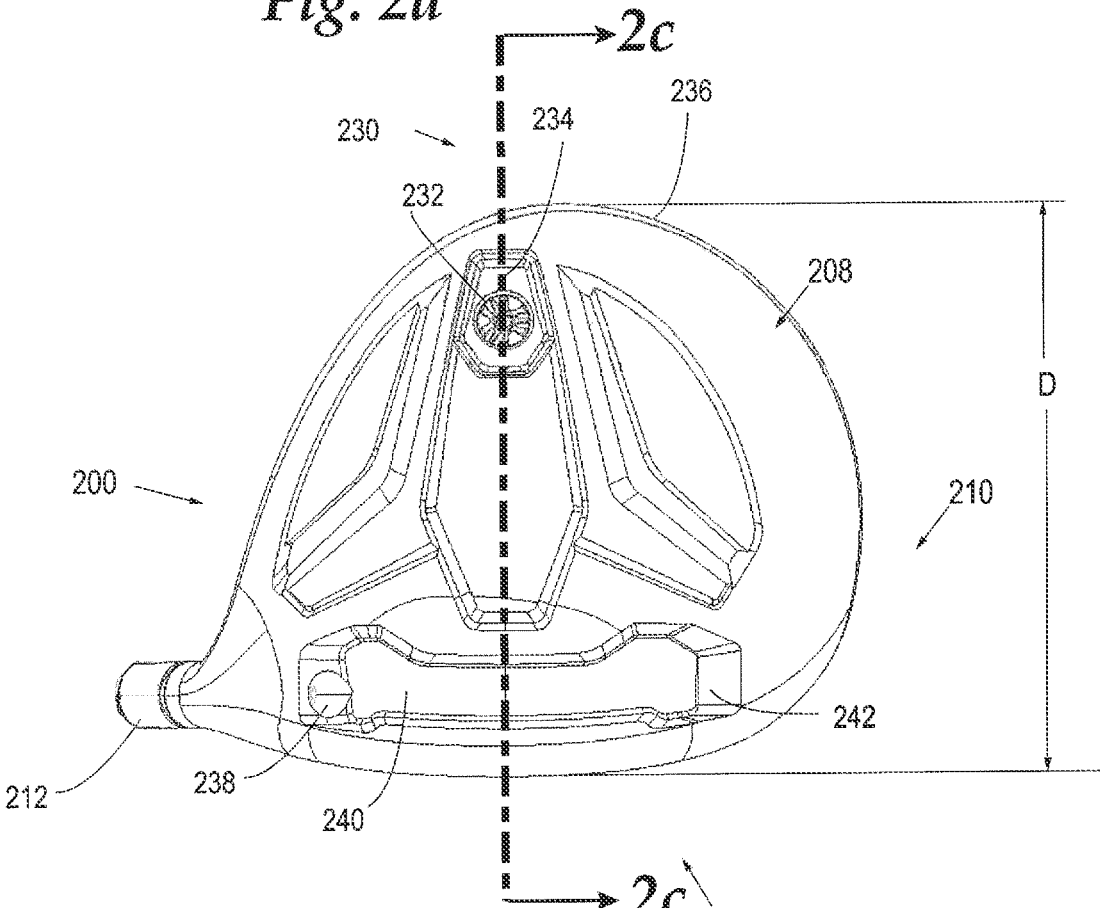
FIG. 2*b* is a sole view of a golf club head.

FIG. 2*b* illustrates a sole view of the club head showing the back portion 230 and an edge 236 between the crown 218 and sole 208 portions. In one embodiment, the club is provided with a weight port 234 and an adjustable weight 232 located in the weight port 234. In addition, a flexible recessed channel portion 240 having a channel sidewall 242 is provided in the front half of the club head sole portion 208 proximate to the striking face 206. Within the channel portion 240, a fastener opening 238 is provided to allow the insertion of a fastening member 268, such as a screw, for engaging with the hosel insert 212 for attaching a shaft to the club head and to allow for an adjustable loft, lie, and/or face angle. In one embodiment, the hosel insert 212 is configured to allow for the adjustment of at least one of a loft, lie or face angle.

Figure 2C:
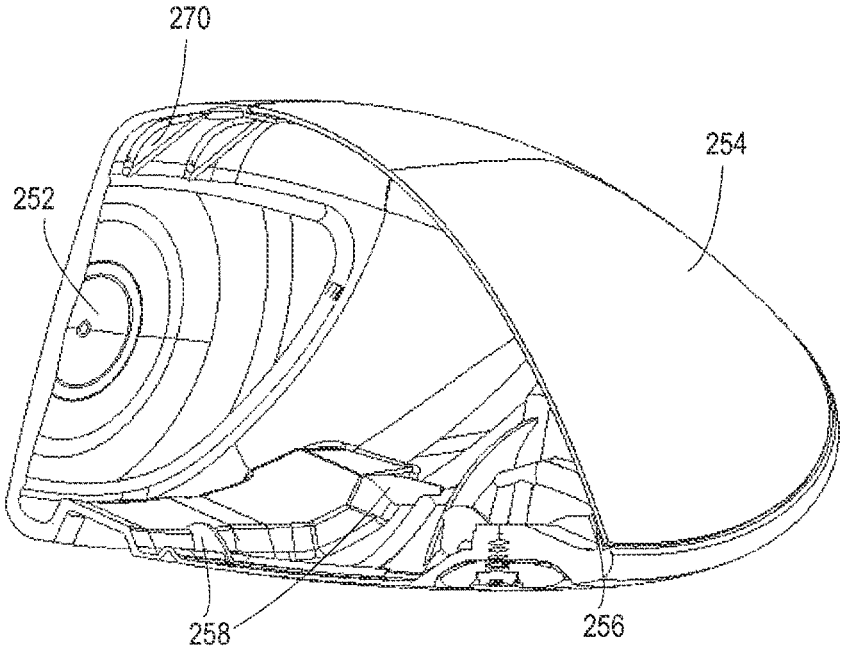
FIG. 2*c* is an isometric cross-sectional view taken along section lines 2*c*-2*c* in FIG. 2*b*.

FIG. 2*c* illustrates a cross-sectional view taken along lines 2*c*-2*c* in FIG. 2*b*. In one embodiment, a machined face insert 252 is welded to a front opening on the club head. The face insert 252 has a variable face thickness having an inverted recess in the center portion of the back surface of the face insert 252. In addition, a composite crown 254 is bonded to the crown portion 218 and rests on a bonding ledge 256. In one embodiment, the bonding ledge is between 1-7 mm, 1-5 mm, or 1-3 mm and continuously extends around a circumference of the opening to support the crown. A plurality of ribs 258 are connected to the interior portion of the channel 240 to improve the sound of the club upon impact with a golf ball.

Figure 2D:
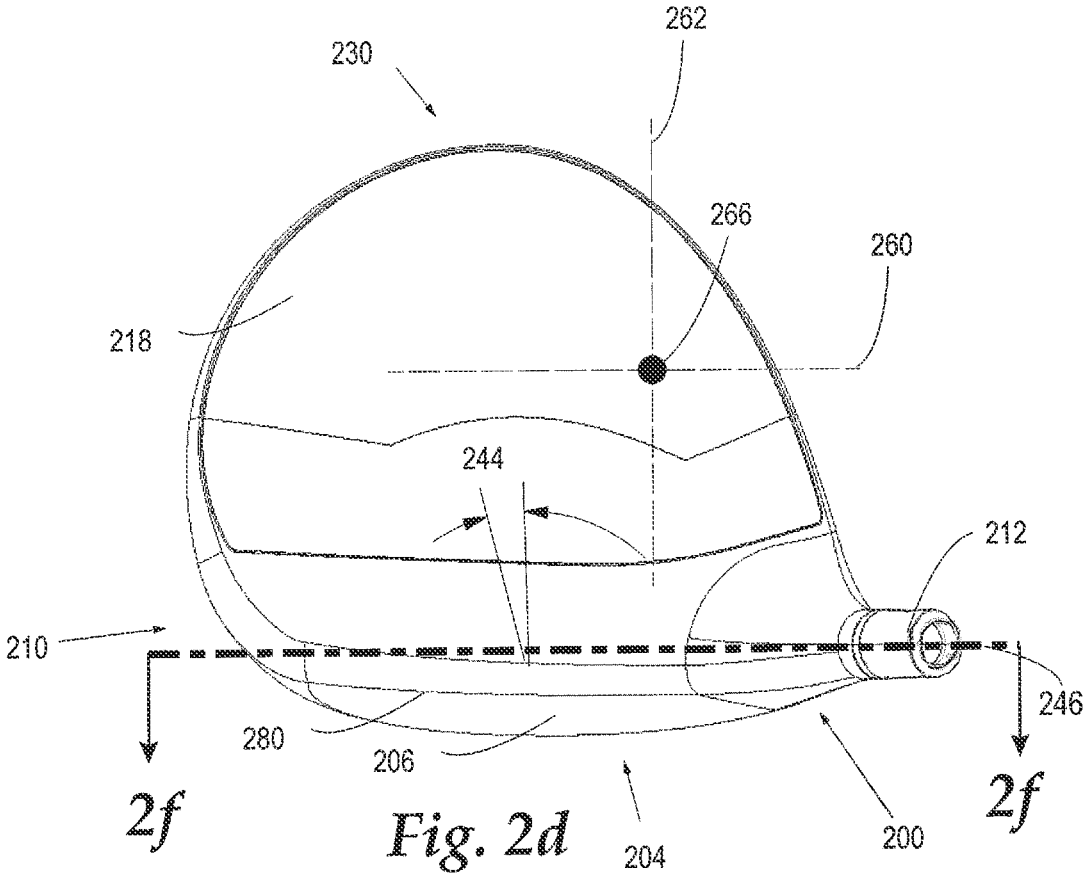
FIG. 2*d* is a top view of a golf club head.

FIG. 2*d* illustrates a top view of the golf club head in the address position. A hosel plane 246 is shown being perpendicular to the ground plane and containing the hosel axis 214. In addition, a center face nominal face angle 244 is shown which can be adjusted by the hosel insert 212. A positive face angle indicates the golf club face is pointed to the right of a center line target at a given measured point. A negative face angle indicates the golf club face is pointed to the left of a centerline target at a given measured point. A topline 280 is also shown. The topline 280 is defined as the intersection of the crown and the face of the golf club head. Often the paint line of the crown stops at the topline 280.

FIG. 2*d* also shows golf club head moments of inertia defined about three axes extending through the golf club head CG 266 including: a CG z-axis 264 (see FIG. 2*e*) extending through the CG 266 in a generally vertical direction relative to the ground 202 when the club head is at address position, a CG x-axis 260 extending through the CG 266 in a heel-to-toe direction generally parallel to the striking surface 206 and generally perpendicular to the CG z-axis 264, and a CG y-axis 262 extending through the CG 266 in a front-to-back direction and generally perpendicular to the CG x-axis 260 and the CG z-axis 264. The CG x-axis 260 and the CG y-axis 262 both extend in a generally horizontal direction relative to the ground 202 when the club head 200 is at the address position.

The moment of inertia about the golf club head CG x-axis 260 is calculated by the following equation:

$$I_{CGx}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CG x-axis 260 and the CG z-axis 264. The CG xy-plane is a plane defined by the CG x-axis 260 and the CG y-axis 262.

Moreover, a moment of inertia about the golf club head CG z-axis 264 is calculated by the following equation:

$$I_{CGz}=(x_2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis 262 and the CG z-axis 264.

In certain implementations, the club head can have a moment of inertia about the CG z-axis, between about 450 kg·mm2 and about 650 kg·mm2, and a moment of inertia about the CG x-axis between about 300 kg·mm2 and about 500 kg·mm2, and a moment of inertia about the CG y-axis between about 300 kg·mm2 and about 500 kg·mm2.

Figure 2E:
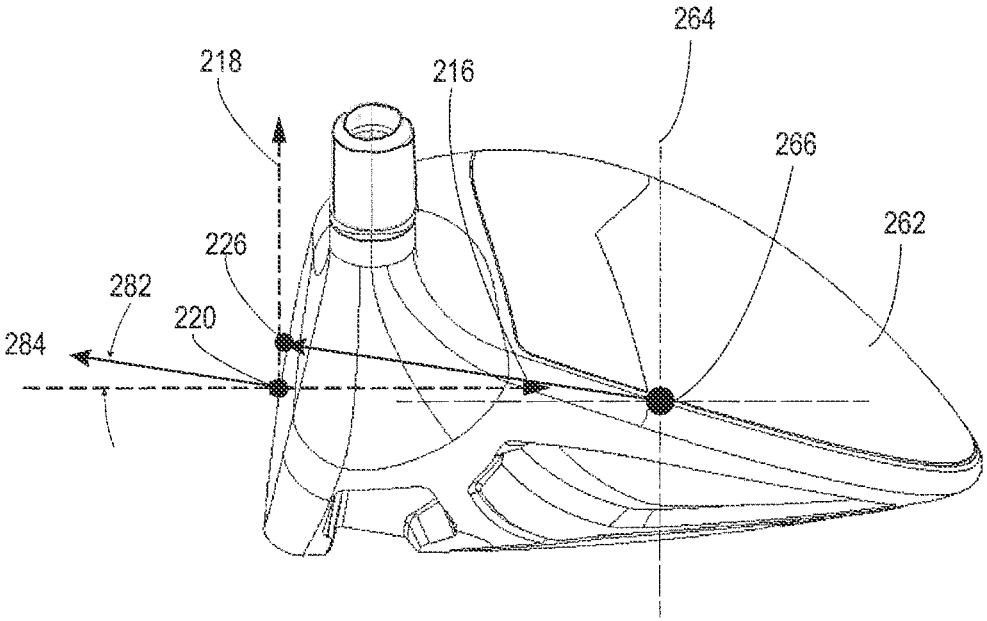
FIG. 2*e* is an elevated heel perspective view of a golf club head.

FIG. 2*e* shows the heel side view of the club head and provides a side view of the positive y-axis 216 and how the CG 266 is projected onto the face at a projected CG location 226 previously described. A nominal center face loft angle 282 is shown to be the angle created by a perpendicular center face vector 284 relative to a horizontal plane parallel to a ground plane.

Figure 2F:
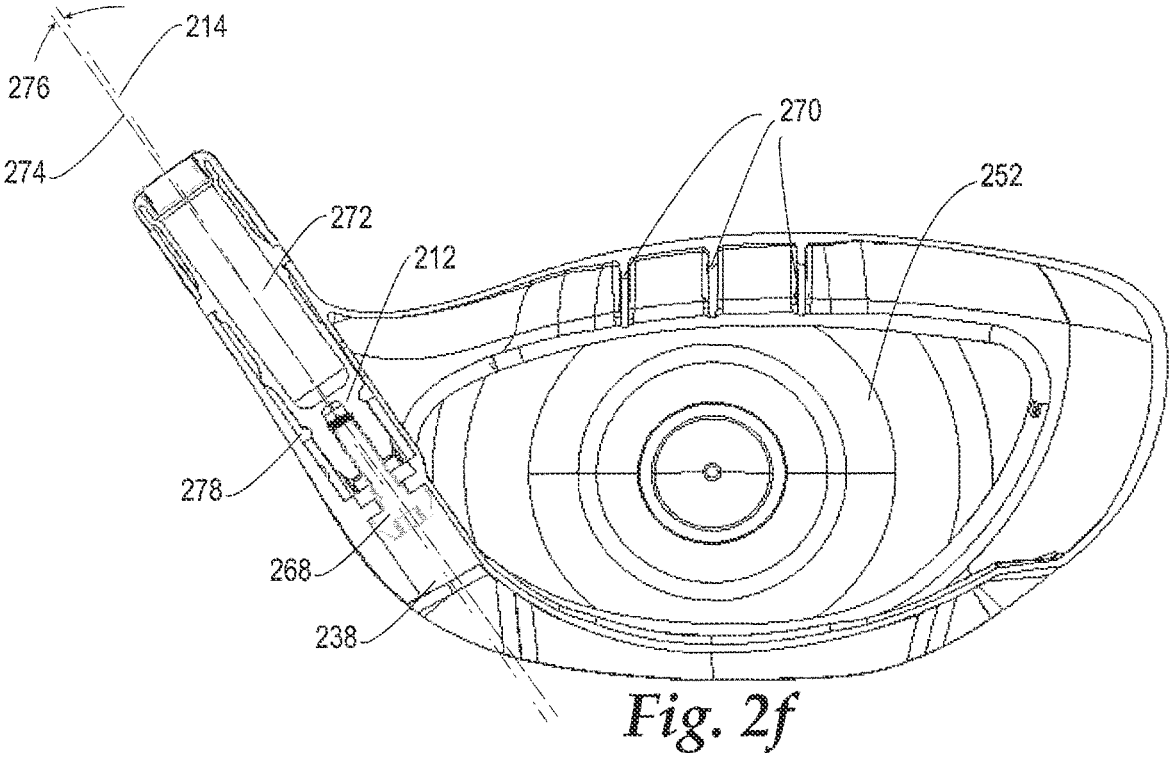
FIG. 2*f* is a cross-sectional view taken along section lines 2*f*-2*f* in FIG. 2*d*.

FIG. 2*f* illustrates a cross-sectional view taken along lines 2*f*-2*f* shown in FIG. 2*d*. The mechanical fastener 268 is more easily seen being inserted into the opening 238 for threadably engaging with the sleeve 212. The sleeve includes a sleeve bore 272 for allowing the shaft to be inserted for adhesive bonding with the sleeve 212. A plurality of crown ribs 270 are also shown in the face to crown transition portion.

Figure 3:
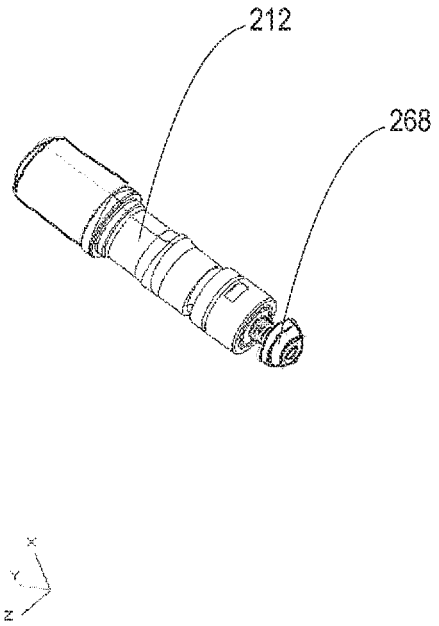
FIG. 3 is an isometric view of a shaft tip sleeve.

FIG. 3 illustrates the sleeve 212 and mechanical fastener 268 when removed from the golf club head. The embodiments described above include an adjustable loft, lie, or face angle system that is capable of adjusting the loft, lie, or face angle either in combination with one another or independently from one another. For example, a portion of the sleeve 212, the sleeve bore 272, and the shaft collectively define a longitudinal axis 274 of the assembly. In one embodiment, the longitudinal axis 274 of the assembly is co-axial with the sleeve bore 272. A portion of the hosel sleeve is effective to support the shaft along the longitudinal axis 274 of the assembly, which is offset from a longitudinal axis 214 of the interior hosel tube bore 278 by offset angle 276. The longitudinal axis 214 is co-axial with the interior hosel tube bore 278. The sleeve can provide a single offset angle that can be between 0 degrees and 4 degrees, in 0.25 degree increments. For example, the offset angle can be 1.0 degree, 1.25 degrees, 1.5 degrees, 1.75 degrees, 2.0 degrees, 2.25 degrees, 2.5 degrees, 2.75 degrees, or 3.0 degrees. The offset angle of the embodiment shown in FIG. 2*f* is 1.5 degrees.

Figure 4A:
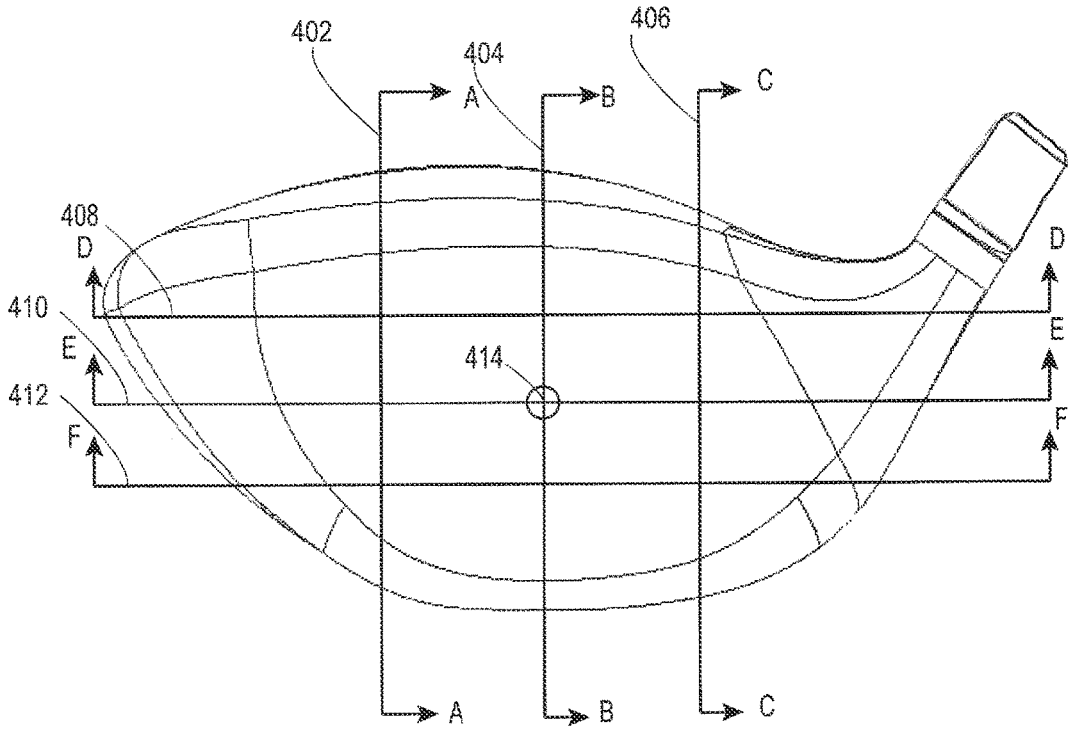
FIG. 4*a* is an elevated front view of a golf club according to an embodiment.

FIG. 4*a* illustrates a plurality of vertical planes 402,404, 406 and horizontal planes 408,410,412. More specifically, the toe side vertical plane 402, center vertical plane 404 (passing through center face), and heel vertical plane 406 are separated by a distance of 30 mm as measured from the center face location 414. The upper horizontal plane 408, the center horizontal plane 410 (passing through center face 414), and the lower horizontal plane 412 are spaced from each other by 15 mm as measured from the center face location 414.

Figure 4B:
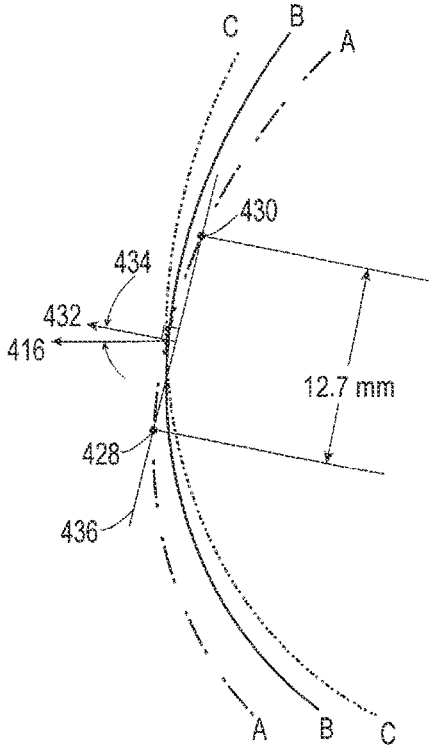
FIG. 4*b* is an exaggerated comparative view of face surface contours taken along section lines A-A, B-B, and C-C as seen from a heel view.

FIG. 4*b* illustrates all three striking face surface roll contours A,B,C that are overlaid on top of one another as viewed from the heel side of the golf club. The three face surface contours are defined as face contours that intersect the three vertical planes 402,404, 406. Specifically, toe side contour A, represented by a dashed line, is defined by the intersection of the striking face surface and vertical plane 402 located on the toe side of the striking face. Center face vertical contour B, represented by a solid line, is defined by the intersection of the striking face surface and center face vertical plane 404 located at the center of the striking face. Heel side contour C, represented by a finely dashed line, is defined by the intersection of the striking face surface a vertical plane 406 located on the heel side of the striking face. Roll contours A,B,C are considered three different roll contours across the striking face taken at three different locations to show the variability of roll across the face. The toe side vertical contour A is more lofted (having positive LA° Δ) relative to the center face vertical contour B. The heel side vertical contour C is less lofted (having a negative LA° Δ) relative to the center face vertical contour B.

FIG. 4*b* shows a loft angle change 434 that is measured between a center face vector 416 located at the center face 414 and the toe side roll curvature A having a face angle vector 432. The vertical pin distance of 12.7 mm is measured along the toe side roll curvature A from a center location to a crown side and a sole side to locate a crown side measurement 430 point and sole side measurement points 428. A segment line 436 connects the two points of measurement. A loft angle vector 432 is perpendicular to the segment line 436. The loft angle vector 432 creates a loft angle 434 with the center face vector 416 located at the center face point 414. As described, a more lofted angle indicates that the loft angle change (LA° Δ) is positive relative to the center face vector 416 and points above or higher relative to the center face vector 416 as is the case for the roll curvature A.

Figure 4C:
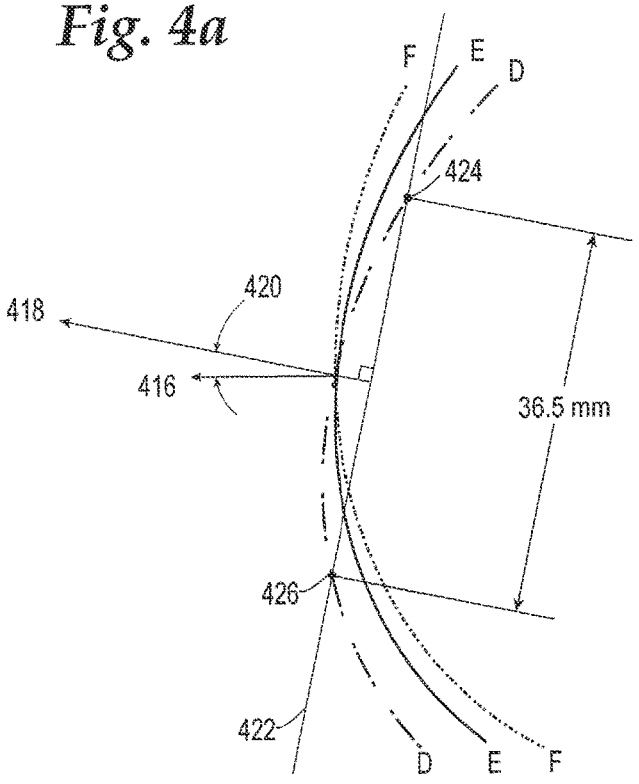
FIG. 4*c* is an exaggerated comparative view of face surface contours taken along section lines D-D, E-E, and F-F as seen from a top view

FIG. 4*c* further illustrates three striking face surface bulge contours D,E,F that are overlaid on top of one another as viewed from the crown side of the golf club. The three face surface contours are defined as face contours that intersect the three horizontal planes 408,410, 412. Specifically, crown side contour D, represented by a dashed line, is defined by the intersection of the striking face surface and upper horizontal plane 408 located on the upper side of the striking face toward the crown portion. Center face contour E, represented by a solid line, is defined by the intersection of the striking face surface and horizontal plane 408 located at the center of the striking face. Sole side contour F, represented by a finely dashed line, is defined by the intersection of the striking face surface a horizontal plane 412 located on the lower side of the striking face. Bulge contours D,E,F are considered three different bulge contours across the striking face taken at three different locations to show the variability of bulge across the face. The crown side bulge contour D is more open (having a positive FA° Δ, defined below) when compared to the center face bulge contour E. The sole side bulge contour F is more closed (having a negative FA° Δ when measured about the center vertical plane).

With the type of "twisted" bulge and roll contour defined above, a ball that is struck in the upper portion of the face will be influenced by horizontal contour D. A typical shot having an impact in the upper portion of a club face will influence the golf ball to land left of the intended target. However, when a ball impacts the "twisted" face contour described above, horizontal contour D provides a general curvature that points to the right to counter the left tendency of a typical upper face shot.

Likewise, a typical shot having an impact location on the lower portion of the club face will land typically land to the right of the intended target. However, when a ball impacts the "twisted" face contour described above, horizontal contour F provides a general curvature that points to the left to counter the right tendency of a typical lower face shot. It is understood that the contours illustrated in FIGS. 4*b* and 4*c* are severely distorted in order for explanation purposes.

In order to determine whether a 2-D contour, such as A,B,C,D,E, or F, is pointing left, right, up, or down, two measurement points along the contour can be located 18.25 mm from a center location or 36.5 mm from each other. A first imaginary line can be drawn between the two measurement points. Finally, a second imaginary line perpendicular to the first imaginary line can be drawn. The angle between the second imaginary line of a contour relative to a line perpendicular to the center face location provides an indication of how open or closed a contour is relative to a center face contour. Of course, the above method can be implemented in measuring the direction of a localized curvature provided in a CAD software platform in a 3D or 2D model, having a similar outcome. Alternatively, the striking surface of an actual golf club can be laser scanned or profiled to retrieve the 2D or 3D contour before implementing the above measurement method. Examples of laser scanning devices that may be used are the GOM Atos Core 185 or the Faro Edge Scan Arm HD. In the event that the laser scanning or CAD methods are not available or unreliable, the face angle and the loft of a specific point can be measured using a "black gauge" made by Golf Instruments Co. located in Oceanside, CA. An example of the type of gauge that can be used is the M-310 or the digital-manual combination C-510 which provides a block with four pins for centering about a desired measurement point. The horizontal distance between pins is 36.5 mm while the vertical distance between the pins is 12.7 mm.

When an operator is measuring a golf club with a black gauge for loft at a desired measurement point, two vertical pins (out of the four) are used to measure the loft about the desired point that is equidistant between the two vertical pins that locate two vertical points. When measuring a golf club with a black gauge for face angle at a desired measurement point, two horizontal pins (out of the four) are used to measure the face angle about the desired point. The desired point is equidistant between the two horizontal points located by the pins when measuring face angle.

FIG. 4*c* shows a face angle 420 that is measured between a center face vector 416 located at the center face 414 and the crown side bulge curvature D having a face angle vector 418. The horizontal pin distance of 18.25 mm is measured along the crown side bulge curvature D from a center location to a heel side and a toe side to locate a heel side measurement 426 point and toe side measurement points 424. A segment line 422 connects the two points of measurement. A face angle vector 418 is perpendicular to the segment line 422. The face angle vector 418 creates a face angle 420 with the center face vector 416 located at the center face point 414. As described, an open face angle indicates that the face angle change (FA° Δ) is positive relative to the center face vector 416 and points to the right as is the case for the bulge curvature D.

Figure 5:
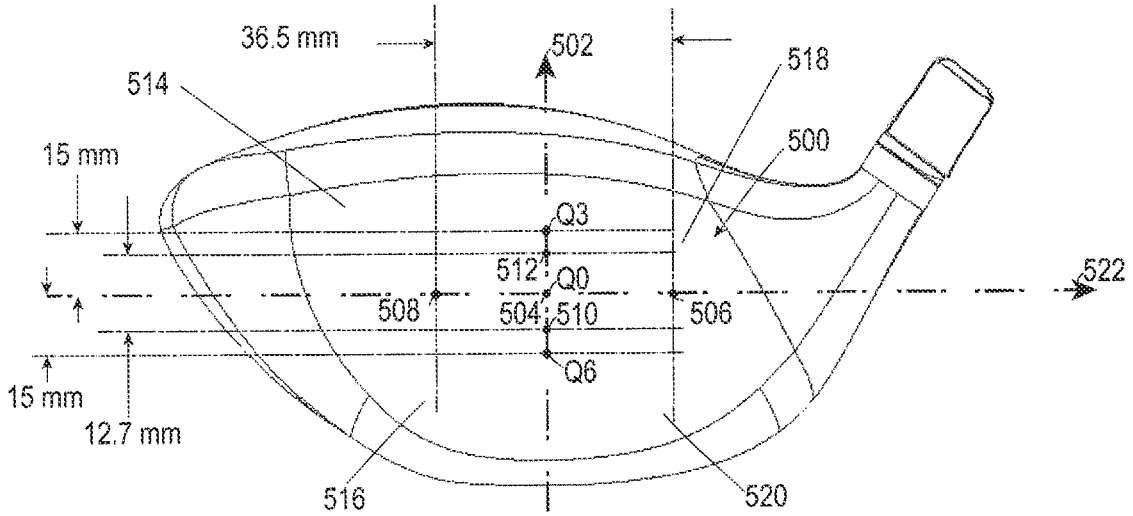
FIG. 5 is a front view of a golf club face with multiple measurement points and four quadrants.

FIG. 5 shows a desired measurement point Q0 located at the center of the striking face 500. A horizontal plane 522 and a vertical plane 502 intersect at the desired measurement point Q0 and divide the striking face 500 into four quadrants. The upper toe quadrant 514, the upper heel quadrant 518, the lower heel quadrant 520, and the lower toe quadrant 516 all form the striking face 500, collectively. In one embodiment, the upper toe quadrant 514 is more "open" than all the other quadrants. In other words, the upper toe quadrant 514 has a face angle pointing to the right, in the aggregate. In other words, if a plurality of evenly spaced points (for example a grid with measurement points being spaced from one another by 5 mm) covering the entire upper toe quadrant 514 were measured, it would have an average face angle that points right of the intended target more than any other quadrant.

The term "open" is defined as having a face angle generally pointing to the right of an intended target at address, while the term "closed" is defined as having a face angle generally pointing to the left of an intended target ad address. In one embodiment, the lower heel quadrant 520 is more "closed" than all the other quadrants, meaning it has a face angle, in the aggregate, that is pointing more left than any of the other quadrants.

If the edge of the striking surface 500 is not visually clear, the edge of the striking face 500 is defined as a point at which the striking surface radius becomes less than 127 mm. If the radius is not easily computed within a computer modeling program, three points that are 0.1 mm apart can be used as the three points used for determining the striking surface radius. A series of points will define the outer perimeter of the striking face 500. Alternatively, if a radius is not easily obtainable in a computer model, a 127 mm curvature gauge can be used to detect the edge of the face of an actual golf club head. The curvature gauge would be rotated about a center face point to determine the face edge.

In one illustrative example in FIG. 5, the face angle and loft are measured for a center face point Q0 when an easily measureable computer model method is not available, for example, when an actual golf club head is measured. A black gauge is utilized to measure the face angle by selecting two horizontal points 506,508 along the horizontal plane 522 that are 36.5 mm apart and centered about the center face point Q0 so that the horizontal points 506,508 are equidistant from the center face point Q0. The two pins from the black gauge engage these two points and provide a face angle measurement reading on the angle measurement readout provided. Furthermore, a loft is measured about the Q0 point by selecting two vertical points 512,510 that are spaced by a vertical distance of 12.7 mm apart from each other. The two vertical pins from the black gauge engage these two vertical points 512,510 and provide a loft angle measurement reading on the readout provided.

The positive x-axis 522 for face point measurements extends from the center face toward the heel side and is tangent to the center face. The positive y-axis 502 for face point measurements extends from the center face toward the crown of the club head and is tangent to the center face. The x-y coordinate system at center face, without a loft component, is utilized to locate the plurality of points P0-P36 and Q0-Q8, as described below. The positive z-axis 504 extends from the face center and is perpendicular to the face center point and away from the internal volume of the club head. The positive z-axis 504 and positive y-axis 502 will be utilized as a reference axis when the face angle and loft angle are measured at another x-y coordinate location, other than center face.

FIG. 5 further shows two critical points Q3 and Q6 located at coordinates (0 mm, 15 mm) and (0 mm, −15 mm), respectively. As used herein, the terms "1° twist" and "2° twist" are defined as the total face angle change between these two critical point locations at Q3 and Q6. For example, a "1° twist" would indicate that the Q3 point has a 0.5° twist relative to the center face, Q0, and the Q6 point has a −0.5° twist relative to the center face, Q0. Therefore, the total degree of twist as an absolute value between the critical points Q3,Q6 is 10, hence the nomenclature "1° twist".

Figure 6A:
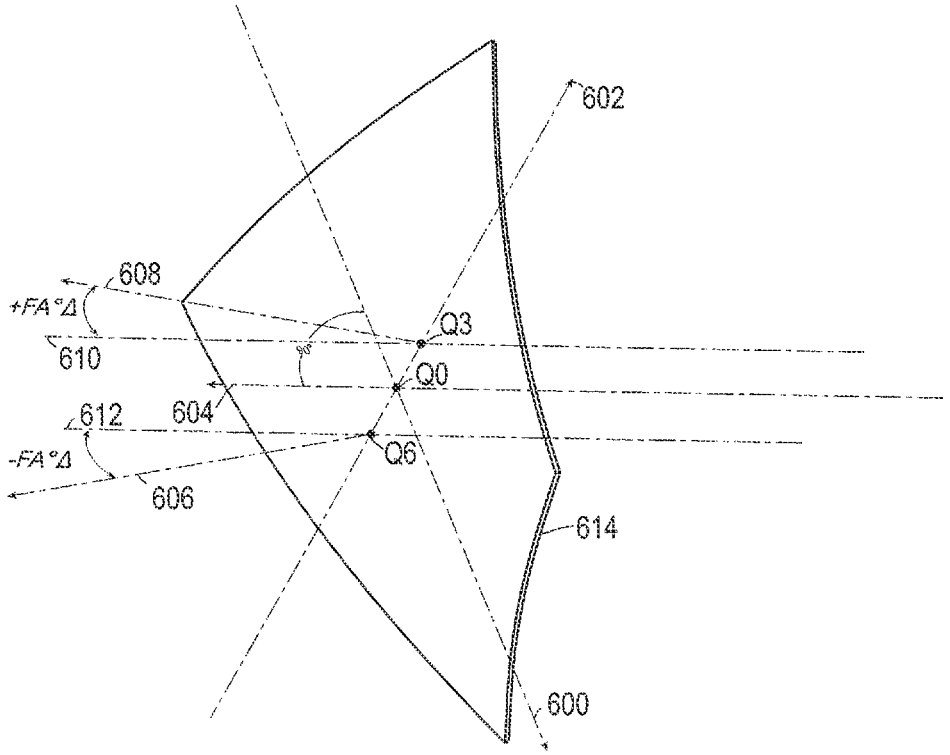
FIG. 6*a* is an isometric view of an exemplary twisted face surface plane.

To further the understanding of what is meant by a "twisted face", FIG. 6*a* provides an isometric view of an over-exaggerated twisted striking surface plane 614 of "10° twist" to illustrate the concept as applied to a golf club striking face. Each point located on the golf club face has an associated loft angle change (defined as "LA° Δ") and face angle change (defined as "FA° Δ"). Each point has an associated loft angle change (defined as "LA° Δ") and face angle change (defined as "FA° Δ").

FIG. 6*a* shows the center face point, Q0, and the two critical points Q3,Q6 described above, and a positive x-axis 600, positive z-axis 604, and positive y-axis 602 located on a twisted plane in an isometric view. The center face has a perpendicular axis 604 that passes through the center face point Q0 and is perpendicular to the twisted plane 614. Likewise, the critical points Q3 and Q6 also have a reference axis 610, 612 which is parallel to the center face perpendicular axis 604. The reference axes 610, 612 are utilized to measure a relative face angle change and loft angle change at these critical point locations. The critical points Q3, Q6 each have a perpendicular axis 608, 606 that is perpendicular to the face. Thus, the face angle change is defined at the critical points as the change in face angle between the reference axis 610,612 and the relative perpendicular axis 608, 606.

Figure 6B:
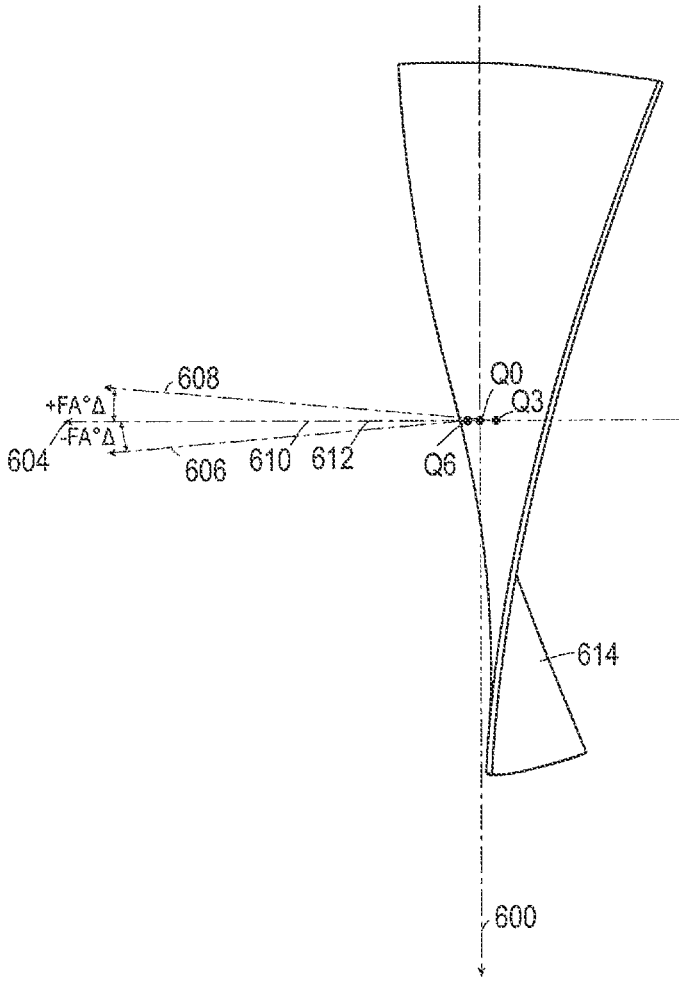
FIG. 6*b* is a top view of an exemplary twisted face surface plane.

FIG. 6*b* shows a top view of the twisted plane 614 and further illustrates how the face angle change is measured between the perpendicular axes 608, 606 at the critical points and the reference axes 610, 612 that are parallel with the center face perpendicular axis 604. A positive face angle change +FA° Δ indicates a perpendicular axis at a measured point that points to the right of the relative reference axis. A negative face angle change −FA° Δ indicates a perpendicular axis that points to the left of the relative reference axis. The face angle change is measured within the plane created by the positive x-axis 600 and positive z-axis 604.

Figure 6C:
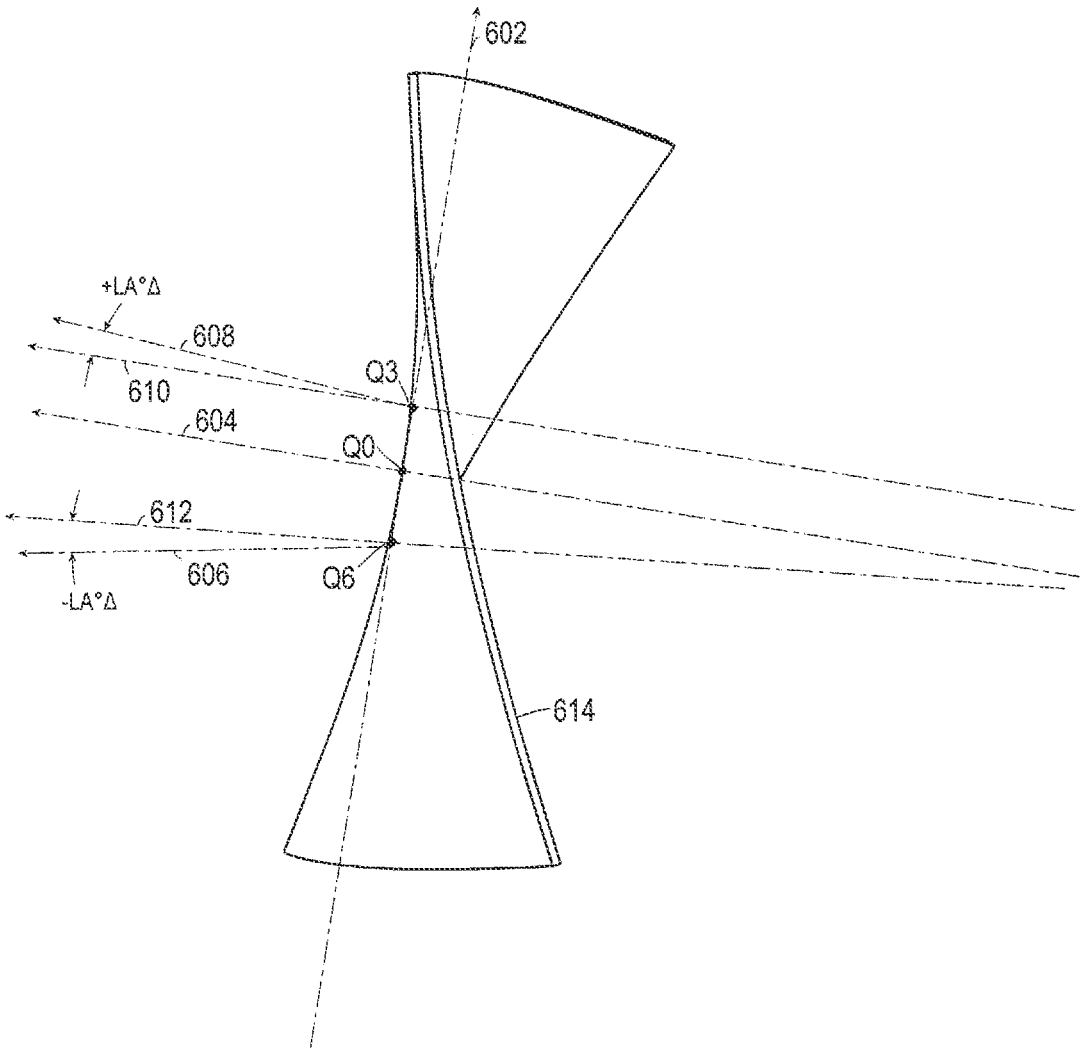
FIG. 6*c* is an elevated heel view of an exemplary twisted face surface plane.

FIG. 6*c* shows a heel side view of a twisted plane 614 and the loft angle change between the perpendicular axes 608, 606 and the reference axes 610,612 at the critical point locations. A positive loft angle change +LA° Δ indicates a perpendicular axis at a measured point that points above the relative reference axis. A negative loft angle change −LA° Δ indicates a perpendicular axis that points below the relative reference axis. The loft angle is measured within the plane created by the positive z-axis 604 and positive y-axis 602 for a given measured point.

Figure 7:
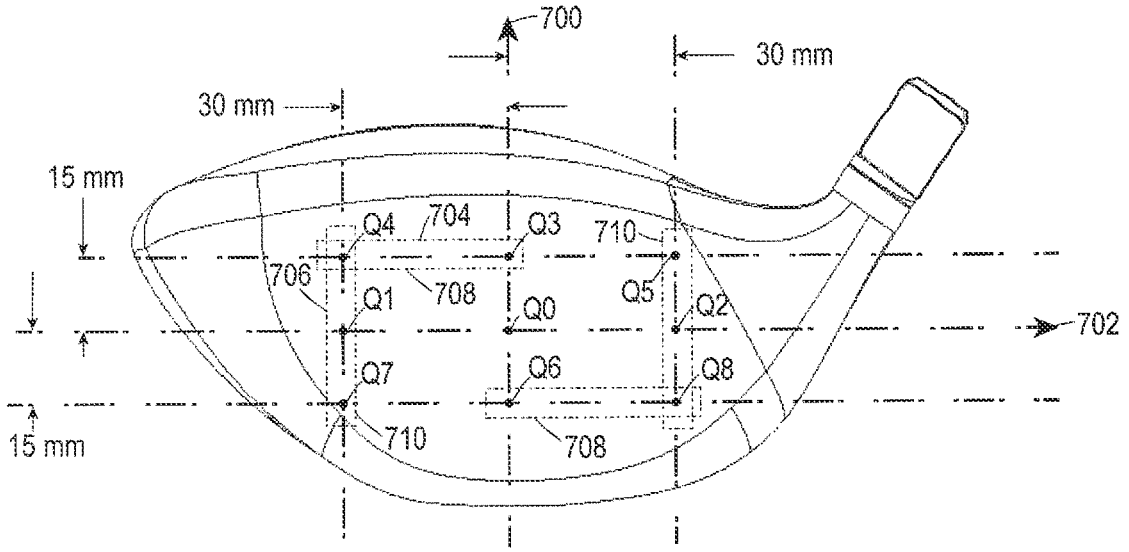
FIG. 7 illustrates a front view of a golf club with a predetermined set of measurement points.

FIG. 7 shows an additional plurality of points Q0-Q8 that are spaced apart across the striking face in a grid pattern. In addition to the critical points Q3,Q6 described above, heel side points Q5,Q2,Q8 are spaced 30 mm away from a vertical axis 700 passing through the center face. Toe side points Q4,Q1,Q7 are spaced 30 mm away from the vertical axis 700 passing through the center face. Crown side points Q3,Q4,Q5 are spaced 15 mm away from a horizontal axis 702 passing through the center face. Sole side points Q6,Q7, Q8 are spaced 15 mm away from the horizontal axis 702. Point Q5 is located in an upper heel quadrant at a coordinate location (30 mm, 15 mm) while point Q7 is located in a lower toe quadrant at a coordinate location (−30 mm, −15 mm). Point Q4 is located in an upper toe quadrant at a coordinate location (−30 mm, 15 mm) while point Q8 is located in a lower heel quadrant at a coordinate location (30 mm, −15 mm).

It is understood that many degrees of twist are contemplated and the embodiments described are not limiting. For example, a golf club having a "0.25° twist", "0.75° twist", "1.25° twist", "1.5° twist", "1.75° twist", "2.25° twist", "2.5° twist", "2.75° twist, "3° twist", "3.25° twist", "3.5° twist", "3.75° twist", "4.25° twist", "4.5° twist", "4.75° twist", "5° twist", "5.25° twist", "5.5° twist", "5.75° twist", "6° twist", "6.25° twist", "6.5° twist", "6.75° twist", "7° twist", "7.25° twist", "7.5° twist", "7.75° twist", "8° twist", "8.25° twist", "8.5° twist", "8.75° twist", "9° twist", "9.25° twist", "9.5° twist", "9.75° twist", and "10° twist" are considered other possible embodiments of the present invention. A golf club having a degree of twist greater than 0°, between 0.25° and 5°, between 0.1° and 5°, between 0° and 5°, between 0° and 10°, or between 0° and 20° are contemplated herein.

Utilizing the grid pattern of FIG. 7, a plurality of embodiments having a nominal center face loft angle of 9.5°, a bulge of 330.2 mm, and a roll of 279.4 mm were analyzed having a "0.5° twist", "1° twist", "2° twist", and "4° twist". A comparison club having "0° twist" is provided for reference in contrast to the embodiments described.

Table 1 shows the LA° Δ and FA° Δ relative to center face for points located along the vertical axis 700 and horizontal axis 702 (for example points Q1,Q2, Q3, and Q6). With regard to points located away from the vertical axis 700 and horizontal axis 702, the LA° Δ and FA° Δ are measured relative to a corresponding point located on the vertical axis 700 and horizontal axis 702, respectively.

For example, regarding point Q4, located in the upper toe quadrant of the golf club head at a coordinate of (−30 mm, 15 mm), the LA° Δ is measured relative to point Q3 having the same vertical axis 700 coordinate at (0 mm, 15 mm). In other words, both Q3 and Q4 have the same y-coordinate location of 15 mm. Referring to Table 1, the LA° Δ of point Q4 is 0.4° with respect to the loft angle at point Q3. The LA° Δ of point Q4 is measured with respect to point Q3 which is located in a corresponding upper toe horizontal band 704.

In addition, regarding point Q4, located in the upper toe quadrant of the golf club head at a coordinate of (−30 mm, 15 mm), the FA° Δ is measured relative to point Q1 having the same horizontal axis 702 coordinate at (−30 mm, 0 mm). In other words, both Q1 and Q4 have the same x-coordinate location of −30 mm. Referring to Table 1, the FA° Δ of point Q4 is 0.2° with respect to the face angle at point Q1. The FA° Δ of point Q4 is measured with respect to point Q1 which is located in a corresponding upper toe vertical band 706.

To further illustrate how LA° Δ and FA° Δ are calculated for points located within a quadrant that are away from a vertical or horizontal axis, the LA° Δ of point Q8 is measured relative to a loft angle located at point Q6 within a lower heel quadrant horizontal band 708. Likewise, the FA° Δ of point Q8 is measured relative to a face angle located at point Q2 within a lower heel quadrant vertical band 710.

In summary, the LA° Δ and FA° Δ for all points that are located along either a horizontal 702 or vertical axis 700 are measured relative to center face Q0. For points located within a quadrant (such as points Q4, Q5, Q7, and Q8) the LA° Δ is measured with respect to a corresponding point located in a corresponding horizontal band, and the FA° Δ of a given point is measured with respect to a corresponding point located in a corresponding vertical band. In FIG. 7, not all bands are shown in the drawing for the improved clarity of the drawing.

The reason that points located within a quadrant have a different procedure for measuring LA° Δ and FA° Δ is that this method eliminates any influence of the bulge and roll curvature on the LA° Δ and FA° Δ numbers within a quadrant. Otherwise, if a point located within a quadrant is measured with respect to center face, the LA° Δ and FA° Δ numbers will be dependent on the bulge and roll curvature. Therefore utilizing the horizontal and vertical band method of measuring LA° Δ and FA° Δ within a quadrant eliminates any undue influence of a specific bulge and roll curvature. Thus the LA° Δ and FA° Δ numbers within a quadrant should be applicable across any range of bulge and roll curvatures in any given head. The above described method of measuring LA° Δ and FA° Δ within a quadrant has been applied to all examples herein.

The relative LA° Δ and FA° Δ can be applied to any lofted driver, such as a 9.5°, 10.5°, 120 lofted clubs or other commonly used loft angles such as for drivers, fairway woods, hybrids, irons, or putters.

the center face) is shown. The FA° Δ at the critical point Q3 can be between 0° and 5°, between 0.10 and 4°, between 0.2° and 4°, or between 0.2° and 3°, in some embodiment. In addition, the critical point Q6 has a LA° Δ of −3.4°, or less than zero, with respect to the center face for Examples 1-4. In some embodiments, a LA° Δ at Q6 is between 0° and −7°, between −1° and −5°, between −2° and −4°, or between −3° and −4°. A FA° Δ of less than zero at the critical point Q6 (−15 mm below the center face) is shown. In some embodiments, the FA° Δ at the critical point Q6 can be between 0° and −5°, between −0.1° and −4°, between −0.2° and −4°, or between −0.2° and −3°. In Examples 1-4, the loft angle remains constant relative to center face at the critical points Q3,Q6 while the face angle changes relative to center face as the degree of twist is changed.

Examples 1-4 of Table 1 further show a heel side point Q2 located at a x-y coordinate (30 mm, 0 mm) where the LA° Δ relative to center is −0.5°, −1°, −2°, and −4°, respectively, for each example. Therefore, a LA° Δ of less than zero at the point Q2 is shown. In some embodiments, the LA° Δ at the Q2 point is between 0° and −8°. In addition, Examples 1-4 at Q2 show a FA° Δ of less than −4° relative to center face as the degree of twist gets larger. In some embodiments, the FA° Δ at Q2 is between −0.2° and −10°, between −0.3° and −9°, or between −1° and −8°.

Examples 1-4 of Table 1 further show a toe side point Q1 located at a coordinate (−30 mm, 0 mm) where the LA° Δ relative to center is 0.5°, 1°, 2°, and 4°, respectively. Therefore, a LA° Δ of greater than zero at the point Q1 is shown. In some embodiments, the LA° Δ at the Q1 point is between 0° and 8°, between 0.10 and 7°, between 0.2° and 6°, or between 0.3° and 5°. In addition, a FA° Δ at Q1 can be between 1° and 8°, between 2° and 7°, or between 3° and 6°.

Examples 1-4 of Table 1 further show at least one upper heel quadrant point Q5 having a FA° Δ relative to point Q2 that is greater than 0.10, greater than 0.2° or 0.3°. For instance, at point Q5, Examples 1, 2, 3, and 4 show a FA° Δ relative to point Q2 of 0.3°, 0.5°, 0.9°, and 1.9°, respectively, which are all greater than 0.1°. Examples 1-4 of Table 1 also show at least one upper heel quadrant point Q5 having a LA° Δ relative to point Q3 that is less than −0.2°. For instance, at point Q5, Examples 1, 2, 3, and 4 show a LA° Δ relative to point Q3 of −0.5°, −1, −2°, and −4°, respectively, which are all less than −0.1°, less than −0.3, or less than −0.4.

TABLE 1

| Relative to Center Face and Bands | | | | | | | | | | | | |
|---|---|---|---|---|---|---|---|---|---|---|---|---|
| | X-axis | Y-Axis | Example 1 0.5° twist | | Example 2 1° twist | | Example 3 2° twist | | Example 4 4° twist | | 0° twist | |
| Point | (mm) | (mm) | LA° Δ | FA°Δ | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 | 0 | 0 |
| Q1 | −30 | 0 | 0.5 | 5.7 | 1 | 5.7 | 2 | 5.6 | 4 | 5.6 | 0 | 5.7 |
| Q2 | 30 | 0 | −0.5 | −5.7 | −1 | −5.7 | −2 | −5.6 | −4 | −5.6 | 0 | −5.7 |
| Q3 | 0 | 15 | 3.4 | 0.25 | 3.4 | 0.5 | 3.4 | 1 | 3.4 | 2 | 3.4 | 0 |
| Q4 | −30 | 15 | 0.4 | 0.2 | 0.9 | 0.4 | 1.9 | 1 | 3.9 | 2 | 0 | 0 |
| Q5 | 30 | 15 | −0.5 | 0.3 | −1 | 0.5 | −2 | 0.9 | −4 | 1.9 | 0 | 0 |
| Q6 | 0 | −15 | −3.4 | −0.25 | −3.4 | −0.5 | −3.4 | −1 | −3.4 | −2 | −3.4 | 0 |
| Q7 | −30 | −15 | 0.5 | −0.3 | 1 | −0.5 | 2 | −0.9 | 4 | −2 | 0 | 0 |
| Q8 | 30 | −15 | −0.5 | −0.2 | −1 | −0.4 | −2 | −1 | −4.1 | −2 | 0 | 0 |

In Examples 1-4 of Table 1, the critical point Q3 has a LA° Δ of +3.4° with respect to the center face. In some embodiments, a LA° Δ at Q3 is between 0° and 7°, between 1° and 5°, between 2° and 4°, or between 3° and 4°. A FA° Δ of greater than zero at the critical point Q3 (15 mm above Examples 1-4 of Table 1 further show at least one upper toe quadrant point Q4 having a FA° Δ relative to point Q1 that is greater than 0.1°. For instance, at point Q5, Examples 1, 2, 3, and 4 show a FA° Δ relative to point Q1 of 0.2°, 0.4°, 10, and 2°, respectively, which are all greater than 0.15°. Examples 1-4 of Table 1 also show at least one upper toe quadrant point Q4 having a LA° Δ relative to point Q1 that is greater than 0.1°. For instance, at point Q4, Examples 1, 2, 3, and 4 show a LA° Δ relative to point Q1 of 0.4°, 0.9°, 1.9°, and 3.9°, respectively, which are all greater than 0.2° or greater than 0.3°.

Examples 1-4 of Table 1 further show at least one lower heel quadrant point Q8 having a FA° Δ relative to point Q2 that is less than −5.7°. For instance, at point Q8, Examples 1, 2, 3, and 4 show a FA° Δ relative to point Q2 of −0.2°, −0.4°, −1°, and −2°, respectively, which are all less than −0.1°. Examples 1-4 of Table 1 also show at least one lower heel quadrant point Q8 having a LA° Δ relative to point Q6 that is less than −0.1°. For instance, at point Q8, Examples 1, 2, 3, and 4 show a LA° Δ relative to point Q6 of −0.5°, −1°, −2°, and −4.1°, respectively, which are all less than −0.2°, less than 0.3° or less than 0.4°.

Examples 1-4 of Table 1 further show at least one lower toe quadrant point Q7 having a FA° Δ relative to point Q1 that is less than −0.1°. For instance, at point Q7, Examples 1, 2, 3, and 4 show a FA° Δ relative to center of −0.3°, −0.5°, −0.9°, and −2°, respectively, which are all less than −0.2°. Examples 1-4 of Table 1 also show at least one lower heel quadrant point Q7 having a LA° Δ relative to point Q6 that is greater than 0.2°. For instance, at point Q7, Examples 1, 2, 3, and 4 show a LA° Δ relative to point Q6 of 0.5°, 10, 2°, and 4°, respectively, which are all greater than 0.3° or greater than 0.4°.

Table 2 shows the same embodiments of Table 1 but provides the difference in LA° Δ and FA° Δ when compared to the golf club head with "0° twist" as the base comparison. Example 1 has up to +/−0.5° of LA° Δ and up to +/−0.3 FA° Δ when compared to the golf club head with "0° twist". Example 2 has up to +/−1° of LA° Δ and up to +/−0.5 FA° Δ when compared to the golf club head with "0° twist". Example 3 has up to +/−2° of LA° Δ and up to +/−1 FA° Δ when compared to the golf club head with "0° twist". Example 4 has up to +/−4.1° of LA° Δ and up to +/−2.1 FA° Δ when compared to the golf club head with "0° twist".

In Examples 1-4, the LA° Δ and FA° Δ relative to center face remains unchanged at the center face location (0 mm, 0 mm) when compared to the "0° twist" head. However, all other points away from the center face location in Examples 1-4 have some non-zero amount of either LA° Δ or FA° Δ.

TABLE 2

Relative to Zero Degree Twist

| | X-axis | Y-Axis | Example 1 0.5° twist | | Example 2 1° twist | | Example 3 2° twist | | Example 4 4° twist | |
|---|---|---|---|---|---|---|---|---|---|---|
| Point | (mm) | (mm) | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 |
| Q1 | −30 | 0 | 0.5 | 0 | 1 | 0 | 2 | −0.1 | 4 | −0.1 |
| Q2 | 30 | 0 | −0.5 | 0 | −1 | 0 | −2 | 0.1 | −4 | 0.1 |
| Q3 | 0 | 15 | 0 | 0.25 | 0 | 0.5 | 0 | 1 | 0 | 2 |
| Q4 | −30 | 15 | 0.4 | 0.2 | 0.9 | 0.4 | 1.9 | 1 | 3.9 | 2 |
| Q5 | 30 | 15 | −0.5 | 0.3 | −1 | 0.5 | −2 | 0.9 | −4 | 1.9 |
| Q6 | 0 | −15 | 0 | −0.25 | 0 | −0.5 | 0 | −1 | 0 | −2 |
| Q7 | −30 | −15 | 0.5 | −0.3 | 1 | −0.5 | 2 | −0.9 | 4 | −2 |
| Q8 | 30 | −15 | −0.5 | −0.2 | −1 | −0.4 | −2 | −1 | −4.1 | −2 |

Figure 8:
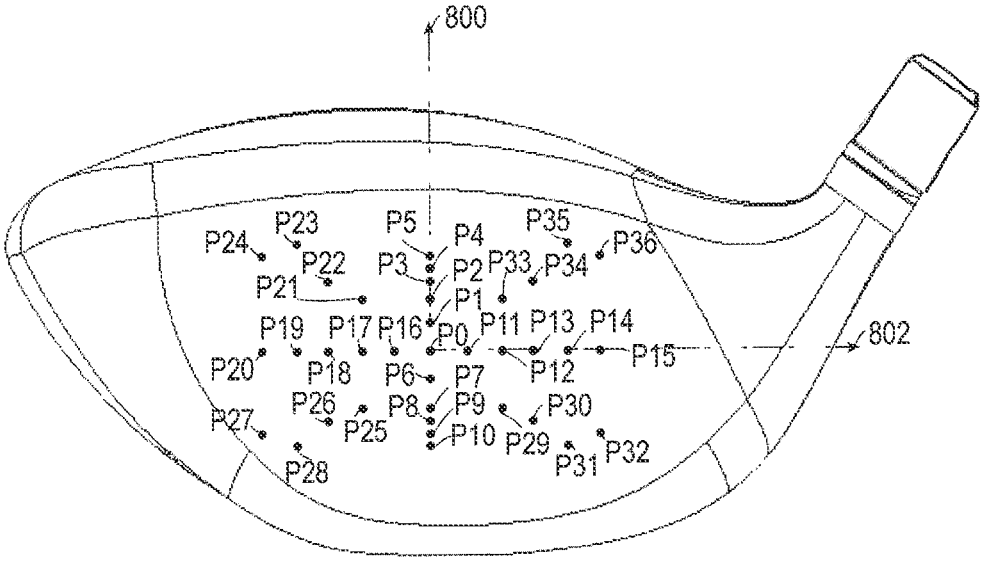
FIG. 8 illustrates a front view of a golf club with a predetermined set of measurement points.

FIG. 8 illustrates a plurality of points P0-P36 at which the face angle and loft angle are measured in a computer model. However, these same points can be measured on an actual golf club head utilizing the methods described above. Table 3 below provides the exact measurement of FA° Δ and LA° Δ at the thirty-seven plurality points spread across the golf club face. The FA° Δ and LA° Δ of each point is provided for two different embodiments having a 1° twist and 2° twist and a nominal center face loft angle of 9.2°, a bulge of 330.2 mm, and a roll of 279.4 mm are identified as Examples 5 and 6, respectively. Examples 5 and 6 are provided next to a golf club face that has 00 of twist for comparison purposes.

TABLE 3

Relative to Center Face and Bands

| | X-axis | Y-axis | Example 5 1° twist | | Example 6 2° twist | | 0° twist | |
|---|---|---|---|---|---|---|---|---|
| Point | (mm) | (mm) | LA°Δ | FA°Δ | LA°Δ | FA°Δ | LA°Δ | FA°Δ |
| P0 | 0 | 0 | 0.000 | 0.000 | 0.000 | 0.000 | 0.000 | 0.000 |
| P1 | 0 | 5 | 1.025 | 0.167 | 1.025 | 0.333 | 1.025 | 0.000 |
| P6 | 0 | −5 | −1.025 | −0.167 | −1.025 | −0.333 | −1.025 | 0.000 |
| P2 | 0 | 10 | 2.051 | 0.333 | 2.051 | 0.667 | 2.051 | 0.000 |
| P7 | 0 | −10 | −2.051 | −0.333 | −2.051 | −0.667 | −2.051 | 0.000 |
| P3 | 0 | 12 | 2.462 | 0.400 | 2.462 | 0.800 | 2.462 | 0.000 |

TABLE 3-continued

| Relative to Center Face and Bands | | | | | | | | |
|---|---|---|---|---|---|---|---|---|
| | X-axis | Y-axis | Example 5 1° twist | | Example 6 2° twist | | 0° twist | |
| Point | (mm) | (mm) | LA°Δ | FA°Δ | LA°Δ | FA°Δ | LA°Δ | FA°Δ |
| P8 | 0 | −12 | −2.462 | −0.400 | −2.462 | −0.800 | −2.462 | 0.000 |
| P4 | 0 | 15 | 3.077 | 0.500 | 3.077 | 1.000 | 3.077 | 0.000 |
| P9 | 0 | −15 | −3.077 | −0.500 | −3.077 | −1.000 | −3.077 | 0.000 |
| P5 | 0 | 20 | 4.105 | 0.667 | 4.105 | 1.333 | 4.105 | 0.000 |
| P10 | 0 | −20 | −4.105 | −0.667 | −4.105 | −1.333 | −4.105 | 0.000 |
| P11 | 5 | 0 | −0.167 | −0.868 | −0.333 | −0.868 | 0.000 | −0.868 |
| P16 | −5 | 0 | 0.167 | 0.868 | 0.333 | 0.868 | 0.000 | 0.868 |
| P12 | 10 | 0 | −0.333 | −1.735 | −0.667 | −1.735 | 0.000 | −1.735 |
| P17 | −10 | 0 | 0.333 | 1.735 | 0.667 | 1.735 | 0.000 | 1.735 |
| P13 | 18 | 0 | −0.600 | −3.125 | −1.200 | −3.125 | 0.000 | −3.125 |
| P18 | −18 | 0 | 0.600 | 3.125 | 1.200 | 3.125 | 0.000 | 3.125 |
| P14 | 25 | 0 | −0.833 | −4.342 | −1.667 | −4.342 | 0.000 | −4.342 |
| P19 | −25 | 0 | 0.833 | 4.342 | 1.667 | 4.342 | 0.000 | 4.342 |
| P15 | 30 | 0 | −1.000 | −5.213 | −2.000 | −5.213 | 0.000 | −5.213 |
| P20 | −30 | 0 | 1.000 | 5.213 | 2.000 | 5.213 | 0.000 | 5.213 |
| P33 | 10 | 10 | −0.333 | 0.333 | −0.667 | 0.667 | 0.000 | 0.000 |
| P34 | 18 | 12 | −0.600 | 0.400 | −1.200 | 0.800 | 0.000 | 0.000 |
| P35 | 25 | 20 | −0.833 | 0.667 | −1.667 | 1.333 | 0.000 | 0.000 |
| P36 | 30 | 15 | −1.000 | 0.500 | −2.000 | 1.000 | 0.000 | 0.000 |
| P21 | −10 | 10 | 0.333 | 0.333 | 0.667 | 0.667 | 0.000 | 0.000 |
| P22 | −18 | 12 | 0.600 | 0.400 | 1.200 | 0.800 | 0.000 | 0.000 |
| P23 | −25 | 20 | 0.833 | 0.667 | 1.667 | 1.333 | 0.000 | 0.000 |
| P24 | −30 | 15 | 1.000 | 0.500 | 2.000 | 1.000 | 0.000 | 0.000 |
| P29 | 10 | −10 | −0.333 | −0.333 | −0.667 | −0.667 | 0.000 | 0.000 |
| P30 | 18 | −12 | −0.600 | −0.400 | −1.200 | −0.800 | 0.000 | 0.000 |
| P31 | 25 | −20 | −0.833 | −0.667 | −1.667 | −1.333 | 0.000 | 0.000 |
| P32 | 30 | −15 | −1.000 | −0.500 | −2.000 | −1.000 | 0.000 | 0.000 |
| P25 | −10 | −10 | 0.333 | −0.333 | 0.667 | −0.667 | 0.000 | 0.000 |
| P26 | −18 | −12 | 0.600 | −0.400 | 1.200 | −0.800 | 0.000 | 0.000 |
| P28 | −25 | −20 | 0.833 | −0.667 | 1.667 | −1.333 | 0.000 | 0.000 |
| P27 | −30 | −15 | 1.000 | −0.500 | 2.000 | −1.000 | 0.000 | 0.000 |

Table 3 shows the same nine key points of measurement shown in Table 1. Specifically, points P0, P4, P9, P15, P20, P24, P27, P32, and P36 correspond to the locations of points Q0-Q8 in Table 1. However, additional points have been measured to provide a higher resolution of the twisted face in Examples 5 and 6.

Point P5 located at x-y coordinate (0 mm, 20 mm) and point P10 located at x-y coordinate (0 mm, −20 mm) are helpful in determining the extreme face angle changes further away from the center face. In Example 5 of Table 3 at point P5, the FA° Δ is between 0.10 and 4°, between 0.2° and 3.5°, between 0.3° and 3°, between 0.4° and 3°, or between 0.5° and 2°. The LA° Δ at point P5 is between 1° and 10°, between 2° and 8°, between 3° and 7°, or between 3° and 6°.

In Example 5 of Table 3 at point P10, the FA° Δ is between −0.1° and −4°, between −0.2° and −3.5°, between −0.3° and −3°, between −0.4° and −3°, or between −0.5° and −2°. The LA° Δ at point P10 is between −1° and −10°, between −2° and −8°, between −3° and −7°, or between −3° and −6°.

Table 3 and FIG. 8 also show a plurality of points located in each quadrant. The upper toe quadrant has at least four measured points P21, P22, P23, P24. The lower toe quadrant has at least four measured points P25, P26, P27, P28. The upper heel quadrant has at least four measured points P33, P34, P35, P36. The lower heel quadrant has at least four measured points P29, P30, P31, P32.

The average of the FA° Δ and LA° Δ of the four points described in each quadrant are shown in Table 4 below.

TABLE 4

| Average in Quadrants | | | | | | |
|---|---|---|---|---|---|---|
| | Example 5 1° twist | | Example 6 2° twist | | 0° twist | |
| | Avg. LA°Δ | Avg. FA°Δ | Avg. LA°Δ | Avg. FA°Δ | Avg. LA°Δ | Avg. FA°Δ |
| Upper Toe Quadrant | 0.692 | 0.475 | 1.383 | 0.950 | 0.000 | 0.000 |
| Upper Heel Quadrant | −0.692 | 0.475 | −1.383 | 0.950 | 0.000 | 0.000 |
| Lower Toe Quadrant | 0.692 | −0.475 | 1.383 | −0.950 | 0.000 | 0.000 |
| Lower Heel Quadrant | −0.692 | −0.475 | −1.383 | −0.950 | 0.000 | 0.000 |

Table 4 shows that average FA° Δ in Example 5 for the upper toe quadrant and the upper heel quadrant are more open (more positive) than the 0° twist golf club head by more than 0.1°, more than 0.2°, more than 0.3°, or more than 0.4°. In some embodiments the upper toe quadrant and upper heel quadrant have an average FA° Δ more open than the 0° twist golf club by between 0.10 to 0.8°, 0.2° to 0.6°, or 0.3° to 0.5° more open. The lower toe quadrant and lower heel quadrant of Example 5 has a FA° Δ that is more closed (more negative) than the 0° twist golf club head. In some embodiments, the FA° Δ relative to a 0° twist club head in the lower toe quadrant and lower heel quadrant is less than −0.1°, less than −0.2, less than −0.3, or less than −0.4. In some embodiments, the FA° Δ relative to a 0° twist club head in the lower toe quadrant and lower heel quadrant is between −0.1° to −0.8°, −0.2° to −0.6°, or −0.3° to −0.5°.

Table 4 shows that average FA° Δ in Example 6 for the upper toe quadrant and the upper heel quadrant are more open (more positive) than the 0° twist golf club head by more than 0.6°, more than 0.7°, more than 0.8°, or more than 0.9°. In some embodiments the upper toe quadrant and upper heel quadrant are more open than the 0° twist golf club by between 0.6° to 1.2°, 0.7° to 1.10, or 0.80 to 1° more open. The lower toe quadrant and lower heel quadrant of Example 6 has a FA° Δ that is more closed (more negative) than the 0° twist golf club head. In some embodiments, the FA° Δ relative to a 0° twist club head in the lower toe quadrant and lower heel quadrant is less than −0.6°, less than −0.7, less than −0.8, or less than −0.9. In some embodiments, the FA° Δ relative to a 0° twist club head in the lower toe quadrant and lower heel quadrant is between −0.6° to −1.2°, −0.7° to −1.1°, or −0.8° to −1°.

Table 4 shows that average LA° Δ in Example 5 for the upper toe quadrant and lower toe quadrant are more lofted (more positive) than the 0° twist golf club head by more than 0.2°, more than 0.3°, more than 0.4°, more than 0.5°, or more than 0.6°. In some embodiments, the upper toe quadrant and lower toe quadrant have a LA° Δ between 0.2° to 1°, between 0.3° to 0.9°, between 0.4° to 0.8°, or between 0.5° to 0.7° more lofted. The average LA° Δ of the upper heel quadrant and lower heel quadrant of Example 5 relative to a 0° twist club head are less lofted (more negative) than the 0° twist golf club head by less than −0.2° less than −0.3°, less than −0.4°, less than −0.5°, or less than −0.6°. In some embodiments, the upper heel quadrant and lower heel quadrant have a LA° Δ between −0.2° to −1°, between −0.3° to −0.9°, between −0.4° to −0.8°, or between −0.5° to −0.7° less lofted. The lower toe quadrant and upper toe quadrant of Example 5 are more lofted (more positive) than the 0° twist golf club head by more than 0.10 or between 0° to 1.5° more lofted. The lower heel quadrant and upper heel quadrant of Example 5 are less lofted (more negative) than the 0° twist golf club head by less than −0.1° or between 0° to −1° less lofted.

Table 4 shows that average LA° Δ in Example 6 for the upper toe quadrant and lower toe quadrant are more lofted (more positive) than the 0° twist golf club head by more than 0.5°, more than 0.6°, more than 0.7°, more than 0.8°, or more than 0.9°. In some embodiments, the upper toe quadrant and lower toe quadrant have a LA° Δ between 0.5° to 2.5°, between 0.6° to 2°, between 0.7° to 1.8°, or between 0.9° to 1.5° more lofted. The average LA° Δ of the upper heel quadrant and lower heel quadrant of Example 6 is less lofted (more negative) than the 0° twist golf club head by less than-0.5° less than −0.6°, less than −0.7°, less than −0.8°, or less than −0.9°. In some embodiments, the upper heel quadrant and lower heel quadrant have an average LA° Δ relative to 0° twist club head of between −0.5° to −2.5°, between −0.6° to −2°, between −0.7° to −1.8°, or between −0.9° to −1.5° less lofted. The lower toe quadrant and upper toe quadrant of Example 6 are more lofted (more positive) than the 0° twist golf club head by more than 0.10 or between 0° to 2.5° more lofted. The lower heel quadrant and upper heel quadrant of Example 6 are less lofted (more negative) than the 0° twist golf club head by less than −0.1° or between 0° to −2.5° less lofted.

Therefore, Examples 5 and 6 show a golf club head having four quadrants where the FA° Δ is more open (more positive) in the upper heel and toe quadrants and more closed (more negative) in the lower heel and toe quadrants. Examples 5 and 6 also show a golf club head having four quadrants where the LA° Δ is more lofted (more positive) in the upper toe quadrant and lower toe quadrant while being less lofted (more negative) in the upper heel quadrant and lower heel quadrant when compared to a 0° twist golf club head.

Figure 9:
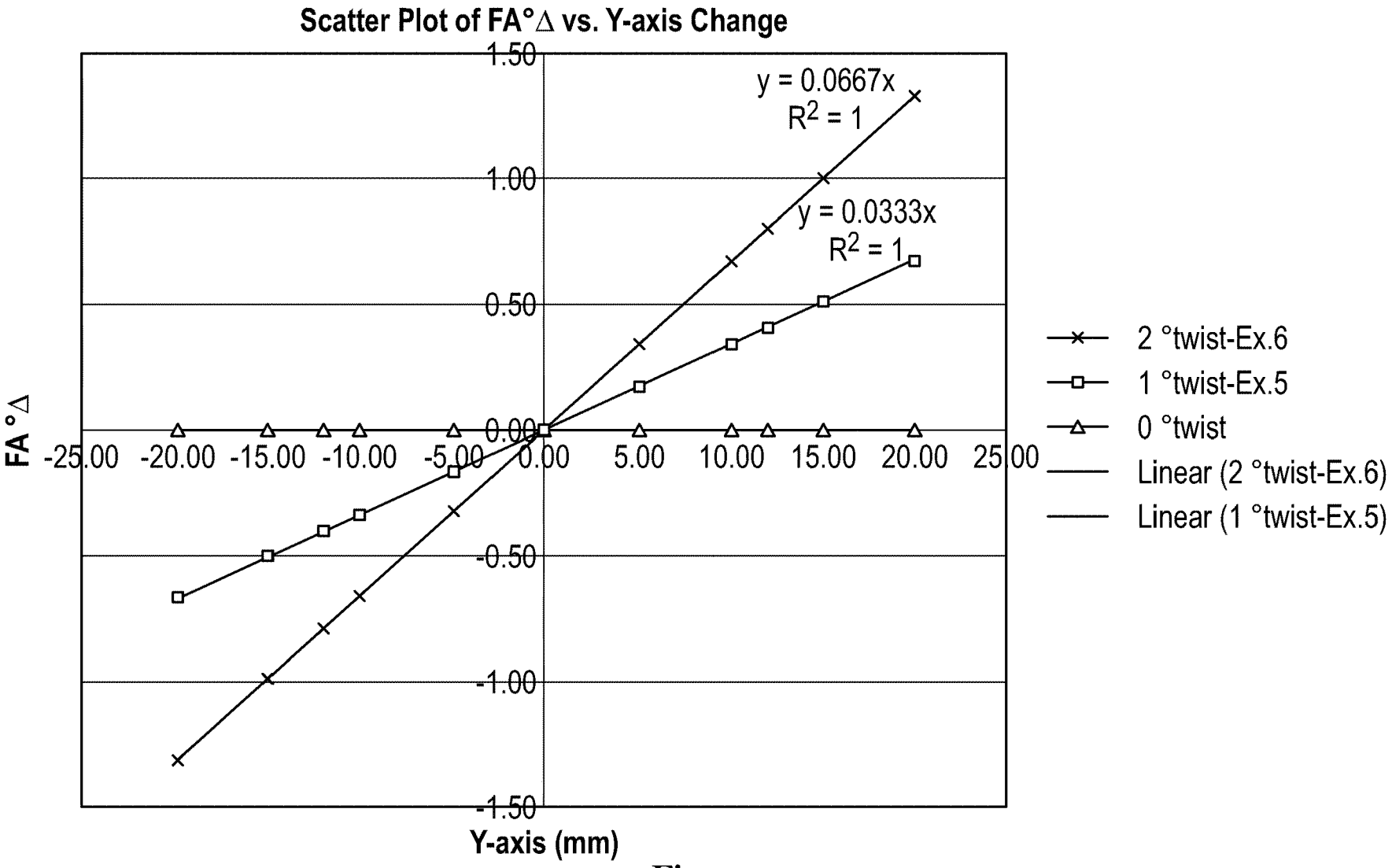
FIG. 9 is a graph showing a FA° Δ along a y-axis location.

FIG. 9 provides a chart showing the rate of change of FA° Δ relative to a y-axis 800 change with zero x-axis 802 change. In other words, FIG. 9 graphs the points P0-P10 shown in Table 3 above. It is noted that the points P0-P10 lie along the y-axis 800 only and have no x-axis 802 component. The rate of change is shown by the trend line fit to the measurements of Examples 5 and 6. The FA° Δ for Example 5 and 6 have a trend line defined as:

$$y=0.0333x \quad \text{(Eq. 1)Example 5}$$

$$y=0.0667x \quad \text{(Eq. 2)Example 6}$$

Equation 1 illustrates that for every 1 mm in movement along the y-axis 800, there is a relative FA° Δ of 0.0333° for a "1° twist" golf club head. Equation 2 shows that for every 1 mm in movement along the y-axis 800, there is a corresponding relative FA° Δ of 0.0667° for a "2° twist" golf club head. The slope of the equation describes the rate of change of the FA° Δ relative to the measurement point as it is moved along the y-axis 800. Therefore, the rate of change can be represented as a x/mm where x is the FA° Δ (in units of ° Δ).

In some embodiments, the FA° Δ to y-axis rate of change is greater than zero, greater than 0.01° Δ/mm, greater than 0.02° Δ/mm, greater than 0.03° Δ/mm, greater than 0.04° Δ/mm, greater than 0.05° Δ/mm, or greater than 0.6° Δ/mm. In some embodiments, the FA° Δ to y-axis rate of change is between 0.005° Δ/mm and 0.2° Δ/mm, between 0.01° Δ/mm and 0.1° Δ/mm, between 0.02° Δ/mm and 0.09° Δ/mm, or between 0.03° Δ/mm and 0.08° Δ/mm.

Figure 10:
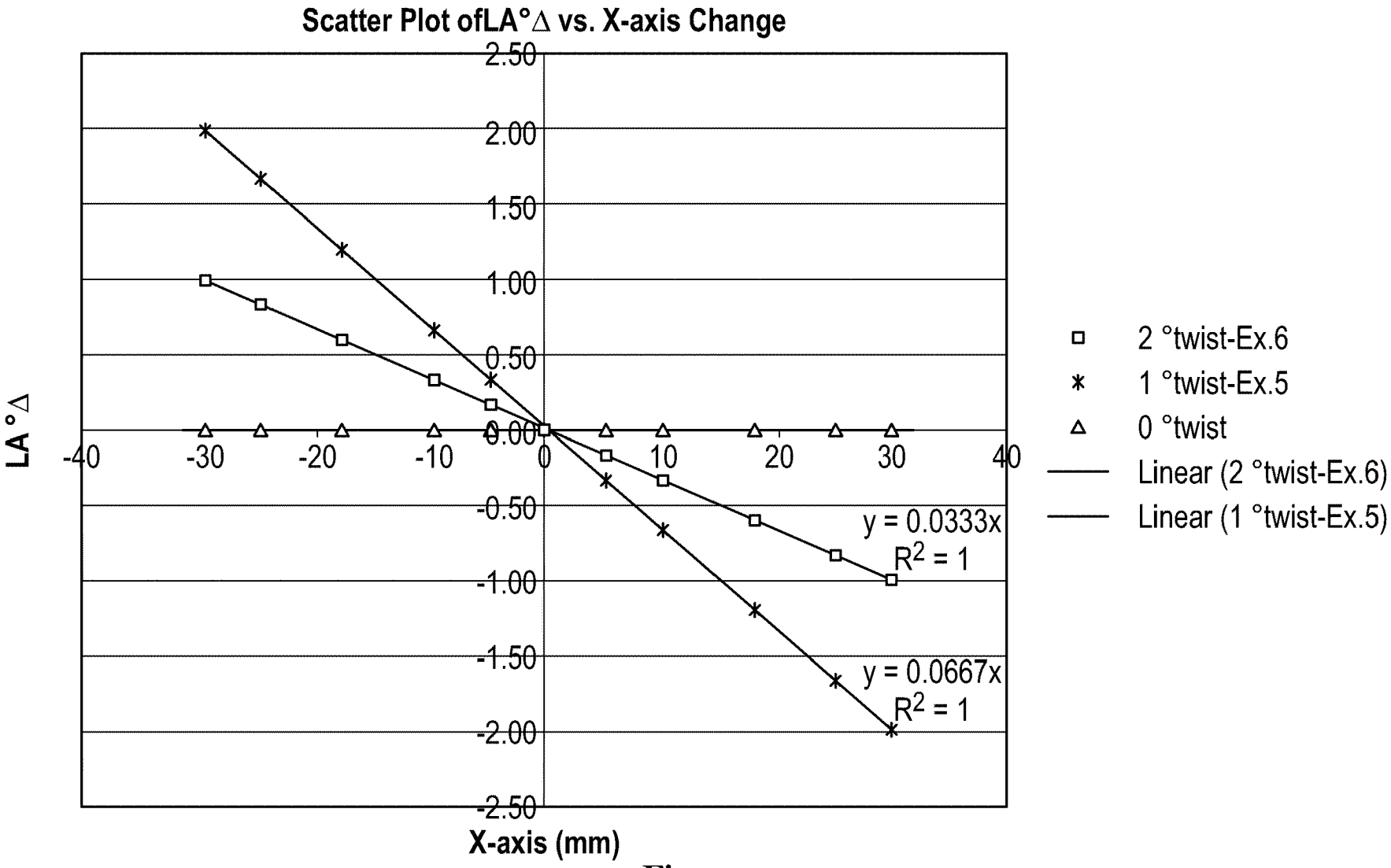
FIG. 10 is a graph showing a LA° Δ along a x-axis location.

FIG. 10 shows a chart illustrating the rate of change of the LA° Δ relative to a x-axis 802 change with zero y-axis 800 change. In other words, FIG. 10 graphs the points P11-P20 shown in Table 3 above. It is noted that the points P11-P20 lie along the x-axis 802 only and have no y-axis 800 component.

The LA° Δ for Example 5 and 6 have a trend line defined as:

$$y=-0.0333x \quad \text{(Eq. 3) Example 5}$$

$$y=-0.0667x \quad \text{(Eq. 4) Example 6}$$

Equation 3 illustrates that for every 1 mm in movement along the x-axis 802, there is a relative LA° Δ of −0.0333° for a "1° twist" golf club head. Equation 2 shows that for every 1 mm in movement along the x-axis 802, there is a corresponding relative LA° Δ of −0.0667° for a "2° twist" golf club head. The rate of change for the LA° Δ is negative for every positive movement along the x-axis 802.

In some embodiments, the LA° Δ to x-axis rate of change is less than zero for every millimeter, less than −0.01° Δ/mm, less than −0.02° Δ/mm, less than −0.03° Δ/mm, less than −0.04° Δ/mm, less than −0.05° Δ/mm, or less than −0.06° Δ/mm.

In some embodiments, the LA° Δ to x-axis rate of change is between −0.005° Δ/mm and −0.2° Δ/mm, between −0.01° Δ/mm and −0.1° Δ/mm, between −0.02° Δ/mm and −0.09° Δ/mm, or between −0.03° Δ/mm and −0.08° Δ/mm.

TABLE 5

| Relative to Zero Degree Twist | | | | | | |
|---|---|---|---|---|---|---|
| | X-axis | Y-axis | Example 5 1° twist | | Example 6 2° twist | |
| Point | (mm) | (mm) | LA°Δ | FA°Δ | LA°Δ | FA°Δ |
| P0 | 0 | 0 | 0.000 | 0.000 | 0.000 | 0.000 |
| P1 | 0 | 5 | 0.000 | 0.167 | 0.000 | 0.333 |
| P6 | 0 | −5 | 0.000 | −0.167 | 0.000 | −0.333 |
| P2 | 0 | 10 | 0.000 | 0.333 | 0.000 | 0.667 |
| P7 | 0 | −10 | 0.000 | −0.333 | 0.000 | −0.667 |
| P3 | 0 | 12 | 0.000 | 0.400 | 0.000 | 0.800 |
| P8 | 0 | −12 | 0.000 | −0.400 | 0.000 | −0.800 |
| P4 | 0 | 15 | 0.000 | 0.500 | 0.000 | 1.000 |
| P9 | 0 | −15 | 0.000 | −0.500 | 0.000 | −1.000 |
| P5 | 0 | 20 | 0.000 | 0.667 | 0.000 | 1.333 |
| P10 | 0 | −20 | 0.000 | −0.667 | 0.000 | −1.333 |
| P11 | 5 | 0 | −0.167 | 0.000 | −0.333 | 0.000 |
| P16 | −5 | 0 | 0.167 | 0.000 | 0.333 | 0.000 |
| P12 | 10 | 0 | −0.333 | 0.000 | −0.667 | 0.000 |
| P17 | −10 | 0 | 0.333 | 0.000 | 0.667 | 0.000 |
| P13 | 18 | 0 | −0.600 | 0.000 | −1.200 | 0.000 |
| P18 | −18 | 0 | 0.600 | 0.000 | 1.200 | 0.000 |
| P14 | 25 | 0 | −0.833 | 0.000 | −1.667 | 0.000 |
| P19 | −25 | 0 | 0.833 | 0.000 | 1.667 | 0.000 |
| P15 | 30 | 0 | −1.000 | 0.000 | −2.000 | 0.000 |
| P20 | −30 | 0 | 1.000 | 0.000 | 2.000 | 0.000 |
| P33 | 10 | 10 | −0.333 | 0.333 | −0.667 | 0.667 |
| P34 | 18 | 12 | −0.600 | 0.400 | −1.200 | 0.800 |
| P35 | 25 | 20 | −0.833 | 0.667 | −1.667 | 1.333 |
| P36 | 30 | 15 | −1.000 | 0.500 | −2.000 | 1.000 |
| P21 | −10 | 10 | 0.333 | 0.333 | 0.667 | 0.667 |
| P22 | −18 | 12 | 0.600 | 0.400 | 1.200 | 0.800 |
| P23 | −25 | 20 | 0.833 | 0.667 | 1.667 | 1.333 |
| P24 | −30 | 15 | 1.000 | 0.500 | 2.000 | 1.000 |
| P29 | 10 | −10 | −0.333 | −0.333 | −0.667 | −0.667 |
| P30 | 18 | −12 | −0.600 | −0.400 | −1.200 | −0.800 |
| P31 | 25 | −20 | −0.833 | −0.667 | −1.667 | −1.333 |
| P32 | 30 | −15 | −1.000 | −0.500 | −2.000 | −1.000 |
| P25 | −10 | −10 | 0.333 | −0.333 | 0.667 | −0.667 |
| P26 | −18 | −12 | 0.600 | −0.400 | 1.200 | −0.800 |
| P28 | −25 | −20 | 0.833 | −0.667 | 1.667 | −1.333 |
| P27 | −30 | −15 | 1.000 | −0.500 | 2.000 | −1.000 |

Table 5 shows the same embodiments of Table 3 but provides the difference in LA° Δ and FA° Δ when compared to the golf club head with "0° twist" as the base comparison. Example 5 has up to about +/−10 of LA° Δ or up to about +/−0.7 FA° Δ when compared to the golf club head with "0° twist". Example 6 has up to about +/−2° of LA° Δ and up to +/−1.4 FA° Δ when compared to the golf club head with "0° twist".

In Examples 5 and 6, the LA° Δ and FA° Δ relative to center face remains unchanged at the center face location (0 mm, 0 mm) when compared to the "0° twist" head. However, all other points away from the center face location in Examples 5 and 6 also have some non-zero amount of change in either LA° Δ or FA° Δ.

The numbers provided in the Tables above show loft angle change or face angle change relative to center face location or relative to a key point within a band. However, the actual nominal face angle or loft angle can be calculated quantitatively for a desired point using the below equation:

$$LA = CFLA + \arcsin\left(\frac{YLOC}{\text{Roll}}\right) * \left(\frac{180}{PI}\right) - XLOC * \left(\frac{DEG}{30}\right) \quad \text{Eq. 5}$$

$$FA = CFFA - \arcsin\left(\frac{XLOC}{\text{Bulge}}\right) * \left(\frac{180}{PI}\right) + YLOC * \left(\frac{DEG}{30}\right) \quad \text{Eq.6}$$

In Eq. 5 and Eq. 6 above, the variables are defined as:

Roll=Roll Radius (mm)

Bulge=Bulge Radius (mm)

LA=Nominal Loft Angle (°) at a desired point

FA=Nominal Face Angle (°) at a desired point

CFLA=Center Face Loft Angle (°)

CFFA=Center Face Face Angle (°)

YLOC=y-coordinate location on the y-axis of the predetermined point (mm)

XLOC=x-coordinate location on the x-axis of the predetermined point (mm)

DEG=degree of twist in the club head being measured (°)

By way of example, assume a golf club having a 1° twist, CFLA of 9.2°, a CFFA of 0°, a bulge of 330.2 mm, and a roll of 279.4 mm is provided, similar to Example 5 described in Table 3. In order to calculate the LA° Δ and FA° Δ at critical point P4 located at an x-y coordinate of (0 mm, 15 mm), 0 mm is utilized as the XLOC value and 15 mm as the YLOC value. The DEG value is 1°. When these variables are entered into Equation 5 above, a LA value of 12.2770 and a FA value of 0.500° is calculated for critical point P4.

The LA° Δ is the nominal loft at the critical point P4 minus the center face loft. In this case, the CFLA is 9.2°. Therefore the LA° Δ is 12.2770 minus 9.2° which equals 3.077° as shown in Table 3 at the critical point P4 in Example 5.

Likewise, Equation 6 yields the FA value of 0.500°. The FA° Δ is the nominal face angle, FA, at the critical point P4 minus the center face face angle. In this case, the CFFA is 0° (which is likely always the case). Therefore, the FA° Δ at critical point P4 is 0.500° minus 0° which equals 0.500° as shown in Table 3.

Thus, the FA° Δ and LA° Δ can be calculated at any desired x-y coordinate by calculating the nominal FA and LA values in Equations 5 and 6 above utilizing the necessary variables.

It is also possible to use the above equation to set bounds on the desired face shape for a given head. For example, if a head has a bulge radius (Bulge), and roll radius (Roll), it is possible to define two bounding surfaces for the desired twisted face surface by specifying two different twist amounts (DEG). In order to bound the example above, we can use a CFLA of 9.2°, a bulge of 330.2 mm, and a roll of 279.4 mm, then specify a range of twist of, for example 0.5°<DEG<1.5°. Then, preferably at least 50% of the face surface would have a FA and LA within the bounds of the equations using DEG=0.5° and DEG=1.5°. More preferably at least 70% of the face surface would have a FA and LA within the bounds of the equations using DEG=0.5° and DEG=1.5°. Most preferably at least 90% of the face surface would have a FA and LA within the bounds of the equations using DEG=0.5° and DEG=1.5°.

Similarly, if the target twist is, DEG=2.0°, then the upper/lower limits could be 1.5°<DEG<2.5°, and preferably 50%, or more preferably 70%, or most preferably 90% of the face surface would have a FA and LA within the bounds of the equations using those angles.

To make the upper/lower bound FA and LA equations more general for any driver with any bulge and roll, the process would be to define the amount of twist (i.e., 1°, 2°, 3°, etc.), then determine the desired CFLA, CFFA, Bulge and Roll, then define the upper bound equation using those parameters and a twist, DEG+, which is 0.5° higher than the target twist, DEG, and a lower bound with a twist, DEG−, which is 0.5° lower than the target twist, DEG. In this way, preferably 50%, or more preferably 70%, or most preferably 90% of the face surface would have a FA and LA within the bounds of the equations using DEG+ and DEG- and the desired CFLA, CFFA, Bulge and Roll.

For example, the range of CFLA can be between 7.5° and 16.0°, preferably 10.0°, the range of CFFA can be between −3.0° and +3.0°, preferably 0.0°, the range of Bulge can be between 200 mm to 500 mm, 228.6 mm to 457.2 mm, preferably 330.2 mm, and the range of Roll can be between 150 mm to 500 mm, 228.6 mm to 457.2 mm, preferably 279.4 mm. Any combination of these parameters within these ranges can be used to define the nominal FA and LA values over the face surface, and ranges of twist can range from 0.5° to 4.0°, preferably 1.0°.

Although the embodiments above describe a twisted face that has a generally open (more positive) FA° Δ in the upper toe and heel quadrant, it is also possible to create a golf club head with a closed (more negative) FA° Δ in the upper toe and heel quadrants. In other words, the twisting direction could be in the opposite direction of the embodiments described herein.

Because the twisted face described herein has a generally more open (more positive) face angle, the topline 280, shown in FIG. 2*d*, may appear more open or positive face angle to the golfer. For many golfers, this is a useful alignment feature which gives the golfer the confidence that the ball will not fly too far let. Thus, a twisted face golf club that is more open has the advantage of having a more open topline alignment appearance when the paint line of the crown ends at the intersection of the face and the crown at the topline 280.

In contrast, it is possible to have a golf club with a more negative or closed face twist in which case the topline 280 will have a more closed or negative face angle appearance to the golfer when the paint line occurs at the topline 280 of the face and crown intersection.

Second Representative Embodiment

The following describes embodiments of golf club heads for metalwood type golf clubs, including drivers, fairway woods, rescue clubs, hybrid clubs, and the like. Several of the golf club heads incorporate features that provide the golf club heads and/or golf clubs with increased moments of inertia and low centers of gravity, centers of gravity located in preferable locations, improved golf club head and face geometries, increased sole and lower face flexibility, higher coefficients or restitution ("COR") and characteristic times ("CT"), and/or decreased backspin rates relative to fairway wood and other golf club heads that have come before.

This disclosure describes embodiments of golf club heads in the exemplary context of fairway wood-type golf clubs, but the principles, methods and designs described may be applicable in whole or in part to other wood-type golf clubs, such as drivers, utility clubs (also known as hybrid clubs), rescue clubs, and the like.

Golf club head "forgiveness" generally describes the ability of a golf club head to deliver a desirable golf ball trajectory despite a miss-hit (e.g., a ball struck at a location on the face plate other than an ideal impact location, e.g., an impact location where coefficient of restitution is maximized). Large mass moments of inertia contribute to the overall forgiveness of a golf club head. In addition, a low center-of-gravity improves forgiveness for golf club heads used to strike a ball from the turf by giving a higher launch angle and a lower spin trajectory (which improves the distance of a fairway wood golf shot). Providing a rearward center-of-gravity reduces the likelihood of a slice or fade for many golfers. Accordingly, forgiveness of fairway wood golf club heads, can be improved using the techniques described above to achieve high moments of inertia and low center-of-gravity compared to conventional fairway wood golf club heads.

For example, a golf club head with a crown thickness less than about 0.65 mm throughout at least about 70% of the crown can provide significant discretionary mass. A 0.60 mm thick crown formed from steel can provide as much as about 8 grams of discretionary mass compared to a 0.80 mm thick crown. Alternatively, a 0.80 mm thick crown formed from a composite material having a density of about 1.5 g/cc can provide as much as about 26 grams of discretionary mass compared to a 0.80 mm thick crown formed from steel. The large discretionary mass can be distributed to improve the mass moments of inertia and desirably locate the golf club head center-of-gravity. Generally, discretionary mass should be located sole-ward rather than crown-ward to maintain a low center-of-gravity, forward rather than rearward to maintain a forwardly positioned center of gravity, and rearward rather than forward to maintain a rearwardly positioned center-of-gravity. In addition, discretionary mass should be located far from the center-of-gravity and near the perimeter of the golf club head to maintain high mass moments of inertia.

Another parameter that contributes to the forgiveness and successful playability and desirable performance of a golf club is the coefficient of restitution (COR) of the golf club head. Upon impact with a golf ball, the golf club head's face plate deflects and rebounds, thereby imparting energy to the struck golf ball. The golf club head's coefficient of restitution is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. In order to maximize the moment of inertia (MOI) about the center of gravity (CG) and achieve a high COR, it typically is desirable to incorporate thin walls and a thin face plate into the design of the golf club head. Thin walls afford the designers additional leeway in distributing golf club head mass to achieve desired mass distribution, and a thinner face plate may provide for a relatively higher COR.

Thus, thin walls are important to a club's performance. However, overly thin walls can adversely affect the golf club head's durability. Problems also arise from stresses distributed across the golf club head upon impact with the golf ball, particularly at junctions of golf club head components, such as the junction of the face plate with other golf club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the golf club head. Thus, these golf club heads fail to provide optimal MOI, CG, and/or COR parameters, and as a result, fail to provide much forgiveness for off-center hits for all but the most expert golfers.

Thus, the golf club heads of this disclosure are designed to allow for introduction of a face which can be adjusted in thickness as needed or desired to interact with the other disclosed aspects, such as a channel or slot positioned behind the face, as well as increased areas of mass and/or removable weights. The golf club heads of this disclosure may utilize, for example, the variable thickness face features described in U.S. Pat. Nos. 8,353,786, 6,997,820, 6,800,038, and 6,824,475, which are incorporated herein by reference in their entirety. Additionally, the mass of the face, as well as other of the above-described properties can be adjusted by using different face materials, structures, and features, such as those described in U.S. Pat. Nos. RE42,544; 8,096,897; 7,985,146; 7,874,936; 7,874,937; 8,628,434; and 7,267,620; and U.S. Patent Pub. Nos. 2008/0149267 and 2009/0163289, which are herein incorporated by reference in their entirety. Additionally, the structure of the front channel, club head face, and surrounding features of any of the embodiments herein can be varied to further impact COR and related aspects of the golf club head performance, as further described in U.S. Pat. No. 9,662,545; and U.S. Patent Pub. No. 2016/0023062, which are incorporated by reference herein in their entirety.

Golf club heads and many of their physical characteristics disclosed herein will be described using "normal address position" as the golf club head reference position, unless otherwise indicated. The normal address position of the club head is defined as the angular position of the head relative to a horizontal ground plane when the shaft axis lies in a vertical plane that is perpendicular to the centerface target line vector and when the shaft axis defines a lie angle relative to the ground plane such that the scorelines on the face of the club are horizontal (if the club does not have scorelines, then the normal address position lie angle shall be defined as 60-degrees). The centerface target line vector is defined as a horizontal vector that points forward (along the Y-axis) from the centerface point of the face. The centerface point (axis origin point) can be defined as the geometric center of the striking surface and/or can be defined as an ideal impact location on the striking surface.

Figure 11A:
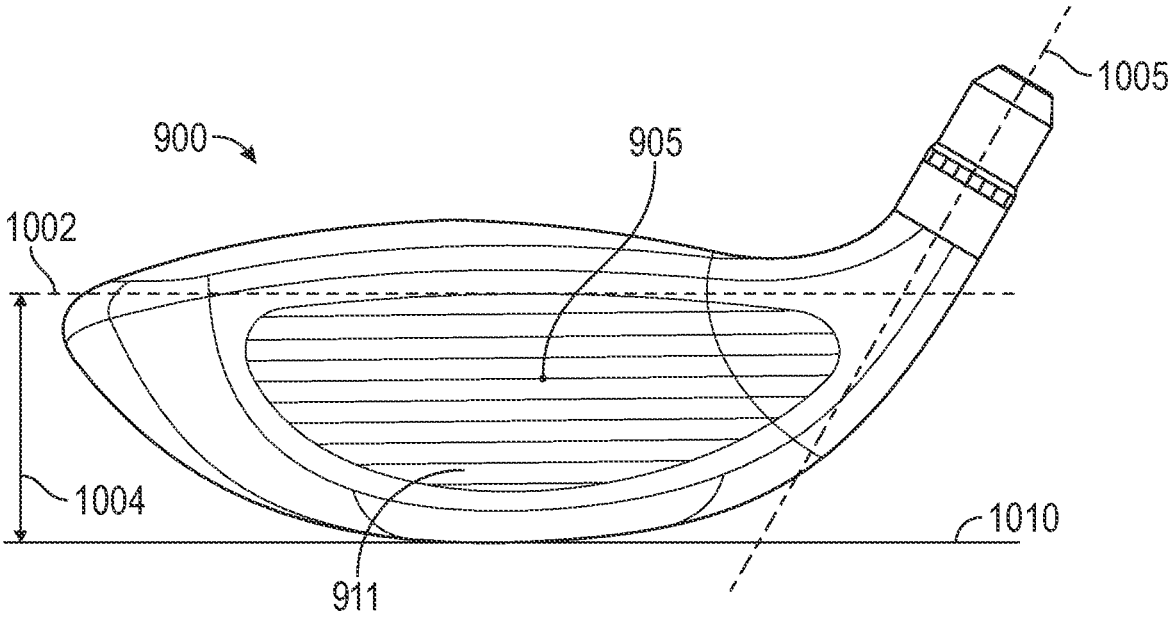
FIG. 11A is a front elevational view of an exemplary golf club head disclosed herein.
Figure 11B:
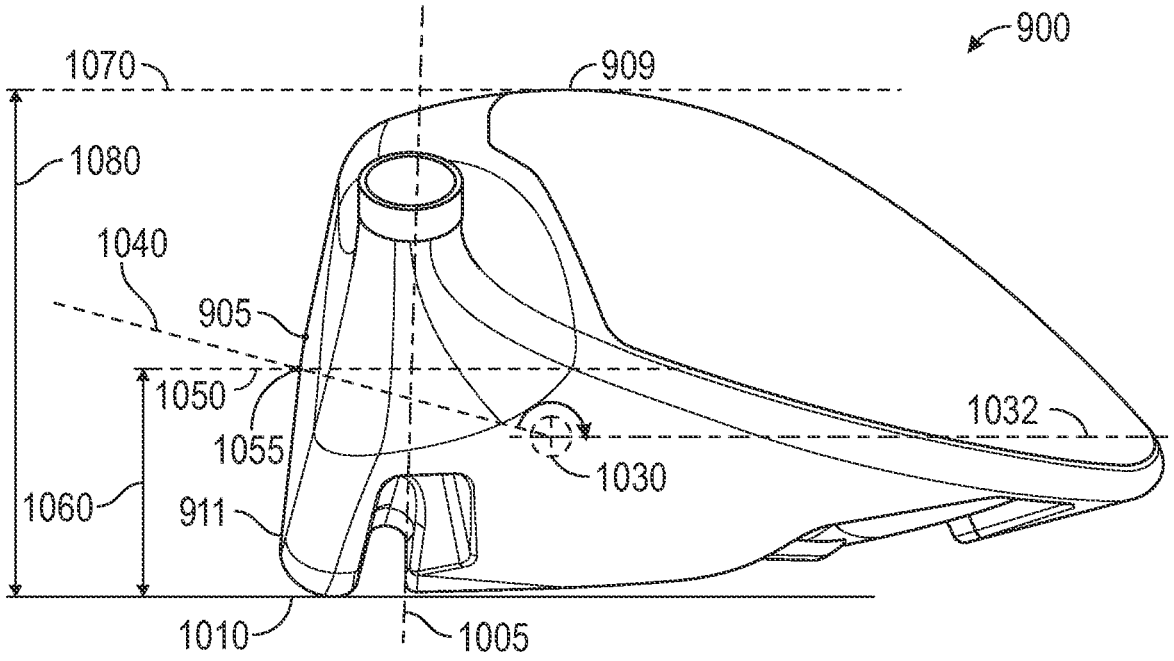
FIG. 11B is heel-side view of the golf club head of FIG. 11A.

FIGS. 11A-11B illustrate one embodiment of a fairway wood type golf club head 900 at normal address position, though it is understood that similar measurements may be made for other wood-type golf clubs, such as drivers, utility clubs (also known as hybrid clubs), rescue clubs, and the like. At normal address position, the golf club head 900 rests on a ground plane 1010, a plane parallel to the ground, which is intersected by a centerline axis 1005 of a club shaft of the golf club head 900.

In addition to the thickness of the face plate and the walls of the golf club head, the location of the center of gravity also has a significant effect on the COR and other properties of a golf club head. For example, as illustrated in FIG. 11B, a given golf club head having a given CG will have a projected center of gravity or "balance point" or "CG projection" on the face plate 911 that is determined by an imaginary line 1040 passing through the CG 1030 and oriented normal to the face plate 911. The location 1055 where the imaginary line 1040 intersects the face plate 911 is the projected CG point 1055, which is typically expressed as a distance above or below the geometric center 905 of the face plate 911.

When the projected CG point 1055 is well above the center 905 of the face, impact efficiency, which is measured by COR, is not maximized. It has been discovered that a fairway wood with a relatively lower CG projection or a CG projection located at or near an ideal impact location on the striking surface of the club face, as described more fully below, improves the impact efficiency of the golf club head as well as initial ball speed. One important ball launch parameter, namely ball spin, is also improved.

The distance from the ground plane 1010 to the Projected CG point 1055 may also be an advantageous measurement of golf head playability, and may be represented by a CG plane 1050 that is parallel to the ground plane 1010. The distance 1060 from the ground plane 1010 to this CG plane 1050 representing CG projection on the face plate 911 may be referred to as the balance point up (BP Up). In the advantageous examples disclosed herein, BP Up may be less than 23 mm, regardless of the position of a weight member along its path of travel, (e.g., path 937 in FIGS. 15A and 19A). In particular instances, BP Up may be lower than 22 mm for any position of the weight member along its path of travel. In still further examples, BP Up made be lower than 20 mm for any position of the weight member along its path of travel.

Additionally, "Zup," as further described herein, may also provide an advantageous measurement of golf club head playability. Zup generally refers to the height of the CG above the ground plane as measured along the z-axis. For example, as illustrated in FIG. 11B, an imaginary line 1032 representing Zup extends out from the CG 1030 parallel to the ground plane 1010.

Fairway wood shots typically involve impacts that occur below the center of the face, and ball speed and launch parameters are often less than ideal. This results because most fairway wood shots are from the ground and not from a tee, and most golfers have a tendency to hit their fairway wood ground shots low on the face of the golf club head. Maximum ball speed is typically achieved when the ball is struck at a location on the striking face where the COR is greatest.

For traditionally designed fairway woods, the location where the COR is greatest is the same as the location of the CG projection on the striking surface. This location, however, is generally higher on the striking surface than the below center location of typical ball impacts during play. In contrast to these conventional golf clubs, it has been discovered that greater shot distance is achieved by configuring the golf club head to have a CG projection that is located near to the center of the striking surface of the golf club head.

It is known that the coefficient of restitution of a golf club may be increased by increasing the height $H_{ss}$ of the face plate—illustrated in FIG. 11A as the distance 1004 between the ground plane 1010 and a plane 1002 intersecting the top of the face plate—and/or by decreasing the thickness of the face plate of a golf club head. However, in the case of a fairway wood, hybrid, or rescue golf club, increasing the face height may be considered undesirable because doing so will potentially cause an undesirable change to the mass properties of the golf club (e.g., center of gravity location) and to the golf club's appearance.

The United States Golf Association (USGA) regulations constrain golf club head shapes, sizes, and moments of inertia. Due to these constraints, golf club manufacturers and designers struggle to produce golf club heads having maximum size and moment of inertia characteristics while maintaining all other golf club head characteristics. For example, one such constraint is a volume limitation of 460 $cm^3$. In general, volume is measured using the water displacement method. However, the USGA will fill any significant cavities in the sole or series of cavities which have a collective volume of greater than 15 $cm^3$.

To produce a more forgiving golf club head, designers struggle to maximize certain parameters such as face area, moment of inertia about the z-axis and x-axis, and address area. A larger face area makes the golf club head more forgiving. Likewise, higher moment of inertia about the z-axis and x-axis makes the golf club head more forgiving. Similarly, a larger front to back dimension will generally increase moment of inertia about the z-axis and x-axis because mass is moved further from the center of gravity and the moment of inertia of a mass about a given axis is proportional to the square of the distance of the mass away from the axis. Additionally, a larger front to back dimension will generally lead to a larger address area which inspires confidence in the golfer when s/he addresses the golf ball.

However, when designers seek to maximize the above parameters it becomes difficult to stay within the volume limits and golf club head mass targets. Additionally, the sole curvature begins to flatten as these parameters are maximized. A flat sole curvature provides poor acoustics. To counteract this problem, designers may add a significant amount of ribs to the internal cavity to stiffen the overall structure and/or thicken the sole material to stiffen the overall structure. See for example FIGS. 55C and 55D and the corresponding text of U.S. Pub. No. 2016/0001146 A1, published Jan. 7, 2016. This, however, wastes discretionary mass that could be put elsewhere to improve other properties like moment of inertia about the z-axis and x-axis, or to permit adjustment of other mass properties such as BP Up or center of gravity movement.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

Figure 12A:
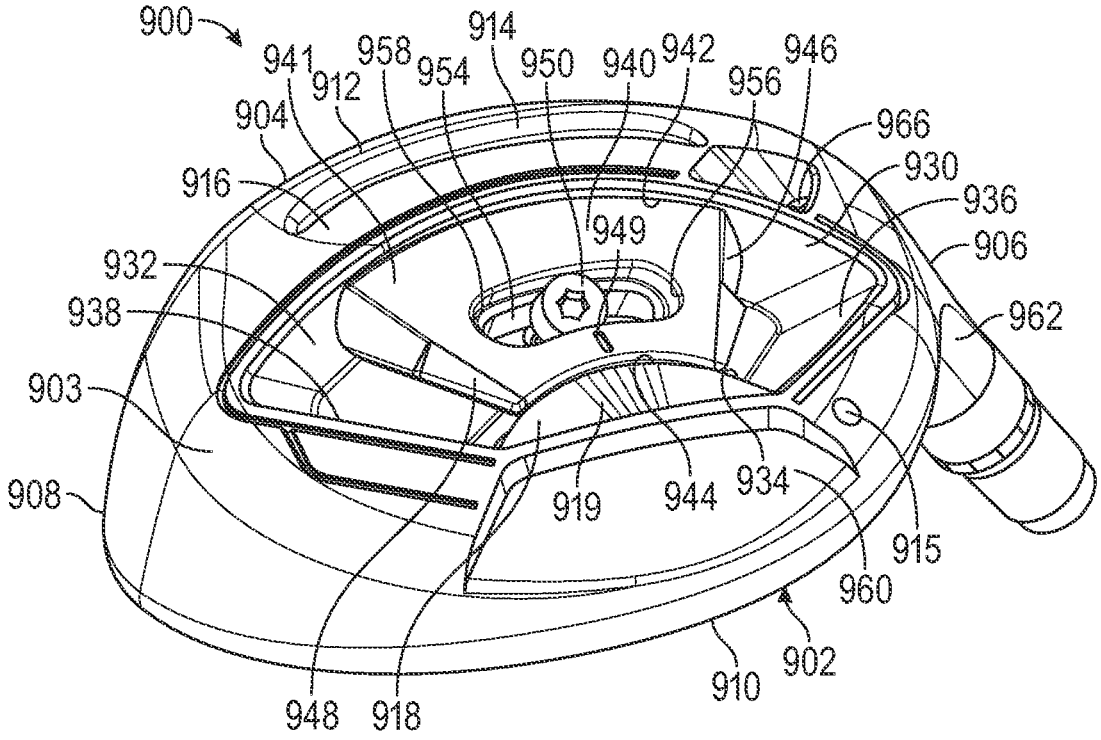
FIG. 12A is a bottom rear perspective view of the golf club head of FIG. 11A.

FIGS. 11A-23 illustrate an exemplary golf club head 900 that embodies certain inventive technologies disclosed herein. This exemplary embodiment of a golf club head provides increased COR by increasing or enhancing the perimeter flexibility of a face plate 911 of the golf club without necessarily increasing the height or decreasing the thickness of the face plate 911. Additionally, it improves BP Up by positioning a significant amount of discretionary mass low and forward of the club head's center of gravity. For example, FIG. 12A is a bottom perspective view of a golf club head 900 having a high COR. The golf club head 900 comprises a body 902 having a hosel 962 (best illustrated in FIGS. 21, 22 and 23), in which a golf club shaft may be inserted and secured to the golf club head 900. A weight member 940 may be at least partially secured within a weight channel 930 and secured with a fastener 950 as further described below. The golf club head 900 defines a front end or face 904, an opposed rear end 910, heel side 906, toe side 908, lower side or sole 903, and upper side or crown 909 (all embodiments disclosed herein share similar directional references).

The front end 904 includes a face plate 911 (FIG. 11A) for striking a golf ball, which may be an integral part of the body 902 (e.g., the body 902 and face plate 911 may be cast as a single part), or may comprise a separate insert. For embodiments where the face plate is not integral to the body 902, the front end 904 can include a face opening (not shown) to receive a face plate 911 that is attached to the body by welding, braising, soldering, screws or other fastening means.

Figure 21:
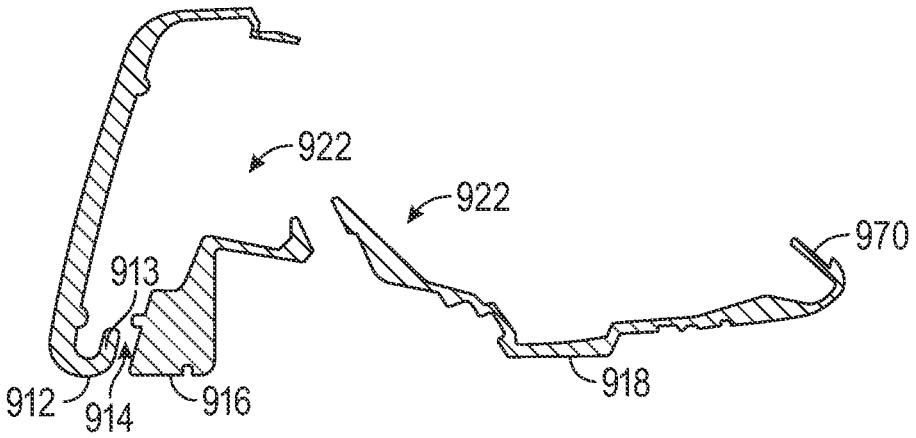
FIG. 21 is a cross-section of the golf club head of FIG. 20, taken along line 21-21 in FIG. 20.

Near the face plate 911, a front channel 914 is formed in the sole 903. As illustrated in FIG. 21, the front channel 914 extends between a lip 913 formed below or behind the front ground contact surface 912 and the intermediate ground contact surface 916 into an interior cavity 922 of the golf club head 900. In some embodiments (not shown), the front channel 914 may comprise a slot that is raised up from the sole 903, but does not extend fully into the interior cavity 912. In some embodiments, the slot or channel may be provided with a slot or channel insert (not shown) to prevent dirt, grass, or other elements from entering the interior cavity 922 of the body 902 or from getting lodged in the slot or channel. The front channel 914 extends in a toe-heel direction across the sole, with a heelward end near the hosel 962 and an opposite toeward end. The front channel can improve coefficient of restitution across the striking face and can provide increased forgiveness on off-center ball strikes. For example, the presence of the front channel can expand zones of the highest COR across the face of the club, particularly at the bottom of the club face near the channel, so that a larger fraction of the face area has a COR above a desired value, especially at the lower regions of the face. More information regarding the construction and performance benefits of the front channel 914 and similar front channels can be found in U.S. Pat. Nos. 8,870,678; 9,707,457; and 9,700,763, and U.S. Patent Pub. No. 2016/0023063 A1, all of which are incorporated by reference herein in their entireties, and various of the other publications that are incorporated by reference herein.

Figure 14:
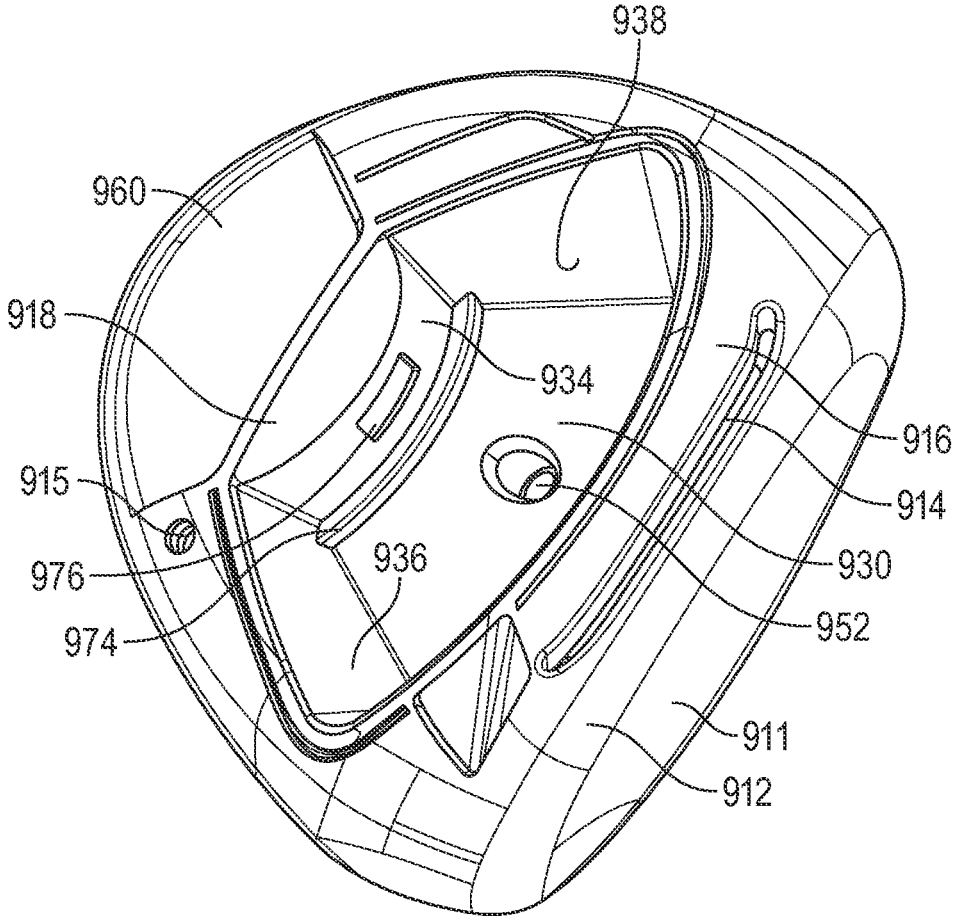
FIG. 14 is a bottom perspective view of the golf club head of FIG. 11A, with a weight member removed.

As best illustrated in FIG. 14, a weight channel 930 is separated from and positioned rearward of the front channel 914 in a forward portion of the golf club head. The weight channel 930 is further described below. The body 902 can include a front ground contact surface 912 on the body forward of the front channel 914 adjacent the bottom of the face plate 911. The body can also have an intermediate ground contact surface, or sit pad, 916 rearward of the front channel 914. The intermediate ground contact surface 916 can have an elevation and curvature congruent with that of the front ground contact surface 912. Some embodiments may not include a front channel or slot in which case the intermediate ground contact surface may extend to the bottom of the face plate 911, thereby providing addition potential contact surface area. The body 902 can further comprise a downwardly extending rear sole surface 918 that extends around at least a portion of the perimeter of the rear end 910 of the body. The rear sole surface may comprise one or more visual markings 919 that may correspond to a visual weight position indicator 949 on a weight member 940 that may be positioned within weight channel 930. In some embodiments, the rear sole surface 918 can act as a ground contact or sit pad as well, having a curvature and elevation congruent with that of the front ground contact surface 912 and the intermediate ground contact surface 916.

The body 902 can further include a raised sole portion 960 that is recessed up from the rear sole surface 918. The raised sole portion 960 can span over any portion of the sole 903, and in the illustrated embodiment the raised sole portion 960 spans over most of the rearward portion of the sole. The sole 903 can include a sloped transition portion where the intermediate ground contact surface 916 transitions up to the raised sole portion 960. The sole can also include other similar sloped portions (not shown), such as around the boundary of the raised sole portion 960. In some embodiments (not shown), one or more cantilevered ribs or struts can be included on the sole that span from the sloped transition portion to the raised sole portion 960, to provide increased stiffness and rigidity to the sole.

The raised sole portion 960 can optionally include grooves, channels, ridges, or other surface features that increase its rigidity. Similarly, the intermediate ground contact surface 916 can include stiffening surface features, such as ridges, though grooves or other stiffening features can be substituted for the ridges. A sole such as the sole 903 of the golf club head 900 may be referred to as a two-tier construction, bi-level construction, raised sole construction, or dropped sole construction, in which one portion of the sole is raised or recessed relative to the other portion of the sole. The terms raised, lowered, recessed, dropped, etc. are relative terms depending on perspective. For example, the intermediate ground contact surface 916 could be considered "raised" relative to the raised sole portion 960 and the weight channel 930 when the head is upside down with the sole facing upwardly as in FIG. 12A. On the other hand, the intermediate ground contact surface 916 portion can also be considered a "dropped sole" part of the sole, since it is located closer to the ground relative to the raised sole portion 960 and the weight channel 930 when the golf club head is in a normal address position with the sole facing the ground.

Additional disclosure regarding the use of recessed or dropped soles is provided in U.S. Provisional Patent Application No. 62/515,401, filed on Jun. 5, 2017, the entire contents of which are incorporated herein by reference.

The raised sole constructions described herein and in the incorporated references are counterintuitive because the raised portion of the sole tends to raise the Iyy position, which is sometimes considered disadvantageous. However, the raised sole portion 960 (and other raised sole portions disclosed herein) allows for a smaller radius of curvature for that portion of the sole (compared to a conventional sole without the raised sole portion) resulting in increased rigidity and better acoustic properties due to the increased stiffness from the geometry. This stiffness increase means fewer ribs or even no ribs are needed in that portion of the sole to achieve a desired first mode frequency, such as 3000 Hz or above, 3200 Hz or above, or even 3400 Hz or above. Fewer ribs provides a mass/weight savings, which allows for more discretionary mass that can be strategically placed elsewhere in the golf club head or incorporated into user adjustable movable weights.

Furthermore, sloped transition portions around the raised sole portion 960, as well as optional grooves and ridges associated therewith can provide additional structural support and additional rigidity for the golf club head, and can also modify and even fine tune the acoustic properties of the golf club head. The sound and modal frequencies emitted by the golf club head when it strikes a golf ball are very important to the sensory experience of a golfer and provide functional feedback as to where the ball impact occurs on the face (and whether the ball is well struck).

In some embodiments, the raised sole portion 960 can be made of a relatively thinner and/or less dense material compared to other portions of the sole and body that take more stress, such as the ground contact surfaces 912, 916, 918, the face region, and the hosel region. By reducing the mass of the raised sole portion 960, the higher CG effect of raising that portion of the sole is mitigated while maintaining a stronger, heavier material on other portions of the sole and body to promote a lower CG and provide added strength in the area of the sole and body where it is most needed (e.g., in a sole region proximate to the hosel and around the face and shaft connection components where stress is higher).

Figure 20:
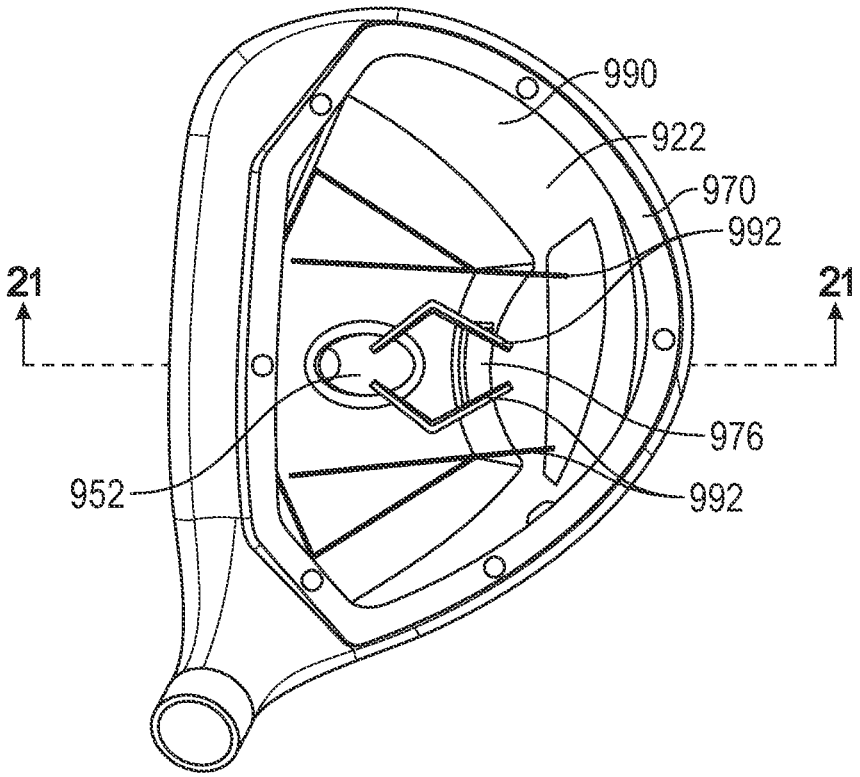
FIG. 20 is a top view of the golf club head of FIG. 11A, with the crown insert removed.

The body 902 can also include one or more internal ribs, such as ribs 992, as best shown in FIG. 20, that are integrally formed with or attached to the inner surfaces of the body. Such ribs can vary in size, shape, location, number and stiffness, and can be used strategically to reinforce or stiffen designated areas of the body's interior and/or fine tune acoustic properties of the golf club head.

Generally, the center of gravity (CG) of a golf club head is the average location of the weight of the golf club head or the point at which the entire weight of the golf club-head may be considered as concentrated so that if supported at this point the head would remain in equilibrium in any position. A golf club head origin coordinate system can be defined such that the location of various features of the golf club head, including the CG, can be determined with respect to a golf club head origin positioned at the geometric center of the striking surface and when the club-head is at the normal address position (i.e., the club-head position wherein a vector normal to the club face substantially lies in a first vertical plane perpendicular to the ground plane, the centerline axis of the club shaft substantially lies in a second substantially vertical plane, and the first vertical plane and the second substantially vertical plane substantially perpendicularly intersect).

The head origin coordinate system defined with respect to the head origin includes three axes: a head origin z-axis (or simply "z-axis") extending through the head origin in a generally vertical direction relative to the ground; a head origin x-axis (or simply "x-axis") extending through the head origin in a toe-to-heel direction generally parallel to the striking surface (e.g., generally tangential to the striking surface at the center) and generally perpendicular to the z-axis; and a head origin y-axis (or simply "y-axis") extending through the head origin in a front-to-back direction and generally perpendicular to the x-axis and to the z-axis. The x-axis and the y-axis both extend in generally horizontal directions relative to the ground when the golf club head is at the normal address position. The x-axis extends in a positive direction from the origin towards the heel of the golf club head. The y axis extends in a positive direction from the head origin towards the rear portion of the golf club head. The z-axis extends in a positive direction from the origin towards the crown. Thus for example, and using millimeters as the unit of measure, a CG that is located 3.2 mm from the head origin toward the toe of the golf club head along the x-axis, 36.7 mm from the head origin toward the rear of the clubhead along the y-axis, and 4.1 mm from the head origin toward the sole of the golf club head along the z-axis can be defined as having a CGx of −3.2 mm, a CGy of +36.7 mm, and a CGz of −4.1 mm.

Further as used herein, Delta 1 is a measure of how far rearward in the golf club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can promote a higher launch and a reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

Similarly, Delta 2 is the distance between the CG and the hosel axis along the x axis (in the direction straight toward the back of the body of the golf club face from the geometric center of the striking face).

Adjusting the location of the discretionary mass in a golf club head as described herein can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

In addition to the position of the CG of a club-head with respect to the head origin another important property of a golf club-head is the projected CG point, e.g., projected CG point 1055 discussed above. This projected CG point (also referred to as "CG Proj") can also be referred to as the "zero-torque" point because it indicates the point on the ball striking club face that is centered with the CG. Thus, if a golf ball makes contact with the club face at the projected CG point, the golf club head will not twist about any axis of rotation since no torque is produced by the impact of the golf ball. A negative number for this property indicates that the projected CG point is below the geometric center of the face. So, in the exemplary golf club head illustrated in FIG. 11B, because the projected CG point 1055 is located below the geometric center 905 of the golf club head 900 on the club face 911, this property would be expected to have a negative value. As discussed above, this point can also be measured using a value (BP Up) that measures the distance of the CG point 1055 from the ground plane 1010.

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the golf club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the golf club head is at normal address position. The CG x-axis extends in a positive direction from the CG origin to the heel of the golf club head. The CG y-axis extends in a positive direction from the CG origin towards the rear portion of the golf club head. The CG z-axis extends in a positive direction from the CG origin towards the crown. Thus, the axes of the CG origin coordinate system are parallel to corresponding axes of the head origin coordinate system. In particular, the CG z-axis is parallel to the z-axis, the CG x-axis is parallel to the x-axis, and CG y-axis is parallel to the y-axis.

Specifically, a golf club head has a moment of inertia about the vertical CG z-axis ("Izz"), a moment of inertia about the heel/toe CG x-axis ("lxx"), and a moment of inertia about the front/back CG y-axis ("Iyy"). Typically, however, the MOI about the CG z-axis (Izz) and the CG x-axis (Ixx) is most relevant to golf club head forgiveness.

A moment of inertia about the golf club head CG x-axis (Ixx) is calculated by the following Equation 7:

$$Ixx=\int(y^2+z^2)dm \tag{7}$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following Equation 8:

$$Izz=\int(x^2+y^2)dm \tag{8}$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found in U.S. Pat. No. 9,358,430, the entire contents of which are incorporated by reference herein.

An alternative, above ground, club head coordinate system places the head origin at the intersection of the z-axis and the ground plane, providing positive z-axis coordinates for every club head feature. As used herein, "Zup" means the CG z-axis location determined according to this above ground coordinate system. Zup generally refers to the height of the CG above the ground plane 1010 as measured along the z-axis, which is illustrated, e.g., by Zup line 1032 extending from the CG 1030 illustrated in FIG. 11B.

As described herein, desired golf club head mass moments of inertia, golf club head center-of-gravity locations, and other mass properties of a golf club head can be attained by distributing golf club head mass to particular locations. Discretionary mass generally refers to the mass of material that can be removed from various structures providing mass that can be distributed elsewhere for tuning one or more mass moments of inertia and/or locating the golf club head center-of-gravity.

Golf club head walls provide one source of discretionary mass. In other words, a reduction in wall thickness reduces the wall mass and provides mass that can be distributed elsewhere. Thin walls, particularly a thin crown 909, provide significant discretionary mass compared to conventional golf club heads. For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on the golf club head body 902, such as a thin crown 909, a golf club head body 902 can be formed from an alloy of steel or an alloy of titanium. For further details concerning titanium casting, please refer to U.S. Pat. No. 7,513,296, incorporated herein by reference.

Additionally, the thickness of the hosel 962 may be varied to provide for additional discretionary mass, as described in U.S. Pat. No. 9,731,176, the entire contents of which are hereby incorporated by reference.

Various approaches can be used for positioning discretionary mass within a golf club head. For example, golf club heads may have one or more integral mass pads (not shown in the illustrated embodiments) cast into the head at predetermined locations that can be used to lower, to move forward, to move rearward, or otherwise to adjust the location of the golf club head's center-of-gravity, as further described herein. Also, epoxy can be added to the interior of the golf club head, such as through an epoxy port 915 (illustrated in FIGS. 11A and 18) in the golf club head to obtain a desired weight distribution. Alternatively, weights formed of high-density materials can be attached to the sole or other parts of a golf club head, as further described, for example, in co-pending U.S. patent application Ser. No. 15/859,071, the entire contents of which are hereby incorporated by reference. With such methods of distributing the discretionary mass, installation is critical because the golf club head endures significant loads during impact with a golf ball that can dislodge the weight. Accordingly, such weights are usually permanently attached to the golf club head and are limited to a fixed total mass, which of course, permanently fixes the golf club head's center-of-gravity and moments of inertia.

Alternatively, weights can be attached in a manner which allows adjustment of certain mass properties of the golf club head. For example, FIG. 12A illustrates positioning a weight member 940 within a weight channel 930, as further described below.

Figure 12B:
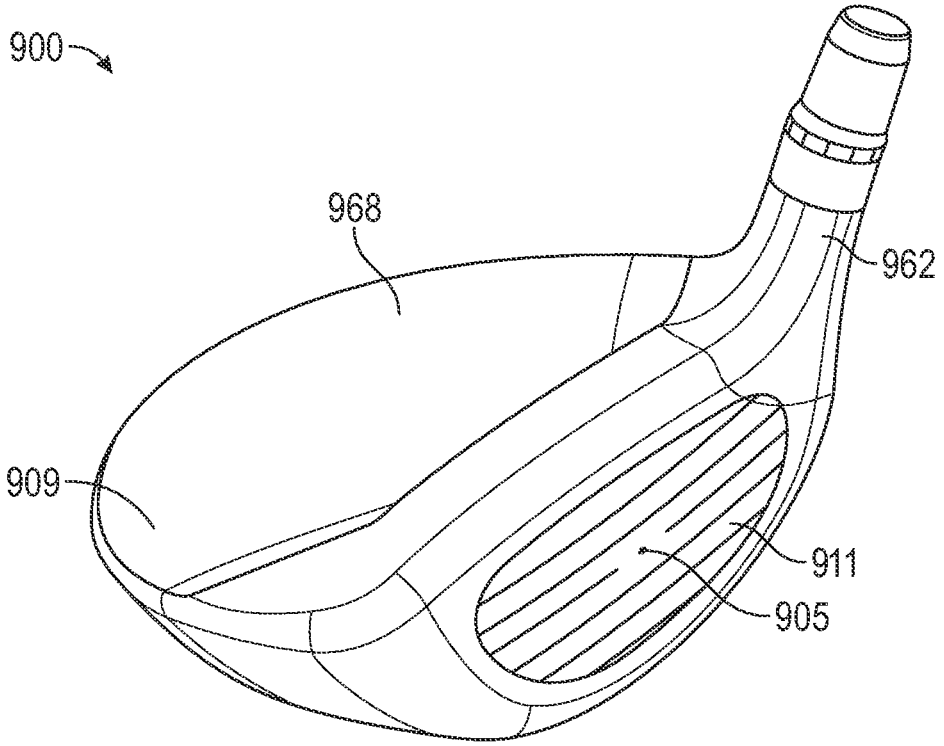
FIG. 12B is a front perspective view of the golf club head of FIG. 12A.

As shown in FIG. 12B, the golf club head 900 can optionally include a separate crown insert 968 that is secured to the body 902, such as by applying a layer of epoxy adhesive 967 or other securement means, such as bolts, rivets, snap fit, other adhesives, or other joining methods or any combination thereof, to cover a large opening 990 (illustrated in FIG. 20) at the top and rear of the body, forming part of the crown 909 of the golf club head. The crown insert 968 covers a substantial portion of the crown's surface area as, for example, at least 30%, at least 40%, at least 50%, at least 60%, at least 70% or at least 80% of the crown's surface area. The crown's outer boundary generally terminates where the crown surface undergoes a significant change in radius of curvature, e.g., near where the crown transitions to the golf club head's sole 903, hosel 962, and front end 904.

As best illustrated in FIG. 20, the crown can be formed to have a recessed peripheral ledge or seat 970 to receive the crown insert 968, such that the crown insert is either flush with the adjacent surfaces of the body to provide a smooth seamless outer surface or, alternatively, slightly recessed below the body surfaces. The front of the crown insert 968 can join with a front portion of the crown 909 on the body to form a continuous, arched crown extend forward to the face. The crown insert 968 can comprise any suitable material (e.g., lightweight composite and/or polymeric materials) and can be attached to the body in any suitable manner, as described in more detail elsewhere herein.

A wood-type golf club head, such as golf club head 900 and the other wood-type club heads disclosed herein have a volume, typically measured in cubic-centimeters ($cm^3$) equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports.

In some embodiments, as in the case of a fairway wood (as illustrated), the golf club head may have a volume between about 100 $cm^3$ and about 300 $cm^3$, such as between about 150 $cm^3$ and about 250 $cm^3$, or between about 130 $cm^3$ and about 190 $cm^3$, or between about 125 $cm^3$ and about 240 $cm^3$, and a total mass between about 125 g and about 260 g, or between about 200 g and about 250 g. In the case of a utility or hybrid club (analogous to the illustrated embodiments), the golf club head may have a volume between about 60 $cm^3$ and about 150 $cm^3$, or between about 85 $cm^3$ and about 120 $cm^3$, and a total mass between about 125 g and about 280 g, or between about 200 g and about 250 g. In the case of a driver (analogous to the illustrated embodiments), any of the disclosed golf club heads can have a volume between about 300 $cm^3$ and about 600 $cm^3$, between about 350 $cm^3$ and about 600 $cm^3$, and/or between about 350 $cm^3$ and about 500 $cm^3$, and can have a total mass between about 145 g and about 1060 g, such as between about 195 g and about 205 g.

In some of the embodiments described herein, a comparatively forgiving golf club head for a fairway wood can combine an overall golf club head height ($H_{ch}$)—illustrated in FIG. 11B as the distance 1080 from a ground plane 1010 to a parallel height plane 1070 at a crown 909 of the golf club head 900—of less than about 46 mm and an above ground balance point (BP Up) between 10 and 25 mm, such as a BP Up of less than about 23 mm. Some examples of the golf club head provide a BP Up less than about 22 mm, less than about 21 mm, or less than about 20 mm.

In some of these golf club heads, Zup may be between 10 and 30 mm, such as less than 24 mm, less than 20 mm, less than 19 mm, less than 17 mm, less than 16 mm, less than 15 mm, less than 14 mm, between 13 mm to 21 mm, or between 15 mm to 20 mm. Some examples of the golf club head 900 provide a head height of less than 48 mm, and preferably less than 46 mm, and more preferably less than 42 mm, as measured with the head positioned at a 60 degree lie angle. These measurements, and all other dimensions and parameters described herein, can be applicable to the fairway wood, hybrid, and rescue-type golf club heads including "twisted" striking faces described below.

The crown insert 968, disclosed in various embodiments herein, can help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, such as a composite material having a density of less than 2 grams per cubic centimeter. In still further embodiments, the material has a density of no more than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional ribs 992 can be strategically added to the hollow interior of the golf club head and thereby improve the acoustic properties of the head. Discretionary mass in the form of ribs, mass pads or other features also can be strategically located in the interior, or even on the exterior of the golf club head to shift the effective CG fore or aft, toeward or heelward or both (apart from any further CG adjustments made possible by adjustable weight features) or to improve desirable MOI characteristics, as further described herein.

Methods of making any of the golf club heads disclosed herein, or associated golf clubs, may include one or more of the following steps:

- forming a frame having a sole opening, forming a composite laminate sole insert, injection molding a thermoplastic composite head component over the sole insert to create a sole insert unit, and joining the sole insert unit to the frame, as described in more detail in the incorporated U.S. Provisional Patent Application No. 62/440,886;
- providing a composite head component which is a weight track capable of supporting one or more slidable weights;
- forming the sole insert and/or crown insert from a thermoplastic composite material having a matrix compatible for bonding with the weight track;
- forming the sole insert and/or crown insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof, wherein the sole insert is formed from a composite material having a density of less than 2 grams per cubic centimeter. In still further embodiments, the material has a density of less than 1.5 grams per cubic centimeter, or a density between 1 gram per cubic centimeter and 2 grams per cubic centimeter and the sole insert has a thickness of from about 0.195 mm to about 0.9 mm, preferably from about 0.25 mm to about 0.75 mm, more preferably from about 0.3 mm to about 0.65 mm, even more preferably from about 0.36 mm to about 0.56 mm;
- forming both the sole insert and/or crown insert and weight track from thermoplastic composite materials having a compatible matrix;
- forming the sole insert and/or crown insert from a thermosetting material, coating the sole insert with a heat activated adhesive, and forming the weight track from a thermoplastic material capable of being injection molded over the sole insert after the coating step;
- forming the frame from a material selected from the group consisting of titanium, one or more titanium alloys, aluminum, one or more aluminum alloys, steel, one or more steel alloys, and any combination thereof;
- forming the frame with a crown opening, forming a crown insert from a composite laminate material, and joining the crown insert to the frame such that the crown insert overlies the crown opening;
- selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof;
- forming the sole insert and crown insert from a continuous carbon fiber composite material;
- forming the sole insert and crown insert by thermosetting using materials suitable for thermosetting, and coating the sole insert with a heat activated adhesive;
- forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof;
- forming the frame with a crown opening, forming a crown insert from a thermoplastic composite material, and joining the crown insert to the frame such that it overlies the crown opening; and
- providing a crown to sole stiffening member, as described in more detail in U.S. Pat. No. 9,693,291, the entire contents of which is hereby incorporated by reference in its entirety.

The bodies of the golf club heads disclosed herein, and optionally other components of the club heads as well, serve as frames and may be made from a variety of different types of suitable materials. In some embodiments, for example, the body and/or other head components can be made of a metal material such as steel and steel alloys, a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The body may be formed by conventional casting, metal stamping or other known processes. The body also may be made of other metals as well as non-metals. The body can provide a framework or skeleton for the club head to strengthen the club head in areas of high stress caused by the golf ball's impact with the face, such as the transition region where the club head transitions from the face to the crown area, sole area and skirt area located between the sole and crown areas.

In some embodiments, the sole insert and/or crown insert of the club head may be made from a variety of composite materials and/or polymeric materials, such as from a thermoplastic material, preferably from a thermoplastic composite laminate material, and most preferably from a thermoplastic carbon composite laminate material. For example, the composite material may comprise an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42% to 57%) will suffice. The material weighs about 200 g/m$^2$.

Another similar exemplary material which may be used for the crown insert and/or sole insert is TEPEX® DYNALITE 208. This material also has a carbon fiber volume range of 42% to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming sole and crown inserts.

Once the crown insert and/or sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

A crown insert and/or sole insert can have a complex three-dimensional curvature corresponding generally to the crown and sole shapes of a fairway wood-type club head and specifically to the design specifications and dimensions of the particular head designed by the manufacturer. It will be appreciated that other types of club heads, such as drivers, utility clubs (also known as hybrid clubs), rescue clubs, and the like may be manufactured using one or more of the principles, methods and materials described herein.

In an alternative embodiment, the sole insert and/or crown insert can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a compression mold, e.g., a metal matched compression mold, or a bladder mold, and stacked/oriented with the carbon or other fibers oriented in different directions. The plies are heated to activate the chemical reaction and form the sole (or crown) insert. Each insert is cooled and removed from its respective mold. Additional disclosure regarding methods of forming sole and/or crown inserts can be found in U.S. Pat. No. 9,579,549, the entire contents of which are incorporated by reference.

The carbon fiber reinforcement material for the thermoset sole/crown insert may be a carbon fiber known as "34-700" fiber, available from Grafil, Inc., of Sacramento, California, which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, California.

In one example, the prepreg sheets have a quasi-isotropic fiber reinforcement of 34-700 fiber having an areal weight of about 70 g/m$^2$ and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

Once the sole insert and crown insert are formed, they can be joined to the body in a manner that creates a strong integrated construction adapted to withstand normal stress, loading and wear and tear expected of commercial golf clubs. For example, the sole insert and crown insert each may be bonded to the frame using epoxy adhesive, such as an adhesive applied between an interior surface of each respective insert and a corresponding exterior surface of the body, with the crown insert seated in and overlying the crown opening and the sole insert seated in and overlying the sole opening. Alternatively, a sole insert or crown insert may be attached inside an internal cavity of the body and then subsequently attached by securing an exterior surface of the insert to an interior surface of the body. Alternative attachment methods for bonding an insert to either an internal or an external surface of the body include bolts, rivets, snap fit, adhesives, other known joining methods or any combination thereof.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which are hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-S02-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases.

The polysulfones are fully thermoplastic, allowing fabrication by most standard methods such as injection molding, extrusion, and thermoforming. They also enjoy a broad range of high temperature engineering uses.

Three commercially significant polysulfones are:

polysulfone (PSU);

Polyethersulfone (PES also referred to as PESU); and

Polyphenylene sulfoner (PPSU).

Particularly important and preferred aromatic polysulfones are those comprised of repeating units of the structure—$C_6H_4SO_2$—$C_6H_4$—O— where $C_6H_4$ represents an m- or p-phenylene structure. The polymer chain can also comprise repeating units such as —$C_6H_4$—, $C_6H_4$—O—, —$C_6H_4$-(lower-alkylene)-$C_6H_4$—O—, —$C_6H_4$—O—$C_6H_4$—O—, —$C_6H_4$—S—$C_6H_4$—O— and other thermally stable substantially-aromatic difunctional groups known in the art of engineering thermoplastics. Also included are the so called modified polysulfones where the individual aromatic rings are further substituted in one or substituents including

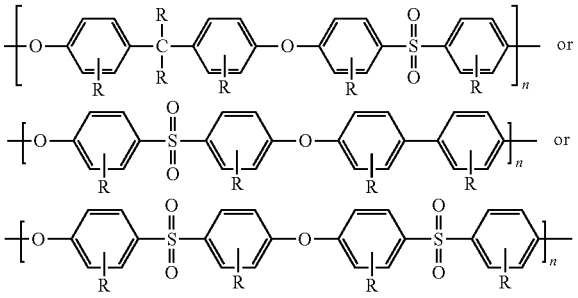

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a $C_1$-$C_{20}$ alkyl group, a $C_2$-$C_{20}$ alkenyl group, a $C_3$-$C_{20}$ cycloalkyl group, a $C_3$-$C_{20}$ cycloalkenyl group, and a $C_6$-$C_{20}$ aromatic hydrocarbon group. These hydrocarbon groups may be partly substituted by a halogen atom or atoms, or may be partly substituted by a polar group or groups other than the halogen atom or atoms. As specific examples of the $C_1$-$C_{20}$ alkyl group, there can be mentioned methyl, ethyl, propyl, isopropyl, amyl, hexyl, octyl, decyl and dodecyl groups. As specific examples of the $C_2$-$C_{20}$ alkenyl group, there can be mentioned propenyl, isopropepyl, butenyl, isobutenyl, pentenyland hexenyl groups. As specific examples of the $C_3$-$C_{20}$ cycloalkyl group, there can be mentionedcyclopentyl and cyclohexyl groups. As specific examples of the $C_3$-$C_{20}$ cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers, include, the polysulfone made by condensation polymerization of bisphenol A and 4,4'-dichlorodiphenyl sulfone in the presence of base, and having the main repeating structure

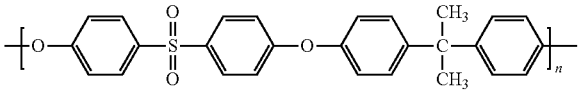

having the abbreviation PSF and sold under the tradenames Udel®, Ultrason® S, Eviva®, RTP PSU, the polysulfone made by condensation polymerization of 4,4'-dihydroxydiphenyl and 4,4'-dichlorodiphenyl sulfone in the presence of base, and having the main repeating structure

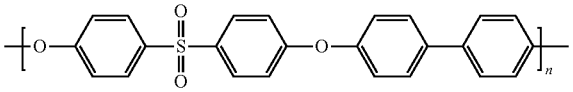

having the abbreviation PPSF and sold under the tradenames RADEL® resin; and a condensation polymer made from 4,4'-dichlorodiphenyl sulfone in the presence of base and having the principle repeating structure

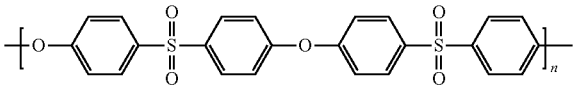

having the abbreviation PPSF and sometimes called a "polyether sulfone" and sold under the tradenames Ultrason® E, LNP™, Veradel®PESU, Sumikaexce, and VICTREX® resin, and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. Reissue Pat. No. RE41,577; U.S. Pat. Nos. 7,267,620; 7,140,974; 8,096,897; 7,628,712; 7,985,146; 7,874,936; 7,874,937; 8,628,434; and 7,874,938;

and U.S. Patent Pub. Nos. 2008/0149267 and 2009/0163289, which are all incorporated herein by reference. The composite material may be manufactured according to the methods described at least in U.S. Patent Pub. No. 2008/0149267, the entire contents of which are herein incorporated by reference.

Alternatively, short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

An example is a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Another example is a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Also an option is a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

The foregoing materials are well-suited for composite, polymer and insert components of the embodiments disclosed herein, as distinguished from components which preferably are made of metal or metal alloys.

Additional details regarding providing composite soles and/or crowns and crown layups are provided in U.S. Patent Pub. No. 2016/0001146, the entire contents of which are hereby incorporated by reference.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell of the golf club head 900 may be made of a composite material, such as, for example, a carbon fiber reinforced epoxy, carbon fiber reinforced polymer, or a polymer. Additionally, U.S. Patent Pub. No. 2004/0116207 and U.S. Pat. No. 6,969,326, also incorporated by reference herein in their entirety, describe golf club heads with lightweight crowns. Furthermore, U.S. patent application Ser. No. 12/974,437 (now U.S. Pat. No. 8,608,591), also incorporated by reference herein in its entirety, describes golf club heads with lightweight crowns and soles.

In some embodiments, composite materials used to construct the crown and/or sole insert should exhibit high strength and rigidity over a broad temperature range as well as good wear and abrasion behavior and be resistant to stress cracking. Such properties include (1) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039); (2) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039); (3) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790); and (4) a Flexural Modulus at room temperature of from about 0.4 Msi to about 21 Msi, from about 0.5 Msi to about 20 Msi, more preferably of from about 10 Msi to about 19 Msi (as measured by ASTM D 790).

In certain embodiments, composite materials that are useful for making club-head components comprise a fiber portion and a resin portion. In general, the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However, for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of g/m$^2$. Crown and/or sole panels may be formed of plies of composite material having a fiber areal weight of between 20 g/m$^2$ and 200 g/m$^2$ and a density between about 1 g/cc and 2 g/cc. However, FAW values below 100 g/m$^2$, and more desirably 75 g/m$^2$ or less, can be particularly effective. A particularly suitable fibrous material for use in making prepreg plies is carbon fiber, as noted. More than one fibrous material can be used. In other embodiments, however, prepreg plies having FAW values below 70 g/m$^2$ and above 100 g/m$^2$ may be used. Generally, cost is the primary prohibitive factor in prepreg plies having FAW values below 70 g/m$^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Some of the embodiments of the golf club head 900 discussed throughout this application may include a separate crown, sole, and/or face that may be a composite, such as, for example, a carbon fiber reinforced epoxy, carbon fiber reinforced polymer, or a polymer crown, sole, and/or face. Alternatively, the crown, sole, and/or face may be made from a less dense material, such as, for example, Titanium or Aluminum. A portion of the crown may be cast from either steel (~7.8-8.05 g/cm$^3$) or titanium (~4.43 g/cm$^3$) while a majority of the crown may be made from a less dense material, such as for example, a material having a density of about 1.5 g/cm$^3$ or some other material having a density less than about 4.43 g/cm$^3$. In other words, the crown could be some other metal or a composite. Additionally or alternatively, the face may be welded in place rather than cast as part of the sole.

By making the crown, sole, and/or face out of a less dense material, it may allow for weight to be redistributed from the crown, sole, and/or face to other areas of the club head, such as, for example, low and forward and/or low and back. Both low and forward and low and back may be possible for club heads incorporating a front to back sliding weight track.

U.S. Pat. No. 8,163,119 discloses composite articles and methods for making composite articles, which disclosure is incorporated by reference herein in the entirety. U.S. Pat. Nos. 9,452,325 and 7,279,963 disclose various composite crown constructions that may be used for golf club heads, which disclosures are also incorporated by reference herein in their entireties. The techniques and layups described in U.S. Pat. Nos. 8,163,119; 9,452,325; and 7,279,963, incorporated herein by reference in their entirety, may be employed for constructing a composite crown panel, composite sole panel, composite toe panel located on the sole, and/or composite heel panel located on the sole.

U.S. Pat. No. 8,163,119 discloses the usual number of layers for a striking plate is substantial, e.g., fifty or more. However, improvements have been made in the art such that the layers may be decreased to between 30 and 50 layers. Additionally, for a panel located on the sole and/or crown the layers can be substantially decreased down to three, four, five, six, seven, or more layers.

Table 6 below provides examples of possible layups. These layups show possible crown and/or sole construction using unidirectional plies unless noted as woven plies. The construction shown is for a quasi-isotropic layup. A single layer ply has a thickness ranging from about 0.065 mm to about 0.080 mm for a standard FAW of 70 g/m$^2$ with about 36% to about 40% resin content, however the crown and/or sole panels may be formed of plies of composite material having a fiber areal weight of between 20 g/m$^2$ and 200 g/m$^2$. The thickness of each individual ply may be altered by adjusting either the FAW or the resin content, and therefore the thickness of the entire layup may be altered by adjusting these parameters.

TABLE 6

| ply 1 | ply 2 | ply 3 | ply 4 | ply 5 | ply 6 | ply 7 | ply 8 | AW g/m2 |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | − 45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| 0 | 90 | +45 | −45 | 0/90 woven | | | | 490-720 |
| 0 | 90 | +45 | −45 | +45 | 0/90 woven | | | 490-720 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | 45 | 0/90 woven | | | 590-720 |
| 90 | 0 | 45 | −45 | 45 | 90/0 woven | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |

TABLE 6-continued

| ply 1 | ply 2 | ply 3 | ply 4 | ply 5 | ply 6 | ply 7 | ply 8 | AW g/m2 |
|---|---|---|---|---|---|---|---|---|
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm3 and for titanium the density is about 4.5 g/cm3. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly, the main body of the golf club head 900 may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the golf club head 900. The thin walled titanium construction increases the manufacturing difficulty and ultimately fewer parts are cast at a time. In the past, 100+ golf club heads could be cast at a single time, however due to the thinner wall construction fewer golf club heads are cast per cluster to achieve the desired combination of high yield and low material usage.

An important strategy for obtaining more discretionary mass is to reduce the wall thickness of the golf club head 900. For a typical titanium-alloy "metal-wood" club-head having a volume of 460 cm3 (i.e., a driver) and a crown area of 100 cm2, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

The following examples will help to illustrate the possible discretionary mass "savings" by making a composite crown rather than a titanium-alloy crown. For example, reducing the material thickness to about 0.73 mm yields an additional discretionary mass "savings" of about 25.0 g over a 0.8 mm titanium-alloy crown. For example, reducing the material thickness to about 0.73 mm yields an additional discretionary mass "savings" of about 25 g over a 0.8 mm titanium-alloy crown or 34 g over a 1.0 mm titanium-alloy crown. Additionally, a 0.6 mm composite crown yields an additional discretionary mass "savings" of about 27 g over a 0.8 mm titanium-alloy crown. Moreover, a 0.4 mm composite crown yields an additional discretionary mass "savings" of about 30 g over a 0.8 mm titanium-alloy crown. The crown can be made even thinner yet to achieve even greater weight savings, for example, about 0.32 mm thick, about 0.26 mm thick, about 0.195 mm thick. However, the crown thickness must be balanced with the overall durability of the crown during normal use and misuse. For example, an unprotected crown i.e. one without a head cover could potentially be damaged from colliding with other woods or irons in a golf bag.

For example, any of the embodiments disclosed herein may have a crown or sole insert formed of plies of composite material having a fiber areal weight of between 20 g/m$^2$ and 200 g/m$^2$, preferably between 50 g/m$^2$ and 100 g/m$^2$, the weight of the composite crown being at least 20% less than the weight of a similar sized piece formed of the metal of the body. The composite crown may be formed of at least four plies of uni-tape standard modulus graphite, the plies of uni-tape oriented at any combination of 0° (forward to rearward of the club head), +45°, −45° and 90° (heelward to toeward of the golf club head). Additionally or alternatively, the crown may include an outermost layer of a woven graphite cloth. Carbon crown panels or inserts or carbon sole panels as disclosed herein and in the incorporated applications may be utilized with any of the embodiments herein, and may have a thickness between 0.40 mm to 1.0 mm, preferably 0.40 mm to 0.80 mm, more preferably 0.40 mm to 0.65 mm, and a density between 1 gram per cubic centimeter and 2 grams per cubic centimeter, though other thicknesses and densities are also possible.

One potential embodiment of a carbon sole panel that may be utilized with any of the embodiments herein weighs between 1.0 grams and 5.0 grams, such as between 1.25 grams and 2.75 grams, such as between 3.0 grams and 4.5 grams. In other embodiments, the carbon sole panel may weigh less than 3.0 grams, such as less than 2.5 grams, such as less than 2.0 grams, such as less than 1.75 grams. The carbon sole panel may have a surface area of at least 1250 mm$^2$, 1500 mm$^2$, 1750 mm$^2$, or 2000 mm$^2$.

One potential embodiment of a carbon crown panel that may be utilized with any of the embodiments herein weighs between 3.0 grams and 8.0 grams, such as between 3.5 grams and 7.0 grams, such as between 3.5 grams and 7.0 grams. In other embodiments, the carbon crown panel may weigh less than 7.0 grams, such as less than 6.5 grams, such as less than 6.0 grams, such as less than 5.5 grams, such as less than 5.0 grams, such as less than 4.5 grams. The carbon crown panel may have a surface area of at least 3000 mm$^2$, 3500 mm$^2$, 3750 mm$^2$, 4000 mm$^2$.

FIG. 12A illustrates one embodiment of a COR feature in combination with a sliding weight track. Similar features are shown in the other embodiments. While the illustrated embodiments may only have a COR feature and a sliding weight track, other embodiments may have a COR feature, a sliding weight track, and an adjustable loft/lie feature or some other combination of features.

As already discussed, and making reference to the embodiment illustrated in FIG. 12A, the COR feature may have a certain length L (which may be measured as the distance between toeward end and heelward end of the front channel 914), width W (e.g., the measurement from a forward edge to a rearward edge of the front channel 914), and offset distance OS from the front end, or face 904 (e.g., the distance between the face 904 and the forward edge of front channel 914, also shown in FIG. 14 as the width of the front ground contact surface 912 between the face plate 911 and the front channel 914). During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

During development, it was discovered that a ratio of COR feature length to the offset distance may be preferably greater than 4, and even more preferably greater than 5, and most preferably greater than 5.5. However, the ratio of COR feature length to offset distance also has an upper limit and is preferably less than 15, and even more preferably less than 14, and most preferably less than 13.5. For example, for a COR feature length of 30 mm the offset distance from the face would preferably be less than 7.5 mm, and even more preferably 6 mm or less from the face. Additional disclosure about the relationship between COR feature length and offset, and related effects are provided in in co-pending U.S. patent application Ser. No. 15/859,071, the entire contents of which are hereby incorporated by reference.

The offset distance is highly dependent on the slot length. As slot length increases so do the stresses in the club head, as a result the offset distance must be increased to manage stress. Additionally, as slot length increases the first mode frequency is negatively impacted.

Figure 27:
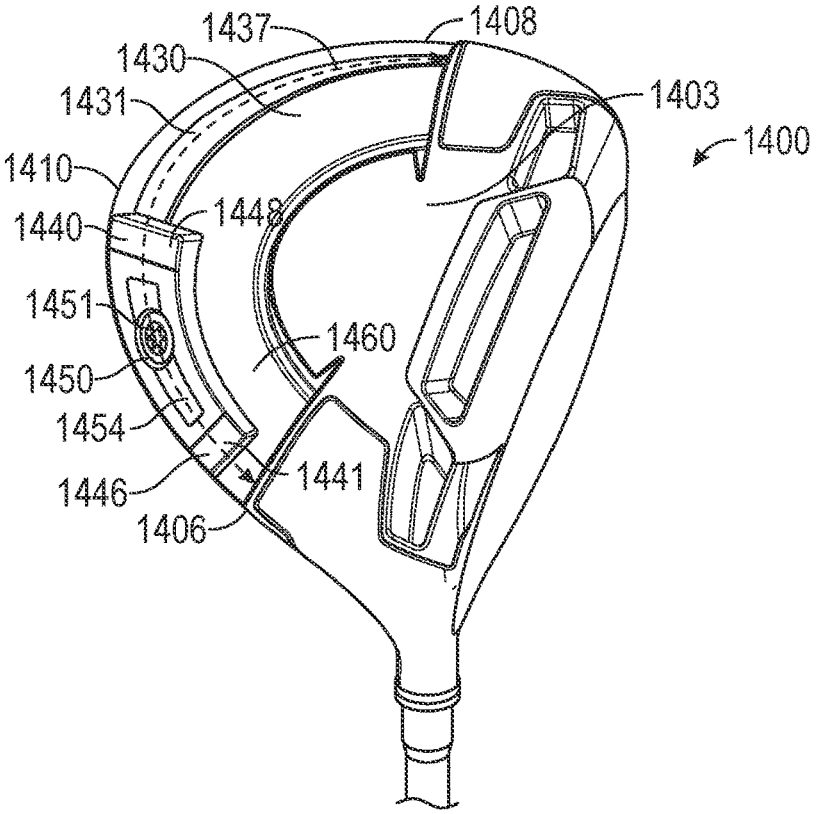
FIG. 27 is a bottom perspective view of another exemplary golf club head disclosed herein.
Figure 28:
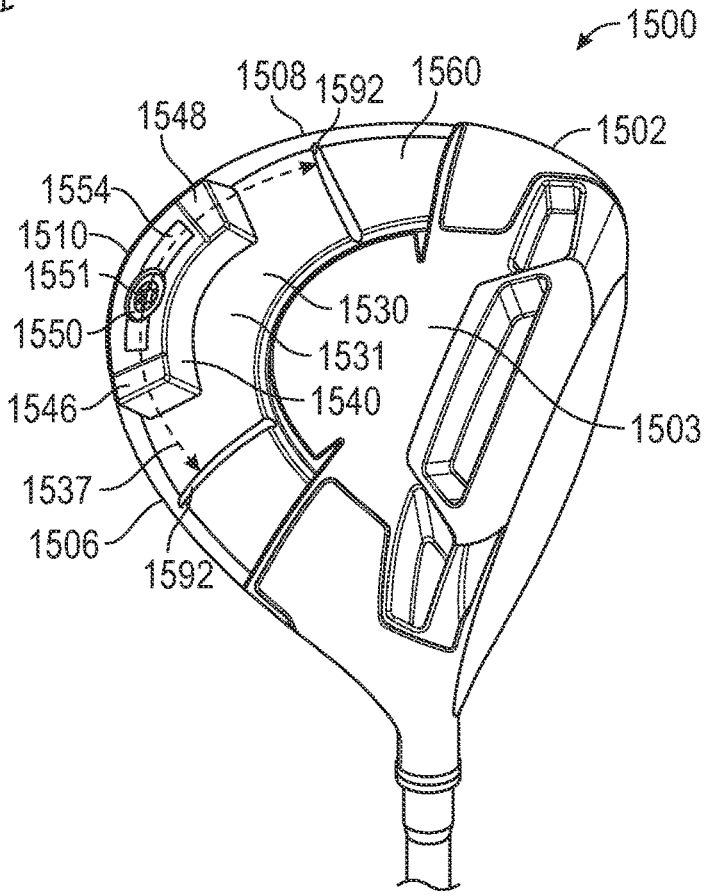
FIG. 28 is a bottom perspective view of another exemplary golf club head disclosed herein.

Exemplary embodiments of the structure of the weight channel 930 are further described herein. As best illustrated in in FIGS. 12A and 13-15B, weight channel 930 may be formed as a curved arc extending in a generally heel-toe direction, which may be bounded by a curved forward edge 932 opposing a curved rearward edge 934. Forward edge 932 may comprise an outer arc of the weight channel 930 that extends at least or (as illustrated) greater than half the width of the golf club head, which the USGA defines in "United States Golf Association and R&A Rules Limited PROCEDURE FOR MEASURING THE CLUB HEAD SIZE OF WOOD CLUBS," USGA-TPX3003, Revision 1.0.0, Nov. 21, 2003, as being measured from the heel of the golf club head to the toe of the golf club head. This length (heel-to-toe) is measured with the head positioned at a 60 degree lie angle. If the outermost point of the heel is not clearly defined, it is deemed to be 0.875 inches above the horizontal plane on which the club is lying. In some embodiments, the forward edge 932 may comprise an outer arc of the weight channel 930 that extends at least or (as illustrated) greater than half the depth of the golf club head, as measured from the face 904 of the golf club head to a trailing edge at the rear end 910 of the golf club head. The weight channel may curve rearwardly away from the face 904 to a heelward end 936 and a toeward end 938, respectively. These ends 936, 938 may be positioned rearward of the forward edge 932 of the weight channel. In certain other embodiments (not shown), the weight channel may extend in a primarily linear direction, such as in a heel-toe direction or in a forward-rearward direction. In still other embodiments, the weight channel may extend in a curved arc along either a toe side or a heel side of the golf club head. While in the examples shown in FIGS. 12-26, the weight channel is shown as being positioned in the forward portion of the golf club head, in other embodiments (as shown in FIGS. 27-28), the weight channel may be positioned in a rearward portion of the golf club head, as further described below.

Figure 13:
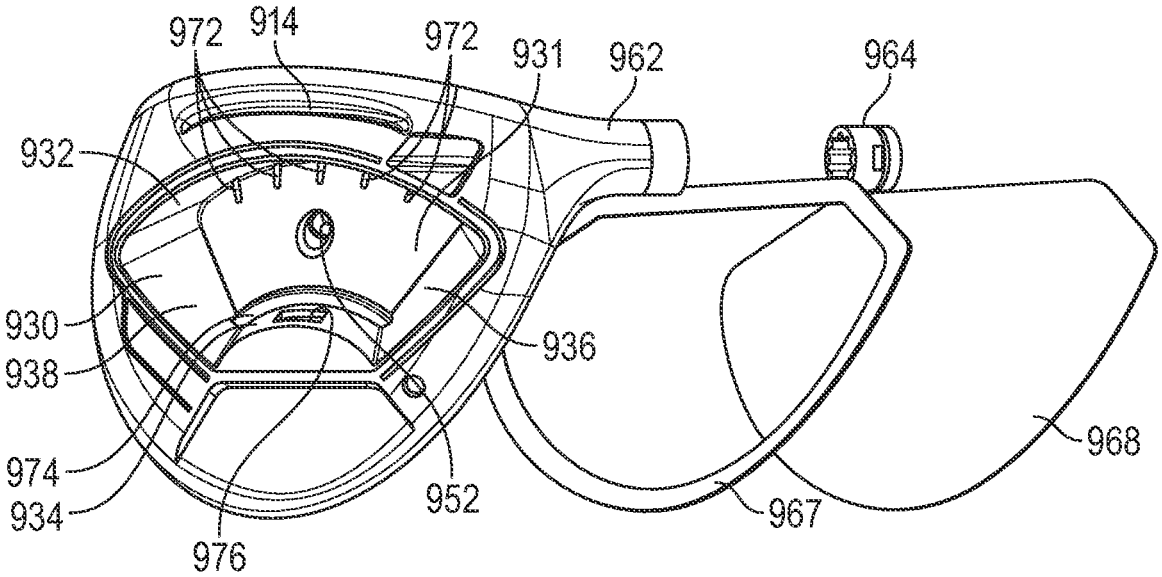
FIG. 13 is an exploded perspective view of the golf club head of FIG. 12A, with a weight member removed.

The rearward edge 134 of the weight channel may drop down to a lower channel surface 931 that is raised up from the sole of the golf club. Lower channel surface 931 may be substantially parallel to, or as illustrated, slightly angled away from the sole 903 of the golf club head, so that the weight channel 930 may be deeper at the forward edge 932 than it is at the rearward edge 934. As illustrated in FIG. 20, one or more cantilevered ribs or struts 992 may be provided within the interior cavity 922 of the golf club head on the underside of the weight channel 930 to support and provide rigidity to the weight channel 930. As illustrated in FIG. 13, projections (such as parallel ribbed projections 972 may be provided on the lower channel surface 931 of the weight channel 930, such as at the forward edge 932, to interact with corresponding ribbed weight projections 982 on a mating surface of the weight member 940 to better hold the weight member 940 in a desired position when a fastener 950 is tightened to secure the weight member 940. A rear weight channel ledge 974 may protrude up and out from the lower channel surface 931 and run parallel to the rearward edge 934 of the weight channel 930, to engage a corresponding recessed ledge portion 984 on a surface of the weight member 940, as further described below. Additionally, an indentation 976 may be formed within the rearward edge 934 of the weight channel 930 and configured for at least partially containing a material for damping the weight member 940. One example of such a material would be a layer of compressible foam, such as PORON® foam, though other materials, such as or a SORBOTHANE®, or PORON®, polyurethane foam material, thermoplastic elastomer or other appropriate damping materials may be used.

In certain embodiments, this compressible material may comprise an elastically compressible material that can be compressed down to, e.g., less than 90% of its original uncompressed thickness, down to less than 50% of its original uncompressed thickness, down to less than 20% of its original uncompressed thickness, or, in particular embodiments, down to less than 10% of its original uncompressed thickness, while typically being able to rebound substantially to its uncompressed thickness upon removal of a compression force. In some embodiments, the material may be compressed down to less than 50% of its original uncompressed thickness when a compression force is applied and rebound to more than 90% of its original uncompressed thickness upon removal of the compression force.

The following table provides examples A-I showing an example initial uncompressed material depth, a final compressed material depth, the delta between the uncompressed and compressed material depths, and the percent the material was compressed. In this example, an uncompressed depth of 1.5 mm is used, however this is purely an example and several other depths could be used for the compressible material within indentation 976, ranging from about 0.25 mm to about 5 mm, preferably from about 0.5 mm to about 3.5 mm, more preferably from about 0.8 mm to about 2.0 mm depending on the application.

TABLE 7

| Example | Un-compressed Height (mm) | Compressed Height (mm) | Delta (mm) | Percent Change |
|---|---|---|---|---|
| A | 1.5 | 0.15 | 1.35 | −90% |
| B | 1.5 | 0.3 | 1.2 | −80% |
| C | 1.5 | 0.45 | 1.05 | −70% |

TABLE 7-continued

| Example | Un-compressed Height (mm) | Compressed Height (mm) | Delta (mm) | Percent Change |
|---|---|---|---|---|
| D | 1.5 | 0.6 | 0.9 | −60% |
| E | 1.5 | 0.75 | 0.75 | −50% |
| F | 1.5 | 0.9 | 0.6 | −40% |
| G | 1.5 | 1.05 | 0.45 | −30% |
| H | 1.5 | 1.2 | 0.3 | −20% |
| I | 1.5 | 1.35 | 0.15 | −10% |

The percent the material is compressed is calculated by subtracting the initial uncompressed thickness from the final compressed thickness, dividing the result by the initial uncompressed shim thickness, and finally multiplying by 100 percent. See Equation 9 below for further clarification. The equation yields a negative percent change because the shim is being compressed i.e. the final thickness is less than the uncompressed shim thickness.

$$\text{Percent Change}=100\%*(T_{final}-T_{initial})/T_{initial} \quad (9)$$

Additionally or alternatively, the percent change could also be expressed as an absolute percent change along with the word compression or tension to indicate the sign. In tensions the sign is positive and in compression the sign is negative. For example, a material that is compressed at least 10% is the same as a shim that has a percent change of at least −10%.

Additional disclosure regarding the use of compressible material is provided in U.S. Pat. No. 9,868,036, issued on Jan. 16, 2018, the entire contents of which are incorporated herein by reference.

Within lower channel surface 931 is positioned a fastener port 952. The fastener port 952 may be configured to receive a fastener 950. As such, fastener port 952 may be threaded so that fastener 950 can be loosened or tightened either to allow movement of, or to secure in position, weight member 940, as further described herein. The fastener may comprise a head 951 with which a tool (not shown) may be used to tighten or loosen the fastener, and a fastener body 953 that may, e.g., be threaded to interact with corresponding threads on the fastener port 952 to facilitate tightening or loosening the fastener 950. The fastener port 952 can have any of a number of various configurations to receive and/or retain any of a number of fasteners, which may comprise simple threaded fasteners, such as described below, or which may comprise removable weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein. As illustrated in FIG. 19B, fastener port 952 may be angled diagonally so that the fastener 950 is angled away from the front end 904 of the golf club head, and the fastener port is forward of a head 951 of the fastener, which may provide a more secure attachment by "sandwiching" the portion of the weight member 940 likely to have the greatest mass between the forward edge 932 of the weight channel 930 and the fastener 950.

Figure 15A:
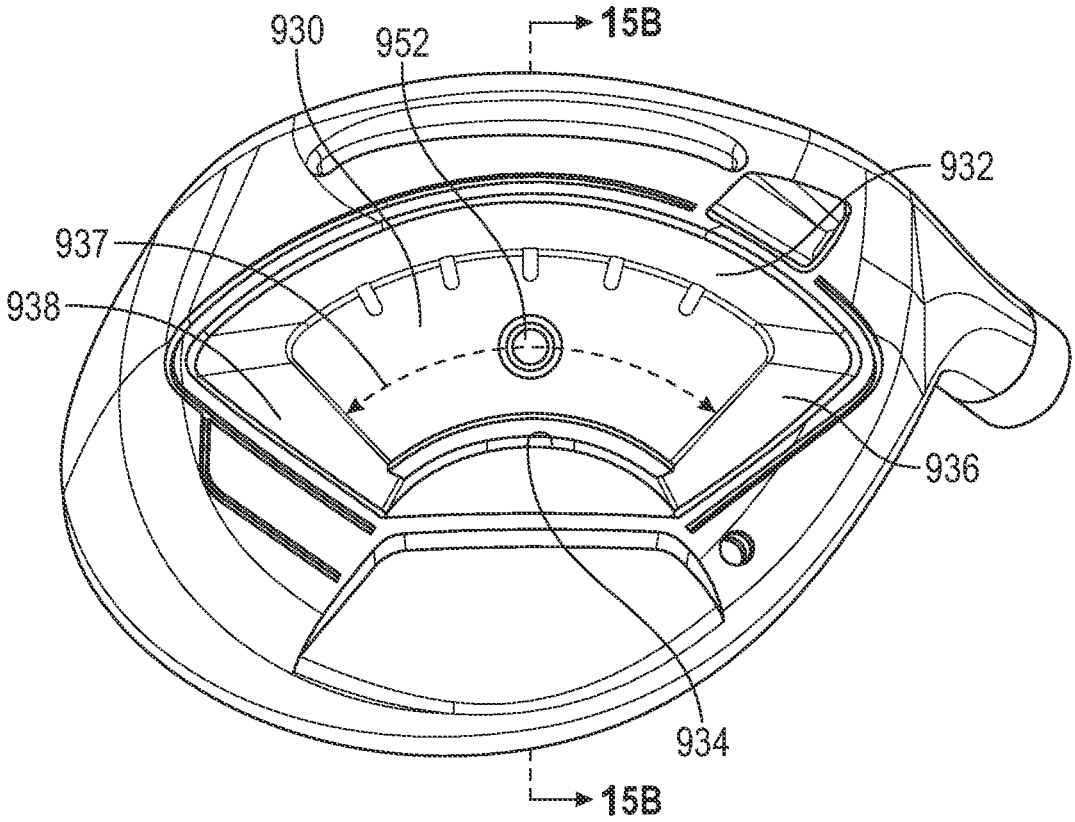
FIG. 15A is a bottom view of the golf club head of FIG. 11, with a weight member removed.
Figure 15B:
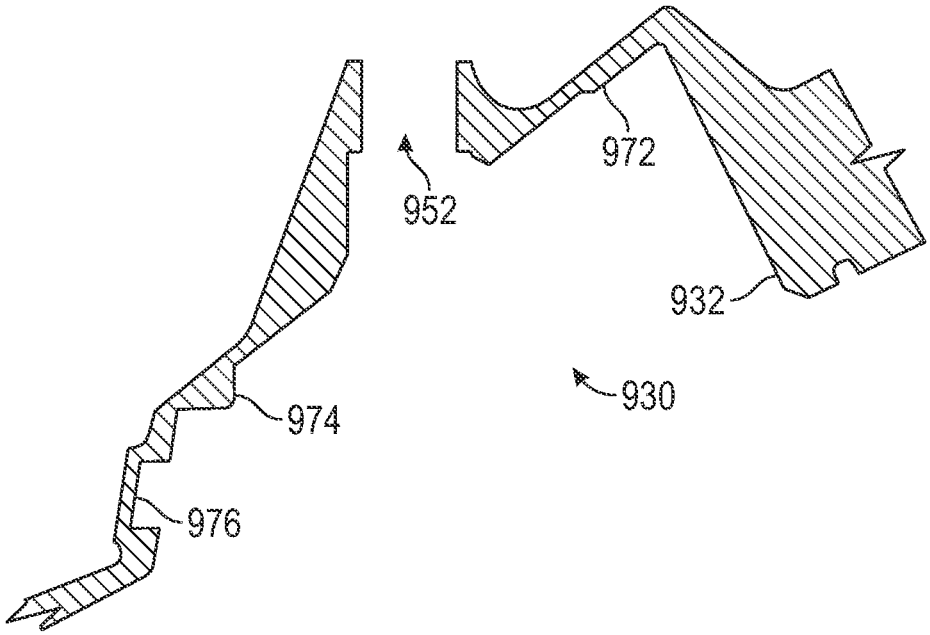
FIG. 15B is a cross-sectional view of a weight channel in the golf club head of FIG. 15A, taken along line 15B-15B in FIG. 15A.
Figure 16:
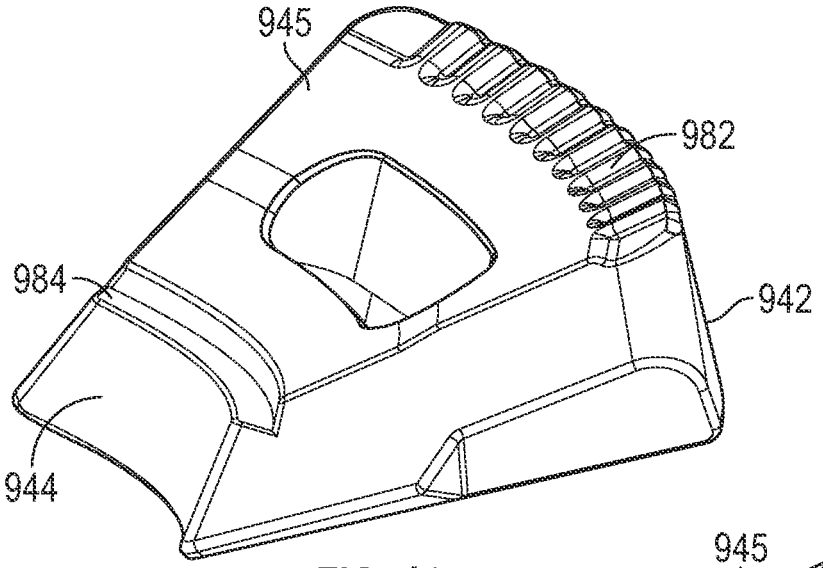
FIG. 16 is a perspective view of a weight member that may be used with the golf club heads of this disclosure.
Figure 17:
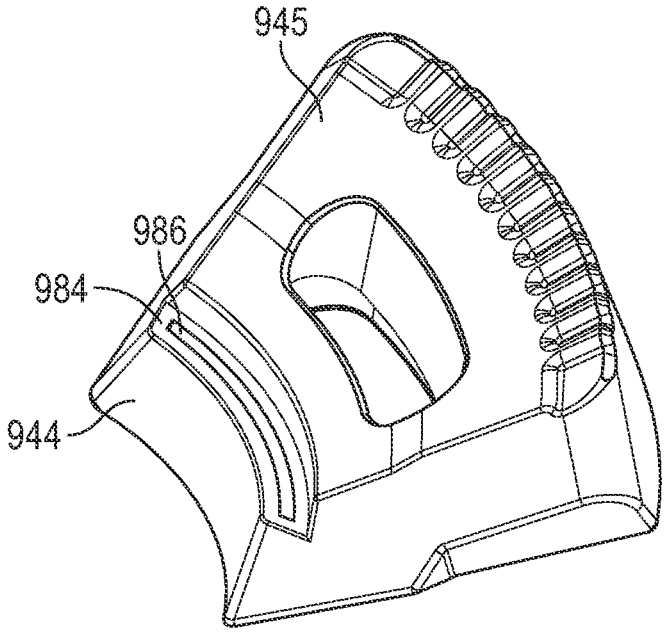
FIG. 17 is a perspective view of another weight member that may be used with the golf club heads of this disclosure.
Figure 19A:
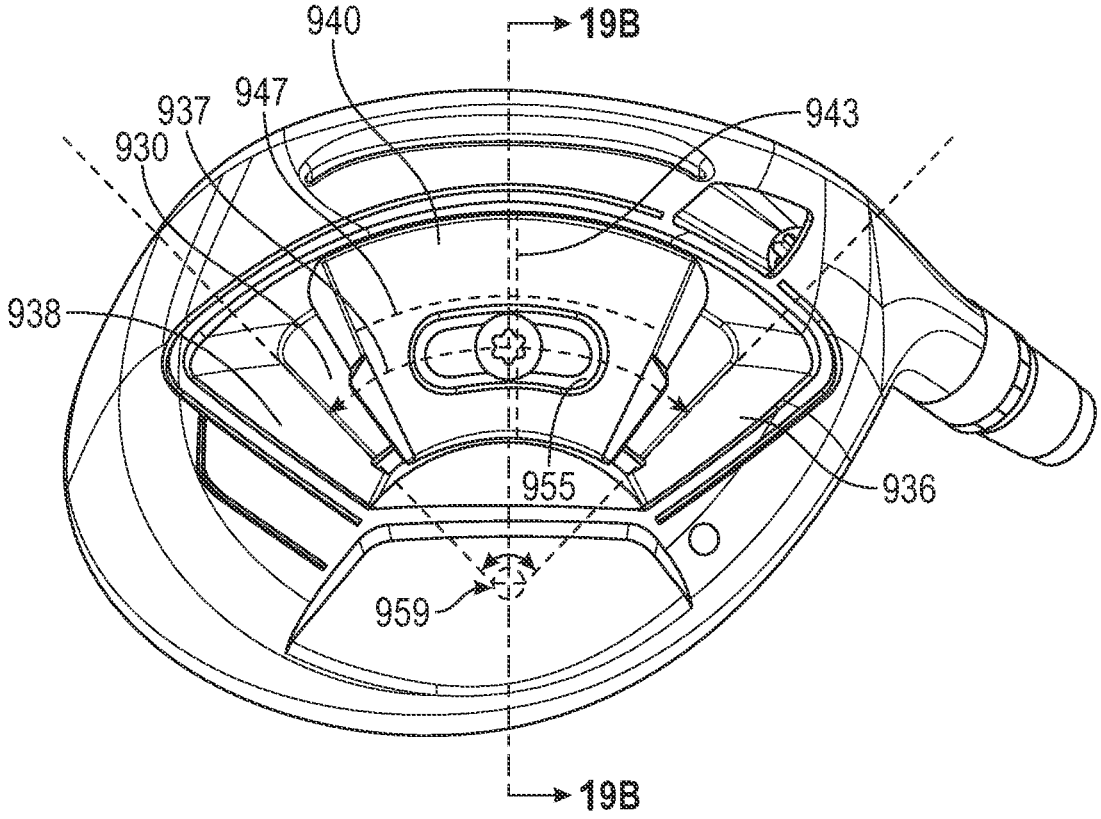
FIG. 19A is a bottom view of the golf club head of FIG. 11A.
Figure 19B:
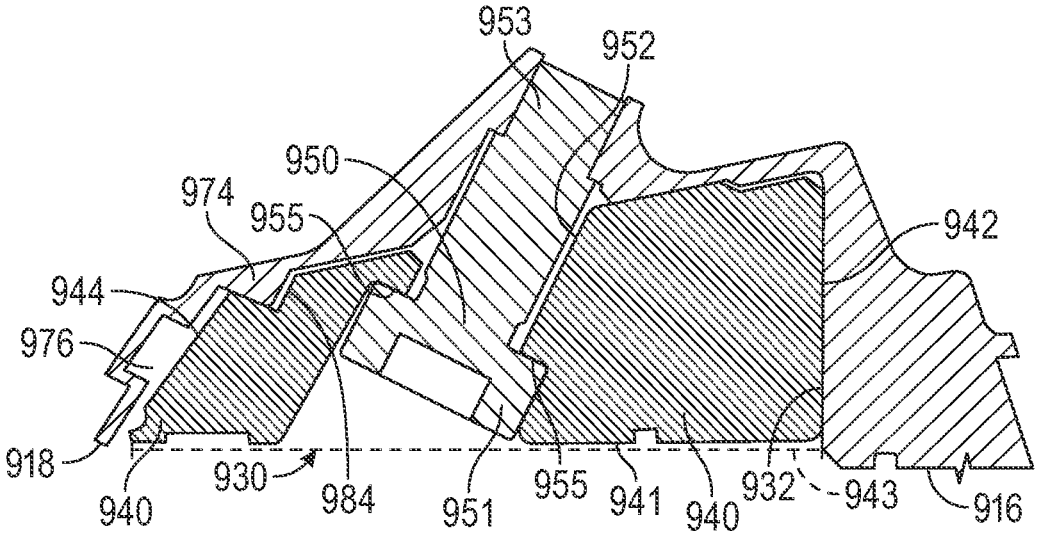
FIG. 19B is a cross-sectional view of a weight member, weight channel, and fastener in the golf club head of FIG. 19A, taken along line 19B-19B in FIG. 19A.

As illustrated in FIGS. 15A and 19A, weight channel 930 is configured to define a path 937 for and to at least partially contain an adjustable weight member 940 (best illustrated in FIG. 19A) that is both configured to translate along the path 937 defined by the weight channel 930 and sized to be slidably retained, or at least partially retained, within the footprint of the weight channel 930 by a fastener 950. The path 937 may comprise a path dimension representing a distance of travel for the weight member 940, wherein the distance comprises the distance between a first end of the path proximate to a first end of the channel (e.g., heelward end 936) and a second path end positioned proximate to a second end of the channel (e.g., toeward end 938). Fastener 950 may be removable, and may comprise a screw, bolt, or other suitable device for fastening as described herein and in the incorporated applications. Fastener 950 may extend through an elongated weight slot 954 passing through the body of the weight member 940. Weight slot 954 may extend through weight member 940 from a lower surface 941 of the weight member that is substantially parallel to the sole 903—and may serve as an additional ground contact point when the golf club head is soled—through an upper surface 945 of the weight member that is positioned against the lower channel surface 931 of the weight channel and into a fastener port 952 in the weight channel 930. The weight member 940 is positioned within the weight channel 930 and entirely external to the interior cavity 922, and (as illustrated in FIGS. 19A and 19B) has a depth 943 that extends normal to the path 937 between a forward side 942 that may be curved parallel to the forward edge 932 of the weight channel 930 and a rearward side 944 that may be curved parallel to the rearward edge 934 of the weight channel. Additionally, as shown in FIG. 19B, the weight member may have a greater height at the forward side 942 than at a rearward side 944, and may taper down from the forward side 942 to the rearward side 944. In particular cases, the weight member 940 may be configured so that the center of mass is positioned closer to the forward side 942 than to the rearward side 944. Additionally, the weight member may comprise two or more stepped portions, such as a first "higher" step portion nearer the forward side of the weight member having a first height, and a second "lower" step portion adjacent the rearward side having a second height that is smaller than the first height. Additional "steps" may also be used to move from the height at the forward portion to the height at the rearward portion. In the illustrated embodiment, the second stepped portion may comprise a chamfered edge positioned in the upper surface 945 at the rearward side 944 of the weight member, which is configured to form a recessed ledge portion 984 to engage a corresponding rear weight channel ledge 974 on the weight channel 930. As illustrated in FIG. 17, an indentation 986 may be provided within the shelf within which a damping material, such as a polymeric pad (or other suitable material, such as the damping material described above with regard to indentation 976) may be provided to position between the weight member 940 and the body of the golf club head 900, such as between the recessed ledge portion 984 and the rear weight channel ledge 974.

Figure 18:
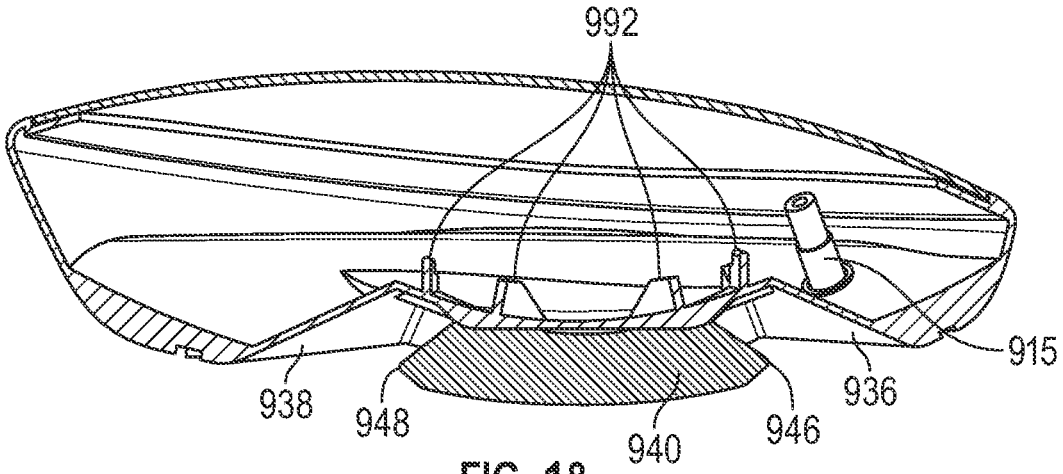
FIG. 18 is a front cross-sectional view of the golf club head of FIG. 11A.

The weight member 940, which may comprise a steel weight member or other suitable material, has a length 947 (as illustrated in FIG. 19A) that extends parallel to the path 937 along which the weight member translates, measured from a heelward end 946 to a toeward end 948 of the weight member 940. While in the illustrated example, length 947 is an arc, length 947 may be measured as either an arc or a straight line, as appropriate to the particular shape of the weight member 940 and the path 937. The length of the weight member 940 in the illustrated example is at least 50 percent of the length of the path 937, and in some instances may be at least 70 percent of the length of the path 937. As shown in FIG. 18, the ends of the weight member may be cantilevered, so that the heelward end 946 and toeward end 948 of an upper portion of the weight member adjacent the lower channel surface 931 of the weight channel are parallel to the heelward end 936 and toeward end 938, respectively, of the weight channel, while the heelward end 946 and toeward end 948 of a lower portion of the weight member that extends from the upper portion of the weight member up towards the sole 903 may be angled away from the heelward end 936 and toeward end 938, respectively, of the weight channel 930. The weight slot 954 may comprise an elongated slot that runs a substantial portion of the length of the weight member parallel to the rearward edge 944 of the weight member 940 from a heelward end 956 to a toeward end 958. The weight slot may further comprise an interior fastener ledge 955 to support the head 951 of a fastener 950. When tightened, the fastener 950 retains the weight member 940 in place. When fastener 950 is loosened, the fastener may be configured to remain stationary relative to the fastener port 952, while the position of the weight member 940 may be adjusted.

In the illustrated example shown in FIG. 19A, weight member 940 may be translated laterally along the path 937 in a heelward or toeward direction to adjust, for example, golf club center of gravity movement along an x-axis (CGx), such as to control left or right tendency of a golf swing. Adjusting the weight member from a first position that is closer to a heelward end 936 of the weight channel 930 to a second position that is closer to a toeward end 938 of the weight channel may provide a CGx movement of at least 3 mm. In particular instances, CGx movement may exceed 4 mm, or in even more specific instances, CGx movement may exceed 5 mm. It is to be understood that in the illustrated embodiment, the weight is moving along the path 937 in an arc about a center axis of curvature 959 (illustrated in FIG. 19A), which is situated rearward of the golf club head's face 904. In particular cases, the center axis of curvature may be positioned rearward of the weight channel 930 itself, and in some instances, the center axis of curvature 959 may be rearward of a center of gravity of the golf club head. In the illustrated embodiment, the weight member is configured to move around the center axis of curvature 959 in an arc of less than 180 degrees, but may in particular embodiments move in an arc of less than 90 degrees, such as in an arc of between 5 degrees and 90 degrees, or between 10 degrees and 30 degrees, or between 15 degrees and 45 degrees, or may not move in an arc at all, but simply translate linearly. It is to be understood that in the illustrated embodiment the center axis of curvature 959 is not collocated with the position of the fastener. Ribbed weight projections 982 may be provided on the lower surface 945 of the weight member 940, such as adjacent to the forward edge 942, to interact with corresponding parallel ribbed projections 972 on a mating surface of the weight channel 930 to better hold weight member 940 in any of a number of selectable positions which may be selected by translating weight member 940 heelward or toeward (in the illustrated example) along the path of the weight channel 930 until a desired position is achieved. In some instances, five or more such positions may be provided. In other embodiments, ten or more such positions are provided. Weight member may also be configured with a visual weight position indicator 949 which may be aligned with visual markings 919 on the sole 903 of the golf club head to indicate the relative position of the weight member 940 along the path of the weight channel 930. Once the desired position is achieved, fastener 950 may be tightened to secure the weight member 940 in place. The weight member may have a mass that is between 10 to 80 grams, or in some particular instances, a mass that is above 30 grams, above 40 grams, above 50 grams, or above 60 grams. In certain embodiments, the weight member 940 may comprise at least 25 percent of a total mass of the golf club head 900. In particular cases, the weight member 940 may comprise at least 30 percent of the total mass of the golf club head 900.

As shown in FIG. 13, the golf club head 900 can optionally include a separate crown insert 968 that is secured to the body 902, such as by applying a layer of epoxy adhesive 967 or other securement means, such as bolts, rivets, snap fit, other adhesives, or other joining methods or any combination thereof, to cover a large opening 990 at the top and rear of the body, forming part of the crown 909 of the golf club head. The crown insert 968 covers a substantial portion of the crown's surface area as, for example, at least 30%, at least 40%, at least 50%, at least 60%, at least 70% or at least 80% of the crown's surface area. The crown's outer boundary generally terminates where the crown surface undergoes a significant change in radius of curvature, e.g., near where the crown transitions to the golf club head's sole 903, hosel 962, and front end 904. As described above, and as partially shown in FIG. 20, the crown opening 990 can be formed to have a recessed peripheral ledge or seat 970 to receive the crown insert 968, such that the crown insert is either flush with the adjacent surfaces of the body to provide a smooth seamless outer surface or, alternatively, slightly recessed below the body surfaces. The front of the crown insert 968 can join with a front portion of the crown 909 on the body 902 to form a continuous, arched crown extend forward to the face. The crown insert 968 can comprise any suitable material, and can be attached to the body in any suitable manner, as described in more detail herein.

Figure 23:
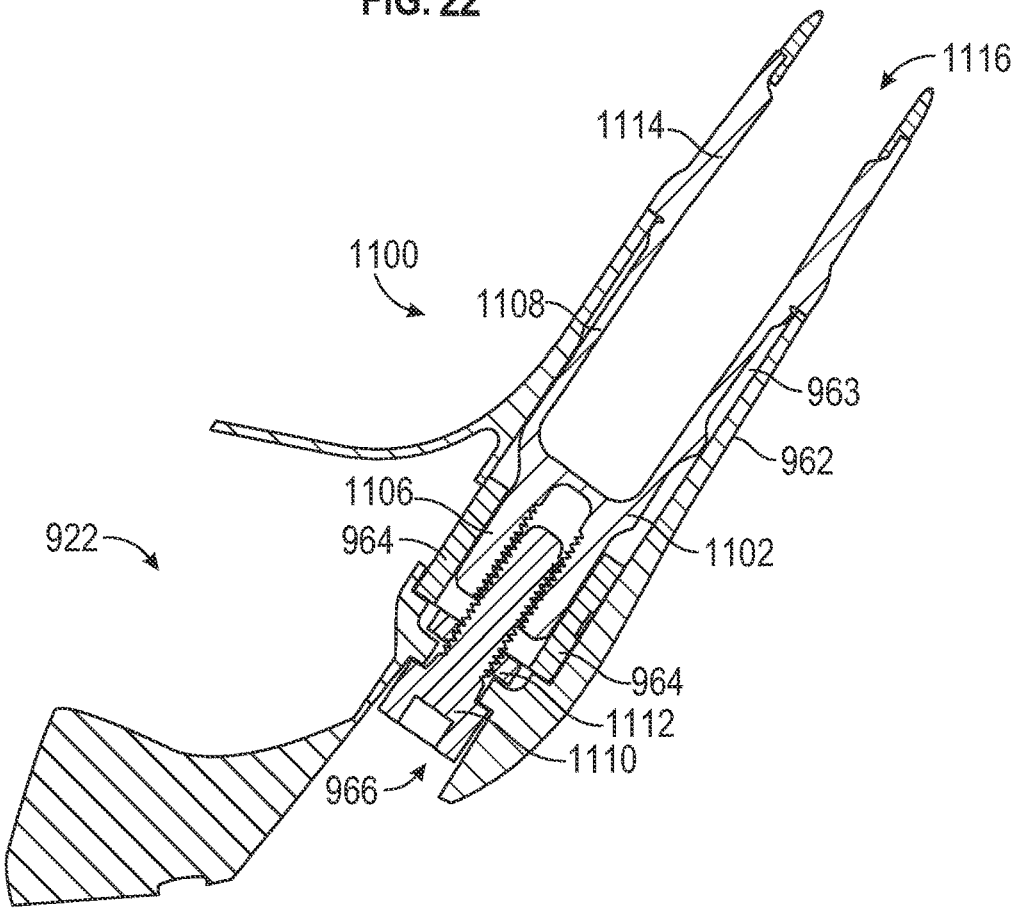
FIG. 23 is a cross-sectional view of an adjustable hosel-shaft assembly of the golf club head of FIG. 11A.

As illustrated in FIG. 23, the golf club head's hosel 962 further provides a shaft connection assembly 1100 that allows the shaft to be easily disconnected from the golf club head, and that may provide the ability for the user to selectively adjust a and/or lie-angle of the golf club. The hosel 962 defines a hosel bore 963, which in turn is adapted to receive a hosel insert 964. The hosel bore 963 is also adapted to receive a shaft sleeve 1102 mounted on the lower end portion of a shaft, as described in U.S. Pat. No. 8,303,431. A recessed port 966 is provided on the sole 903, and extends from the sole 903 into the interior cavity 922 of the body 902 toward the hosel 962, and in particular the hosel bore 963. The hosel bore 963 extends from the hosel 962 through the golf club head and opens within the recessed port 966 at the sole 903 of the golf club head 900.

The golf club head is removably attached to the shaft by shaft sleeve 1102 (which is mounted to the lower end portion of a golf club shaft (not shown)) by inserting the shaft sleeve 1102 into the hosel bore 963 and a hosel insert 964 (which is mounted inside the hosel bore 963), and inserting a screw 1110 (or other suitable fixation device) upwardly through a recessed port 966 in the sole 903 and, in the illustrated embodiment, tightening the screw 1110 into a threaded opening of the shaft sleeve 1102, thereby securing the golf club head to the shaft sleeve 1102. A screw capturing device, such as in the form of an O-ring or washer 1112, can be placed on the shaft of the screw 1110 to retain the screw in place within the golf club head when the screw is loosened to permit removal of the shaft from the golf club head.

Figure 22:
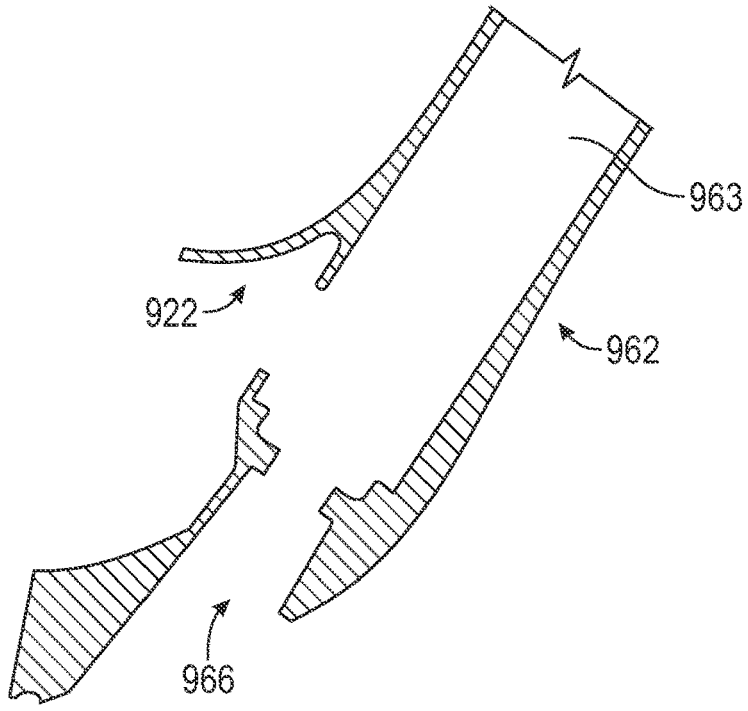
FIG. 22 is a cross-sectional view of a hosel of the golf club head of FIG. 11A.

The recessed port 966 extends from the bottom portion of the golf club head into the interior of the outer shell toward the top portion of the golf club head 1000 at the location of hosel 962, as seen in FIGS. 22 and 23. In the embodiment shown in FIG. 12A, the mouth of the recessed port 966 in the sole 903 is generally trapezoidal-shaped, although the shape and size of the recessed port 966 may be different in alternative embodiments.

The shaft sleeve 1102 has a lower portion 1106 including splines that mate with mating splines of the hosel insert 964, an intermediate portion 1108 and an upper head portion 1114. The intermediate portion 1108 and the upper head portion 1114 define an internal bore 1116 for receiving the tip end portion of the shaft 1100. In the illustrated embodiment, the intermediate portion 1108 of the shaft sleeve has a cylindrical external surface that is concentric with the inner cylindrical surface of the hosel bore 963. As described in more detail in U.S. Patent Application Pub. No. 2010/0197424, which is hereby incorporated by reference, inserting the shaft sleeve 1102 at different angular positions relative to the hosel insert 964 is effective to adjust the shaft loft and/or the lie angle. For example, the loft angle may be increased or decreased by various degrees, depending on the angular position, such as +/−1.5 degrees, +/−2.0 degrees, or +/−2.5 degrees. Other loft angle adjustments are also possible.

In the embodiment shown, because the intermediate portion 1108 is concentric with the hosel bore 963, the outer surface of the intermediate portion 1108 can contact the adjacent surface of the hosel bore 963, as depicted in FIG. 23. This allows easier alignment of the mating features of the assembly during installation of the shaft and further improves the manufacturing process and efficiency.

In certain embodiments, the golf club head may be attached to the shaft via a removable head-shaft connection assembly as described in more detail in U.S. Pat. No. 8,303,431, the entire contents of which are incorporated by reference herein in their entirety. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. Nos. 8,025,587; 8,235,831; 8,337,319; 8,758,153; 8,398,503; 8,876,622; 8,496,541; and 9,033,821, the entire contents of which are incorporated in their entirety by reference herein.

Additional Embodiments and Features

Figure 24:
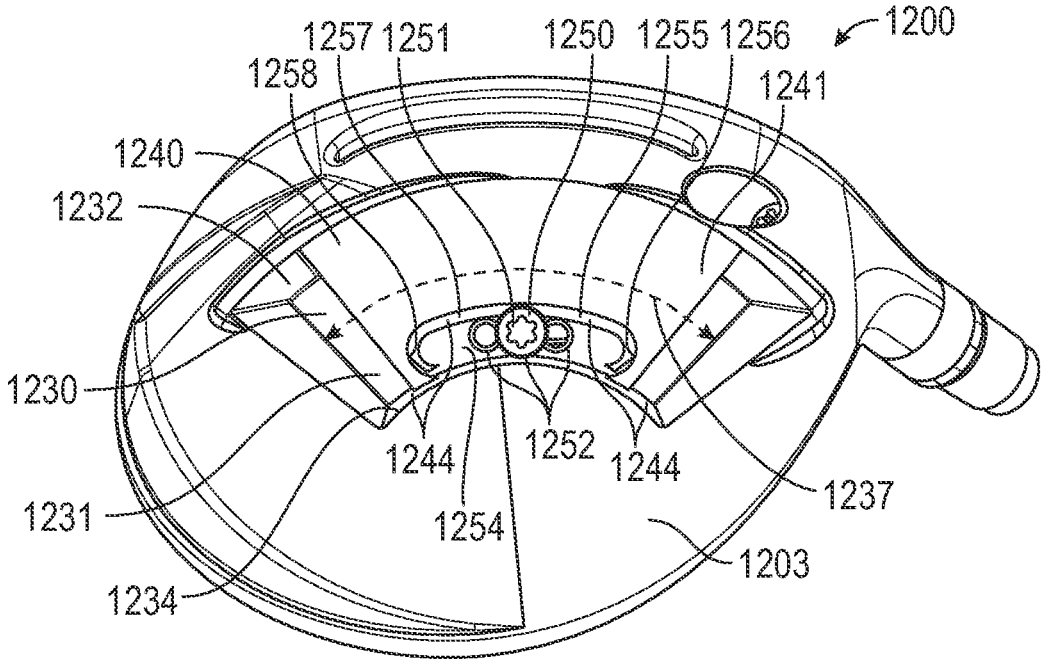
FIG. 24 is a bottom view of another exemplary golf club head disclosed herein.
Figure 25:
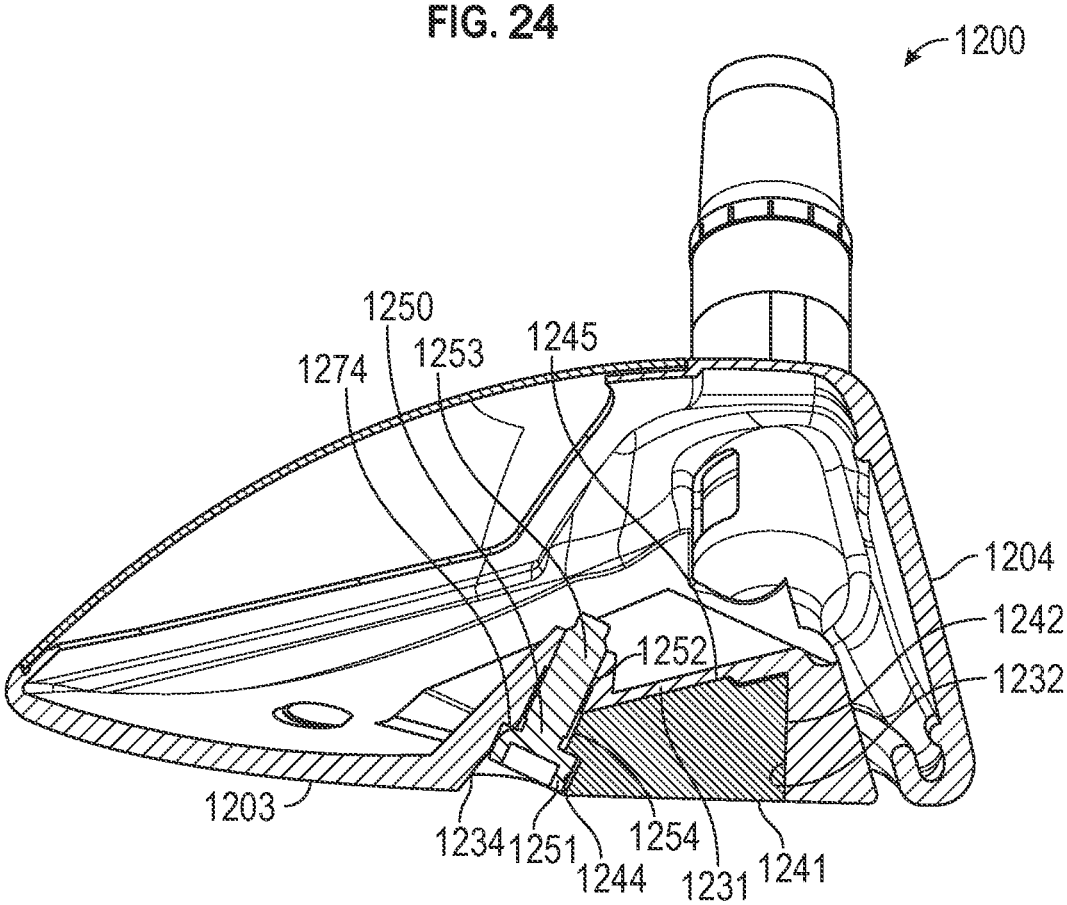
FIG. 25 is a toe-side cross-sectional view of the golf club head of FIG. 24.

FIGS. 24-25 illustrate another exemplary golf club head 1200 that embodies certain inventive technologies disclosed herein. The golf club head 1200 is similar to golf club head, 900. In golf club head 1200, weight channel 1230 may contain features similar to weight channel 930, and may be formed as a curved arc extending in a generally heel-toe direction. Weight channel 1230 may comprise a lower channel surface 1231 that may be substantially parallel to, or as illustrated, slightly angled away from a sole 1203 of the golf club head, so that the weight channel 1230 may be deeper at a forward edge 1232 than it is at the rearward edge 1234. Within lower channel surface 1231 are positioned several fastener ports 1252. Each of the fastener port may be configured to receive a fastener 1250. As such, fastener ports 1252 may be threaded so that one or more fasteners 1250 secured therein can be loosened or tightened either to allow movement of, or to secure in position a weight member 1240, as further described herein. The fastener may comprise a head 1251 with which a tool (not shown) may be used to tighten or loosen the fastener 1250, and a fastener body 1253 that may, e.g., be threaded to interact with corresponding threads on the fastener port 1252 to facilitate tightening or loosening the fastener 1250. The fastener port 1252 can have any of a number of various configurations to receive and/or retain any of a number of fasteners, which may comprise simple threaded fasteners, as described above, or any of the fastener types described in the incorporated patents and/or applications. As illustrated in FIG. 25, fastener port 1252 may be angled diagonally so that the head 1251 of fastener 1250 is angled away from the front end 1204 of the golf club head, and the fastener port 1252 is forward of the head 1251 of the fastener.

Similar to weight channel 930, weight channel 1230 is configured to define a path 1237 for and to at least partially contain adjustable weight member 1240 that is both configured to translate along the path 1237 and sized to be slidably retained, or at least partially retained, within the footprint of the weight channel 1230 by fastener 1250. Fastener 1250 may be removable, and may comprise a screw, bolt, or other suitable device for fastening as described herein and in the incorporated applications. Fastener may be moved between or among the fastener ports 1252 to further adjust mass properties of the golf club head 1200. Fastener 1250 may extend through an elongated weight slot 1254 passing through the body of the weight member 1240. Weight slot 1254 may extend through weight member 1240 from a lower surface 1241 of the weight member that is substantially parallel to the sole 1203—and may serve as an additional ground contact point when the golf club head is soled—through an upper surface 1245 of the weight member that is positioned against the lower channel surface 1231 of the weight channel and into a fastener port 1252 in the weight channel 1230. The weight member 1240 is positioned within the weight channel 1230 and may have a greater height at a forward side 1242 than at a rearward side 1244, and may taper down from the forward side 1242 to the rearward side 1244. In particular cases, the weight member 1240 may be configured so that the center of mass is positioned closer to the forward side 1242 than to the rearward side 1244. In the illustrated example, this is aided by the fact that the weight slot 1254 and fastener 1250 are positioned at the rearward side 1244 of the weight member, such that the rearward side 1244 of the weight member at least partially surrounds weight slot 1254. The weight slot may further comprise an interior fastener ledge 1255 to support the head 1251 of fastener 1250. In the illustrated example, this fastener ledge is coextensive with much of the rearward side 1244 of the weight member 1240, and the rearward side of the weight member curves around to bound the fastener 1250 at a forward edge 1257, at a heelward end 1256, and at a toeward end 1258 of the weight slot 1254. In the illustrated example, the rearward edge 1234 of weight channel 1230 bounds the fastener 1250 to the rear, and may comprise a ledge 1274 (as shown in FIG. 25) that protrudes up and out behind the fastener port 1252 and runs parallel to the rearward edge 1234 of the weight channel 1230 to further support the head 1251 of the fastener 1250 when tightened. When tightened, the fastener 1250 retains the weight member 1240 in place. Once fastener 1250 is loosened, the fastener is configured to remain stationary relative to the fastener port 1252, while the position of the weight member 1240 may be adjusted relative to the fastener port. In the illustrated example shown in FIG. 24, weight member 1240 may be translated laterally along the path 1237 in a heelward or toeward direction to adjust, for example, golf club center of gravity movement along an x-axis (CGx), such as to control left or right tendency of a golf swing.

Figure 26:
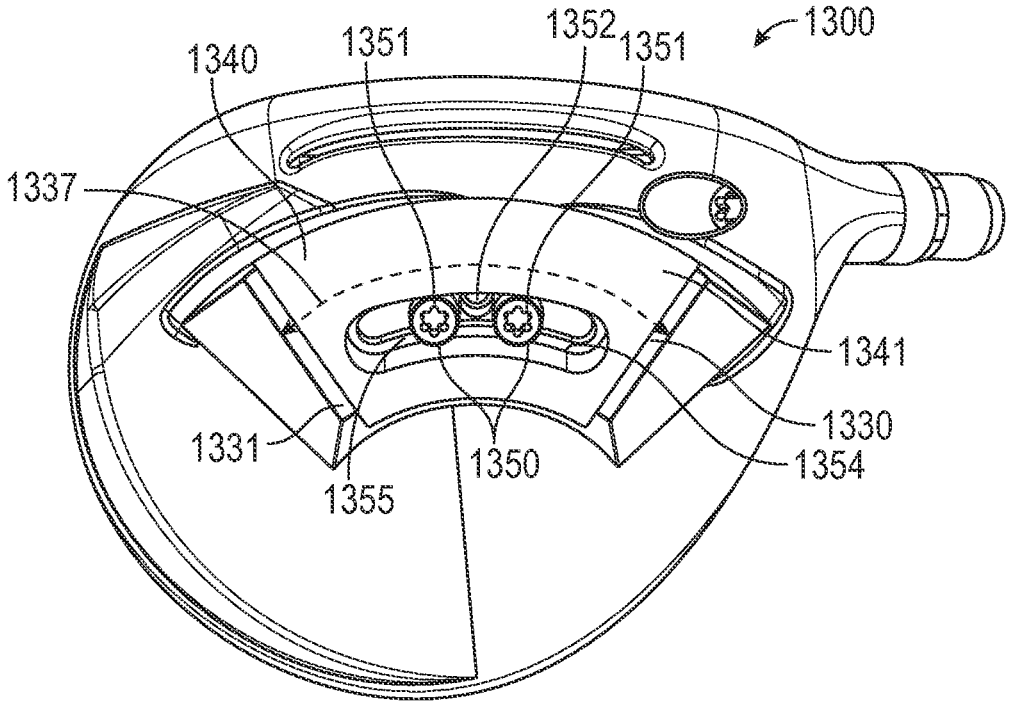
FIG. 26 is a bottom view of another exemplary golf club head disclosed herein.

FIG. 26 illustrates another exemplary golf club head 1300 that embodies certain inventive technologies disclosed herein. The golf club head 1300 is similar to golf club head 900. In golf club head 1300, weight channel 1330 may contain features similar to weight channel 930, and may be formed as a curved arc extending in a generally heel-toe direction. Within a lower channel surface 1331 are positioned several fastener ports 1352. Each of the fastener port may be configured to receive a fastener 1350, or, as in the illustrated embodiment, multiple such fasteners. As such, fastener ports 1352 may be threaded so that fasteners 1350 can be loosened or tightened either to allow movement of, or to secure in position a weight member 1340, as further described herein. The fasteners may each comprise a head 1351 with which a tool (not shown) may be used to tighten or loosen the fastener, and a fastener body (not shown) that may, e.g., be threaded to interact with corresponding threads on the fastener port 1352 to facilitate tightening or loosening the fasteners 1350. The fastener port 1352 can have any of a number of various configurations to receive and/or retain any of a number of fasteners, which may comprise simple threaded fasteners, as described above, or any of the fastener types described in the incorporated patents and/or applications. Similar to weight channel 930, weight channel 1330 is configured to define a path 1337 for and to at least partially contain adjustable weight member 1340 that is both configured to translate along the path 1337 and sized to be slidably retained, or at least partially retained, within the footprint of the weight channel 1330 by fastener 1350. Fasteners 1350 may be removable, and may comprise screws, bolts, or other suitable devices for fastening as described herein and in the incorporated applications. Fasteners may be moved between or among the fastener ports 1352 to further adjust mass properties of the golf club head 1300. Fasteners 1350 may extend through an elongated weight slot 1354 passing through the body of the weight member 1340. Weight slot 1354 may extend through weight member 1340 from a lower surface 1341 of the weight member that is substantially parallel to the sole 1303—and may serve as an additional ground contact point when the golf club head is soled—through an upper surface of the weight member (not shown) that is positioned against the lower channel surface 1331 of the weight channel and into a fastener port 1352 in the weight channel 1330. The weight slot may further comprise an interior fastener ledge 1355 to support the head 1351 of fastener 1350. When tightened, fasteners 1350 retain the weight member 1340 in place. When fasteners 1350 are loosened, the fasteners may be configured to remain stationary relative to their respective fastener ports 1352, while the position of the weight member 1340 may be adjusted. In the illustrated example, weight member 1340 may be translated laterally along the path 1337 in a heelward or toeward direction to adjust, for example, golf club center of gravity movement along an x-axis (CGx), such as to control left or right tendency of a golf swing.

FIG. 27 illustrates another exemplary golf club head 1400 that embodies certain inventive technologies disclosed herein. The golf club head 1400 is similar to golf club head, 900, though one difference is that in golf club head 1400, weight channel 1430 is positioned within a raised sole portion 1460 at the rear end 1410 of the golf club head 1400, and curves forward at the ends towards the front end 1404 of the golf club head. Weight channel 1430 and weight member 1440 may contain features similar to weight channel 930 and weight member 940. In the illustrated example, however, weight channel extends around the rear end 1410 of the golf club head 1400, from a position around a periphery of the golf club head situated on the toe side 1408 to a position on the heel side 1406. Weight channel 1430 may comprise a lower channel surface 1431 that may be substantially parallel to or slightly angled away from a sole 1403 of the golf club head, and may be coextensive, raised up from, or lowered from a raised sole portion 1460 at the rear end 1410 of the golf club head. Additionally, the weight channel 1430 may extend around an entire length of the raised sole portion 1460, as illustrated, or may in some embodiments comprise only a portion of a length of the raised sole portion 1460. Within lower channel surface 1431 is positioned at least one fastener port (not shown)—which may be similar to the fastener ports described herein and in the incorporated patents and/or applications—that may be configured to receive a fastener 1450. The fastener may comprise a head 1451 with which a tool (not shown) may be used to tighten or loosen the fastener, and a fastener body (not shown) that may, e.g., be threaded to interact with corresponding threads on the fastener port to facilitate tightening or loosening the fastener 1450.

Similar to weight channel 930, weight channel 1430 is configured to define a path 1437 for and to at least partially contain adjustable weight member 1440 that is both configured to translate along the path 1437 and sized to be slidably retained, or at least partially retained, within the footprint of the weight channel 1430 by fastener 1450. The path 1437 may run the length of the weight channel 1430, or may, in some embodiments, comprise only a portion of the weight channel 1430. Fastener 1450 may be removable, and may comprise a screw, bolt, or other suitable device for fastening as described herein and in the incorporated applications. Fastener 1450 may extend through an elongated weight slot 1454 passing through the body of the weight member 1440. Weight slot 1454 may extend through weight member 1440 from a lower surface 1441 of the weight member that is substantially parallel to the sole 1403—and may serve as an additional ground contact point when the golf club head is soled—through an upper surface of the weight member (not shown) that is positioned against the lower channel surface 1431 of the weight channel and into the fastener port in the weight channel 1430. The weight slot may further comprise an interior fastener ledge (not shown) to support the head 1451 of fastener 1450. The weight member may have additional discretionary mass positioned proximate to its ends, such as within a first discretionary mass portion positioned at a heelward end 1446 and a second discretionary mass portion positioned at a toeward end 1448. The weight slot may further comprise an interior fastener ledge (not shown) to support the head 1451 of fastener 1450. Alternatively, the lower surface 1441 of the portion of weight member 1440 containing the weight slot may be slightly recessed between heelward end 1446 and toeward end 1448 so that the head 1451 of the fastener 1450 is lower than, or no higher than, or substantially similar in height to the remainder of the lower surface 1441 of the weight member, as described further herein. When tightened, the fastener 1450 retains the weight member 1440 in place. When fastener 1450 is loosened, the fastener may be configured to remain stationary relative to the fastener port 1452, while the position of the weight member 1440 may be adjusted. In the illustrated example, weight member 1440 may be translated laterally along the path 1437 in a heelward or toeward direction to adjust, for example, golf club center of gravity movement along an x-axis (CGx), such as to control left or right tendency of a golf swing.

Weight member 1440 may have a mass that is between 10 to 50 grams, or in some particular instances, a mass that is above 10 grams, or a mass that is below 40 grams, or a mass in the range of 12 to 38 grams.

FIG. 28 illustrates another exemplary golf club head 1500 that embodies certain inventive technologies disclosed herein. The golf club head 1500 is similar to golf club head, 900, though one difference is that in golf club head 1500, weight channel 1530 is positioned within a raised sole portion 1560 at the rear end 1510 of the golf club head 1500, and curves forward at the ends towards the front end 1504 of the golf club head. Weight channel 1530 and weight member 1540 may contain features similar to weight channel 930 and weight member 940. In the illustrated example, however, weight channel extends around the rear end 1510 of the golf club head 1500, from a position around a periphery of the golf club head situated on the toe side 1508 to a position on the heel side 1506. Weight channel 1530 may comprise a lower channel surface 1531 that may be substantially parallel to or slightly angled away from a sole 1503 of the golf club head, and may be coextensive, raised up from, or lowered from a raised sole portion 1560 at the rear end 1510 of the golf club head. Additionally, in the illustrated embodiment, the weight channel 1530 comprises only a portion of a length of the raised sole portion 1560. Raised sole portion 1560 further comprises external ribs 1592 that may be integrally formed with the body 1502 of the golf club head 1500.

Within lower channel surface 1531 is positioned at least one fastener port (not shown)—which may be similar to the fastener ports described herein and in the incorporated patents and/or applications—that may be configured to receive a fastener 1550. The fastener may comprise a head 1551 with which a tool (not shown) may be used to tighten or loosen the fastener, and a fastener body (not shown) that may, e.g., be threaded to interact with corresponding threads on the fastener port to facilitate tightening or loosening the fastener 1550.

Similar to weight channel 930, weight channel 1530 is configured to define a path 1537 for and to at least partially contain adjustable weight member 1540 that is both configured to translate along the path 1537 and sized to be slidably retained, or at least partially retained, within the footprint of the weight channel 1530 by fastener 1550. In the illustrated embodiment, the path 1537 may run the length of the weight channel 1530, or may, in some embodiments, comprise only a portion of the weight channel 1530. Fastener 1550 may be removable, and may comprise a screw, bolt, or other suitable device for fastening as described herein and in the incorporated patents and applications. Fastener 1550 may extend through an elongated weight slot 1554 passing through the body of the weight member 1540. Weight slot 1554 may extend through weight member 1540 from a lower surface 1541 of the weight member that is substantially parallel to the sole 1503—and may serve as an additional ground contact point when the golf club head is soled—through an upper surface of the weight member (not shown) that is positioned against the lower channel surface 1531 of the weight channel and into the fastener port in the weight channel 1530. The weight member may have additional discretionary mass positioned proximate to its ends, such as within a first discretionary mass portion positioned at a heelward end 1546 and a second discretionary mass portion positioned at a toeward end 1548. The weight slot may further comprise an interior fastener ledge (not shown) to support the head 1551 of fastener 1550. Alternatively, the portion of the lower surface 1441 of the portion of weight member 1540 containing the weight slot may be slightly recessed between heelward end 1546 and toeward end 1548 so that the head 1551 of fastener 1550 is lower than, or no higher than, or substantially similar in height to the remainder of the lower surface 1541 of the weight member, as described further herein. When tightened, the fastener 1550 retains the weight member 1540 in place. When fastener 1550 is loosened, the fastener may be configured to remain stationary relative to the fastener port 1552, while the position of the weight member 1540 may be adjusted. In the illustrated example, weight member 1540 may be translated laterally along the path 1537 in a heelward or toeward direction to adjust, for example, golf club center of gravity movement along an x-axis (CGx), such as to control left or right tendency of a golf swing.

Weight member 1540 may have a mass that is between 10 to 50 grams, or in some particular instances, a mass that is above 10 grams, or a mass that is below 40 grams, or a mass in the range of 12 to 38 grams. FIGS. 29-32 illustrate exemplary weight members that may be used with the golf clubs head disclosed herein.

Figure 29:
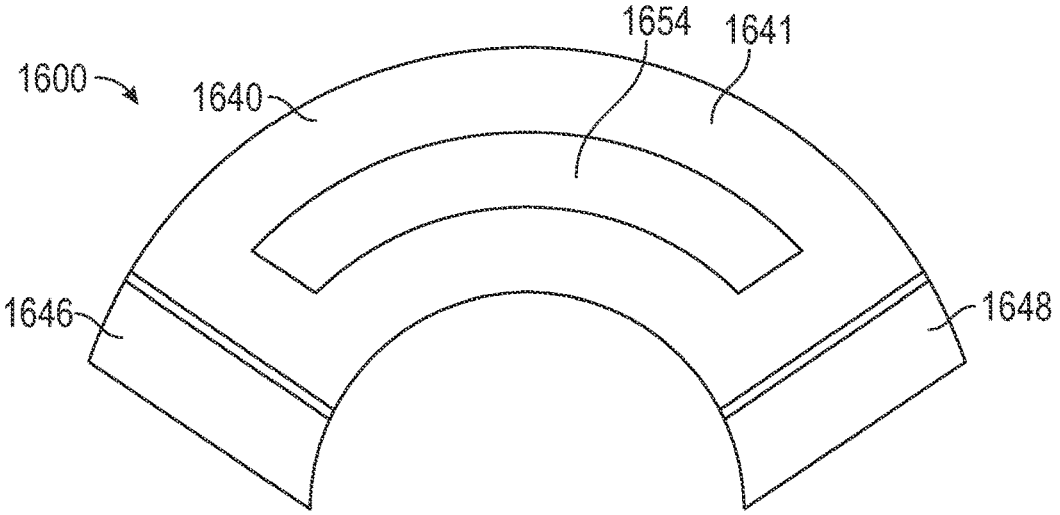
FIG. 29 is a top view of another weight member that may be used with the golf club heads of this disclosure.
Figure 30:
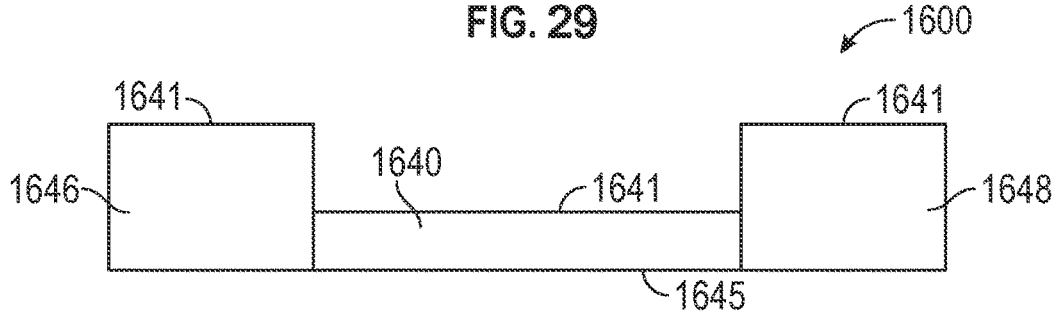
FIG. 30 is an elevational view of the weight member of FIG. 29.

FIGS. 29 and 30 illustrate a weight member 1600 having a curved shape, similar to weight member 1540, above. Weight member 1600 has a middle portion 1640 that contains a curved weight slot 1654. Weight slot 1554 may extend through weight member 1600 from a lower surface 1641 of the weight member that is configured to be substantially parallel to a sole of a golf club head and to serve as an additional ground contact point when the golf club head is soled—through an upper surface 1645 of the weight member 1600 that is configured to be positioned against the body of the golf club head, such as a weight channel or raised sole portion, as described herein. The weight member may have additional discretionary mass positioned proximate to its ends, such as within a first discretionary mass portion positioned at a first end portion 1646 (such as a heelward end portion) and a second discretionary mass portion positioned at a second end portion 1648 (such as a toeward end portion). The weight slot may further comprise an interior fastener ledge (not shown) to support a fastener head. Additionally or alternatively, as illustrated in FIG. 30, the lower surface 1641 of the middle portion 1640 may be slightly recessed up between the first end portion 1646 and the second end portion 1648 so that the head of a fastener inserted through the weight member 1600 is lower than, or no higher than, or substantially similar in height to the lower surface 1641 of the weight member at the first end portion 1646 and the second end portion 1648.

In some embodiments, the weight member 1600 may be formed from a single piece of material, such as by casting, injection molding, machining, or other suitable methods, with first end portion 1646 and the second end portion 1648 formed to have a greater thickness than the middle portion 1640. In other embodiments, additional material, such as additional layers of material, or additional discretionary mass elements may be added to the first end portion 1646 and/or the second end portion 1648 to add additional mass to the ends. In particular embodiments, this may be achieved by welding an additional thickness of mass to the weight member 1600 at one or both of the ends. It is to be understood, however, that additional mass could be added by other methods, such as bolting, adhering, or braising additional mass, or by introducing removable discretionary mass elements, such as described herein.

In some embodiments, weight member 1600 may be formed of a first material, such as titanium. In other embodiments, steel, tungsten or another suitable material or combination of materials may be used. In particular embodiments, higher density materials may be used in certain portions of the weight member 1600 to add additional mass, such as, e.g., at first end portion 1646 and/or second end portion 1648. For example, steel or tungsten or other suitable higher density materials could be used at first end portion 1646 and the second end portion 1648 to add additional discretionary mass to the ends of the weight member 1600 relative to the middle portion 1640, or additional higher density elements, e.g., plates, could be added at first end portion 1646 and/or second end portion 1648 to add additional discretionary mass.

"Split mass" configurations such as those described herein potentially allow for several high MOI positions and allow greater weight to be moved to the outside of the club head while minimizing the overall weight added to the club head. Additionally, providing the added weight along the perimeter of the golf club may have additional benefits for maximizing MOI. And, providing a curved shape weight member, combined with a split mass configuration as described herein also may provide for additional mass to be positioned more forward than in a configuration without a split mass configuration, which provides improved CG projection. Additionally, providing the slidable rear weight as illustrated in FIGS. 27-32 provides the potential for improved CGx movement (which may permit movement to affect, e.g., left/right draw/fade bias), while minimizing CGz movement, and potentially reducing CGy movement versus other traditional weight systems. This may improve overall MOI throughout the range of movement.

Figure 31:
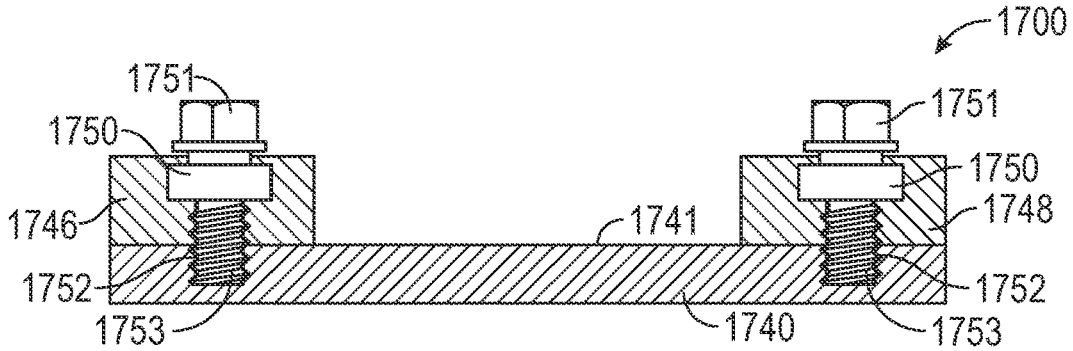
FIG. 31 is a cross-sectional view of another weight member that may be used with the golf club heads of this disclosure.

FIG. 31 illustrates another weight member assembly 1700, which comprises a weight member 1740 that may be similar to weight member 1600, or may alternatively be a linear weight member. Positioned at opposite ends of the weight member 1740 are fastener ports 1752, such as those described herein and/or in the incorporated patents and applications, which may be configured to receive a fastener 1750. The fasteners may be individual movable weights ranging from 1 to 20 grams. The fasteners may have the same mass, or may be different masses. A weight kit may be provided containing weights of varying mass that a user can optionally attach or detach to 1700 and 1800. The fasteners may be used for swing weighting to achieve the targeted swing weight and offset manufacturing tolerance and custom length clubs. Or, the fasteners may help achieve a heavier e.g. D4 or lighter swing weight e.g. D1. One or both of the fasteners may be formed form a higher density material than the central region of the weight member 1740. In some instances, one or both of the fasteners may be formed of the same material as the central region of the weight member 1740. The central region may be formed from a material having a density between 9-20 g/cc (e.g. Tungsten and Tungsten alloys), 7-9 g/cc (e.g. steel and steel alloys), 4-5 g/cc (e.g. Ti and Ti alloys), 2-3 g/cc (e.g. Al and Al alloys), or 1-2 g/cc (e.g. Plastic, Carbon Fiber Reinforced Plastic, Carbon Fiber Reinforced Thermoplastic, Carbon Fiber Reinforced Thermoset), or other suitable materials.

The fastener may comprise a head 1751 with which a tool (not shown) may be used to tighten or loosen the fastener, and a fastener body 1753 that may, e.g., be threaded to interact with corresponding threads on the fastener port 1752 to facilitate tightening or loosening the fastener 1750. Further, fastener 1750 is configured to retain a discretionary mass element between the lower surface 1741 of the weight member 1740 and the head of the fastener 1750, such as first discretionary mass element 1746 positioned at a first end (such as a heelward end) of the weight member 1740 and second discretionary mass element 1748 positioned at a second end (such as a toeward end) of the weight member 1740. Discretionary mass elements 1746 and 1748 may further contain internal apertures, portions of which may be threaded to interact with threads on the fastener body 1753 and other portions which may or may not be threaded and are configured to retain some or all of the fastener head 1751.

In some embodiments, weight member 1700 may be formed of a first material, such as titanium. In other embodiments, steel, tungsten or another suitable material or combination of materials may be used. In particular embodiments, higher density materials may be used in certain portions of the weight member 1700 to add additional mass. For example, steel or tungsten or other suitable higher density materials could be used, e.g., in discretionary mass elements 1746 and 1748 or in fasteners 1750 to add additional discretionary mass to the ends of the weight member 1700.

Figure 32:
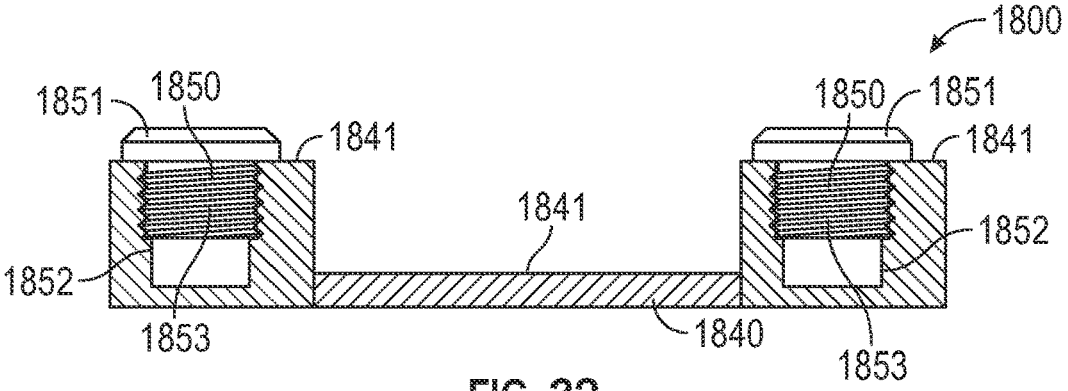
FIG. 32 is a cross-sectional view of another weight member that may be used with the golf club heads of this disclosure.

FIG. 32 illustrates another weight member assembly 1800, which comprises a weight member 1840 that may be similar to weight member 1600, or may alternatively be a linear weight member. Positioned at opposite ends of the weight member 1840 are fastener ports 1852, such as those described herein and/or in the incorporated patents and applications, which may be positioned in the lower surface 1841 of the weight member 1800, and configured to receive a fastener 1850. The fastener may comprise a head 1851 with which a tool (not shown) may be used to tighten or loosen the fastener, and a fastener body 1853 that may, e.g., be threaded to interact with corresponding threads on the fastener ports 1852 to facilitate tightening or loosening the fastener 1850. Fastener 1850 may itself comprise a discretionary mass, as described in the incorporated patents and/or applications, which discretionary mass may be removed and replaced with a heavier or lighter discretionary mass to adjust mass properties of a golf club head, as desired. Portions of fastener port 1852 may be threaded to interact with threads on the fastener body 1853 and other portions may not be threaded and may be configured to retain some or all of the fastener head 1851.

In some embodiments, weight member 1800 may be formed of a first material, such as titanium. In other embodiments, steel, tungsten or another suitable material or combination of materials may be used. In particular embodiments, higher density materials may be used in certain portions of the weight member 1800 to add additional mass. For example, steel or tungsten or other suitable higher density materials could be used, e.g., in fasteners 1850 or for forming them in or adhering them to the ends of the weight member, such as in the manner further described above and in the incorporated patents and applications, to add additional discretionary mass to the ends of the weight member 1800.

Figure 33A:
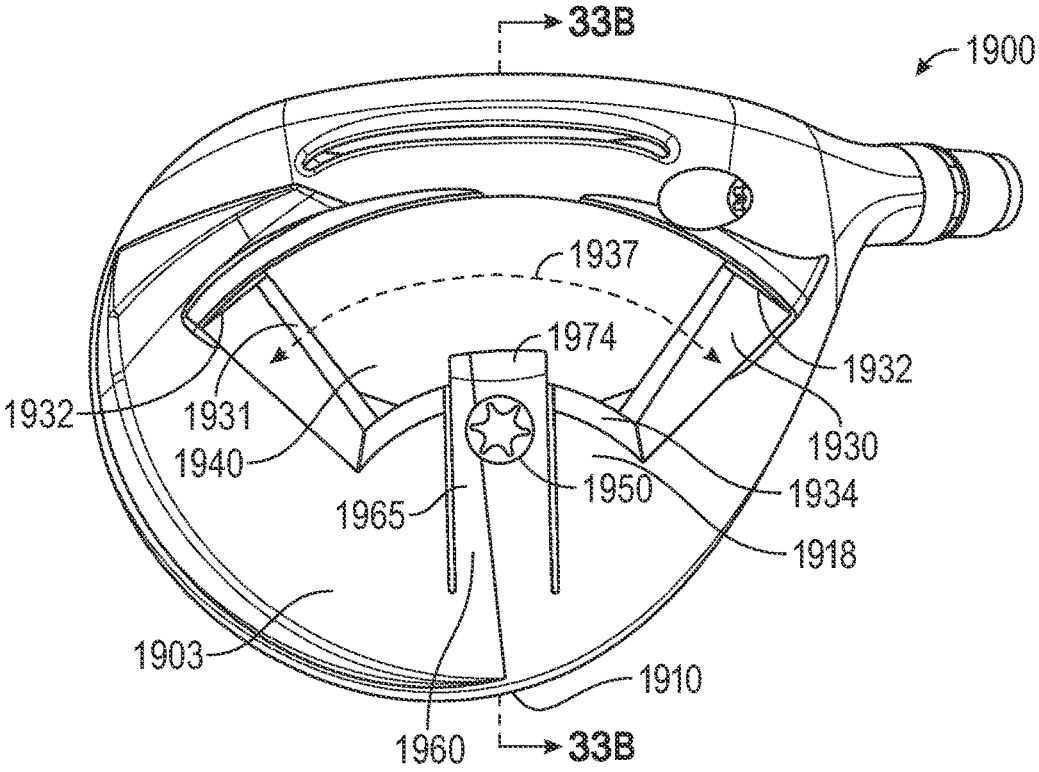
FIG. 33A is a bottom view of another exemplary golf club head disclosed herein.
Figure 33B:
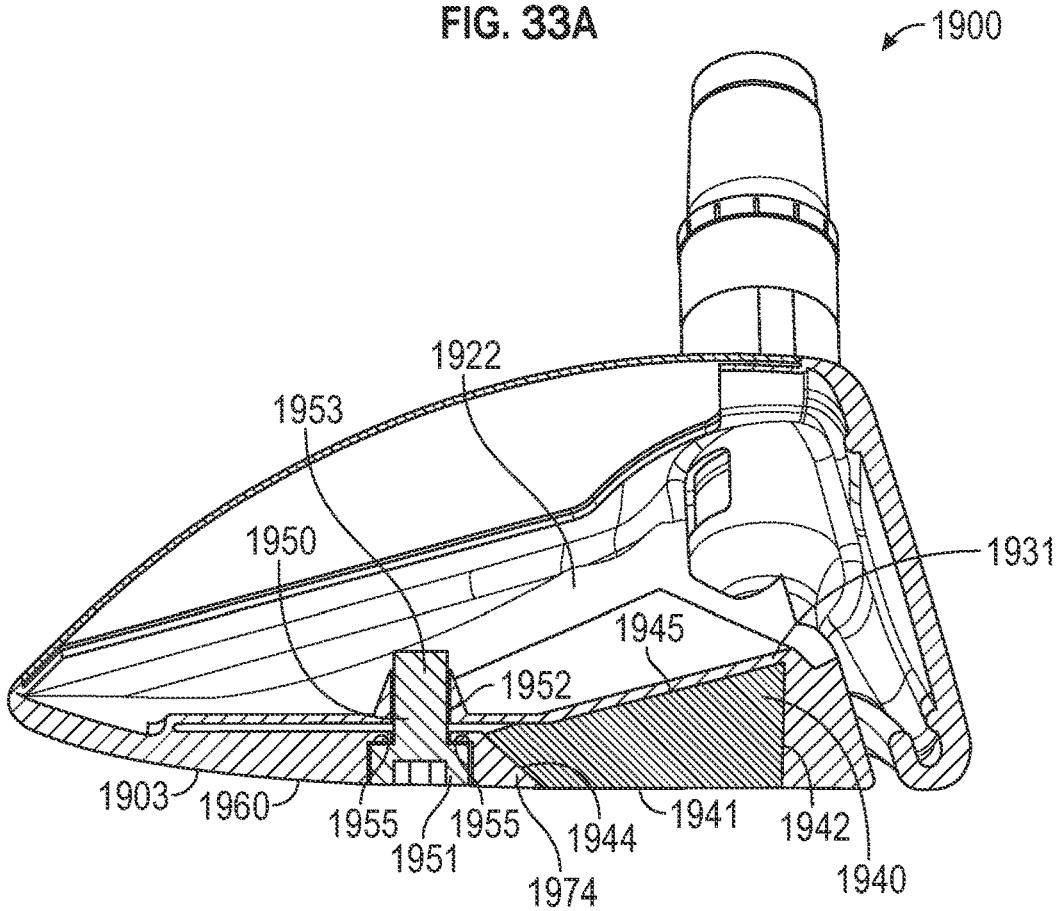
FIG. 33B is a toe-side cross-sectional view of the golf club head of FIG. 33A, taken along line 33B-33B in FIG. 33A.

FIGS. 33A and 33B illustrate another exemplary golf club head 1900 that embodies certain inventive technologies disclosed herein. The golf club head 1900 is similar to golf club head, 1700. In golf club head 1900, weight channel 1930 may contain features similar to weight channel 1730, and may be formed as a curved arc extending in a generally heel-toe direction. Weight channel 1930 may comprise a lower channel surface 1931 that may be substantially parallel to, or as illustrated, slightly angled away from a sole 1903 of the golf club head, so that the weight channel 1930 may be deeper at a forward edge 1932 than it is at a rearward edge 1934.

Similar to weight channel 1730, weight channel 1930 is configured to define a path 1937 for and to at least partially contain adjustable weight member 1940 that is both configured to translate along the path 1937 and sized to be slidably retained, or at least partially retained, within the footprint of the weight channel 1930 by fastener assembly 1960. Unlike the previous examples, which relied on fasteners passing through at least a portion of the weight member, golf club head 1900 comprises a fastener assembly 1960 comprising a fastener tab 1965 that may extend from a rear ground contact surface 1918 proximate to the rear end 1910 of the golf club head to a weight overhang or ledge 1974 that may at least partially cover the weight member 1940, such as its rearward side 1944, as best illustrated in FIG. 33B. Within fastener tab 1965 is positioned one or more fastener ports 1952 (one such port is provided in the illustrated example). Fastener port 1952 may be configured to receive a removable fastener 1950, such as a bolt or screw, or one of the other suitable fasteners described herein or in the incorporated patents and applications. As such, fastener port 1952 may be threaded so that a removable fastener 1950 secured therein can be loosened or tightened either to allow movement of, or to secure weight member 1940 in position, as further described herein. The fastener may comprise a head 1951 with which a tool (not shown) may be used to tighten or loosen the removable fastener 1950, and a fastener body 1953 that may, e.g., be threaded to interact with corresponding threads on the fastener port 1952 to facilitate tightening or loosening the removable fastener 1950. The fastener port 1952 can have any of a number of various configurations to receive and/or retain any of a number of fasteners, which may comprise simple threaded fasteners, as described above, or any of the fastener types described in the incorporated patents and/or applications. The fastener port may further comprise an interior fastener port ledge 1955 to support the head 1951 of fastener 1950, which may be at least partially recessed within the fastener port 1952, and which in the illustrated example is substantially parallel to rear ground contact surface 1918.

As illustrated in FIG. 33B, fastener port 1952 is positioned entirely outside of the weight channel 1930 and extends from the sole 1903 into the body of the golf club head 1900. In some embodiments, the fastener port 1952 may extend into an interior cavity 1122 of the golf club head 1900. Additionally, the weight member may have a greater height at the forward side 1142 than at the rearward side 1944, and may taper down from the forward side 1142 to the rearward side 1944. In particular cases, the weight member 1940 may be configured so that the center of mass is positioned closer to the forward side 1142 than to the rearward side 1944. Additionally, an upper surface 1145 of the weight member may extend further rearward than a lower surface 1141 of the weight member, with a rearward side 1944 of the weight member 1940 sloping up in a rearward direction from the sole 1903, permitting at least a portion of the rearward side 1944 of the weight member to engage the ledge 1974 on the fastener tab 1965. Ledge 1974 may itself be angled so that a lower portion nearest the sole 1903 extends further forward than an upper portion positioned nearer the lower surface 1931 of the weight channel 1930.

When tightened, the removable fastener 1950 presses down on fastener tab 1965 so that the ledge 1974 retains the weight member 1940 in place. Once removable fastener 1950 is loosened, the fastener is configured to remain stationary relative to the fastener port 1952, while the position of the weight member 1940 may be adjusted relative to the fastener port. In the illustrated example shown in FIG. 33A, weight member 1940 may be translated laterally along the path 1937 in a generally heelward or toeward direction to adjust, for example, golf club center of gravity movement along an x-axis (CGx), such as to control left or right tendency of a golf swing. One advantage of the golf club head 1900 shown in this example is that in moving the removable fastener 1950 outside of the weight channel 1930, the weight member 1940 need not be specially engineered to contain a slot passing through the weight member 1940 to receive the removable fastener 1950. This example may also provide a more consistent distribution of mass throughout the weight than some other examples.

Design Parameters for Golf Club Heads with Slidably Repositionable Weight(s)

Although the following discussion cites features related to golf club head 900 and its variations (e.g. 1200, 1300, 1900), the many design parameters discussed below substantially apply to golf club heads 1400 and 1500 due to the common features of the club heads. With that in mind, in some embodiments of the golf clubs described herein, the location, position or orientation of features of the golf club head, such as the golf club head 900, 1200, 1300, 1400, 1500 and 1900, can be referenced in relation to fixed reference points, e.g., a golf club head origin, other feature locations or feature angular orientations. The location or position of a weight or weight assembly, such as the weight member 940, 1240, 1440, 1540, and 1940 is typically defined with respect to the location or position of the weight's or weight assembly's center of gravity. When a weight or weight assembly is used as a reference point from which a distance, i.e., a vectorial distance (defined as the length of a straight line extending from a reference or feature point to another reference or feature point) to another weight or weight assembly location is determined, the reference point is typically the center of gravity of the weight or weight assembly.

The location of the weight assembly on a golf club head can be approximated by its coordinates on the head origin coordinate system. The head origin coordinate system includes an origin at the ideal impact location of the golf club head, which is disposed at the geometric center of the striking surface 905 (see FIGS. 11A and 11B). As described above, the head origin coordinate system includes an x-axis and a y-axis. The origin x-axis extends tangential to the face plate at the origin and generally parallel to the ground when the head is ideally positioned with the positive x-axis extending from the origin towards a heel of the golf club head and the negative x-axis extending from the origin to the toe of the golf club head. The origin y-axis extends generally perpendicular to the origin x-axis and parallel to the ground when the head is ideally positioned with the positive y-axis extending from the head origin towards the rear portion of the golf club. The head origin can also include an origin z-axis extending perpendicular to the origin x-axis and the origin y-axis and having a positive z-axis that extends from the origin towards the top portion of the golf club head and negative z-axis that extends from the origin towards the bottom portion of the golf club head.

As described above, in some of the embodiments of the golf club head 900 described herein, the weight channel 930 extends generally from a heelward end 936 oriented toward the heel side 906 of the golf club head to a toeward end 938 oriented toward the toe side 908 of the golf club head, with both the heelward end 936 and toeward end 938 being at or near the same distance from the front portion of the club head. As a result, in these embodiments, the weight member 940 that is slidably retained within the weight channel 930 is capable of a relatively large amount of adjustment in the direction of the x-axis, while having a relatively small amount of adjustment in the direction of the y-axis. In some alternative embodiments, the heelward end 936 and toeward end 938 may be located at varying distances from the front portion, such as having the heelward end 936 further rearward than the toeward end 938, or having the toeward end 938 further rearward than the heelward end 936. In these alternative embodiments, the weight member 940 that is slidably retained within the weight channel 930 is capable of a relatively large amount of adjustment in the direction of the x-axis, while also having from a small amount to a larger amount of adjustment in the direction of the y-axis.

For example, in some embodiments of a golf club head 900 having a weight member 940 that is adjustably positioned within a weight channel 930, the weight member 940 can have an origin x-axis coordinate between about −40 mm and about 40 mm, depending upon the location of the weight assembly within the weight channel 930. In specific embodiments, the weight member 940 can have an origin x-axis coordinate between about −35 mm and about 35 mm, or between about −30 mm and about 30 mm, or between about −25 mm and about 25 mm, or between about −20 mm and about 20 mm, or between about −15 mm and about 15 mm, or between about −13 mm and about 13 mm. Thus, in some embodiments, the weight member 940 is provided with a maximum x-axis adjustment range (Max Δx) that is less than 80 mm, such as less than 70 mm, such as less than 60 mm, such as less than 50 mm, such as less than 40 mm, such as less than 30 mm, such as less than 26 mm.

On the other hand, in some embodiments of the golf club head 900 having a weight member 940 that is adjustably positioned within a weight channel 930, the weight member 940 can have an origin y-axis coordinate between about 5 mm and about 80 mm. More specifically, in certain embodiments, the weight member 940 can have an origin y-axis coordinate between about 5 mm and about 50 mm, between about 5 mm and about 45 mm, or between about 5 mm and about 40 mm, or between about 10 mm and about 40 mm, or between about 5 mm and about 35 mm. Additionally or alternatively, in certain embodiments, the weight member 940 can have an origin y-axis coordinate between about 35 mm and about 80 mm, between about 45 mm and about 75 mm, or between about 50 mm and about 70 mm. Thus, in some embodiments, the weight member 940 is provided with a maximum y-axis adjustment range (Max Δy) that is less than 45 mm, such as less than 30 mm, such as less than 20 mm, such as less than 10 mm, such as less than 5 mm, such as less than 3 mm. Additionally or alternatively, in some embodiments having a rearward channel, the weight member is provided with a maximum y-axis adjustment range (Max Δy) that is less than 110 mm, such as less than 80 mm, such as less than 60 mm, such as less than 40 mm, such as less than 30 mm, such as less than 15 mm.

In some embodiments, a golf club head can be configured to have a constraint relating to the relative distances that the weight assembly can be adjusted in the origin x-direction and origin y-direction. Such a constraint can be defined as the maximum y-axis adjustment range (Max Δy) divided by the maximum x-axis adjustment range (Max Δx). According to some embodiments, the value of the ratio of (Max Δy)/(Max Δx) is between 0 and about 0.8. In specific embodiments, the value of the ratio of (Max Δy)/(Max Δx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

As discussed above, in some driver-type golf club head embodiments, the mass of the weight member, e.g. weight member 1440 and/or weight member 1540, is between about 1 g and about 50 g, such as between about 3 g and about 40 g, such as between about 5 g and about 25 g. In some alternative embodiments, the mass of the weight member 1440 and/or 1540 is between about 5 g and about 45 g, such as between about 9 g and about 35 g, such as between about 9 g and about 30 g, such as between about 9 g and about 25 g.

As discussed above, in some fairway-type golf club head embodiments, the mass of the weight member, e.g., weight member 940, is between about 50 g and about 90 g, such as between about 55 g and about 80 g, such as between about 60 g and about 75 g. In some alternative embodiments, the mass of the weight member 940 is between about 5 g and about 45 g, such as between about 9 g and about 35 g, such as between about 9 g and about 30 g, such as between about 9 g and about 25 g.

In some embodiments, a golf club head can be configured to have constraints relating to the product of the mass of the weight assembly and the relative distances that the weight assembly can be adjusted in the origin x-direction and/or origin y-direction. One such constraint can be defined as the mass of the weight assembly ($M_{WA}$) multiplied by the maximum x-axis adjustment range (Max Δx). According to some embodiments, the value of the product of $M_{WA}$ x (Max Δx) is between about 250 g·mm and about 4950 g·mm. In specific embodiments, the value of the product of $M_{WA}$ x (Max Δx) is between about 500 g·mm and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

According to some embodiments, the value of the product of $M_{WA}$ x (Max Δx) is between about 250 g·mm and about 2500 g·mm. In specific embodiments, the value of the product of $M_{WA}$ x (Max Δx) is between about 350 g·mm and about 2400 g·mm, or between about 750 g·mm and about 2300 g·mm, or between about 1000 g·mm and about 2200 g·mm, or between about 1100 g·mm and about 2100 g·mm, or between about 1200 g·mm and about 2000 g·mm, or between about 1200 g·mm and about 1950 g·mm, or between about 1250 g·mm and about 1900 g·mm, or between about 1250 g·mm and about 1750 g·mm.

Another constraint relating to the product of the mass of the weight assembly and the relative distances that the weight assembly can be adjusted in the origin x-direction and/or origin y-direction can be defined as the mass of the weight assembly ($M_{WA}$) multiplied by the maximum y-axis adjustment range (Max Δy). According to some embodiments, the value of the product of $M_{WA}$ x (Max Δy) is between about 0 g·mm and about 1800 g·mm. In specific embodiments, the value of the product of $M_{WA}$ x (Max Δy) is between about 0 g·mm and about 1500 g·mm, or between about 0 g·mm and about 1000 g·mm, or between about 0 g·mm and about 500 g·mm, or between about 0 g·mm and about 250 g·mm, or between about 0 g·mm and about 150 g·mm, or between about 0 g·mm and about 100 g·mm, or between about 0 g·mm and about 50 g·mm, or between about 0 g·mm and about 25 g·mm.

As noted above, one advantage obtained with a golf club head having a repositionable weight, such as the golf club head 900 having the weight member 940, is in providing the end user of the golf club with the capability to adjust the location of the CG of the club head over a range of locations relating to the position of the repositionable weight. In particular, the present inventors have found that there is a distance advantage to providing a center of gravity of the club head that is lower and more forward relative to comparable golf clubs that do not include a weight assembly such as the weight member 940 described herein.

In some embodiments, the golf club head 900 has a CG with a head origin x-axis coordinate (CGx) between about −10 mm and about 10 mm, such as between about −4 mm and about 9 mm, such as between about −3 mm and about 8 mm, such as between about −2 mm to about 5 mm, such as between about −0.8 mm to about 8 mm, such as between about 0 mm to about 8 mm. In some embodiments, the golf club head 900 has a CG with a head origin y-axis coordinate (CGy) greater than about 15 mm and less than about 50 mm, such as between about 22 mm and about 43 mm, such as between about 24 mm and about 40 mm, such as between about 26 mm and about 35 mm. In some embodiments, the golf club head 900 has a CG with a head origin z-axis coordinate (CGz) greater than about −8 mm and less than about 3 mm, such as between about −6 mm and about 0 mm. In some embodiments, the golf club head 900 has a CG with a head origin z-axis coordinate (CGz) that is less than 0 mm, such as less than −2 mm, such as less than −4 mm, such as less than −5 mm, such as less than −6 mm.

As described herein, by repositioning the weight member 940 within the weight channel 930 of the golf club head 900, the location of the CG of the club head is adjusted. For example, in some embodiments of a golf club head 900 having a weight member 940 that is adjustably positioned within a weight channel 930, the club head is provided with a maximum CGx adjustment range (Max ΔCGx) attributable to the repositioning of the weight member 940 that is greater than 1 mm, such as greater than 2 mm, such as greater than 3 mm, such as greater than 4 mm, such as greater than 5 mm, such as greater than 6 mm, such as greater than 8 mm, such as greater than 10 mm, such as greater than 11 mm.

Moreover, in some embodiments of the golf club head 900 having a weight member 940 that is adjustably positioned within a weight channel 930, the club head is provided with a CGy adjustment range (Max ΔCGy) that is less than 6 mm, such as less than 3 mm, such as less than 1 mm, such as less than 0.5 mm, such as less than 0.25 mm, such as less than 0.1 mm.

Additionally or alternatively, in some embodiments of the golf club head 900 having a weight member 940 that is adjustably positioned within a rearward channel, the club head is provided with a CGy adjustment range (Max ΔCGy) that is less than 10 mm, such as less than 5 mm, such as less than 3 mm, such as less than 1 mm, such as less than 0.5 mm, such as less than 0.25 mm, such as less than 0.1 mm.

In some embodiments, a golf club head can be configured to have a constraint relating to the relative amounts that the CG is able to be adjusted in the origin x-direction and origin y-direction. Such a constraint can be defined as the maximum CGy adjustment range (Max ΔCGy) divided by the maximum CGx adjustment range (Max ΔCGx). According to some embodiments, the value of the ratio of (Max ΔCGy)/(Max ΔCGx) is between 0 and about 0.8. In specific embodiments, the value of the ratio of (Max ΔCGy)/(Max ΔCGx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

In some embodiments, a golf club head can be configured such that only one of the above constraints apply. In other embodiments, a golf club head can be configured such that more than one of the above constraints apply. In still other embodiments, a golf club head can be configured such that all of the above constraints apply.

Table 8 below lists various properties of an exemplary golf club head, which may be similar to golf club head 900, having a weight assembly retained within a front channel.

TABLE 8

| Property | Value in Exemplary Golf Club Head |
|---|---|
| Slidable weight assembly (g) | 66 |
| volume (cc) | 150 |
| deltal (mm) | 10.7-11.0 |
| max CGx (mm) | 5.3 |
| min CGx (mm) | 0.3 |
| max CGz (mm) | 13.1 Zup |
| min CGz (mm) | 13.1 Zup |
| max CGy (mm) | 11.0 Delta1 |
| min CGy (mm) | 10.7 Delta1 |
| distance of weight assembly to striking face (mm) | From center face to CG of weight assembly: ~31 mm. From leading edge to most forward portion of weight assembly: ~17 mm |
| channel length (mm) | ~81 mm |
| channel width (mm) | ~40 mm |
| channel depth (mm) | ~12 mm |
| Izz (kg · mm$^2$) | 209 kg · mm$^2$ |
| Ixx (kg · mm$^2$) | 93 kg · mm$^2$ |

Table 9 below lists various properties of an exemplary golf club head, which may be similar to golf club head 900, having a weight assembly retained within a front channel, and located at center, toe, and heel positions, respectively.

TABLE 9

| | Value in Exemplary Golf Club Head | | |
|---|---|---|---|
| Property | Center | Toe | Heel |
| CGx (mm) | 2.8 | 0.3 | 5.3 |
| Zup (mm) | 13.1 | 13.1 | 13.1 |
| Delta 1 (mm) | 10.7 | 11.0 | 11.0 |
| Balance Point Up (mm) | 19.532 | 19.684 | 19.732 |
| CGx Delta (mm) | | −2.5 | 2.5 |
| BP Delta (mm) | | 0.152 | 0.200 |
| BP Delta/CGx Delta (mm/mm) | | −0.061 | 0.080 |
| Absolute value BP Delta/CGx Delta (mm/mm) | | 0.061 | 0.080 |

In table 4 above, BP Delta or Balance Point Up Delta represents the change in the Balance Point Up relative to the Balance Point Up when the weight is in the center position. For example, when the weight is in toewardmost position the Balance Point Up is 19.684 mm compared to 19.532 mm in the center position resulting in a delta or change of 0.152 mm. Similarly, in the heel position the BP Delta is 0.200 mm (19.732 mm-19.532 mm). BP Delta/CGx Delta (mm/mm) is again calculated relative to the center position. For example, BP Delta for the heelwardmost position relative to center is 0.200 mm and the CGx delta from center to heel is 2.5 mm (5.3 mm-2.8 mm) resulting in a ratio of 0.08. It was found that this track configuration produced a very large CGx movement with very little impact to Balance Point Up, which was lacking in earlier designs.

In some embodiments described herein, BP Delta in a toewardmost position is no more than 0.50 mm, and is between 0.12 mm and 0.50 mm, such as between 0.13 mm and 0.40 mm, such as between 0.14 mm and 0.30 mm. In some embodiments described herein, BP Delta in a heelwardmost position is no more than 0.30 mm, and is between 0.12 mm and 0.30 mm, such as between 0.13 mm and 0.25 mm, such as between 0.15 mm and 0.25 mm.

In some embodiments described herein, a BP Delta/CGx Delta (mm/mm) when the weight is in the toewardmost position is no more than 0.170 (absolute value). More specifically, the BP Delta/CGx Delta for the toewardmost position relative the center position can be between 0.170 (absolute value) and 0.040 (absolute value). In some embodiments described herein, a BP Delta/CGx Delta (mm/mm) when the weight is in the heelwardmost position is no more than 0.120 (absolute value). More specifically, the BP Delta/CGx Delta for the heelwardmost position relative the center position can be between 0.120 (absolute value) and 0.060 (absolute value). In some embodiments described herein, the summation of the BP Delta/CGx Delta (mm/mm) in the toewardmost position (absolute value) and the BP Delta/CGx Delta (mm/mm) in the heelwardmost position (absolute value) is no more than 0.29, and is between 0.11 and 0.29, such as between 0.12 and 0.28, such as between 0.13 and 0.25. Unexpectedly, the location of the weight bearing channel in the front portion of the club head can lead to synergies in golf club performance. First, because $A_1$ (delta 1) is relatively small, dynamic lofting is reduced; thereby reducing spin that otherwise may reduce distance. Additionally, because the projection of the CG is below the center-face, the gear effect biases the golf ball to rotate toward the projection of the CG—or, in other words, with forward spin. This is countered by the loft of the golf club head imparting back spin. The overall effect is a relatively low spin profile. However, because the CG is below the center face (and, thereby, below the ideal impact location) as measured along the z-axis, the golf ball will tend to rise higher on impact. The result is a high launching but lower spinning golf shot on purely struck shots, which leads to better ball flight (higher and softer landing) with more distance due to less energy loss from spin.

The distance between weight channels/weight ports and weight size can contribute to the amount of CG change made possible in a golf club head, particularly in a golf club head used in conjunction with a removable sleeve assembly, as described above.

In some exemplary embodiments of a golf club head having two, three or four weights, a maximum weight mass multiplied by the distance between the maximum weight and the minimum weight is between about 100 g·mm and about 3,750 g·mm or about 200 g·mm and 2,000 g·mm. More specifically, in certain embodiments, the maximum weight mass multiplied by the weight separation distance is between about 500 g·mm and about 1,500 g·mm, between about 1,200 g·mm and about 1,400 g·mm.

When a weight or weight port is used as a reference point from which a distance, i.e., a vectorial distance (defined as the length of a straight line extending from a reference or feature point to another reference or feature point) to another weight or weights port is determined, the reference point is typically the volumetric centroid of the weight port. When a movable weight club head and sleeve assembly are combined, it is possible to achieve the highest level of club trajectory modification while simultaneously achieving the desired look of the club at address. For example, if a player prefers to have an open club face look at address, the player can put the club in the "R" or open face position. If that player then hits a fade (since the face is open) shot but prefers to hit a straight shot, or slight draw, it is possible to take the same club and move the heavy weight to the heel port to promote draw bias. Therefore, it is possible for a player to have the desired look at address (in this case open face) and the desired trajectory (in this case straight or slight draw).

In yet another advantage, by combining the movable weight concept with an adjustable sleeve position (effecting loft, lie and face angle) it is possible to amplify the desired trajectory bias that a player may be trying to achieve.

For example, if a player wants to achieve the most draw possible, the player can adjust the sleeve position to be in the closed face position or "L" position and also put the heavy weight in the heel port. The weight and the sleeve position work together to achieve the greater draw bias possible. On the other hand, to achieve the greatest fade bias, the sleeve position can be set for the open face or "R" position and the heavy weight is placed in the top port.

As described above, the combination of a large CG change (measured by the heaviest weight multiplied by the distance between the ports) and a large loft change (measured by the largest possible change in loft between two sleeve positions, Aloft) results in the highest level of trajectory adjustability. Thus, a product of the distance between at least two weight ports, the maximum weight, and the maximum loft change is important in describing the benefits achieved by the embodiments described herein.

In one embodiment, the product of the distance between at least two weight ports, the maximum weight, and the maximum loft change is between about 50 mm·g·deg and about 8,000 mm·g·deg, preferably between about 2000 mm·g·deg and about 6,000 mm·g·deg, more preferably between about 2500 mm·g·deg and about 4,500 mm·g·deg, or even more preferably between about 3000 mm·g·deg and about 4,100 mm·g·deg. In other words, in certain embodiments, the golf club head satisfies the following expressions in Equations 4-7. Notably, the maximum loft change may vary between 2-4 degrees, and the preferred embodiment having a maximum loft change of 4 degrees or ±2 degrees.

$$50\ \text{mm·g·degrees} < \text{Dwp·Mhw·}\Delta\text{loft} < 8{,}000\ \text{mm·g·degrees} \quad (4)$$

$$2000\ \text{mm·g·degrees} < \text{Dwp·Mhw·}\Delta\text{loft} < 6{,}000\ \text{mm·g·degrees} \quad (5)$$

$$2500\ \text{mm·g·degrees} < \text{Dwp·Mhw·}\Delta\text{loft} < 4{,}500\ \text{mm·g·degrees} \quad (6)$$

$$3000\ \text{mm·g·degrees} < \text{Dwp·Mhw·}\Delta\text{loft} < 4{,}100\ \text{mm·g·degrees} \quad (7)$$

In the above expressions, Dwp, is the distance between two weight port centroids (mm), Mhw, is the mass of the heaviest weight (g), and Aloft is the maximum loft change (degrees) between at least two sleeve positions. A golf club head within the ranges described above will ensure the highest level of trajectory adjustability.

Additional disclosure regarding providing both a movable weight and an adjustable shaft assembly to a golf club head can be found in U.S. Pat. No. 8,622,847, the entire contents of which are incorporated by reference.

According to some exemplary embodiments of a golf club head described herein, head an areal weight, i.e., material density multiplied by the material thickness, of the golf club head sole, crown and skirt, respectively, is less than about 0.45 g/cm2 over at least about 50% of the surface area of the respective sole, crown and skirt. In some specific embodiments, the areal weight is between about 0.05 g/cm$^2$ and about 0.15 g/cm$^2$, between about 0.10 g/cm$^2$ and about 0.20 g/cm$^2$ between about 0.15 g/cm$^2$ and about 0.25 g/cm$^2$, between about 0.25 g/cm$^2$ and about 0.35 g/cm$^2$ between about 0.35 g/cm$^2$ and about 0.45 g/cm$^2$, or between about 0.45 g/cm$^2$ and about 0.55 g/cm$^2$.

According to some exemplary embodiments of a golf club head described herein, the head comprises a skirt with a thickness less than about 0.8 mm, and the head skirt areal weight is less than about 0.41 g/cm$^2$ over at least about 50% of the surface area of the skirt. In specific embodiments, the skirt areal weight is between about 0.15 g/cm$^2$ and about 0.24 g/cm$^2$, between about 0.24 g/cm$^2$ and about 0.33 g/cm$^2$ or between about 0.33 g/cm$^2$ and about 0.41 g/cm$^2$.

Some of the exemplary golf club heads described herein can be configured to have a constraint defined as the moment of inertia about the golf club head CG x-axis (Ixx) multiplied by the total movable weight mass. According to some embodiments, the second constraint is between about 1.4 kg$^2$·mm$^2$ and about 40 kg$^2$·mm$^2$. In certain embodiments, the second constraint is between about 1.4 kg$^2$·mm$^2$ and about 2.0 kg$^2$·mm$^2$, between about 2.0 kg$^2$·mm$^2$ and about 10 kg$^2$·mm$^2$ or between about 10 kg$^2$·mm$^2$ and about 40 kg$^2$·mm$^2$.

Some of the exemplary golf club heads described herein can be configured to have another constraint defined as the moment of inertia about the golf club head CG z-axis (Izz) multiplied by the total movable weight mass. According to some embodiments, the fourth constraint is between about 2.5 kg$^2$·mm$^2$ and about 72 kg$^2$·mm$^2$. In certain embodiments, the fourth constraint is between about 2.5 kg$^2$·mm$^2$ and about 3.6 kg$^2$·mm$^2$ between about 3.6 kg$^2$·mm$^2$ and about 18 kg$^2$·mm$^2$ or between about 18 kg$^2$·mm$^2$ and about 72 kg$^2$·mm$^2$.

In some embodiments described herein, a moment of inertia about a golf club head CG z-axis (Izz) can be greater than about 190 kg·mm$^2$. More specifically, the moment of inertia about head CG z-axis 1003 can be between about 190 kg·mm$^2$ and about 300 kg·mm$^2$, between about 300 kg·mm$^2$ and about 350 kg·mm$^2$, between about 350 kg·mm$^2$ and about 400 kg·mm$^2$, between about 400 kg·mm$^2$ and about 450 kg·mm$^2$, between about 450 kg·mm$^2$ and about 500 kg·mm$^2$ or greater than about 500 kg·mm$^2$.

In some embodiments described herein, a moment of inertia about a golf club head CG x-axis (Ixx) can be greater than about 80 kg·mm$^2$. More specifically, the moment of inertia about the head CG x-axis 1001 can be between about 80 kg·mm$^2$ and about 180 kg·mm$^2$, between about 180 kg·mm$^2$ and about 250 kg·mm$^2$ between about 250 kg·mm$^2$ and about 300 kg·mm$^2$, between about 300 kg·mm$^2$ and about 350 kg·mm$^2$, between about 350 kg·mm$^2$ and about 400 kg·mm$^2$, or greater than about 400 kg·mm$^2$.

Additional disclosure regarding areal weight and calculating values for moments of inertia providing both a movable weight and an adjustable shaft assembly to a golf club head can be found in U.S. Pat. No. 7,963,861, the entire contents of which are incorporated by reference.

Other Club Heads Having Twist

Figure 34A:
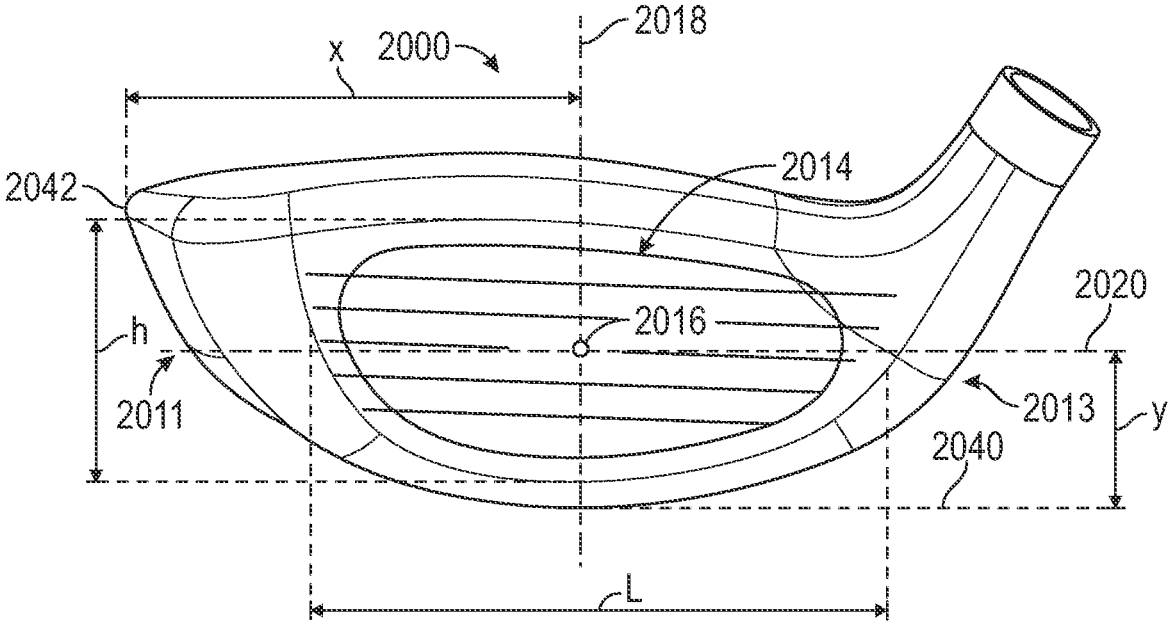
FIGS. 34A and 34B are front elevation views of another embodiment of a fairway wood-type golf club head.
Figure 34B:
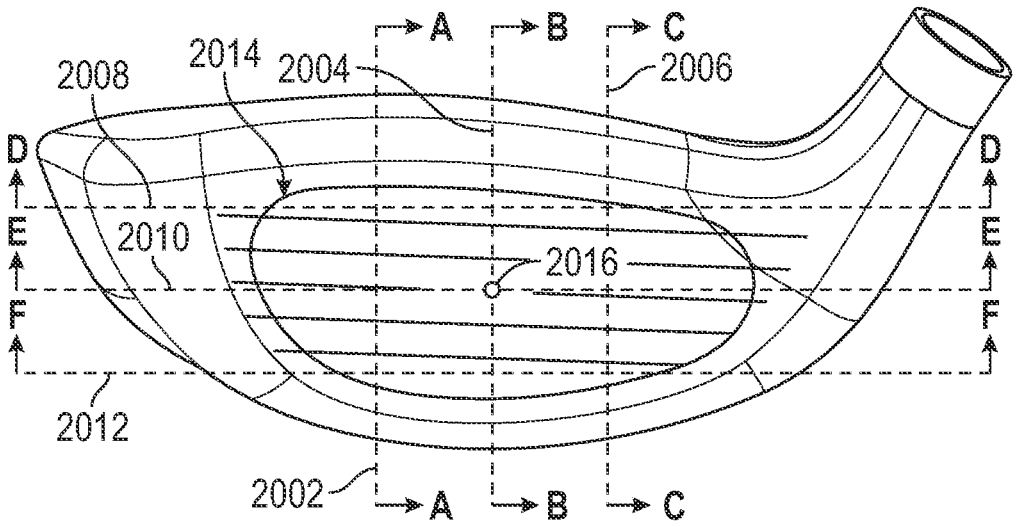

The "twisted" bulge and roll striking face contours described above with reference to FIGS. 1-10 can be applicable to the fairway woods, rescue clubs, hybrid clubs, and the like described with reference to FIGS. 11A-33B. For example, FIGS. 34A and 34B illustrate a fairway wood type golf club head 2000 similar to the club head 900 of FIG. 11A including a toe portion 2011, a heel portion 2013, and a striking face 2014 having a center face location indicated at 2016. With reference to FIG. 34A, in certain embodiments the striking face 2014 can have a height dimension h and a length dimension L. In some embodiments, the height dimension h can be from 15 mm to 42 mm, 20 mm to 30 mm, or 23 mm to 28 mm. In particular embodiments, the height dimension h can be about 25 mm. In some embodiments, the length dimension L can be from 40 mm to 105 mm, 50 mm to 70 mm, or 55 mm to 65 mm. In particular embodiments, the length dimension L can be about 60 mm, such as about 59.5 mm. The club head 2000 may be at least partially hollow.

In particular embodiments, the center face location 2016 (also referred to as the "USGA center face") can correspond to the geometric center of the striking face 2014 as determined by the U.S. Golf Association (USGA) "Procedure for Measuring the Flexibility of a Golf Clubhead," Revision 2.0, Mar. 25, 2005, described in U.S. Pat. No. 10,052,530, which is incorporated herein by reference. In other embodiments, the center face location 2016 can correspond to the CG location projected onto the striking face, and/or to an ideal impact location on the striking face, as described above. In certain embodiments, the center face location 2016 can be located at a height distance y above a ground plane 2040 (which may also correspond to the lowest point of the club head body). A toe-ward most point 2042 of the club head 2000 can be located a horizontal distance x from the center face location 2016. In some embodiments, the distance y can be from 15 mm to 25 mm, 17 mm to 23 mm, or 18 mm to 20 mm. In particular embodiments, the distance y can be 19 mm. In some embodiments, the distance x can be from 40 mm to 70 mm, 45 mm to 65 mm, 50 mm to 60 mm, or about 55 mm. In particular embodiments, the distance x can be about 54.6 mm.

In certain embodiments, the fairway wood-type club head 2000 can have a club head height ($H_{ch}$) similar to that illustrated in FIG. 11B (e.g., the distance 1080 from the ground plane 1010 to the parallel height plane 1070 at the crown 909 of the golf club head 900). In certain embodiments, the club head height ($H_{ch}$) of the club head 2000 can be less than about 48 mm, such as less than 46 mm, from 25 mm to 48 mm, 30 mm to 48 mm, 30 mm to 40 mm, or 34 mm to 40 mm. In particular embodiments, the club head height Heh can be about 39 mm. The club head 2000 can also have a CG z-axis location or "Zup" of 24 mm or less, as described above with reference to FIG. 11B.

FIG. 34B illustrates the striking face 2014 with a plurality of representative vertical planes 2002, 2004, 2006 and horizontal planes 2008, 2010, 2012 superimposed thereon. In the illustrated embodiment, the toe side vertical plane 2002, the center vertical plane 2004 (passing through center face location 2016), and the heel vertical plane 2006 are separated by a distance of 14 mm as measured from the center face location 2106. The upper horizontal plane 2008, the center horizontal plane 2010 (passing through the center face 2016), and the lower horizontal plane 2012 are spaced from each other by 7.5 mm as measured from the center face location 2016.

The vertical planes 2002, 2004, and 2006 can define striking face surface roll contours A, B, and C similar to FIG. 4*b* above. In the illustrated embodiment, the toe side vertical contour A is more lofted (having positive LA° Δ) relative to the center face vertical contour B, and the heel side vertical contour C is less lofted (having a negative LA° Δ) relative to the center face vertical contour B. The horizontal planes can define striking face bulge contours D, E, and F similar to FIG. 4*c* above. In the illustrated embodiment, the crown side bulge contour D is more open (having a positive FA° Δ, defined below) when compared to the center face bulge contour E, and the sole side bulge contour F is more closed (having a negative FA° Δ when measured about the center vertical plane).

Figure 35A:
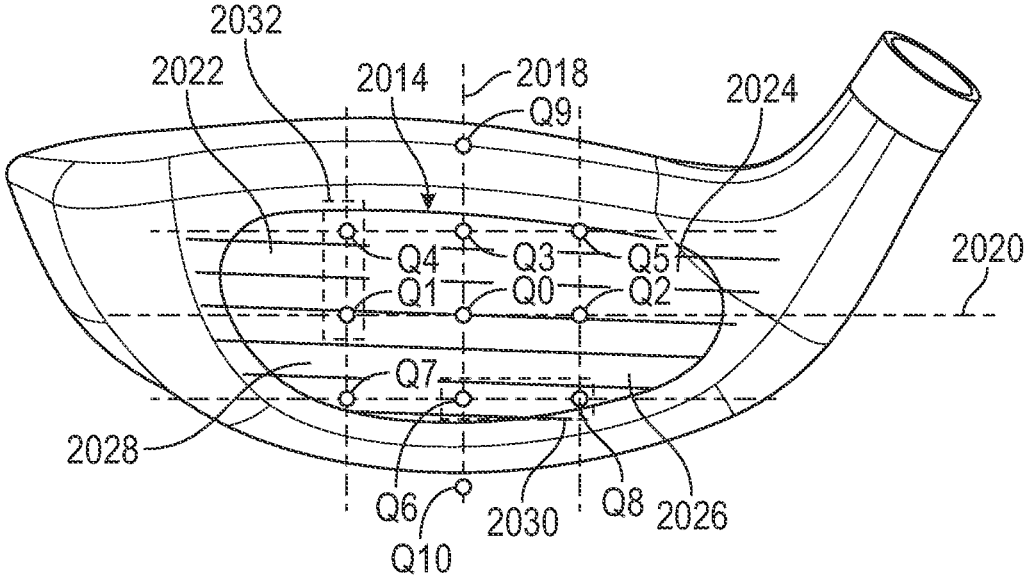
FIGS. 35A and 35B are front elevation views illustrating a plurality of measurement points on the striking face of the golf club head of FIGS. 34A and 35B.

FIG. 35A shows a plurality of points Q0-Q10 that are spaced apart across the striking face in a grid pattern, including two "critical points" Q9 and Q10. In the illustrated embodiment, a measurement point Q0 can be located at the center face location 2016. A vertical axis 2018 and a horizontal plane 2020 intersect at the desired measurement point Q0 and divide the striking face 2014 into four quadrants. The upper toe quadrant 2022, the upper heel quadrant 2024, the lower heel quadrant 2026, and the lower toe quadrant 2028 all form the striking face 2014, collectively. In certain embodiments, the upper toe quadrant 2022 can be more "open" than all the other quadrants, and the lower heel quadrant 2026 can be more "closed" than all the other quadrants.

As noted previously, the total face angle and loft angle change for various points on the striking face can be determined by Equations 5 and 6 above, and the absolute value of the total face angle change between "critical" point locations 30 mm apart determines the amount of "twist" of the striking face. In the illustrated embodiment, the critical points Q9 and Q10 are located at coordinates (0 mm, 15 mm) and (0 mm, −15 mm), respectively, as in the examples above. However, because the striking face 2014 of the fairway wood-type club head 2000 is smaller than the striking face of the drivers described above, the critical points Q9 and Q10 lie outside the boundary of the striking face 2014, but on the twisted bulge/roll plane defined by the twisted striking surface. Thus, the amount of "twist" of the striking face 2014 is still defined by the absolute value of the total face angle change between the critical points Q9 and Q10. However, in the illustrated embodiment, the points Q3 and Q6 are located within the boundary of the striking face at coordinates (0 mm, 7.5 mm) and (0 mm, −7.5 mm), respectively. Thus, because the points Q3 and Q6 are separated by 15 mm on the y-axis instead of 30 mm, the total face angle change between the locations Q3 and Q6 will be about ½ or 50% of the total nominal twist of the club head. For example, for a club head 2000 with a "1° twist," the Q3 point has a 0.25° twist relative to the center face location Q0, and the Q6 point has a −0.25° twist relative to the center face location Q0, together totaling 0.5°.

In the embodiment illustrated in FIG. 35A, the heel side points Q5, Q2, and Q8 are spaced 14 mm away from the vertical axis 2018 passing through the center face location 2016. Toe side points Q4, Q1, and Q7 are spaced 14 mm away from the vertical axis 2018 passing through the center face. Crown side points Q3, Q4, and Q5 are spaced 7.5 mm away from the horizontal axis 2020 passing through the center face location 2016, although in other embodiments they may be spaced 10 mm away from the axis 2020. Sole side points Q6, Q7, and Q8 are spaced 7.5 mm away from the horizontal axis 2020, although in other embodiments they may be spaced 10 mm away from the axis 2020. Point Q5 is located in the upper heel quadrant 2024 at a coordinate location (14 mm, 7.5 mm) while point Q7 is located in the lower toe quadrant 2028 at a coordinate location (−14 mm, −7.5 mm). Point Q4 is located in the upper toe quadrant 2022 at a coordinate location (−14 mm, 7.5 mm), while point Q8 is located in the lower heel quadrant 2026 at a coordinate location (14 mm, −7.5 mm).

The golf club head 2000 may have any of the degrees of twist or twist ranges described herein, such as "0.5° twist", "1° twist", "1.5° twist", "2° twist", "3° twist", "4° twist", "5° twist," "6° twist," etc. Utilizing the grid pattern of FIG. 35A, a plurality of embodiments having a nominal center face loft angle of 15°, a bulge radius of 254 mm, a roll radius of 254 mm, and a volume of 151.6 cc, are analyzed having a "0.5° twist," a "1° twist," a "1.5° twist", and a "2° twist." These club heads correspond to Examples 7-10 in Table 10 below.

Table 10 shows the LA° Δ and FA° Δ relative to center face for points located along the vertical axis 2018 and the horizontal axis 2020 (for example points Q1, Q2, Q3, and Q6). With regard to points located away from the vertical axis 2018 and the horizontal axis 2020, the LA° Δ and FA° Δ can be measured relative to a corresponding point located on the vertical axis 2018 and horizontal axis 2020, respectively, as described above. A representative lower heel quadrant band is illustrated at 2030 encompassing points Q6 and Q8, where the LA° Δ and FA° Δ of point Q8 can be measured relative to the loft angle and face angle of the point Q6 to eliminate the influence of the bulge radius of the striking face within the lower heel quadrant. Similarly, a representative upper toe vertical band 2032 encompasses the points Q1 and Q4, and the LA° Δ and the FA° Δ of point Q4 can be measured with respect to point Q1, which shares an x-coordinate with the point Q4 of −14 mm.

TABLE 10

| Relative to Center Face and Bands | | | | | | | | | | |
|---|---|---|---|---|---|---|---|---|---|---|
| | X-axis | Y-Axis | Example 7 0.5° twist | | Example 8 1.0° twist | | Example 9 1.5° twist | | Example 10 2° twist | |
| Point | (mm) | (mm) | LA° Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 |
| Q1 | −14 | 0 | 0.23 | 0 | 0.47 | 0 | 0.7 | 0 | 0.93 | 0 |
| Q2 | 14 | 0 | −0.23 | 0 | −0.47 | 0 | −0.7 | 0 | −0.93 | 0 |
| Q3 | 0 | 7.5 | 0 | 0.13 | 0 | 0.25 | 0 | 0.38 | 0 | 0.5 |
| Q4 | −14 | 7.5 | 0.23 | 0.13 | 0.47 | 0.25 | 0.7 | 0.38 | 0.93 | 0.5 |
| Q5 | 14 | 7.5 | −0.23 | 0.13 | −0.47 | 0.25 | −0.7 | 0.38 | −0.93 | 0.5 |
| Q6 | 0 | −7.5 | 0 | −0.13 | 0 | −0.25 | 0 | −0.38 | 0 | −0.5 |
| Q7 | −14 | −7.5 | 0.23 | −0.13 | 0.47 | −0.25 | 0.7 | −0.38 | 0.93 | −0.5 |
| Q8 | 14 | −7.5 | −0.23 | −0.13 | −0.47 | −0.25 | −0.7 | −0.38 | −0.93 | −0.5 |

As shown in Table 10, for the fairway wood-type club 2000 illustrated in FIGS. 34A-34B and 35A-35B, the LA° Δ can vary from 0.230 at points Q1, Q4 and Q7 to −0.23° at points Q2, Q5, and Q8 when the club head has 0.5° of twist. When the club head has 2° of twist, the LA° Δ can vary from 0.930 at points Q1, Q4 and Q7 to −0.93° at points Q2, Q5, and Q8. The FA° Δ can vary from 0.130 at points Q3, Q4 and Q5 to −0.13° at points Q6, Q7, and Q8 when the club head has 0.5° of twist, and from 0.5° at points Q3, Q4 and Q5 to −0.5° at points Q6, Q7, and Q8 when the club head has 2° of twist.

In certain embodiments, the grid points Q3-Q5 located at a y-coordinate of 7.5 mm can have a FA° Δ of between 0.10 and 1.5°, where the FA° Δ of 1.5° corresponds to a "6° twist." In certain embodiments, the grid points Q3-Q5 located at a y-coordinate of 7.5 mm can have a FA° Δ of between 0.1° and 1°, where the FA° Δ of 1° corresponds to a "4° twist." In certain embodiments, the grid points Q3-Q5 located at a y-coordinate of 7.5 mm can have a FA° Δ of between 0.10 and 0.75°, where the FA° Δ of 0.75° corresponds to a "3 twist." Grid points Q6-Q8 with y-coordinates of −7.5 mm can have FA° Δ values similar to those given above for the recited amounts of twist but with the opposite sign.

In certain embodiments, the grid points Q2, Q5, and Q8 located at an x-coordinate of 14 mm can have a LA° Δ of between −0.2° and −2.8°, where the LA° Δ of −2.8° corresponds to a "6° twist." In certain embodiments, the grid points Q2, Q5, and Q8 located at an x-coordinate of 14 mm can have a LA° Δ of between −0.2° and −1.9°, such as −1.864°, where the LA° Δ of −1.864° corresponds to a "4° twist." In certain embodiments, the grid points Q2, Q5, and Q8 located at an x-coordinate of 14 mm can have a LA° Δ of between −0.2° and −1.4°, where the LA° Δ of −1.4° corresponds to a "3 twist." Grid points Q1, Q4, and Q7 with x-coordinates of −14 mm can have LA° Δ values similar to those given above for the recited amounts of twist but with the opposite sign. The LA° Δ and FA° Δ values described above can be applicable to any of the fairway, rescue, and hybrid wood-type golf club heads described herein.

In certain embodiments, the club head 2000 can have a volume of 50 cc to 430 cc, 100 cc to 430 cc, 100 cc to 400 cc, 100 cc to 350 cc, 100 cc to 300 cc, 100 cc to 299 cc, 100 cc to 250 cc, 100 cc to 200 cc, 140 cc to 160 cc, or 149 cc to 154 cc. In a particular embodiment, the club head 2000 can have a volume of 151.6 cc.

In particular embodiments, the striking face 2014 and/or the club head 2000 can have a bulge curvature or radius of from 100 mm to 500 mm, 190 mm to 500 mm, 200 mm to 450 mm, 203 mm to 407 mm, 250 mm to 460 mm, 224 mm to 355 mm, 250 mm to 355, 203 mm to 305 mm, or 230 mm to 280 mm. In a particular embodiment, the club head 2000 can have a bulge radius of 254 mm.

In particular embodiments, the striking face 2014 and/or the club head 2000 can have a roll curvature radius of from 100 mm to 510 mm, 120 mm to 500 mm, 150 mm to 500 mm, 200 mm to 450 mm, 203 mm to 407 mm, 224 mm to 355 mm, 250 mm to 355, 203 mm to 305 mm, or 230 mm to 280 mm. In a particular embodiment, the club head 2000 can have a roll radius of 254 mm.

Figure 35B:
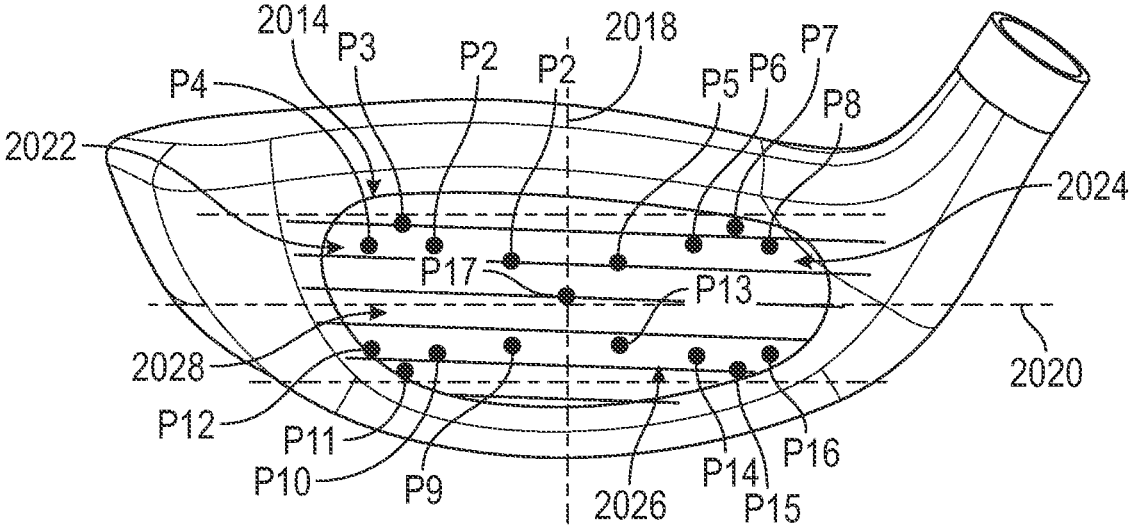

FIG. 35B illustrates a plurality of points P1-P17 distributed across the striking face 2014 and located in the various striking face quadrants defined by the vertical axis 2018 and the horizontal axis 2020. In the illustrated embodiment, points P1-P4 are located in the upper toe quadrant 2022, points P5-P8 are located in the upper heel quadrant 2024, points P9-P12 are located in the lower toe quadrant 2028, and points P13-P16 are located in the lower heel quadrant 2026. Representative x and y coordinates of points P1-P16 are given below in Table 11. Point P17 is located at the center face location where the axes 2018 and 2020 intersect at coordinates (0 mm, 0 mm), and is not included in Table 11.

TABLE 11

LA°A and FA°A for Points P1-P16

| | | | | Ex. 7 0.5° twist | | Ex. 8 1.0° twist | | Ex. 9 1.5° twist | | Ex. 10 2° twist | |
|---|---|---|---|---|---|---|---|---|---|---|---|
| Quadrant | Point | X-axis (mm) | Y-Axis (mm) | LA°Δ | FA°Δ | LA°Δ | FA°Δ | LA°A | FA°Δ | LA°Δ | FA°Δ |
| Upper Toe | P1 | −4 | 3 | 0.07 | 0.05 | 0.13 | 0.10 | 0.20 | 0.15 | 0.27 | 0.20 |
| | P2 | −15 | 5 | 0.25 | 0.08 | 0.5 | 0.17 | 0.75 | 0.25 | 0.99 | 0.33 |
| | P3 | −20 | 8 | 0.33 | 0.13 | 0.66 | 0.27 | 0.99 | 0.40 | 1.33 | 0.53 |
| | P4 | −23 | 5 | 0.38 | 0.08 | 0.76 | 0.17 | 1.14 | 0.25 | 1.52 | 0.33 |
| Upper Heel | P5 | 4 | 3 | −0.07 | 0.05 | −0.13 | 0.10 | −0.20 | 0.15 | −0.27 | 0.20 |
| | P6 | 15 | 5 | −0.25 | 0.08 | −0.5 | 0.17 | −0.75 | 0.25 | −0.99 | 0.33 |
| | P7 | 20 | 8 | −0.33 | 0.13 | −0.66 | 0.27 | −0.99 | 0.40 | −1.33 | 0.53 |
| | P8 | 23 | 5 | −0.38 | 0.08 | −0.76 | 0.17 | −1.14 | 0.25 | −1.52 | 0.33 |
| Lower Toe | P9 | −4 | −3 | 0.07 | 0.05 | 0.13 | −0.10 | 0.20 | −0.15 | 0.27 | −0.20 |
| | P10 | −15 | −5 | 0.25 | 0.08 | 0.5 | −0.17 | 0.75 | −0.25 | 0.99 | −0.33 |
| | P11 | −20 | −8 | 0.33 | 0.13 | 0.66 | −0.27 | 0.99 | −0.40 | 1.33 | −0.53 |
| | P12 | −23 | −5 | 0.38 | 0.08 | 0.76 | −0.17 | 1.14 | −0.25 | 1.52 | −0.33 |
| Lower Heel | P13 | 4 | −3 | −0.07 | 0.05 | −0.13 | −0.10 | −0.20 | −0.15 | −0.27 | −0.20 |
| | P14 | 15 | −5 | −0.25 | 0.08 | −0.5 | −0.17 | −0.75 | −0.25 | −0.99 | −0.33 |
| | P15 | 20 | −8 | −0.33 | 0.13 | −0.66 | −0.27 | −0.99 | −0.40 | −1.33 | −0.53 |
| | P16 | 23 | −5 | −0.38 | 0.08 | −0.76 | −0.17 | −1.14 | −0.25 | −1.52 | −0.33 |

The points P1-P16 can be used to calculate the average LA° Δ and FA° Δ for the four quadrants 2022-2028 for various degrees of twist. The average LA° Δ and FA° Δ can be calculated by totaling the LA° Δ or FA° Δ values for the points in a given quadrant, and dividing the sum by the total number of points. For example, to determine the average LA° Δ for the upper toe quadrant 2022 at a given amount of twist, the LA° Δ values for the points P1-P4 can be added together, and the resulting sum divided by four. The average FA° Δ and LA° Δ values for Examples 7-10 of Table 11 are given in Table 12. With reference to Example 9 in which the striking face has 1.50 of twist, the upper toe quadrant 2022 can have an average FA° Δ of 0.258° relative to the center face location, the upper heel quadrant 2024 can have an average FA° Δ of 0.258° relative to the center face location, the lower toe quadrant 2028 can have an average FA° Δ of −0.258° relative to the center face location, and the lower heel quadrant 2026 can have an average FA° Δ of −0.258° relative to the center face location.

Still referring to Example 9 of Table 12, the upper toe quadrant 2022 can have an average LA° Δ of 0.773° relative to the center face location, the upper heel quadrant 2024 can have an average LA° Δ of −0.773° relative to the center face location, the lower toe quadrant 2028 can have an average LA° Δ of 0.7730 relative to the center face location, and the lower heel quadrant 2026 can have an average LA° Δ of −0.773° relative to the center face location. In other embodiments, more or fewer points may be used to calculate the average LA° Δ and/or FA° Δ values, and such points may have the same or different locations on the striking face as the points P1-P16 given above.

TABLE 12

| Average in Quadrants | | | | | | | | |
|---|---|---|---|---|---|---|---|---|
| | Example 7 0.5° twist | | Example 8 1° twist | | Example 9 1.5° twist | | Example 10 2° twist | |
| | Avg. LA°Δ | Avg. FA°Δ | Avg. LA°Δ | Avg. FA°Δ | Avg. LA°Δ | Avg. FA°Δ | Avg. LA°Δ | Avg. FA°Δ |
| Upper Toe Quadrant | 0.258 | 0.087 | 0.515 | 0.175 | 0.773 | 0.262 | 1.03 | 0.350 |
| Upper Heel Quadrant | −0.258 | 0.087 | −0.515 | 0.175 | −0.773 | 0.262 | −1.03 | 0.350 |
| Lower Toe Quadrant | 0.258 | −0.087 | 0.515 | −0.175 | 0.773 | −0.262 | 1.03 | −0.350 |
| Lower Heel Quadrant | −0.258 | −0.087 | −0.515 | −0.175 | −0.773 | −0.262 | −1.03 | −0.350 |

In certain embodiments, the average FA° Δ of the upper toe quadrant 2022 can be between 0.080 and 1.05°, where the average FA° Δ of 1.05° corresponds to a "6° twist." In certain embodiments, the average FA° Δ of the upper toe quadrant 2022 can be between 0.080 and 0.7°, where the average FA° Δ of 0.7° corresponds to a "4° twist." In certain embodiments, the average FA° Δ of the upper toe quadrant 2022 can be between 0.080 and 0.525°, where the average FA° Δ of 0.525° corresponds to a "3 twist."

In certain embodiments, the average LA° Δ of the upper toe quadrant 2022 can be between 0.250 and 3.1°, where the average LA° Δ of 3.1° corresponds to a "6° twist." In certain embodiments, the average LA° Δ of the upper toe quadrant 2022 can be between 0.250 and 2.1°, such as 2.06°, where the average LA° Δ of 2.06° corresponds to a "4° twist." In certain embodiments, the average LA° Δ of the upper toe quadrant 2022 can be between 0.250 and 1.6°, where the average LA° Δ of 1.6° corresponds to a "3 twist." The average LA° Δ and FA° Δ values above for the upper toe quadrant 2022 can be applicable to any of the fairway, hybrid, and rescue-type club heads described herein.

Third Representative Embodiment

FIGS. 36-39 illustrate another embodiment of a fairway wood type golf club head 2100 comprising a body 2102 having a hosel 2104 in which a golf club shaft may be inserted, and defining a front end or face 2106, an opposed rear end 2108, a heel side or heel portion 2110, a toe side or toe portion 2112, a lower side or sole 2114, and an upper side or crown 2116. The front end 2106 includes a face plate 2118, which may be an integral part of the body 2102, or may comprise a separate insert. For embodiments where the face plate is not integral to the body 2102, the front end 2106 can include a face opening (not shown) to receive the striking face plate 2118 that is attached to the body by welding, braising, soldering, screws or other fastening means.

Figure 36:
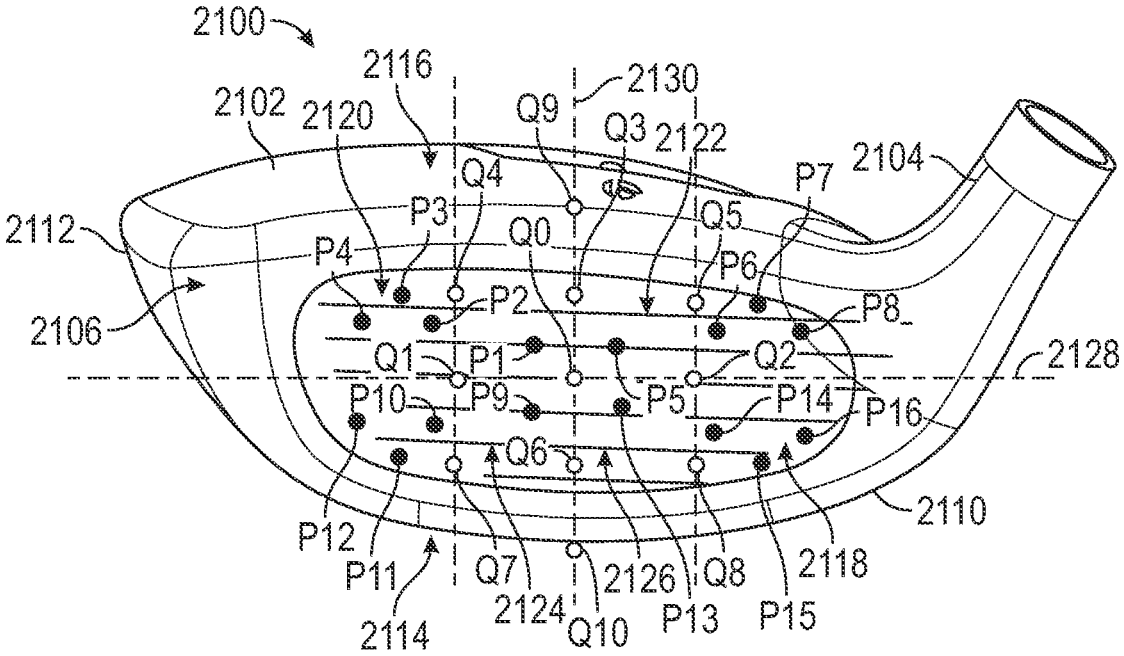
FIG. 36 is a front elevation view of another embodiment of a fairway wood-type golf club head including a plurality of measurement points indicated on the striking face.
Figure 37:
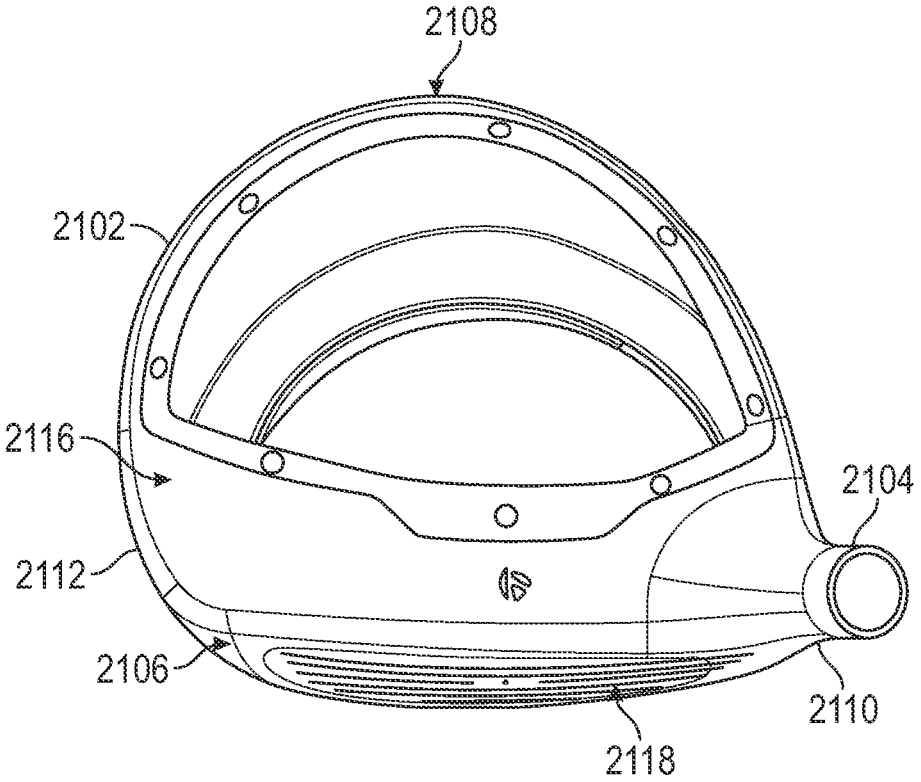
FIGS. 37-39 are a top plan view, a bottom perspective view, and a heel-side elevation view, respectively, of the golf club head of FIG. 36.
Figure 38:
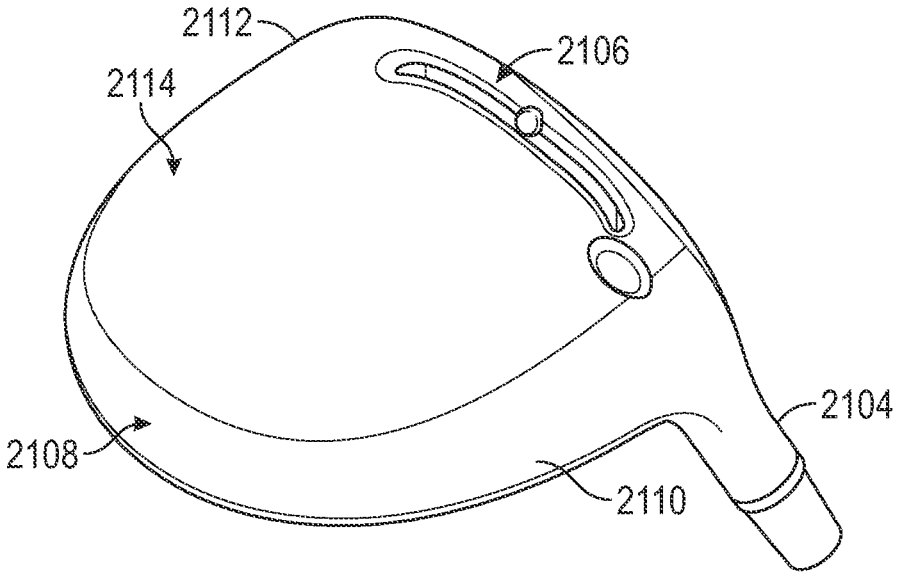
Figure 39:
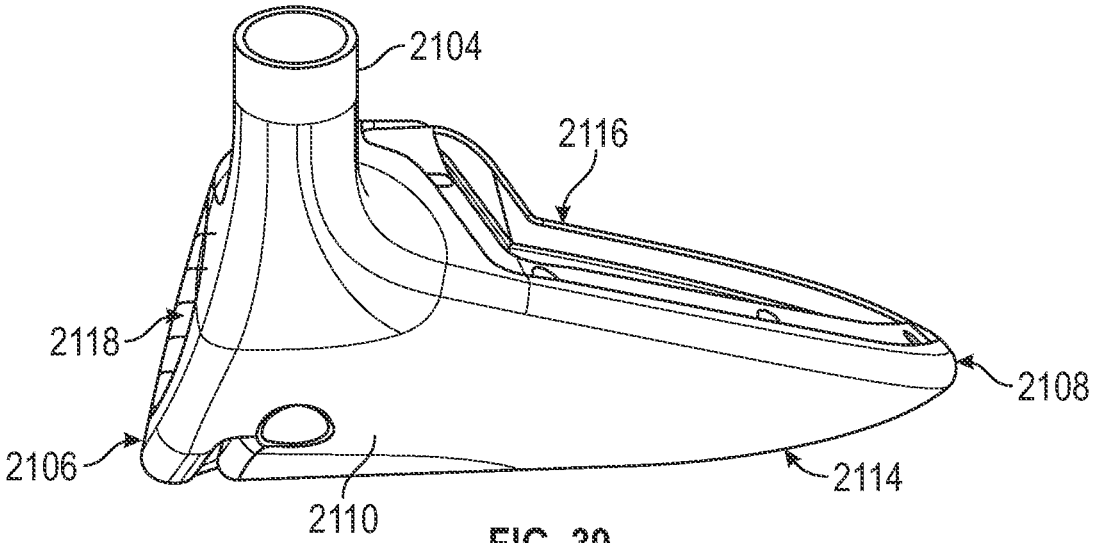

The "twisted" bulge and roll striking face contours described above with reference to FIGS. 1-10 and 34A-35B can be applicable to the striking plate 2118, as described above. The fairway wood-type club head 2100 can have any of the bulge radius, roll radius, and club head volume ranges given above. The striking face 2118 may also have any of the degrees of twist described herein. FIG. 36 shows a plurality of grid points Q0-Q10 that are spaced apart across the striking face 2118 in a grid pattern, including two "critical points" Q9 and Q10 spaced 30 mm apart. Points P1-P16 are also illustrated in FIG. 36, which may be used to calculate the average LA° Δ and FA° Δ of the various quadrants, as described above.

Utilizing the grid pattern of FIG. 36, a plurality of embodiments having a nominal center face loft angle of 15.5°, a bulge radius of 254 mm, a roll radius of 254 mm, and a volume of 201.4 cc, are analyzed having a "0.5° twist," a "1° twist", a "1.5° twist", and a "2° twist" corresponding to Examples 11-14, respectively. The center face location (Q0) can be located at the geometric center of the striking face, and a toe-ward most point of the club head can be spaced from the center face location by a horizontal distance of 57.1 mm. The center face location can be located at a distance of 19.5 mm relative to the ground plane, and the club head can have a height $H_{CH}$ of 41.1 mm. The striking face 2118 can have a length dimension of 66.7 mm and a height dimension of 26.2 mm, although in other embodiments the golf club head 2100 can have any of the loft angle, bulge, roll, volume, center face location, and/or club head height values described herein. LA° Δ and FA° Δ values for the points Q0-Q8 are given for each of Examples 11-14 in Table 13 below.

TABLE 13

| Relative to Center Face and Bands | | | | | | | | | | |
|---|---|---|---|---|---|---|---|---|---|---|
| | X-axis | Y-Axis | Example 11 0.5° twist | | Example 12 1° twist | | Example 13 1.5° twist | | Example 14 2° twist | |
| Point | (mm) | (mm) | LA° Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 |
| Q1 | -14 | 0 | 0.23 | 0 | 0.47 | 0 | 0.70 | 0 | 0.93 | 0 |

TABLE 13-continued

| Relative to Center Face and Bands | | | | | | | | | | |
|---|---|---|---|---|---|---|---|---|---|---|
| | X-axis | Y-Axis | Example 11 0.5° twist | | Example 12 1° twist | | Example 13 1.5° twist | | Example 14 2° twist | |
| Point | (mm) | (mm) | LA° Δ | FA°Δ | LA°Δ | FA°Δ | LA°Δ | FA°Δ | LA°Δ | FA°Δ |
| Q2 | 14 | 0 | -0.23 | 0 | -0.47 | 0 | -0.70 | 0 | -0.93 | 0 |
| Q3 | 0 | 7.5 | 0 | 0.13 | 0 | 0.25 | 0 | 0.38 | 0 | 0.50 |
| Q4 | -14 | 7.5 | 0.23 | 0.13 | 0.47 | 0.25 | 0.70 | 0.38 | 0.93 | 0.50 |
| Q5 | 14 | 7.5 | -0.23 | 0.13 | -0.47 | 0.25 | -0.70 | 0.38 | -0.93 | 0.50 |
| Q6 | 0 | -7.5 | 0 | -0.13 | 0 | -0.25 | 0 | -0.38 | 0 | -0.50 |
| Q7 | -14 | -7.5 | 0.23 | -0.13 | 0.47 | -0.25 | 0.70 | -0.38 | 0.93 | -0.50 |
| Q8 | 14 | -7.5 | -0.23 | -0.13 | -0.47 | -0.25 | -0.70 | -0.38 | -0.93 | -0.50 |

As shown in Table 13, for the fairway wood-type club 2100 illustrated in FIGS. 36-39, the LA° Δ can vary from 0.230 at points Q1, Q4 and Q7 to −0.23° at points Q2, Q5, and Q8 when the club head has 0.5° of twist. When the club head has 2° of twist, the LA° Δ can vary from 0.930 at points Q1, Q4 and Q7 to −0.93° at points Q2, Q5, and Q8. The FA° Δ can vary from 0.130 at points Q3, Q4 and Q5 to −0.13° at points Q6, Q7, and Q8 when the club head has 0.5° of twist, and from 0.5° at points Q3, Q4 and Q5 to −0.5° at points Q6, Q7, and Q8 when the club head has 2° of twist.

Values and coordinates of the points P1-P16 are given below in Table 14. As in the embodiments above, points P1-P4 are located in an upper toe quadrant 2120, points P5-P8 are located in an upper heel quadrant 2122, points P9-P12 are located in a lower toe quadrant 2124, and points P13-P16 are located in a lower heel quadrant 2126. The quadrants 2120-2126 are defined by axes 2128 and 2130, which intersect at the center face location.

The average FA° Δ and LA° Δ values for each quadrant in Examples 11-14 of Table 14 are given in Table 15. In particular embodiments, the fairway-type golf club head 2100 of FIGS. 36-39 may have 2° of twist, as in Example 14 of Tables 14 and 15. Thus, with reference to Example 14, the upper toe quadrant 2120 can have an average FA° Δ of 0.35° relative to the center face location, the upper heel quadrant 2122 can have an average FA° Δ of 0.35° relative to the center face location, the lower toe quadrant 2124 can have an average FA° Δ of −0.35° relative to the center face location, and the lower heel quadrant 2126 can have an average FA° Δ of −0.35° relative to the center face location. Still referring to Example 14 and Table 15, the upper toe quadrant 2120 can have an average LA° Δ of 1.03° relative to the center face location, the upper heel quadrant 2122 has an average LA° Δ of −1.03° relative to the center face location, the lower toe quadrant 2124 has an average LA° Δ of 1.03° relative to the center face location, and the lower heel quadrant 2126 has an average LA° Δ of −1.03° relative to the center face location.

TABLE 14

| LA°Δ and FA°Δ for Points P1-P16 | | | | | | | | | | | |
|---|---|---|---|---|---|---|---|---|---|---|---|
| | | X-axis | Y-Axis | Ex. 11 0.5° twist | | Ex. 12 1.0° twist | | Ex. 13 1.5° twist | | Ex. 14 2° twist | |
| Quadrant | Point | (mm) | (mm) | LA° Δ | FA°Δ | LA°Δ | FA°Δ | LA°Δ | FA°Δ | LA°Δ | FA°Δ |
| Upper | P1 | −4 | 3 | 0.07 | 0.05 | 0.13 | 0.10 | 0.20 | 0.15 | 0.27 | 0.20 |
| Toe | P2 | −15 | 5 | 0.25 | 0.08 | 0.5 | 0.17 | 0.75 | 0.25 | 0.99 | 0.33 |
| | P3 | −20 | 8 | 0.33 | 0.13 | 0.66 | 0.27 | 0.99 | 0.40 | 1.33 | 0.53 |
| | P4 | −23 | 5 | 0.38 | 0.08 | 0.76 | 0.17 | 1.14 | 0.25 | 1.52 | 0.33 |
| Upper | P5 | 4 | 3 | −0.07 | 0.05 | −0.13 | 0.10 | −0.20 | 0.15 | −0.27 | 0.20 |
| Heel | P6 | 15 | 5 | −0.25 | 0.08 | −0.5 | 0.17 | −0.75 | 0.25 | −0.99 | 0.33 |
| | P7 | 20 | 8 | −0.33 | 0.13 | −0.66 | 0.27 | −0.99 | 0.40 | −1.33 | 0.53 |
| | P8 | 23 | 5 | −0.38 | 0.08 | −0.76 | 0.17 | −1.14 | 0.25 | −1.52 | 0.33 |
| Lower | P9 | −4 | −3 | 0.07 | 0.05 | 0.13 | −0.10 | 0.20 | −0.15 | 0.27 | −0.20 |
| Toe | P10 | −15 | −5 | 0.25 | 0.08 | 0.5 | −0.17 | 0.75 | −0.25 | 0.99 | −0.33 |
| | P11 | −20 | −8 | 0.33 | 0.13 | 0.66 | −0.27 | 0.99 | −0.40 | 1.33 | −0.53 |
| | P12 | −23 | −5 | 0.38 | 0.08 | 0.76 | −0.17 | 1.14 | −0.25 | 1.52 | −0.33 |
| Lower | P13 | 4 | −3 | −0.07 | 0.05 | −0.13 | −0.10 | −0.20 | −0.15 | −0.27 | −0.20 |
| Heel | P14 | 15 | −5 | −0.25 | 0.08 | −0.5 | −0.17 | −0.75 | −0.25 | −0.99 | −0.33 |
| | P15 | 20 | −8 | −0.33 | 0.13 | −0.66 | −0.27 | −0.99 | −0.40 | −1.33 | −0.53 |
| | P16 | 23 | −5 | −0.38 | 0.08 | −0.76 | −0.17 | −1.14 | −0.25 | −1.52 | −0.33 |

TABLE 15

| Average in Quadrants | | | | | | | | |
|---|---|---|---|---|---|---|---|---|
| | Example 11 0.5° twist | | Example 12 1° twist | | Example 13 1.5° twist | | Example 14 2° twist | |
| | Avg. LA°Δ | Avg. FA°Δ | Avg. LA°Δ | Avg. FA°Δ | Avg. LA°Δ | Avg. FA°Δ | Avg. LA°Δ | Avg. FA°Δ |
| Upper Toe Quadrant | 0.258 | 0.087 | 0.515 | 0.175 | 0.773 | 0.262 | 1.03 | 0.350 |
| Upper Heel Quadrant | −0.258 | 0.087 | −0.515 | 0.175 | −0.773 | 0.262 | −1.03 | 0.350 |
| Lower Toe Quadrant | 0.258 | −0.087 | 0.515 | −0.175 | 0.773 | −0.262 | 1.03 | −0.350 |
| Lower Heel Quadrant | −0.258 | −0.087 | −0.515 | −0.175 | −0.773 | −0.262 | −1.03 | −0.350 |

Fourth Representative Embodiment

FIGS. 40-43 illustrate another embodiment of a golf club head configured as a rescue-type golf club head 2200 comprising a body 2202 having a hosel 2204 in which a golf club shaft may be inserted, and defining a front end or face 2206, an opposed rear end 2208, a heel side or heel portion 2210, a toe side or toe portion 2212, a lower side or sole 2214, and an upper side or crown 2216. The front end 2206 includes a face plate 2218, which may be an integral part of the body 2202, or may comprise a separate insert. For embodiments where the face plate is not integral to the body 2202, the front end 2206 can include a face opening (not shown) to receive the striking face plate 2218 that is attached to the body by welding, braising, soldering, screws or other fastening means.

Figure 40:
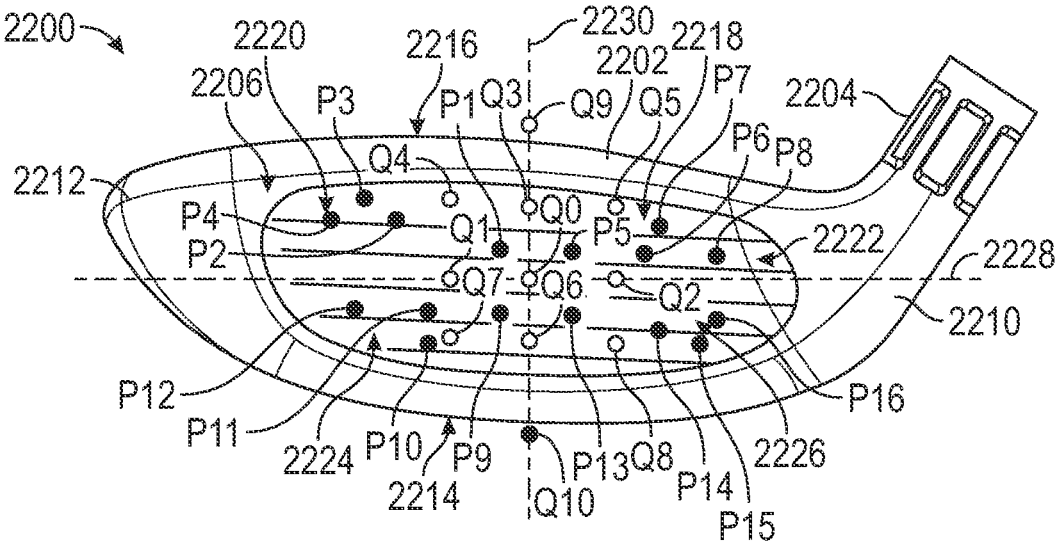
FIG. 40 is a front elevation view of a rescue-type golf club head, according to one embodiment.
Figure 41:
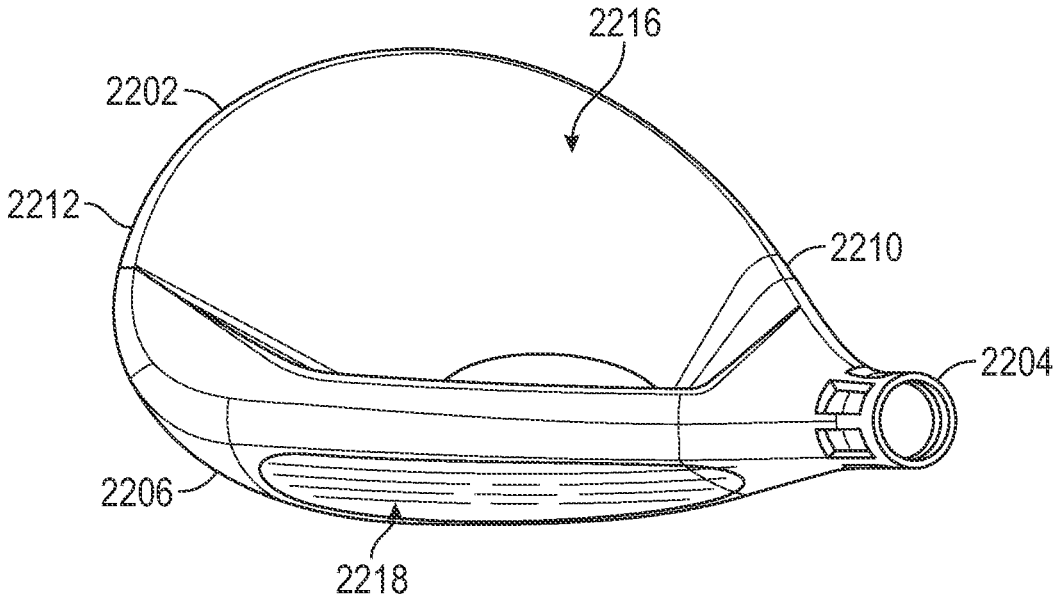
FIGS. 41-43 are a top plan view, a bottom perspective view, and a heel-side elevation view, respectively, of the golf club head of FIG. 40.
Figure 42:
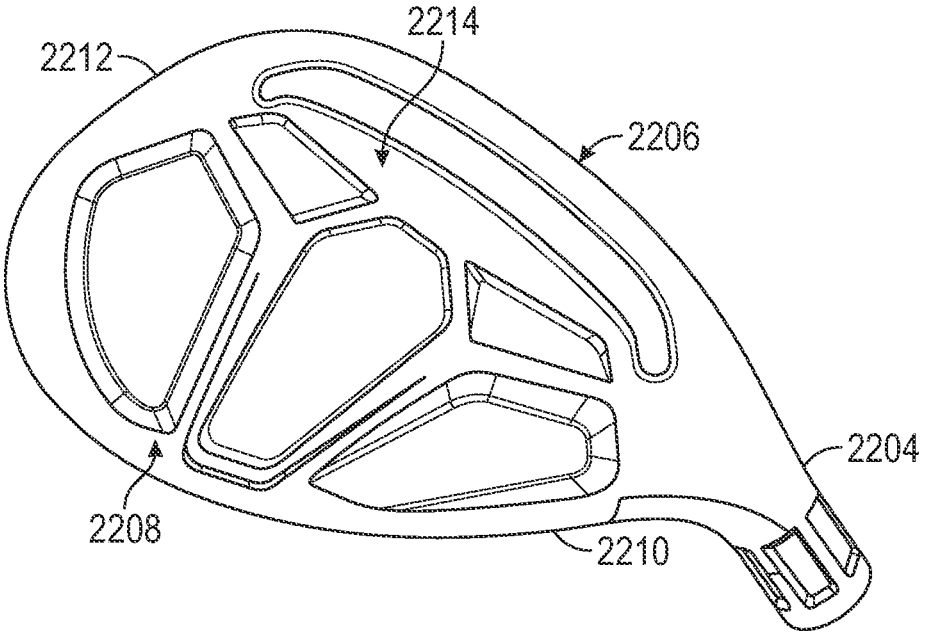
Figure 43:
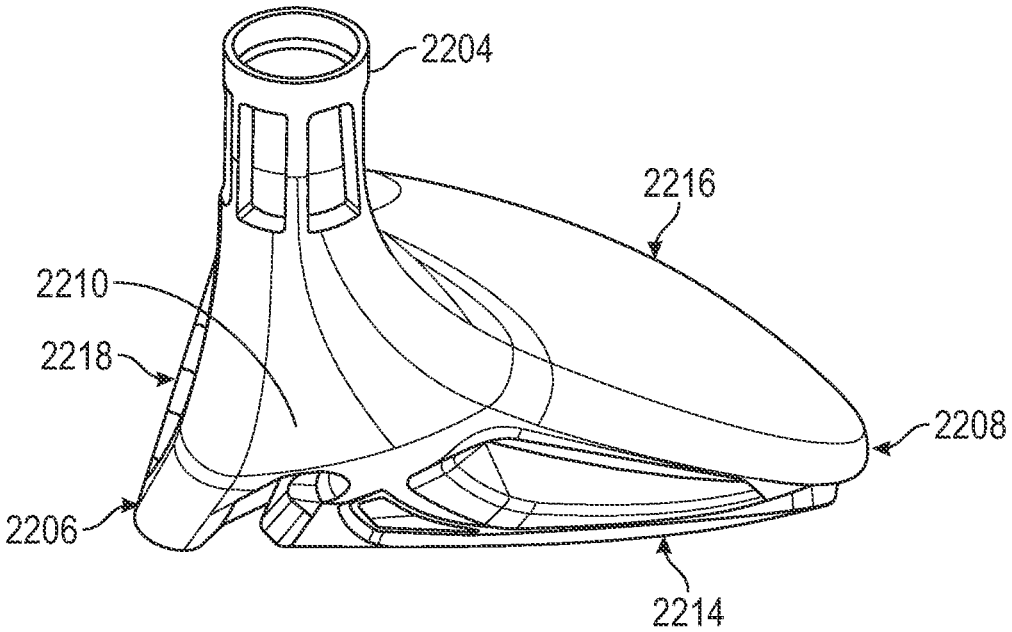

The striking face 2218 of the rescue-type golf club head 2200 may include the "twisted" bulge and roll striking face contours described above with reference to FIGS. 1-10 and 34A-35B. FIG. 40 shows a plurality of grid points Q0-Q10 that are spaced apart across the striking face in a grid pattern, including two "critical points" Q9 and Q10 spaced 30 mm apart. Points P1-P16 are also illustrated in FIG. 40, which may be used to calculate the average LA° Δ and FA° Δ of the various quadrants, as described above.

Utilizing the grid pattern of FIG. 40, a plurality of embodiments having a bulge radius of 320 mm, a roll radius of 356 mm, and a volume of 90 cc to 115 cc, are analyzed having a "0.5° twist," a "1° twist", a "1.5° twist", and a "2° twist" corresponding to Examples 15-18, respectively. In certain embodiments, the club head 2200 can have a nominal center face loft angle of from 19° to 31°. A toe-ward most point of the club head can be spaced a horizontal distance of 52.9 mm relative to the center face location (Q0), and the center face location can be located at a distance of 17.4 mm relative to the ground plane. The club head can have a height $H_CH$ of 34.3 mm. The striking face 2218 can have a length dimension of 62.9 mm and a height dimension of 24.1 mm, although in other embodiments the golf club head 2200 can have any of the loft angle, bulge, roll, volume, center face location, and/or club head height values described herein. LA° Δ and FA° Δ values for the points Q0-Q8 are given for each of Examples 15-18 in Table 16 below.

TABLE 16

| Relative to Center Face and Bands | | | | | | | | | | |
|---|---|---|---|---|---|---|---|---|---|---|
| | X-axis | Y-Axis | Example 15 0.5° twist | | Example 16 1° twist | | Example 17 1.5° twist | | Example 18 2° twist | |
| Point | (mm) | (mm) | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 |
| Q1 | −14 | 0 | 0.23 | 0 | 0.47 | 0 | 0.7 | 0 | 0.93 | 0 |
| Q2 | 14 | 0 | −0.23 | 0 | −0.47 | 0 | −0.7 | 0 | −0.93 | 0 |
| Q3 | 0 | 7.5 | 0 | 0.13 | 0 | 0.25 | 0 | 0.38 | 0 | 0.5 |
| Q4 | −14 | 7.5 | 0.23 | 0.13 | 0.47 | 0.25 | 0.7 | 0.38 | 0.93 | 0.5 |
| Q5 | 14 | 7.5 | −0.23 | 0.13 | −0.47 | 0.25 | −0.7 | 0.38 | −0.93 | 0.5 |
| Q6 | 0 | −7.5 | 0 | −0.13 | 0 | −0.25 | 0 | −0.38 | 0 | −0.5 |
| Q7 | −14 | −7.5 | 0.23 | −0.13 | 0.47 | −0.25 | 0.7 | −0.38 | 0.93 | −0.5 |
| Q8 | 14 | −7.5 | −0.23 | −0.13 | −0.47 | −0.25 | −0.7 | −0.38 | −0.93 | −0.5 |

As shown in Table 16, for the rescue wood-type club 2200 illustrated in FIGS. 40-43, the LA° Δ can vary from 0.23° at points Q1, Q4 and Q7 to −0.23° at points Q2, Q5, and Q8 when the club head has 0.5° of twist. When the club head has 2° of twist, the LA° Δ can vary from 0.930 at points Q1, Q4 and Q7 to −0.93° at points Q2, Q5, and Q8. The FA° Δ can vary from 0.130 at points Q3, Q4 and Q5 to 0.13° at points Q6, Q7, and Q8 when the club head has 0.50 of twist, and from 0.50 at points Q3, Q4 and Q5 to −0.5° at points Q6, Q7, and Q8 when the club head has 2 of twist.

Values and coordinates of the points P1-P16 are given below in Table 17. As in the embodiments above, points P1-P4 are located in an upper toe quadrant 2220, points P5-P8 are located in the upper heel quadrant 2222, points P9-P12 are located in a lower toe quadrant 2224, and points P13-P16 are located in a lower heel quadrant 2226. The quadrants 2220-2226 are defined by axes 2228 and 2230, which intersect at the center face location.

TABLE 17

LA°Δ and FA°Δ for Points P1-P16

| Quadrant | Point | X-axis (mm) | Y-Axis (mm) | Ex. 15 0.5° twist LA°Δ | Ex. 15 0.5° twist FA°Δ | Ex. 16 1.0° twist LA°Δ | Ex. 16 1.0° twist FA°Δ | Ex. 17 1.5° twist LA°Δ | Ex. 17 1.5° twist FA°Δ | Ex. 18 2° twist LA°Δ | Ex. 18 2° twist FA°Δ |
|---|---|---|---|---|---|---|---|---|---|---|---|
| Upper Toe | P1 | −4 | 3 | 0.07 | 0.05 | 0.13 | 0.10 | 0.20 | 0.15 | 0.27 | 0.20 |
| | P2 | −15 | 5 | 0.25 | 0.08 | 0.49 | 0.17 | 0.75 | 0.25 | 0.99 | 0.33 |
| | P3 | −20 | 8 | 0.33 | 0.13 | 0.66 | 0.26 | 0.99 | 0.40 | 1.33 | 0.53 |
| | P4 | −23 | 5 | 0.38 | 0.08 | 0.76 | 0.17 | 1.14 | 0.25 | 1.53 | 0.33 |
| Upper Heel | P5 | 4 | 3 | −0.07 | 0.05 | −0.13 | 0.100 | −0.20 | 0.15 | −0.27 | 0.20 |
| | P6 | 15 | 5 | −0.25 | 0.08 | −0.49 | 0.17 | −0.75 | 0.25 | −0.99 | 0.33 |
| | P7 | 20 | 8 | −0.33 | 0.13 | −0.66 | 0.27 | −0.99 | 0.40 | −1.33 | 0.53 |
| | P8 | 23 | 5 | −0.38 | 0.08 | −0.76 | 0.17 | −1.14 | 0.25 | −1.53 | 0.33 |
| Lower Toe | P9 | −4 | −3 | 0.07 | −0.05 | 0.13 | −0.10 | 0.20 | −0.15 | 0.27 | −0.20 |
| | P10 | −15 | −5 | 0.25 | −0.08 | 0.49 | −0.17 | 0.75 | −0.25 | 0.99 | −0.33 |
| | P11 | −20 | −8 | 0.33 | −0.13 | 0.66 | −0.27 | 0.99 | −0.40 | 1.33 | −0.53 |
| | P12 | −23 | −5 | 0.38 | −0.08 | 0.76 | −0.17 | 1.14 | −0.25 | 1.53 | −0.33 |
| Lower Heel | P13 | 4 | −3 | −0.07 | −0.05 | −0.13 | −0.10 | −0.20 | −0.15 | −0.27 | −0.20 |
| | P14 | 15 | −5 | −0.25 | −0.08 | −0.49 | −0.17 | −0.75 | −0.25 | −0.99 | −0.33 |
| | P15 | 20 | −8 | −0.33 | −0.13 | −0.66 | −0.27 | −0.99 | −0.40 | −1.33 | −0.53 |
| | P16 | 23 | −5 | −0.38 | −0.08 | −0.76 | −0.17 | −1.14 | −0.25 | −1.53 | −0.33 |

The average FA° Δ and LA° Δ values for each quadrant in Examples 15-18 of Table 17 are given in Table 18. In particular embodiments, the rescue-type golf club head 2200 of FIGS. 40-43 may have 1.5° of twist, as in Example 17 of Tables 17 and 18. Thus, with reference to Example 17, the upper toe quadrant 2220 can have an average FA° Δ of 0.262° relative to the center face location, the upper heel quadrant 2222 can have an average FA° Δ of 0.262° relative to the center face location, the lower toe quadrant 2224 can have an average FA° Δ of −0.262° relative to the center face location, and the lower heel quadrant 2226 can have an average FA° Δ of −0.262° relative to the center face location. Still referring to Example 17 and Table 18, the upper toe quadrant 2220 can have an average LA° Δ of 0.774° relative to the center face location, the upper heel quadrant 2222 has an average LA° Δ of −0.774° relative to the center face location, the lower toe quadrant 2224 has an average LA° Δ of 0.774° relative to the center face location, and the lower heel quadrant 2226 has an average LA° Δ of −0.774° relative to the center face location.

TABLE 18

Average in Quadrants

| | Example 1 0.5° twist Avg. LA°Δ | Example 1 0.5° twist Avg. FA°Δ | Example 2 1° twist Avg. LA°Δ | Example 2 1° twist Avg. FA°Δ | Example 3 1.5° twist Avg. LA°Δ | Example 3 1.5° twist Avg. FA°Δ | Example 4 2° twist Avg. LA°Δ | Example 4 2° twist Avg. FA°Δ |
|---|---|---|---|---|---|---|---|---|
| Upper Toe Quadrant | 0.258 | 0.087 | 0.516 | 0.175 | 0.774 | 0.262 | 1.031 | 0.350 |
| Upper Heel Quadrant | −0.258 | 0.087 | −0.516 | 0.175 | −0.774 | 0.262 | −1.031 | 0.350 |
| Lower Toe Quadrant | 0.258 | −0.087 | 0.516 | −0.175 | 0.774 | −0.262 | 1.031 | −0.350 |
| Lower Heel Quadrant | −0.258 | −0.087 | −0.516 | −0.175 | −0.774 | −0.262 | −1.031 | −0.350 |

Fifth Representative Embodiment

FIGS. 44-47 illustrate another embodiment of a hybrid wood-type golf club head 2300 comprising a body 2302 having a hosel 2304 in which a golf club shaft may be inserted, and defining a front end or face 2306, an opposed rear end 2308, a heel side or heel portion 2310, a toe side or toe portion 2312, a lower side or sole 2314, and an upper side or crown 2316. The front end 2306 includes a face plate 2318, which may be an integral part of the body 2302, or may comprise a separate insert. For embodiments where the face plate is not integral to the body 2302, the front end 2306 can include a face opening (not shown) to receive the striking face plate 2318 that is attached to the body by welding, braising, soldering, screws or other fastening means.

Figure 44:
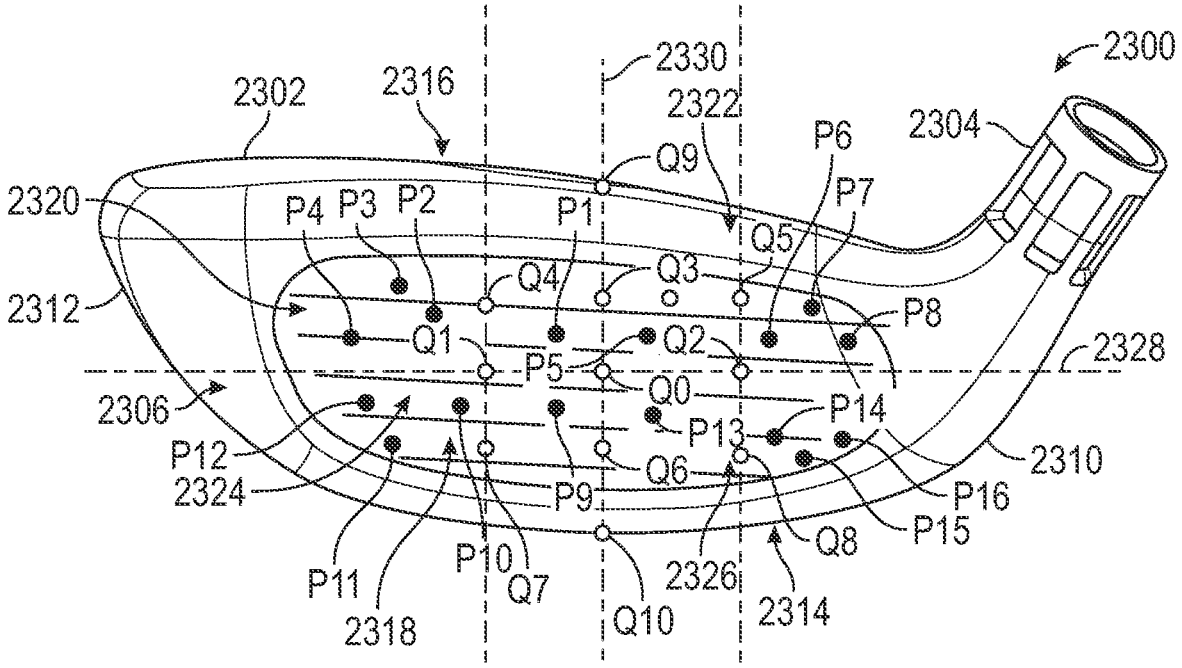
FIG. 44 is a front elevation view of hybrid-type golf club head, according to one embodiment.
Figure 45:
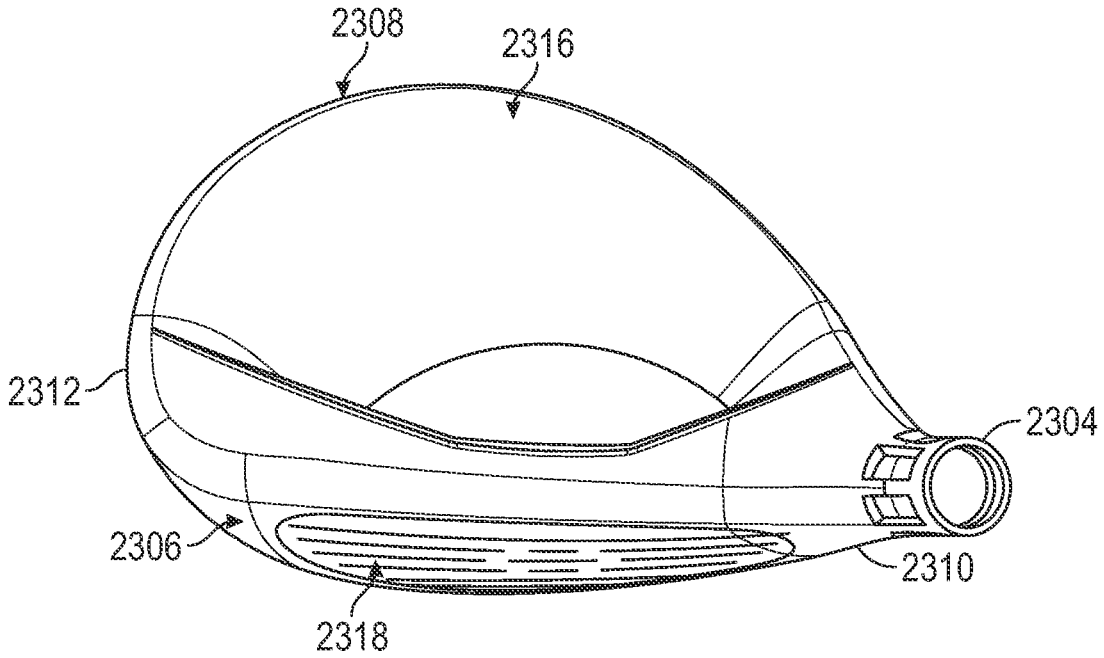
FIGS. 45-47 are a top plan view, a bottom perspective view, and a heel-side elevation view, respectively, of the golf club head of FIG. 44.
Figure 46:
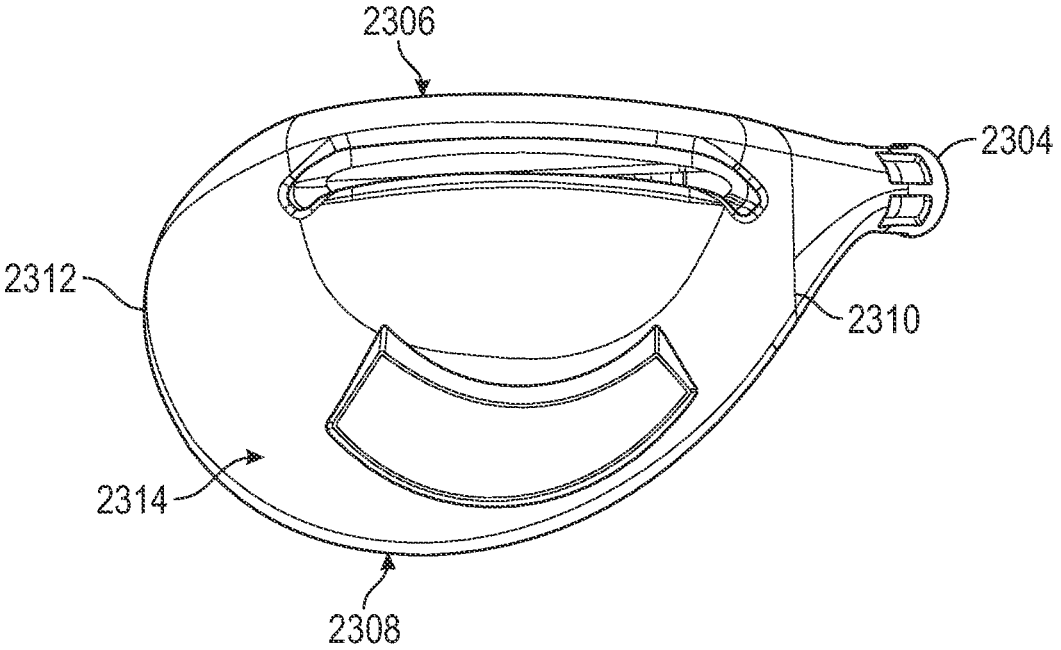
Figure 47:
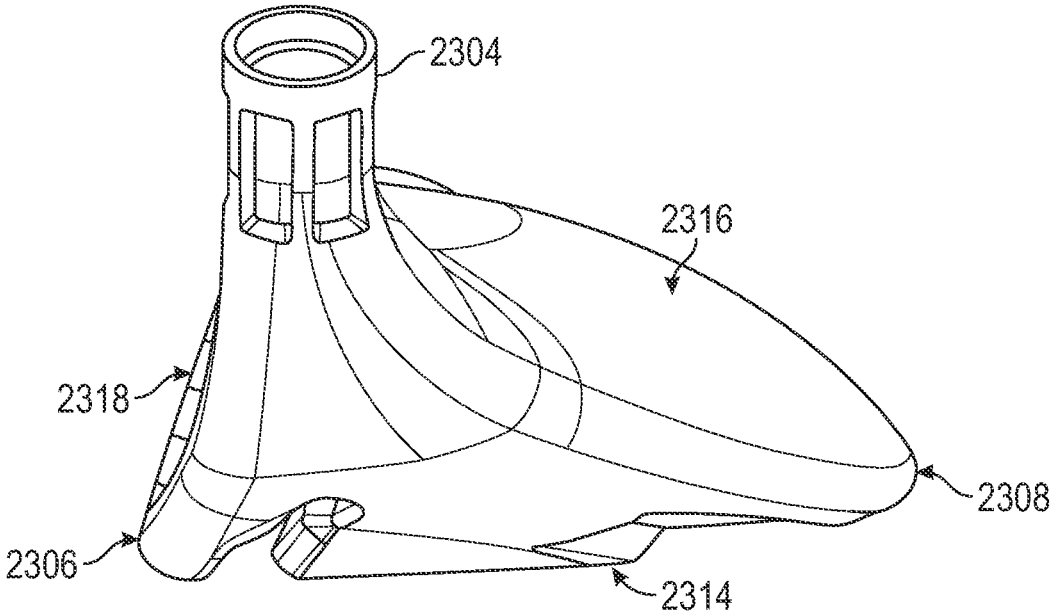

The striking face 2318 of the hybrid-type golf club head 2300 may include the "twisted" bulge and roll striking face contours described above with reference to FIGS. 1-10 and 34A-35B. FIG. 44 shows a plurality of grid points Q0-Q10 that are spaced apart across the striking face 2318 in a grid pattern, including two "critical points" Q9 and Q10 spaced 30 mm apart. Points P1-P16 are also illustrated in FIG. 44, which may be used to calculate the average LA° Δ and FA° Δ of the various quadrants, as described above.

Utilizing the grid pattern of FIG. 44, a plurality of embodiments having a nominal center face loft angle of 19°, a bulge radius of 355.6 mm, a roll radius of 355.6 mm, and a volume of 100 cc to 106 cc, are analyzed having a "1° twist," a "2° twist", a "3 twist", and a "4° twist" corresponding to Examples 19-22, respectively. A toe-ward most point of the club head can be spaced a horizontal distance of 52.4 mm from the center face location (Q0), and the center face location can be spaced 17.4 mm above the ground plane. The club head can have a height $H_{CH}$ of 34.1 mm. The striking face 2318 can have a length dimension of 63.2 mm and a height dimension of 23.9 mm, although in other embodiments the golf club head 2300 can have any of the loft angle, bulge, roll, volume, center face location, and/or club head height values described herein. For example, the hybrid club head 2300 can have a bulge radius of from about 190 mm to 520 mm, or from about 320 mm to about 432 mm, and a roll radius of about 120 mm to 520 mm, or about 355 mm to about 508 mm. In certain embodiments, the club head 2300 can have a volume of from about 85 cc to about 135 cc, or from about 95 cc to about 115 cc.

LA° Δ and FA° Δ values for the points Q0-Q8 are given for each of Examples 19-22 in Table 19 below.

TABLE 19

| Relative to Center Face and Bands | | | | | | | | | | |
|---|---|---|---|---|---|---|---|---|---|---|
| | X-axis | Y-Axis | Example 19 1° twist | | Example 20 2° twist | | Example 21 3° twist | | Example 22 4° twist | |
| Point | (mm) | (mm) | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 |
| Q1 | −14 | 0 | 0.47 | 0 | 0.93 | 0 | 1.4 | 0 | 1.87 | 0 |
| Q2 | 14 | 0 | −0.47 | 0 | −0.93 | 0 | −1.4 | 0 | −1.87 | 0 |
| Q3 | 0 | 7.5 | 0 | 0.25 | 0 | 0.5 | 0 | 0.75 | 0 | 1.0 |
| Q4 | −14 | 7.5 | 0.47 | 0.25 | 0.93 | 0.5 | 1.4 | 0.75 | 1.87 | 1.0 |
| Q5 | 14 | 7.5 | −0.47 | 0.25 | −0.93 | 0.5 | −1.4 | 0.75 | −1.87 | 1.0 |
| Q6 | 0 | −7.5 | 0 | −0.25 | 0 | −0.5 | 0 | −0.75 | 0 | −1.0 |
| Q7 | −14 | −7.5 | 0.47 | −0.25 | 0.93 | −0.5 | 1.4 | −0.75 | 1.87 | −1.0 |
| Q8 | 14 | −7.5 | −0.47 | −0.25 | −0.93 | −0.5 | −1.4 | −0.75 | −1.87 | −1.0 |

As shown in Table 19, for the rescue wood-type club 2300 illustrated in FIGS. 44-47, the LA° Δ can vary from 0.47° at points Q1, Q4 and Q7 to −0.47° at points Q2, Q5, and Q8 when the club head has 1° of twist. When the club head has 4° of twist, the LA° Δ can vary from 1.87° at points Q1, Q4 and Q7 to −1.87° at points Q2, Q5, and Q8. The FA° Δ can vary from 0.25° at points Q3, Q4 and Q5 to −0.25° at points Q6, Q7, and Q8 when the club head has 10° of twist, and from 10° at points Q3, Q4 and Q5 to −1° at points Q6, Q7, and Q8 when the club head has 4° of twist.

Values and coordinates of the points P1-P16 are given below in Table 20. As in the embodiments above, points P1-P4 are located in an upper toe quadrant 2320, points P5-P8 are located in the upper heel quadrant 2322, points P9-P12 are located in a lower toe quadrant 2324, and points P13-P16 are located in a lower heel quadrant 2326. The quadrants 2320-2326 are defined by axes 2328 and 2330, which intersect at the center face location.

TABLE 20

| LA°Δ and FA°Δ for Points P1-P16 | | | | | | | | | | | |
|---|---|---|---|---|---|---|---|---|---|---|---|
| | | X-axis | Y-Axis | Ex. 19 1° twist | | Ex. 20 2° twist | | Ex. 21 3° twist | | Ex. 22 4° twist | |
| Quadrant | Point | (mm) | (mm) | LA°Δ | FA°Δ | LA°Δ | FA°Δ | LA°Δ | FA°Δ | LA°Δ | FA°Δ |
| Upper | P1 | −4 | 3 | 0.13 | 0.10 | 0.27 | 0.20 | 0.40 | 0.30 | 0.53 | 0.40 |
| Toe | P2 | −15 | 5 | 0.50 | 0.17 | 0.99 | 0.33 | 1.49 | 0.50 | 1.99 | 0.67 |
| | P3 | −20 | 8 | 0.66 | 0.27 | 1.33 | 0.53 | 1.99 | 0.80 | 2.66 | 1.06 |
| | P4 | −23 | 5 | 0.76 | 0.17 | 1.53 | 0.33 | 2.29 | 0.50 | 3.06 | 0.67 |
| Upper | P5 | 4 | 3 | −0.13 | 0.10 | −0.27 | 0.20 | −0.40 | 0.30 | −0.53 | 0.40 |
| Heel | P6 | 15 | 5 | −0.50 | 0.17 | −0.99 | 0.33 | −1.49 | 0.50 | −1.99 | 0.67 |
| | P7 | 20 | 8 | −0.66 | 0.27 | −1.33 | 0.53 | −1.99 | 0.80 | −2.66 | 1.06 |
| | P8 | 23 | 5 | −0.76 | 0.17 | −1.53 | 0.33 | −2.29 | 0.50 | −3.06 | 0.67 |
| Lower | P9 | −4 | −3 | 0.13 | −0.10 | 0.27 | −0.20 | 0.40 | −0.30 | 0.53 | −0.40 |
| Toe | P10 | −15 | −5 | 0.50 | −0.17 | 0.99 | −0.33 | 1.49 | −0.50 | 1.99 | −0.67 |
| | P11 | −20 | −8 | 0.66 | −0.27 | 1.33 | −0.53 | 1.99 | −0.80 | 2.66 | −1.06 |
| | P12 | −23 | −5 | 0.76 | −0.17 | 1.53 | −0.33 | 2.29 | −0.50 | 3.06 | −0.67 |
| Lower | P13 | 4 | −3 | −0.13 | −0.10 | −0.27 | −0.20 | −0.40 | −0.30 | −0.53 | −0.40 |
| Heel | P14 | 15 | −5 | −0.50 | −0.17 | −0.99 | −0.33 | −1.49 | −0.50 | −1.99 | −0.67 |
| | P15 | 20 | −8 | −0.66 | −0.27 | −1.33 | −0.53 | −1.99 | −0.80 | −2.66 | −1.06 |
| | P16 | 23 | −5 | −0.76 | −0.17 | −1.53 | −0.33 | −2.29 | −0.50 | −3.06 | −0.67 |

The average FA° Δ and LA° Δ values for each quadrant in Examples 19-22 of Table 20 are given in Table 21. In particular embodiments, the hybrid-type golf club head 2300 of FIGS. 44-47 may have 3° of twist, as in Example 21 of Tables 20 and 21. Thus, with reference to Example 21, the upper toe quadrant 2320 can have an average FA° Δ of 0.525° relative to the center face location, the upper heel quadrant 2322 can have an average FA° Δ of 0.525° relative to the center face location, the lower toe quadrant 2324 can have an average FA° Δ of −0.525° relative to the center face location, and the lower heel quadrant 2326 can have an average FA° Δ of −0.525° relative to the center face location. Still referring to Example 21 and Table 21, the upper toe quadrant 2320 can have an average LA° Δ of 1.548° relative to the center face location, the upper heel quadrant 2322 can have an average LA° Δ of −1.548° relative to the center face location, the lower toe quadrant 2324 can have an average LA° Δ of 1.548° relative to the center face location, and the lower heel quadrant 2326 can have an average LA° Δ of −1.548° relative to the center face location.

TABLE 21

| | Average in Quadrants | | | | | | | |
|---|---|---|---|---|---|---|---|---|
| | Example 1 1° twist | | Example 2 2° twist | | Example 3 3° twist | | Example 4 4° twist | |
| | Avg. LA°Δ | Avg. FA°Δ | Avg. LA°Δ | Avg. FA°Δ | Avg. LA°Δ | Avg. FA°Δ | Avg. LA°Δ | Avg. FA°Δ |
| Upper Toe Quadrant | 0.516 | 0.175 | 1.032 | 0.350 | 1.548 | 0.525 | 2.064 | 0.70 |
| Upper Heel Quadrant | −0.516 | 0.175 | −1.032 | 0.350 | −1.548 | 0.525 | −2.064 | 0.70 |
| Lower Toe Quadrant | 0.516 | −0.175 | 1.032 | −0.350 | 1.548 | −0.525 | 2.064 | −0.70 |
| Lower Heel Quadrant | −0.516 | −0.175 | −1.032 | −0.350 | −1.548 | −0.525 | −2.064 | −0.70 |

Sixth Representative Embodiment

In another representative embodiment, a fairway wood-type golf club head similar to the golf club head 2200 shown in FIGS. 40-43 can have a nominal center face loft angle of 14° to 24°, a bulge radius of 254 mm, a roll radius of 317.5 mm, a volume of 145 cc to 187 cc, a club head height of 38 mm to 42 mm, a striking face length of 65 mm, and a striking face height of about 38 mm. Where the striking face comprises a "0.5° twist", a "1° twist", a "1.5° twist," or a "2° twist," the locations on the striking face corresponding to the points Q0-Q8 and P1-P16 can have FA° Δ and LA° Δ values that are equal to, or substantially equal to, the corresponding values given in Tables 16 and 17 above. The upper toe, upper heel, lower toe, and lower heel quadrants can also have average FA° Δ and LA° Δ values equal to, or substantially equal to, the values given above in Table 18.

In addition to the composite crown and sole inserts described above, any of the golf club heads described herein can include a crown or crown insert(s) configured to reduce aerodynamic drag forces on the golf club head as described further in U.S. Publication No. 2013/0123040 and U.S. Publication No. 2018/0178087, incorporated herein by reference.

In certain embodiments, the fairway, hybrid, and rescue-type golf club heads described herein may have nominal center face loft angles of 140 or greater, such as 140 to 35°, 140 to 31°, 15° to 30°, or 150 to 25°.

Figure 48:
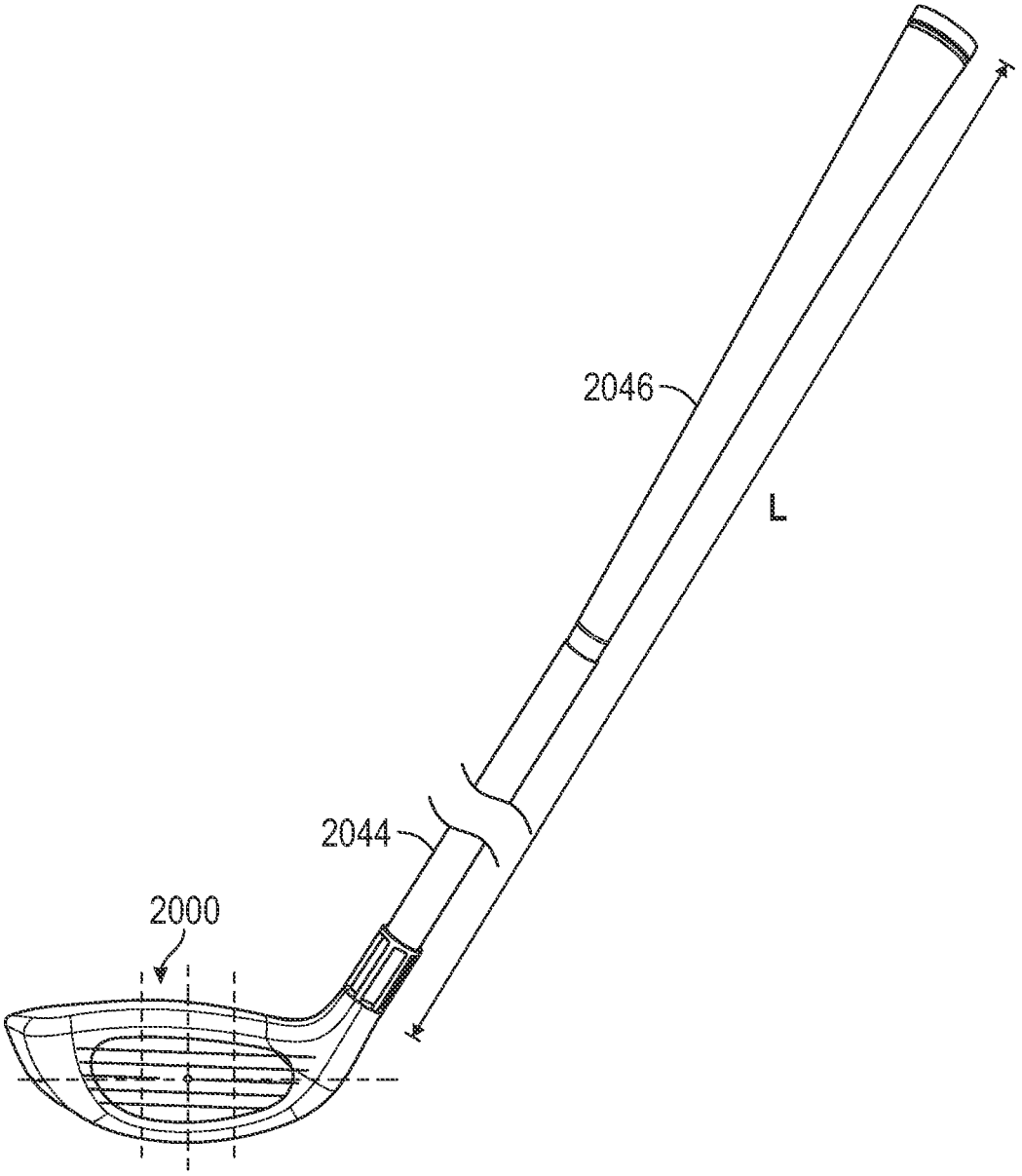
FIG. 48 is a perspective view of the golf club head of FIG. 34A attached to a shaft.

FIG. 48 illustrates the golf club head 2000 coupled to a shaft or shaft portion 2044 including a grip portion 2046. In particular embodiments, the shaft 2044 can have a length L of from 30 inches to 50 inches, such as between 35 inches and 45 inches, between 37 inches and 44 inches, or between 38 inches to 42 inches. The club and shaft assembly can also include a sleeve to adjust the loft, lie, and/or face angle of the club head similar to sleeves 212 and 1102 described above.

Composite Materials

Any of the components of the club heads described herein, including the striking face plate, the club head body, crown inserts, sole inserts, etc., can be made from one or more composite materials. For example, some current approaches to reducing structural mass of a metalwood club-head are directed to making at least a portion of the club-head of an alternative material. Whereas the bodies and face plates of most current metalwoods are made of titanium alloy, several club-heads are available that are made, at least in part, of components formed from either graphite/epoxy-composite (or other suitable composite material) and a metal alloy. Graphite composites have a density of about 1.5 g/cm$^3$, compared to titanium alloy which has a density of about 4.5 g/cm$^3$, which offers tantalizing prospects for providing more discretionary mass in the club-head. For example, considerable weight savings may be had by making the crown, sole, and/or face plate of composite materials.

Composite materials that are useful for making metalwood club-head components often include a fiber portion and a resin portion. In general, the resin portion serves as a "matrix" in which the fibers are embedded in a defined manner. In a composite for club-heads, the fiber portion may be configured as multiple fibrous layers or plies that are impregnated with the resin component.

For example, in one group of such club-heads a portion of the body is made of carbon-fiber (graphite)/epoxy composite and a titanium alloy is used as the primary face-plate material. Other club-heads are made entirely of one or more composite materials. The ability to utilize lighter composite materials in the construction of the face plate can also provide some significant weight and other performance advantages To date there have been relatively few golf club head constructions involving a polymeric material as an integral component of the design. Although such materials possess the requisite light weight to provide for significant weight savings, it is often difficult to utilize these materials in areas of the club head subject to the stresses resulting from the high speed impact of the golf ball.

Any polymeric material used to construct the crown should exhibit high strength and rigidity over a broad temperature range as well as good wear and abrasion behavior and be resistant to stress cracking. Such properties include, a) a Tensile Strength of from about 50 to about 1,000 kpsi, preferably of from about 150 MPa to about 500 MPa, more preferably of from about 200 to about 400 MPa (as measured by ASTM D 638, or ISO 527);

b) a Tensile Modulus of from about 2 GPa to about 100 GPa, preferably of from about 10 GPa to about 80 GPa, more preferably of from about 10 GPa to about 70 GPa (as measured by ASTM D 638, or ISO 527);

c) a Flexural Strength from about 50 MPa to about 1000 MPa, more preferably of from about 100 MPa to about 750 MPa, even more preferably of from about 150 MPa to about 500 MPa (as measured by ASTM D 790 or ISO 178);

d) a Flexural Modulus of from about 2 GPa to about 50 GPa, more preferably of from about 5 to about 40, more preferably of from about 7 to about 30 GPa (as measured by ASTM D 790 or ISO 178);

e) a Tensile Elongation of greater than about 1%, preferably greater than about 1.5% even more preferably greater than about 3% as measured by ASTM D 638 or ISO 527.

Exemplary polymers may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these most preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers and any and all combinations thereof.

In some embodiments, the crown may be formed from a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and Ser. No. 12/156,947, which are incorporated herein by reference. The composite material may be manufactured according to the methods described at least in U.S. patent application Ser. No. 11/825,138, the entire contents of which are herein incorporated by reference.

Alternatively, the crown may be formed from short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

In other embodiments, the crown is formed as a two layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

The laminates may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered composite crown may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming.

The inner layer may be injection molded using conventional techniques and secured to the outer crown layer by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer is secured to the outer layer, the outer surface of the inner layer and/or the inner of the outer layer may be pretreated by means of one or more of the following processes (disclosed in more detail in Ehrenstein, "Handbuch Kunststoff-Verbindungstechnik", Carl Hanser Verlag Munich 2004, pages 494-504):

- Mechanical treatment, preferably by brushing or grinding,
- Cleaning with liquids, preferably with aqueous solutions or organics solvents for removal of surface deposits
- Flame treatment, preferably with propane gas, natural gas, town gas or butane
- Corona treatment (potential-loaded atmospheric pressure plasma)
- Potential-free atmospheric pressure plasma treatment
- Low pressure plasma treatment (air and 02 atmosphere)
- UV light treatment
- Chemical pretreatment, e.g. by wet chemistry by gas phase pretreatment
- Primers and coupling agents In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the crown as a highly integrated part. Typically the injection molded inner layer is prepared from the same polymer family as the matrix material used in the formation of the composite laminate structures used to form the outer layer so as to ensure a good weld bond.

In addition to being formed in the desired shape for the aft body of the club head, a thermoplastic inner layer may also be formed with additional features including one or more stiffening ribs to impart strength and/or desirable acoustical properties as well as one or more weight ports to allow placement of additional tungsten (or other metal) weights.

The thickness of the inner layer is typically of from about 0.25 to about 2 mm, preferably of from about 0.5 to about 1.25 mm.

The thickness of the composite laminate structure used to form the outer layer, is typically of from about 0.25 to about 2 mm, preferably of from about 0.5 to about 1.25 mm, even more preferably from 0.5 to 1 mm.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell may be made of a composite material, such as, for example, a carbon fiber reinforced epoxy, carbon fiber reinforced polymer, or a polymer. Additionally, U.S. patent application Ser. Nos. 10/316,453 and 10/634,023 describe golf club heads with lightweight crowns. Furthermore, U.S. patent application Ser. No. 12/974,437 (now U.S. Pat. No. 8,608,591) describes golf club heads with lightweight crowns and soles.

Composite materials used to construct the crown should exhibit high strength and rigidity over a broad temperature range as well as good wear and abrasion behavior and be resistant to stress cracking. Such properties include, a) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039);

b) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039);

c) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790);

d) a Flexural Modulus at room temperature of from about 0.4 Msi to about 21 Msi, from about 0.5 Msi to about 20 Msi, more preferably of from about 10 Msi to about 19 Msi (as measured by ASTM D 790);

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of g/m$^2$.) FAW values below 100 g/m$^2$, and more desirably below 70 g/m$^2$, can be particularly effective. A particularly suitable fibrous material for use in making prepreg plies is carbon fiber, as noted. More than one fibrous material can be used. In other embodiments, however, prepreg plies having FAW values below 70 g/m$^2$ and above 100 g/m$^2$ may be used. Generally, cost is the primary prohibitive factor in prepreg plies having FAW values below 70 g/m$^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Each of the golf club heads discussed throughout this application may include a separate crown, sole, and/or face that may be a composite, such as, for example, a carbon fiber reinforced epoxy, carbon fiber reinforced polymer, or a polymer crown, sole, and/or face. Alternatively, the crown, sole, and/or face may be made from a less dense material, such as, for example, Titanium or Aluminum. In certain examples, the sole, face, and a portion of the crown may all be cast from either steel (~8.05 g/cm$^3$) or titanium (~4.43 g/cm$^3$) while a majority of the crown may be made from a less dense material, such as for example, a material having a density of about 1.5 g/cm$^3$ or some other material having a density less than about 4.43 g/cm$^3$. In other words, the crown could be some other metal or a composite. Additionally or alternatively, the face may be welded in place rather than cast as part of the sole. Examples of such constructions are provided in U.S. Pat. No. 9,962,584, which is incorporated herein by reference.

By making the crown, sole, and/or face out of a less dense material, it may provide cost savings or it may allow for weight to be redistributed from the crown, sole, and/or face to other areas of the club head, such as, for example, low and/or forward.

U.S. Pat. No. 8,163,119 discloses composite articles and methods for making composite articles, which is incorporated by reference herein in the entirety. This patent discloses the usual number of layers for a striking plate is substantial, e.g., fifty or more. However, improvements have been made in the art such that the layers may be decreased to between 30 and 50 layers. As already discussed for a sole and/or crown the layers can be substantially decreased down to three, four, five, six, seven, or more layers.

Table 22 below provide examples of possible layups. These layups show possible crown and/or sole construction using unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

TABLE 22

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly the main body of the club may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the club. The thin walled titanium construction increases the manufacturing difficulty and ultimately that fewer parts are cast at a time. In the past, 100 plus heads could be cast at a single time, however due to the thin and thinner wall construction less heads are cast per cluster to achieve the desired combination of high yield and low material usage.

As discussed in U.S. Pat. No. 7,513,296, herein incorporated by reference in the entirety, an important strategy for obtaining more discretionary mass is to reduce the wall thickness of the club-head. For a typical titanium-alloy "metal-wood" club-head having a volume of 460 $cm^3$ (i.e., a driver) and a crown area of 100 $cm^2$, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g. Additional materials and configurations are described in U.S. Pat. No. 9,962,584 incorporated by reference above.

Composite Face Plates

In certain embodiments, any of the golf club heads described herein can include a face plate or striking plate made of a composite including multiple plies or layers of a fibrous material (e.g., graphite, or carbon, fiber) embedded in a cured resin (e.g., epoxy). An exemplary thickness range of the composite portion of the face plate is 8.0 mm or less. Composite face plates for use in the metalwood golf clubs may be fabricated using the procedures described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and Ser. No. 12/156,947, which are incorporated herein by reference above. The composite material can be manufactured according to the methods described at least in U.S. patent application Ser. No. 11/825,138, which is incorporated by reference above.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of g/m") FAW values below 200 g/rrr', preferably below 100 g/rrr' and more preferably below 70 g/rn", can be particularly effective. A particularly suitable fibrous material for use in making prepreg plies is carbon fiber, as noted.

The composite desirably is configured to have a relatively consistent distribution of reinforcement fibers across a cross-section of its thickness to facilitate efficient distribution of impact forces and overall durability. In addition, the thickness of the face plate can be varied in certain areas to achieve different performance characteristics and/or improve the durability of the club-head. The face plate can be formed with any of various cross-sectional profiles, depending on the club-head's desired durability and overall performance, by selectively placing multiple strips of composite material in a predetermined manner in a composite lay-up to form a desired profile.

Texture can be incorporated into the surface of the tool used for forming the composite plate, thereby allowing the textured area to be controlled precisely and automatically. For example, in an embodiment having a composite plate joined to a cast body, texture can be located on surfaces where shear and peel are dominant modes of failure. Methods of introducing such texture are more fully disclosed in copending U.S. application Ser. No. 11/960,609 filed on Dec. 1, 2007, Ser. No. 13/111,715 filed on May 19, 2011 and Ser. No. 13/728,683 filed on 27 Dec. 2012, the entire contents of each of which are incorporated herein by reference in their entirety.

Typically the final part is sized larger than the intended final size and after reaching full-cure, the components are subjected to manufacturing techniques (machining, forming, etc.) that achieve the specified final dimensions, size, contours, etc., of the components for use as face plates on club-heads. These techniques are described in more detail in U.S. Pat. No. 7,874,937, the entire contents of which are incorporated by reference herein in their entirety.

In one embodiment, indicia including alignment aids or additional color contrasts or images may be printed on the composite face plate using pad printing or other techniques which are described more fully in copending US Publication No. 2014/0274446, the entire contents of which are incorporated herein by reference in their entirety.

In one embodiment, the face plate can then be covered or coated with a protective outer coating (also referred to herein as a "polymer end cap") which covers the composite face plate. The polymer end cap will protect the face from abrasion caused by an impact and general day-to-day use (dropping the club etc.). A polymer end cap also can reduce or eliminate deterioration of the surface finish of the club face caused by sand from the golf ball. The polymer end cap is made from a polymer and can include a textured or roughened surface. The polymeric materials and polymer end cap for use in the golf clubs of the present are more fully described in copending US Publication No. 2009/0163291A1, filed on Dec. 19, 2007, and US Publication No. 2012/0172143A1, filed on Dec. 19, 2011, the entire contents of each of which are incorporated by reference herein in their entirety.

Club Heads Comprising Titanium Alloy Body/Face

In certain embodiments, any of the club heads described herein can include striking face plates and/or club head bodies made from one or more cast or machined titanium alloys. Compared to titanium golf club faces formed for sheet machining or forging processes, cast faces can have the advantage of lower cost and complete freedom of design. However, golf club faces cast from conventional titanium alloys, such as 6-4 Ti, need to be chemically etched to remove the alpha case on one or both sides so that the faces are durable. Such etching requires application of hydrofluoric (HF) acid, a chemical etchant that is difficult to handle, extremely harmful to humans and other materials, an environmental contaminant, and expensive.

Faces cast from titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys.

Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club heads that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast 9-1-1 Ti face and body unit, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

Another titanium alloy that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces can be cast from Ti-8Al-2.5Mo-2Cr-1V-0.5Fe, and/or stamped from Ti-8Al-2.5Mo-2Cr-1V-0.5Fe sheet stock. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast and/or stamped sheet metal striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

Any of the golf-club head embodiments described herein may also comprise various non-metal filler materials in, for example, slots or cavities defined in the club heads, such as flexible boundary structures as described in U.S. Pat. No. 9,044,653, which is incorporated by reference. In certain embodiments, the non-metal filler materials can comprise any of various polymeric or non-polymeric viscous materials that are injected or otherwise inserted into a cavity, such as a sole slot. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Examples of various foam-filled golf club heads and flexible boundary structures are described in greater detail in U.S. Publication No. 2018/0185717, U.S. Publication No. 2018/0185715, U.S. Pat. Nos. 8,088,025, 6,811,496, 8,535,177, and 8,932,150, which are all incorporated herein by reference.

GENERAL CONSIDERATIONS

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods can be used in conjunction with other methods.

As used in this application and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In view of the many possible embodiments to which the principles of the disclosure may be applied, it should be recognized that the illustrated embodiments are only preferred examples and should not be taken as limiting the scope of the disclosure. It will be evident that various modifications may be made thereto without departing from the broader spirit and scope of the disclosure as set forth. The specification and drawings are, accordingly, to be regarded in an illustrative sense rather than a restrictive sense.

The invention claimed is:

1. A golf club head comprising:

a hosel portion, a heel portion, a sole portion, a toe portion, a crown portion, and a striking face having a striking face surface;

the crown portion comprising a composite crown, the composite crown extending forward of a vertical plane that passes through a center of gravity of the golf club head and extends in a heel-toe direction and in a sole-crown direction, and wherein the composite crown extends forward of a rearward most portion of the hosel portion;

the striking face having a center face location;

a center face vertical plane passing through the center face location, the center face vertical plane extending from adjacent the crown portion to adjacent the sole portion and intersecting with the striking face surface to define a center face roll contour;

a toe side vertical plane being spaced away from the center face vertical plane by 30 mm toward the toe portion, the toe side vertical plane extending from adjacent the crown portion to adjacent the sole portion and intersecting with the striking face surface to define a toe side roll contour;

a heel side vertical plane being spaced away from the center face vertical plane by 30 mm toward the heel portion, the heel side vertical plane extending from adjacent the crown portion to adjacent the sole portion and intersecting with the striking face surface to define a heel side roll contour;

a center face horizontal plane passing through the center face location, the center face horizontal plane extending from adjacent the toe portion to adjacent the heel portion and intersecting with the striking face surface to define a center face bulge contour;

a crown side horizontal plane being spaced away from the center face horizontal plane by 15 mm toward the crown portion, the crown side horizontal plane extending from adjacent the toe portion to adjacent the heel portion and intersecting with the striking face surface to define a crown side bulge contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side bulge contour; and wherein the toe side roll contour is more lofted than the center face roll contour, the heel side roll contour is less lofted than the center face roll contour, the crown side bulge contour is more open than the center face bulge contour, and the sole side bulge contour is more closed than the center face bulge contour.

2. The golf club head of claim 1, wherein a weight is attached to the sole portion of the golf club head and at least a portion of the composite crown extends forward of the weight.

3. The golf club head of claim 2, wherein a fastener secures the weight and at least a portion of the composite crown extends forward of the fastener.

4. The golf club head of claim 3, wherein the weight is adjustable.

5. The golf club head of claim 4, wherein the weight is slidably adjustable.

6. The golf club head of claim 4, wherein the weight is slidably adjustable and a forward portion of the weight has a greater thickness than a rearward portion of the weight.

7. The golf club head of claim 3, wherein an internal portion of the hosel portion has an opening into an interior cavity of the golf club head.

8. The golf club head of claim 7, further comprising a sleeve portion connected to the golf club head, the sleeve portion being capable of adjusting a loft, lie, or face angle of the club head when the sleeve portion is removed from the hosel portion in a first configuration and reinserted into the hosel portion in a second configuration.

9. The golf club head of claim 3, wherein a forward portion of the weight has a greater thickness than a rearward portion of the weight.

10. The golf club head of claim 3, wherein the fastener has a fastener axis and the fastener axis is located rearward of the weight.

11. The golf club head of claim 3, wherein the composite crown is bonded to a bonding ledge of the crown portion, and the bonding ledge has a width between 1 mm and 7 mm.

12. The golf club head of claim 11, wherein:

a coordinate system is located at the center face location of the striking face and includes a positive x-axis projecting toward the heel portion, a positive y-axis projecting toward a rear portion of the club head parallel to a ground plane, and a positive z-axis projecting toward the crown portion; and the composite crown includes an apex of the crown portion defining a highest point of the golf club head as measured along the positive z-axis, and the apex is rearward of a hosel portion axis.

13. The golf club head of claim 12, wherein the striking face comprises a composite face plate.

14. The golf club head of claim 13, wherein an average FA°Δ of an upper toe quadrant is between 0.3° to 0.5°.

15. The golf club head of claim 13, wherein an average LA°Δ of an upper toe quadrant is between 0.4° to 0.8°.

16. The golf club head of claim 1, further comprising a weight positioned rearward of the center of gravity of the golf club head, and a moment of inertia about a golf club head CG z-axis (Izz) is greater than 450 kg·mm$^2$ and a moment of inertia about a golf club head CG x-axis (Ixx) is greater than 300 kg·mm$^2$.

17. The golf club head of claim 16, wherein the weight is adjustable.

18. The golf club head of claim 17, wherein the weight is slidably adjustable.

19. A golf club head comprising:

a hosel portion, a heel portion, a sole portion, a toe portion, a crown portion, and a striking face having a striking face surface;

the crown portion comprising a composite crown, the composite crown extending forward of a vertical plane that passes through a center of gravity of the golf club head and extends in a heel-toe direction and in a sole-crown direction;

the striking face having a center face location;

a center face vertical plane passing through the center face location, the center face vertical plane extending from adjacent the crown portion to adjacent the sole portion and intersecting with the striking face surface to define a center face roll contour;

a toe side vertical plane being spaced away from the center face vertical plane by 30 mm toward the toe portion, the toe side vertical plane extending from adjacent the crown portion to adjacent the sole portion and intersecting with the striking face surface to define a toe side roll contour;

a heel side vertical plane being spaced away from the center face vertical plane by 30 mm toward the heel portion, the heel side vertical plane extending from adjacent the crown portion to adjacent the sole portion and intersecting with the striking face surface to define a heel side roll contour;

a center face horizontal plane passing through the center face location, the center face horizontal plane extending from adjacent the toe portion to adjacent the heel portion and intersecting with the striking face surface to define a center face bulge contour;

a crown side horizontal plane being spaced away from the center face horizontal plane by 15 mm toward the crown portion, the crown side horizontal plane extending from adjacent the toe portion to adjacent the heel portion and intersecting with the striking face surface to define a crown side bulge contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side bulge contour;

wherein the toe side roll contour is more lofted than the center face roll contour, the heel side roll contour is less lofted than the center face roll contour, the crown side bulge contour is more open than the center face bulge contour, and the sole side bulge contour is more closed than the center face bulge contour; and wherein the golf club head further comprises a weight positioned rearward of the center of gravity of the golf club head, and a moment of inertia about a golf club head CG z-axis (Izz) is greater than 450 kg·mm$^2$ and a moment of inertia about a golf club head CG x-axis (Ixx) is greater than 300 kg·mm$^2$.

20. The golf club head of claim 19, wherein the weight is adjustable.

21. The golf club head of claim 20, wherein the weight is slidably adjustable.

22. The golf club head of claim 19, wherein the golf club head has a ratio of depth to width that is between 0.956 and 1.0.

23. The golf club head of claim 19, wherein an internal portion of the hosel portion has an opening into an interior cavity of the golf club head.

24. The golf club head of claim 23, wherein the composite crown is bonded to a bonding ledge of the crown portion, and the bonding ledge has a width between 1 mm and 7 mm.

25. The golf club head of claim 23, wherein the striking face comprises a composite face plate.

26. The golf club head of claim 23, further comprising a sleeve portion connected to the golf club head, the sleeve portion being capable of adjusting a loft, lie, or face angle of the club head when the sleeve portion is removed from the hosel portion in a first configuration and reinserted into the hosel portion in a second configuration.

27. A golf club head comprising:

a hosel portion, a heel portion, a sole portion, a toe portion, a crown portion, and a striking face having a striking face surface;

the crown portion comprising a composite crown;

the striking face having a center face location;

a center face vertical plane passing through the center face location, the center face vertical plane extending from adjacent the crown portion to adjacent the sole portion and intersecting with the striking face surface to define a center face roll contour;

a toe side vertical plane being spaced away from the center face vertical plane by 30 mm toward the toe portion, the toe side vertical plane extending from adjacent the crown portion to adjacent the sole portion and intersecting with the striking face surface to define a toe side roll contour;

a heel side vertical plane being spaced away from the center face vertical plane by 30 mm toward the heel portion, the heel side vertical plane extending from adjacent the crown portion to adjacent the sole portion and intersecting with the striking face surface to define a heel side roll contour;

a center face horizontal plane passing through the center face location, the center face horizontal plane extending from adjacent the toe portion to adjacent the heel portion and intersecting with the striking face surface to define a center face bulge contour;

a crown side horizontal plane being spaced away from the center face horizontal plane by 15 mm toward the crown portion, the crown side horizontal plane extending from adjacent the toe portion to adjacent the heel portion and intersecting with the striking face surface to define a crown side bulge contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side bulge contour;

a weight positioned rearward of a center of gravity of the golf club head, and a moment of inertia about a golf club head CG z-axis (Izz) is greater than 450 $kg \cdot mm^2$ and a moment of inertia about a golf club head CG x-axis (Ixx) is greater than 300 $kg \cdot mm^2$; and wherein a coordinate system is located at the center face location of the striking face and includes a positive x-axis projecting toward the heel portion, a positive y-axis projecting toward a rear portion of the club head parallel to a ground plane, and a positive z-axis projecting toward the crown portion; and wherein the composite crown:

extends forward of a rearward most portion of the hosel portion, is bonded to a bonding ledge of the crown portion, and the bonding ledge has a width between 1 mm and 7 mm, and includes an apex of the crown portion defining a highest point of the golf club head as measured along the positive z-axis, and the apex is rearward of a hosel portion axis.

28. The golf club head of claim 27, wherein the weight is adjustable.

29. The golf club head of claim 28, wherein the weight is slidably adjustable.

30. The golf club head of claim 27, wherein the striking face comprises a composite face plate.

* * * * *